US011643246B2

(12) United States Patent
Ignaut

(10) Patent No.: US 11,643,246 B2
(45) Date of Patent: May 9, 2023

(54) ORIGAMI-INSPIRED ENCLOSURE, TABLE, AND LAMP

(71) Applicant: Degrees of Freedom LLC, Venice, CA (US)

(72) Inventor: Brian Ignaut, Venice, CA (US)

(73) Assignee: DEGREES OF FREEDOM LLC, Venice, CA (US)

( * ) Notice: Subject to any disclaimer, the term of this patent is extended or adjusted under 35 U.S.C. 154(b) by 376 days.

(21) Appl. No.: 16/882,480

(22) Filed: May 23, 2020

(65) Prior Publication Data

US 2020/0369433 A1 Nov. 26, 2020

Related U.S. Application Data

(60) Provisional application No. 62/852,782, filed on May 24, 2019.

(51) Int. Cl.
*B65D 81/36* (2006.01)
*B65D 6/16* (2006.01)
(Continued)

(52) U.S. Cl.
CPC ..... *B65D 9/12* (2013.01); *B65D 9/06* (2013.01); *B65D 9/34* (2013.01); *B65D 81/361* (2013.01); *B65D 2313/04* (2013.01)

(58) Field of Classification Search
CPC ... B65D 9/12; B65D 9/06; B65D 9/34; B65D 81/361; B65D 2313/04; B65D 9/14
See application file for complete search history.

(56) References Cited

U.S. PATENT DOCUMENTS 134,103 A * 12/1872 Selling ..... B65D 9/14 217/14
632,135 A * 8/1899 Joslin ..... B65D 9/12 217/12 R
(Continued)

FOREIGN PATENT DOCUMENTS

DE 9314558 U1 * 9/1993
DE 202018000805 U1 * 4/2018
(Continued)

OTHER PUBLICATIONS

Degreesoffreedomco. Solid copper Kinetic Ring Box. Instagram. May 12, 2019 [retrieved on Jul. 10, 2020]. Retrieved from internet:<URL:https://www.instagram.com/p/BxX5w0TASrg/>.
(Continued)

*Primary Examiner* — J. Gregory Pickett
*Assistant Examiner* — Abigail Elizabeth Guidry
(74) *Attorney, Agent, or Firm* — Ice Miller LLP

(57) ABSTRACT

An apparatus is provided having an open configuration and a closed configuration. The apparatus includes, while in the closed configuration, a first panel, a second panel, a third panel, a fourth panel, a fifth panel, and a sixth panel that together create a box partially enclosing a void space. The first panel is rotatably coupled to the fifth panel and the sixth panel, the second panel is rotatably coupled to the fourth panel and the sixth panel, and the third panel is rotatably coupled to the fourth panel and the fifth panel. The apparatus opens from the closed configuration to present the contents therein through a single degree-of-freedom mechanism where the first, second, and third panels become perpendicular to the fourth, fifth, and sixth panels while the fourth, fifth, and sixth panels become aligned in a same plane.

24 Claims, 105 Drawing Sheets

(51) Int. Cl.
*B65D 6/02* (2006.01)
*B65D 6/34* (2006.01)

(56) References Cited

U.S. PATENT DOCUMENTS 702,411 A * 6/1902 Dice ..... B65D 9/14 217/47
871,614 A * 11/1907 Newby ..... B65D 9/14 217/14
884,572 A * 4/1908 Depp ..... B65D 9/14 217/47
894,097 A * 7/1908 Anishansli ..... B65D 9/14 217/15
1,064,601 A * 6/1913 Bodker ..... B65D 9/14 217/15
1,066,838 A * 7/1913 Norris ..... B65D 9/14 217/15
1,101,019 A * 6/1914 Finkelstein ..... B65D 9/14 217/42
1,115,759 A * 11/1914 Williamson ..... B65D 9/14 217/15
1,159,229 A * 11/1915 Keith ..... B65D 9/12 217/65
1,381,013 A * 6/1921 Rainsford ..... B65D 9/12 217/15
2,628,737 A * 2/1953 Zeni ..... B65D 21/08 217/17
3,692,201 A * 9/1972 Garduna ..... B65D 9/34 217/65
4,173,287 A * 11/1979 Kumakawa ..... B65D 9/12 403/231
5,833,511 A * 11/1998 Outman ..... A63H 33/10 446/104
6,176,757 B1 * 1/2001 Lin ..... A63H 33/101 446/104
7,892,065 B2 * 2/2011 Vicentelli ..... A63H 33/108 446/85
2018/0132583 A1 5/2018 Camburn et al.
2020/0346818 A1 * 11/2020 Haskins ..... B65D 25/04

FOREIGN PATENT DOCUMENTS

FR 2554181 A1 * 11/1983
FR 2702449 A1 * 9/1994 ..... B65D 19/16
GB 131617 A * 12/1917
GB 357215 A * 6/1930
GB 486342 A * 3/1937
GB 766409 A * 1/1954
WO WO-2012/123189 A1 9/2012
WO WO-2016178632 A1 * 11/2016 ..... A45C 3/001

OTHER PUBLICATIONS

International Search Report and Written Opinion for International Application No. PCT/US2020/034432 dated Aug. 26, 2020.

* cited by examiner

150

150

150

150

*Table 1: Impact of Lamp Angles on Boom and Mast Position*

| Variable | Description | Centered Boom | | Swept Boom | | Mast | |
|---|---|---|---|---|---|---|---|
| | | Increase | Decrease | Increase | Decrease | Increase | Decrease |
| δ | Mast Leading Edge Angle | Lower | Raise | Minimal | Minimal | Raise | Lower |
| γ | Mast Deployed Angle | Raise | Lower | Raise | Lower | Lower | Raise |
| α | Link Angle | Raise | Lower | Raise | Lower | Minimal | Minimal |
| β | Boom Deployed Angle | Raise | Lower | Minimal | Minimal | Minimal | Minimum |

Fig. 33

ORIGAMI-INSPIRED ENCLOSURE, TABLE, AND LAMP

CROSS-REFERENCE TO RELATED APPLICATIONS

This application claims the benefit of priority under 35 U.S.C. § 119 to U.S. Application No. 62/852,782 filed May 24, 2019, the entire contents of which are hereby incorporated by reference.

BACKGROUND

Embodiments of the present disclosure generally relate to origami-inspired furniture and home products. In particular, the present disclosure describes an origami-inspired enclosure (e.g., box), table, and lamp.

SUMMARY OF THE DISCLOSED SUBJECT MATTER

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes an apparatus having single degree-of-freedom motion between an open configuration and a closed configuration for creating a partially-enclosed space. The apparatus includes six or more panels where each panel is coupled to two other panels of the six or more panels. Each panel is coupled at a first joint having a first axis and a second joint having a second axis. The six or more panels form a closed loop. The first axis and the second axis do not intersect with one another for each panel. Each panel is rotatable such that the total rotation of all joints is a predetermined number of degrees from the closed configuration to the open configuration (and vice versa). In various embodiments, each of the six or more panels includes a substantially flat shape. In various embodiments, each of the six or more panels includes a non-planar shape. In various embodiments, at least three of the panels comprise a first shape. In various embodiments, at least three of the panels include a second shape that is different from the first shape. In various embodiments, each of the six or more panels is rigid. In various embodiments, the apparatus includes a closed loop of links, having a single degree of freedom. In various embodiments, the first and second joints are cylindrical joints.

In various embodiments, one or more panels each comprise at least one magnet. In various embodiments, rotation of the six or more panels causes the apparatus to switch between the closed configuration and the open configuration, in the open configuration, at least three panels of the six or more panels are aligned in a same plane.

In various embodiments, an apparatus is provided having an open configuration and a closed configuration for creating a partially-enclosed space. The apparatus includes a first panel, a second panel being perpendicular to the first panel in the closed configuration, a third panel being perpendicular to the first panel and the second panel in the closed configuration, a fourth panel opposite the first panel in the closed configuration, the fourth panel being perpendicular to the second panel and the third panel in the closed configuration, a fifth panel opposite the second panel in the closed configuration, the fifth panel being perpendicular to the first panel, the third panel, and the fourth panel in the closed configuration, and a sixth panel opposite the third panel in the closed configuration, the sixth panel being perpendicular to the first panel, the second panel, the third panel, and the fourth panel in the closed configuration. The first panel is rotatably coupled to the fifth panel and the sixth panel, the second panel is rotatably coupled to the fourth panel and the sixth panel, and the third panel is rotatably coupled to the fourth panel and the fifth panel.

In various embodiments, the first panel, the second panel, and the third panel have a similar shape. In various embodiments, the fourth panel, the fifth panel, and the sixth panel have a similar shape. In various embodiments, the first panel, the second panel, and the third panel have a different shape from the fourth panel, the fifth panel, and the sixth panel. In various embodiments, the fourth panel, the fifth panel, and the sixth panel each have a non-linear side such that, when in the open configuration, at least a portion of each non-linear side contacts one another. In various embodiments, at least one panel includes at least one magnet. In various embodiments, the first panel, the second panel, and the third panel each include a magnet and a metal pin. In various embodiments, the magnet of the first panel is aligned with the metal pin of the second panel, the metal pin of the first panel is aligned with the magnet of the third panel, and the magnet of the second panel is aligned with the metal pin of the third panel.

In various embodiments, rotation of each of the first panel, the second panel, the third panel, the fourth panel, the fifth panel, and the sixth panel causes the apparatus to switch between the closed configuration and the open configuration. In various embodiments, in the open configuration, the fourth panel, the fifth panel, and the sixth panel are aligned in a plane and the first panel, the second panel, and the third panel are each perpendicular to the plane. In various embodiments, the first panel, the second panel, the third panel, the fourth panel, the fifth panel, and the sixth panel each comprise a cylindrical pin and a cylindrical aperture. In various embodiments, each cylindrical pin extends perpendicularly to the cylindrical aperture on the same panel. In various embodiments, the cylindrical pin is disposed at a first corner of each panel and the cylindrical aperture is disposed at a second corner on a same side of each panel.

In various embodiments, the first panel, the second panel, the third panel, the fourth panel, the fifth panel, and the sixth panel each include a metal. In various embodiments, the metal is selected from the group including: iron, carbon steel, stainless steel, aluminum, titanium, a nickel alloy, a copper alloy, an aluminum alloy, brass, bronze, a zinc alloy, a magnesium alloy, gold, silver, and/or platinum. In various embodiments, the first panel, the second panel, the third panel, the fourth panel, the fifth panel, and the sixth panel each comprise a polymer. In various embodiments, the polymer is selected from the group including: polyethylene, high-density polyethylene, polyurethane, polyvinyl chloride, polyamide, polyethylene terephthalate, polycarbonate, polypropylene, polystyrene, and/or acrylonitrile butadiene styrene. In various embodiments, the first panel, the second panel, the third panel, the fourth panel, the fifth panel, and the sixth panel each comprise a wood.

In various embodiments, the apparatus further includes a polymer insert in the partially-enclosed space. In various embodiments, the polymer insert is configured to secure an object. In various embodiments, the polymer insert has a triangular shape and a velvet covering.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

BRIEF DESCRIPTION OF THE DRAWINGS

A detailed description of various aspects, features, and embodiments of the subject matter described herein is provided with reference to the accompanying drawings, which are briefly described below. The drawings are illustrative and are not necessarily drawn to scale, with some components and features being exaggerated for clarity. The drawings illustrate various aspects and features of the present subject matter and may illustrate one or more embodiment(s) or example(s) of the present subject matter in whole or in part.

FIG. 33 illustrates a table of impact of lamp angles on boom and mast position according to embodiments of the present disclosure.

DETAILED DESCRIPTION

Kinetic Enclosure (e.g., Box, Sphere, Etc.)

Figure 1A:
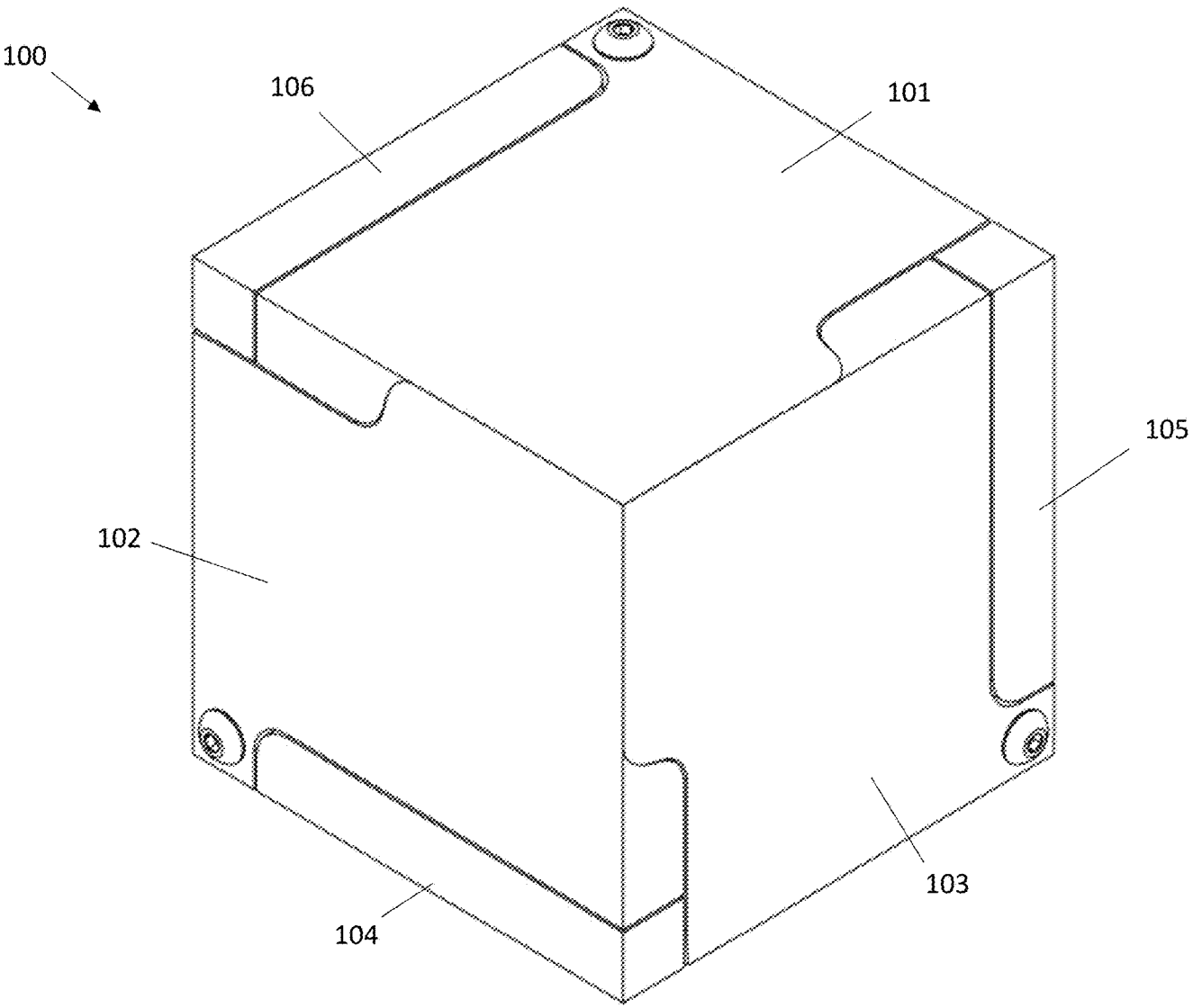
FIG. 1A illustrates a kinetic enclosure (e.g., box) in the closed state according to embodiments of the present disclosure.

At a high level, a kinetic enclosure is any linked-panel enclosure (partial or complete) having single degree-of-freedom motion between a closed configuration and an open configuration revealing the contents (e.g., a ring) enclosed therein. In various embodiments, motion of the kinetic box between the open configuration and the closed configuration may resemble (e.g., be identical to) motion of a Mobius kaleidocycle. In various embodiments, the kinetic box may be created by generating a Hamiltonian path about the faces of any suitable platonic solid (e.g., tetrahedron, cube, octahedron, dodecahedron, icosahedron, etc.) without crossing or intersection of that path. In various embodiments, the kinetic box may include a closed loop of links, where a coordinate transformation of each of the links results in the same value.

In various embodiments, the kinetic box may include six or more panels, such that each panel is coupled (via links) to two other panels of the six or more panels in a closed loop. In various embodiments, each individual panel has a first joint having a first axis and a second joint having a second axis. In various embodiments, the first joint of each panel may be coupled to the second joint of another panel. In various embodiments, the second joint of each panel may be coupled to the first joint of another panel. In various embodiments, the first axis and the second axis of the joints for any given panel in the closed loop may not intersect with one another. In various embodiments, intersection of the first and/or second axes between different panels may occur.

In various embodiments, each panel is rotatable such that the total rotation of each joint is 540 degrees from the closed configuration to the open configuration. For example, in the six panel configuration shown, each panel can rotate up to a predetermined degree rotation, such that the aggregate rotation of all six panels is up to 540 degrees. In various embodiments, some panels may rotate more than other panels. In various embodiments, some panels may rotate less than other panels. For example, for a cube kinetic enclosure, three panels may rotate up to 30 degrees while the other three panels may rotate up to 90 degrees, giving a total rotation of 360 degrees. Also, in some embodiments, the rotation of each panel is equivalent/equidistant with respect to the remaining panels. In various embodiments, each of the six or more panels comprises a substantially flat (e.g., planar) shape. In various embodiments, each of the six or more panels comprises a curved (e.g., non-planar) shape. For example, the panels can have equivalent curvilinear shapes such that when the enclosure is in the closed configuration, the enclosure forms a sphere. In various embodiments, at least three (e.g., three) of the panels of the six or more panels comprise a first shape. In various embodiments, at least three (e.g., three) of the panels of the six or more panels comprise a second shape that is different from the first shape. For example, for a kinetic box based on a cube (having six panels), three panels may include a first shape and three panels may include a second shape that is different than the first shape. In various embodiments, each panel may be a rigid body. In various embodiments, the apparatus comprises a closed loop of links. In various embodiments, the joints are cylindrical joints. In various embodiments, the joints may be a single axis rotational joint. In various embodiments, the joints may be one or more (e.g., two) spherical joint. In various embodiments, the joint may be a combination joint (e.g., spherical joint and ball joint). Additionally or alternatively, the joints can be formed as spherical joints, and can be located proximate to an edge of each panel.

In various embodiments, the joint may include a pseudo-joint, such as a living joint. For example, where a hinge joint is used, the material (e.g., polymer) may be necked down where the joint is located thereby creating a "living hinge." In various embodiments, the kinetic enclosure may be formed of a single injection-molded piece.

In various embodiments, a critical twist angle may be defined for a kinetic enclosure having a closed loop of N tetrahedra.

TABLE 1

| Critical Twist Angle $\alpha_c$ for a closed loop of N tetrahedra: | | | | | | | | | | |
|---|---|---|---|---|---|---|---|---|---|---|
| N | 6 | 7 | 8 | 9 | 10 | 11 | 12 | 13 | 14 | 15 |
| $\alpha_c$ | 90 | 72.819 | 61.968 | 54.183 | 48.240 | 43.525 | 39.678 | 36.473 | 33.758 | 31.427 |

In various embodiments, any panels (e.g. at least one panel) may include at least one magnet. In various embodiments, the magnet(s) of one panel may be aligned with a metal pin and/or a magnet of another panel to thereby create a mechanism to hold the kinetic box in either the closed or open configuration via magnetic coupling. In various embodiments, the magnetic coupling may be between a magnet and a metal (e.g., steel) pin. In various embodiments, upon a predetermined amount of rotational force applied by a user, the kinetic box may rotationally switch between the closed configuration and the open configuration (and vice versa). In various embodiments, the predetermined rotational force may be less moving from the open configuration to the closed configuration than moving from the closed configuration to the open configuration due to the magnetic coupling maintaining the kinetic box in the closed configuration. In various embodiments, in the open configuration, at least three panels of the six or more panels are aligned in a same plane thereby creating a substantially flat surface. For example, when the kinetic box is based on a cube, three or more panels may align in a same plane in the open configuration.

In various embodiments, one or more panels of the kinetic enclosure may itself be magnetic. In various embodiments, the magnetic field generated by the one or more magnets of the kinetic enclosure may be configured to be canceled out when the enclosure is in either the open and/or the closed configuration. In various embodiments, the magnetic field may be designed such that the magnetic field causes the contents to float.

In various embodiments, the kinetic box further includes a polymer insert in the partially-enclosed space. In various embodiments, the polymer insert configured to secure an object.

Figure 1B:
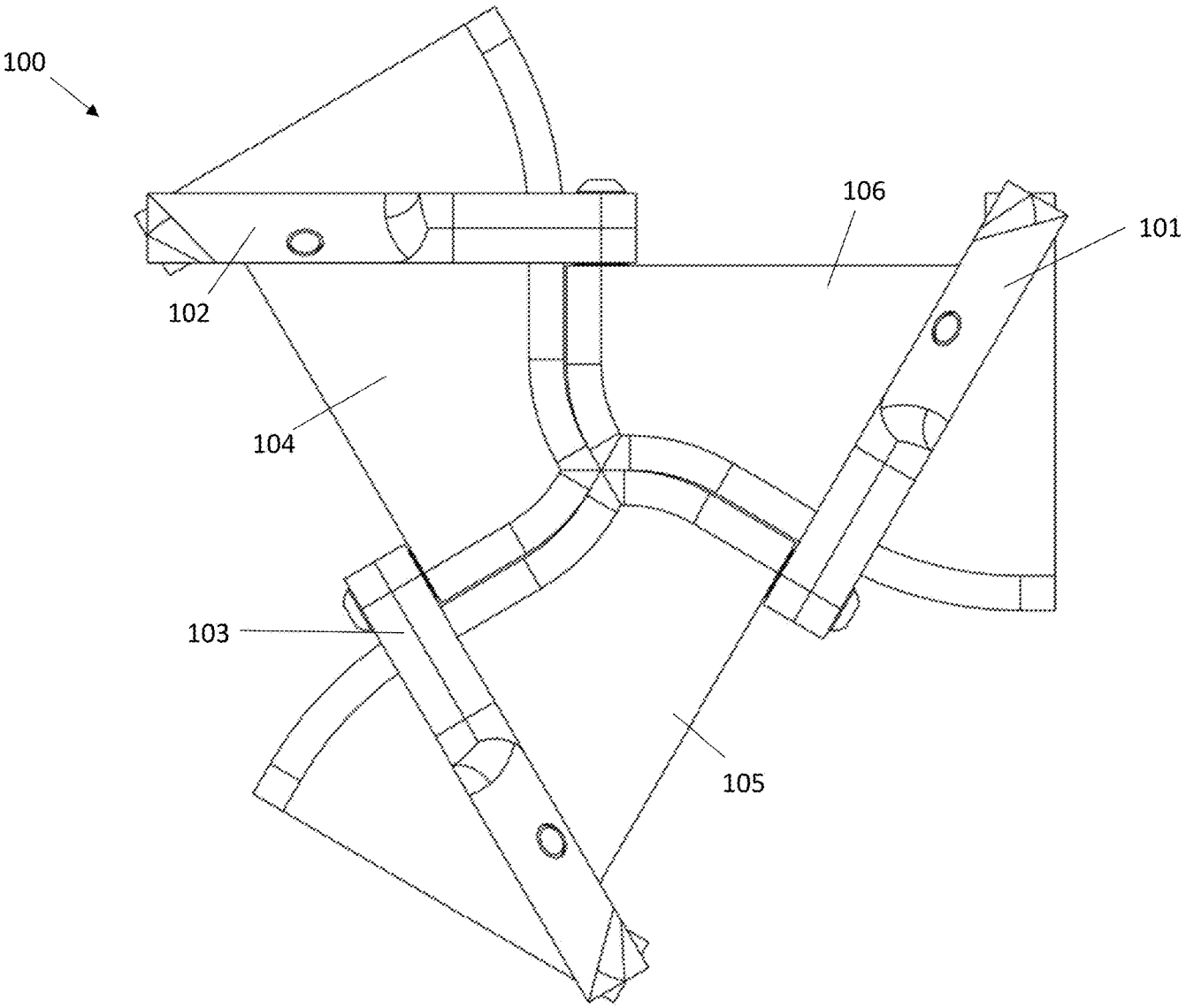
FIG. 1B illustrates a kinetic box in the open state according to embodiments of the present disclosure.
Figure 1C:
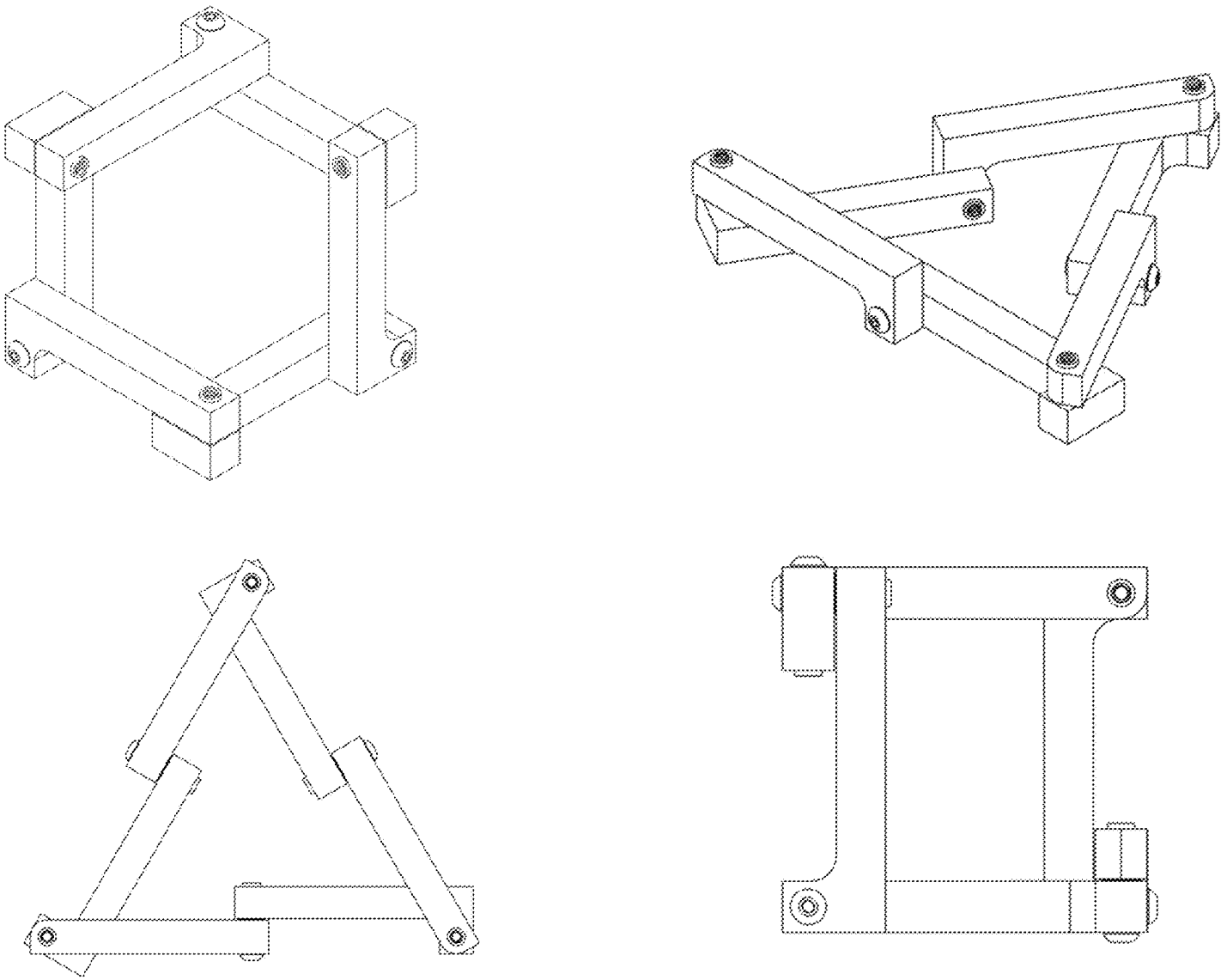
FIGS. 1C-1D illustrate rectangular linkages demonstrating the mechanical coupling of the kinetic enclosure.
Figure 1D:
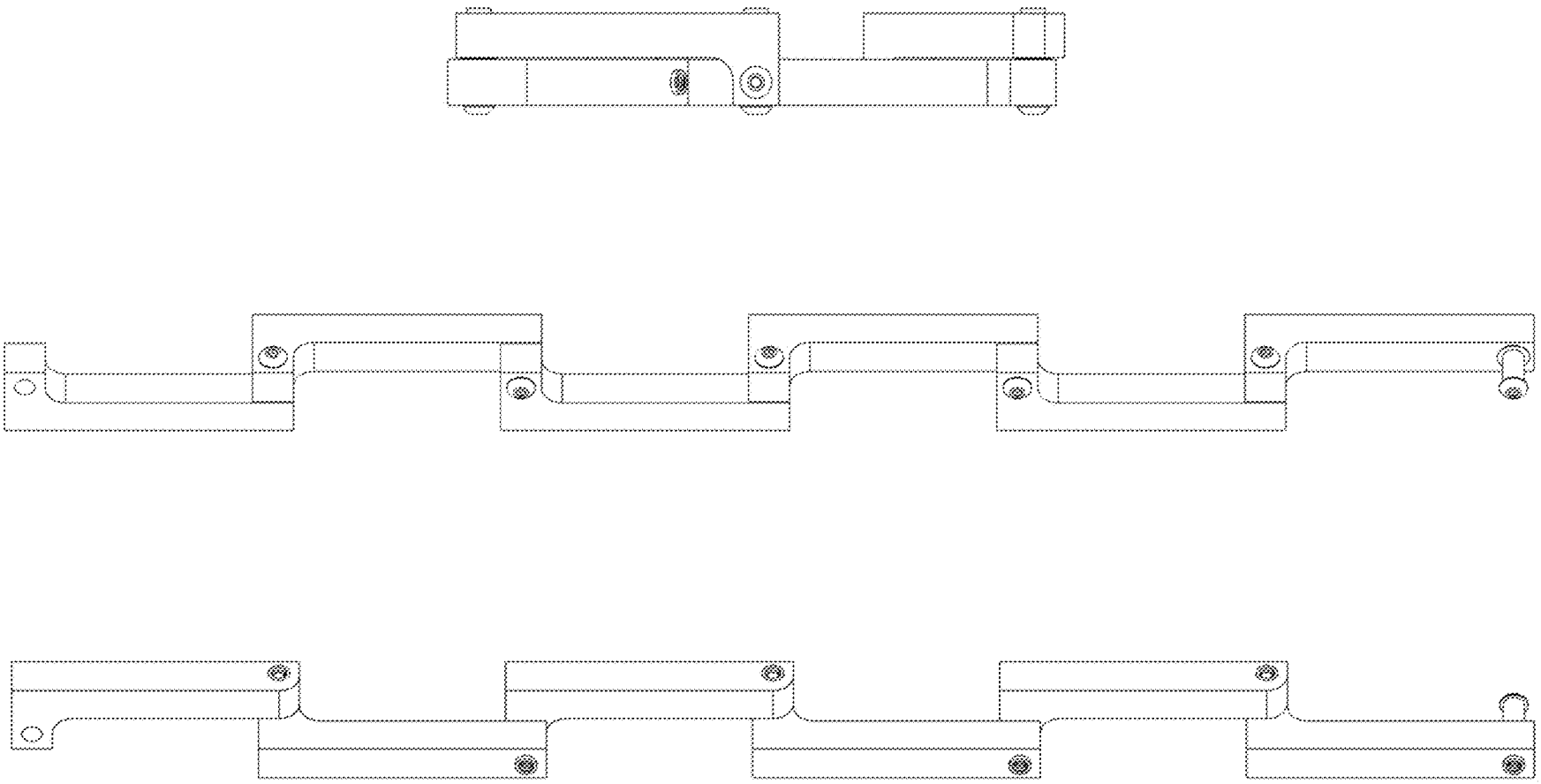

In various embodiments, a kinetic box 100 is provided. In various embodiments, the box 100 includes a closed loop of rigid panels where each panel is interconnected to one or more (e.g., two) other panels via one or more (e.g., two) non-parallel rotary joints to thereby create a single-degree-of-freedom mechanism. In various embodiments, the box 100 may rotatably switch between a closed configuration (which partially, or entirely, encloses a void space) and an open configuration (which reveals the contents of the box within the void space). In various embodiments, the box 100 includes a first panel 101, a second panel 102, a third panel 103, a fourth panel 104, a fifth panel 105, and a sixth panel 106, where each panel represents a side of the box 100. In various embodiments, each panel may be a side of a cube (i.e., all sides having equal length, width, and height). In various embodiments, the box 100 opens from the closed configuration via a twisting motion of the six exterior panels to reveal the contents within the void space. In various embodiments, the box 100 may be configured to contain a ring, e.g., an engagement ring. In the closed configuration, the box encloses (e.g., partially or entirely) the object (e.g., ring) (FIG. 1A) and presents the object (e.g., the ring) when the box is in the open configuration (FIG. 1B). In various embodiments, the box may contain any suitable object and/or material. FIGS. 1C-1D illustrate rectangular linkages demonstrating the mechanical coupling of the kinetic enclosure.

In various embodiments, the first panel 101 may be perpendicular to the second panel 102, the third panel 103, the fifth panel 105, and/or the sixth panel 106. In various embodiments, the second panel 102 may be perpendicular to the first panel 101, the third panel 103, the fourth panel 104, and/or the sixth panel 106. In various embodiments, the third panel 102 may be perpendicular to both the first panel 101, the second panel 102, the fourth panel 104, and/or the fifth panel 105. In various embodiments, the fourth panel 104 may be opposite the first panel 101. In various embodiments, the fourth panel 104 may be perpendicular to the second panel 102, the third panel 103, the fifth panel 105, and the sixth panel 106. In various embodiments, the fifth panel 105 may be opposite the second panel 102. In various embodiments, the fifth panel 105 may be perpendicular to the first panel 101, the third panel 103, the fourth panel 104, and/or the sixth panel 106. In various embodiments, the sixth panel 106 is opposite the third panel 103. In various embodiments, the sixth panel 106 may be perpendicular to the first panel 101, the second panel 102, the fourth panel 104, and/or the fifth panel 105.

In various embodiments, an insert 120 may be disposed within the box 100 to restrain an object 122 (e.g., a ring) to be enclosed therein. In various embodiments, the insert is a polymer. In various embodiments, the polymer is a foam. In various embodiments, the insert may be triangular-shaped. In various embodiments, the insert may have one or more slit joints configured to fold at the slit joint. In various embodiments, the insert may be configured to secure an object. In various embodiments, the insert may include a covering (e.g., velvet). In various embodiments, the covering may be an aesthetic or ornamental covering. In various embodiments, the slits may prevent other material from restricting movement of the enclosure. In various embodiments, the insert includes a material having a lower stiffness than the material of the enclosure assembly.

In various embodiments, the box 100 may have a volume of about a cubic centimeter to about a cubic meter. Preferably, for a ring box, the volume may be larger than or equal to 15 cubic centimeters. Preferably, for a watch box, the volume may be less than or equal to 2000 cubic centimeters. In various embodiments, the partially enclosed void space may represent about 35% to about 97% of the total volume of the box 100. Preferably, for a ring box, the enclosed volume may be larger than or equal to 35%. Preferably, for a watch box, the enclosed volume may be less than or equal to 75%.

In various embodiments, the design of the box 100 may be based on a Mobius kaleidocycle, which is a spatial mechanism using links with non-parallel joints in a closed loop to exhibit single degree-of-freedom motion. In various embodiments, the design of the box is not limited to six links, as shown; a variety of shapes may be possible with similar functionality. Indeed, the present disclosure can employ a variety of shapes and sizes of an enclosure, including all platonic solids where all panels (or "faces") have identical shape.

In various embodiments, the linkages of the Mobius kaleidocycle create the outer panels of the box. In various embodiments, joints are positioned on substantially flat panels, with the panels maintaining the correct relative position and orientation of the rotational axes.

In various embodiments, the exterior of each panel may include an ornamental or decorative design. For example, the external surfaces of the panels may be decorated to resemble an object from a movie, television show, and/or video game.

Figure 2:
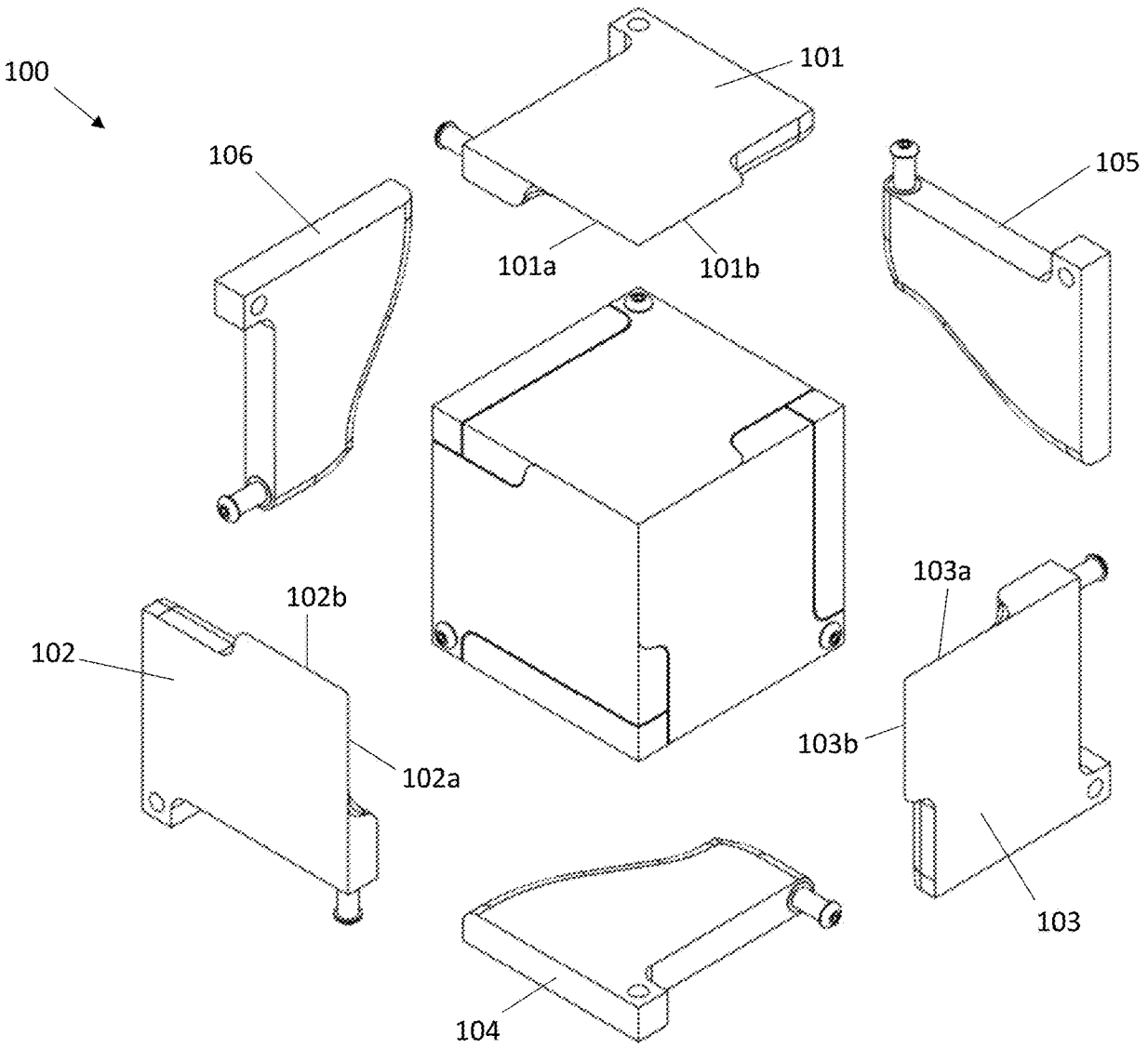
FIG. 2 illustrates an exploded view of a box with an assembled box in the center, according to embodiments of the present disclosure.

FIG. 2 illustrates an exploded view of a box 100 with an assembled box 100 in the center. In various embodiments, once the idealized link geometry is extended to intersect adjacent links and create a substantially closed volume, a complete box having six-link Mobius kaleidocycle geometry. In various embodiments, the box may include a hexaflexahedron box design.

Figure 3A:
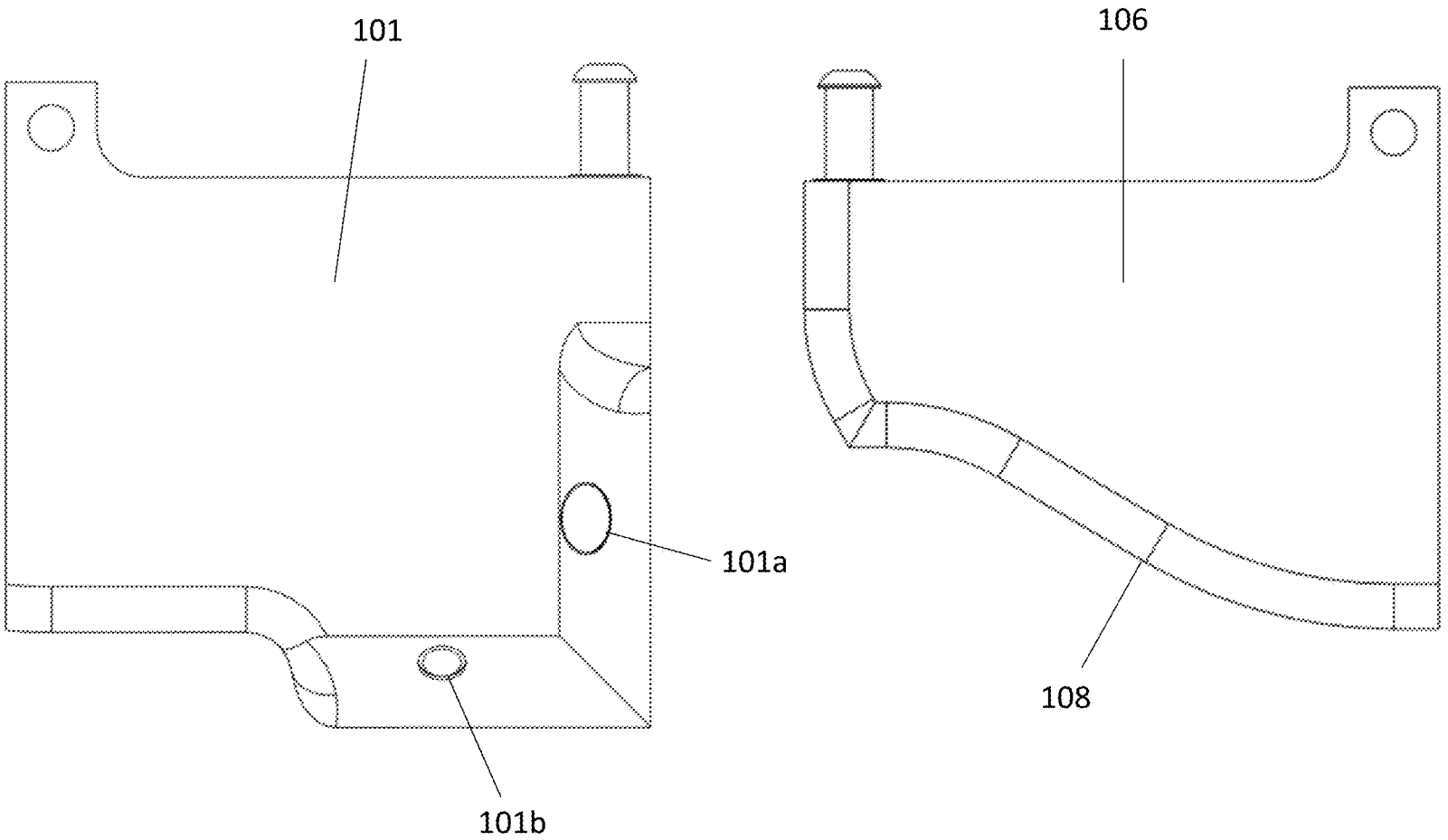
FIG. 3A illustrates rectangular (left) and triangular (right) box panels according to embodiments of the present disclosure.
Figure 3B:
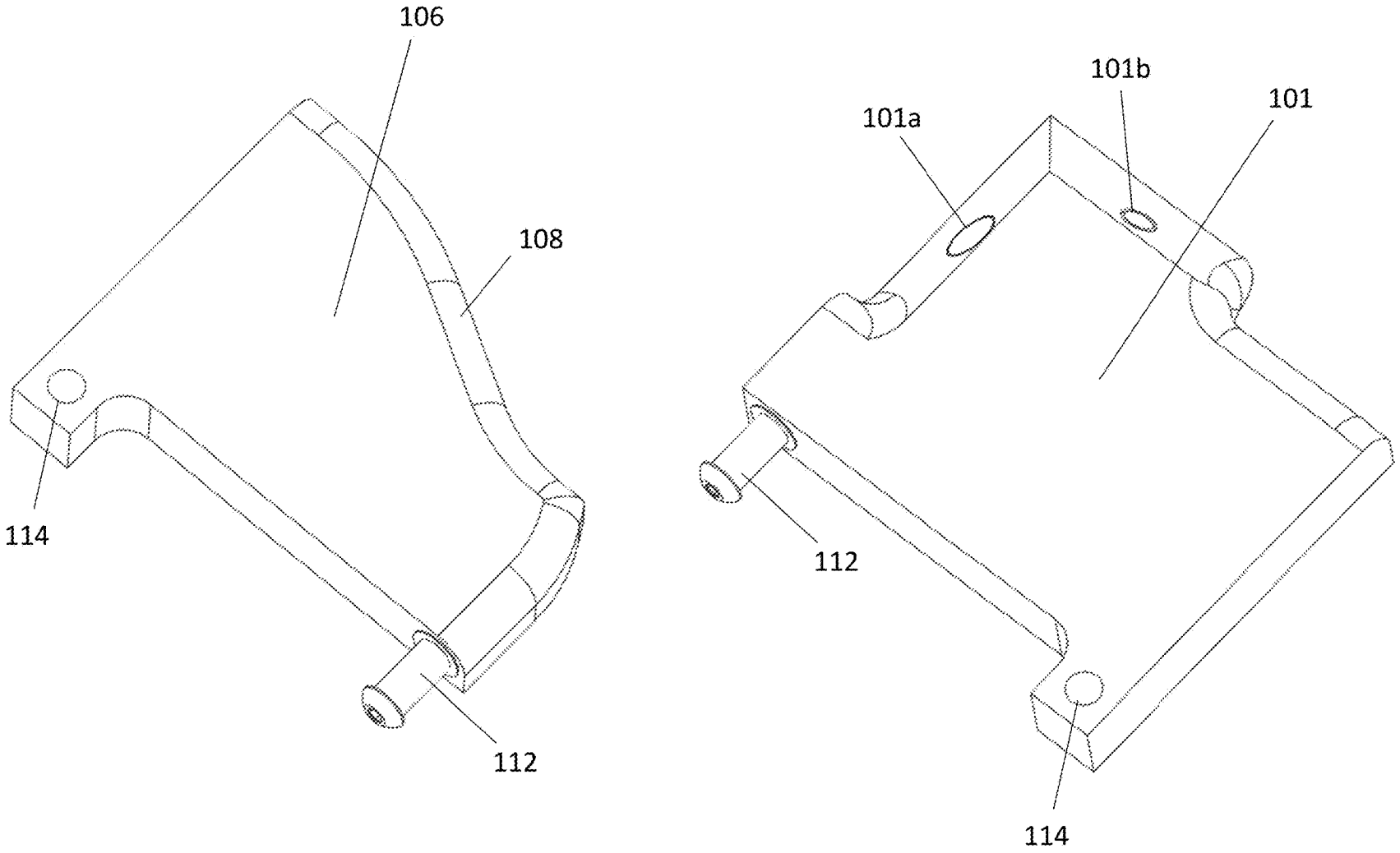
FIG. 3B illustrates isometric views of rectangular (right) and triangular (left) box panels according to embodiments of the present disclosure.

As shown in FIGS. 2 and 3A-3B, each of panels 101, 102, 103 includes a substantially similar (e.g., identical) shape. In various embodiments, the shape of panels 101, 102, 103 may be substantially rectangular (e.g., have an overall rectangular shape). Moreover, as shown each of panels 104, 105, 106 includes a substantially similar (e.g., identical) shape. In various embodiments, the shape of panels 104, 105, 106 may be substantially triangular (e.g., have an overall triangular shape). In various embodiments, the triangular panels need not be triangular at all. In various embodiments, the triangular panels may have any suitable shape that meets in a single point in space (e.g., the rear intersection point). In various embodiments, the panels of the enclosure can be any suitable shape as the relative position of the joints in each panel is what defines the motion of the enclosure. In various embodiments, the rear panels may be smaller than the front panels to allow for opening. In various embodiments, the rear panels may include rectangular shapes if their geometry is partially offset such that they can overlap when opened.

In various embodiments, each of panels 104, 105, 106 may include a non-linear side 108. In various embodiments, the non-linear side 108 may be a curve having a single point of inflection. In various embodiments, the non-linear side may have two or more points of inflection (e.g., two, three, four, five, six, etc.). In various embodiments, the non-linear side may be an 'S'-shaped curve. In various embodiments, in the open configuration, the panels 104, 105, 106 may be aligned in a single two-dimensional plane. In various embodiments, in the open configuration, the panels 104, 105, 106 may be partially in contact with one another (e.g., at least a portion of each non-linear side may be partially in contact with one another). In various embodiments, "in contact" may be defined as the panels have a small (e.g., minimal) air gap between one another such that the panels are capable of sliding relative to one another with minimal (e.g., no) frictional resistance. In various embodiments, in the open configuration, the panels 104, 105, 106 may create a base on which the insert (and secured object, if included) may be disposed. In various embodiments, each side of the triangular panels may be substantially linear. In various embodiments, In various embodiments, in the open configuration, the panels 101, 102, 103 may be perpendicular to panels 104, 105, and 106. In various embodiments, in the open configuration, the panels 101, 102, and 103 may not be parallel with one another (nor aligned in the same plane), while being perpendicular to panels 104, 105, and 106. In various embodiments, when more than six panels are linked together, the panels that create the back of the device may not be substantially planar in the open configuration. In various embodiments, when more than six panels are linked together, the panels that create the front of the device may not be substantially perpendicular to the back panels in the open configuration.

In various embodiments, panels 101, 102, 103, 104, 105, and/or 106 may include one or more magnets. In various embodiments, one or more (e.g., all) of the panels may not include any magnets at all. In various embodiments, the one or more magnets may be configured to maintain the box 100 in the closed configuration until a predetermined amount of force (e.g., rotational force) is applied to separate the magnets from one another. In various embodiments, panels 301, 302, 303, 304, 305, and/or 306 may include one or more pins (e.g., steel pins) configured to engage the one or more magnet of another panel. As shown in FIG. 2, each of panels 101, 102, 103 includes a magnet 101*a*, 102*a*, 103*a* and a steel pin 101*b*, 102*b*, 103*b*, respectively. In various embodiments, the magnet 101*a* of the first panel 101 is aligned with the steel pin 102*b* of the second panel 102, the steel pin 101*b* of the first panel 101 is aligned with the magnet 103*a* of the third panel 103, and the magnet 102*a* of the second panel 102 is aligned with the steel pin 103*b* of the third panel 103. In various embodiments, only one panel may include a magnet while only one panel (different from the panel with the magnet) may include a pin as all panels are coupled together and coupling only two panels via a magnetic coupling will prevent motion of the other linked panels in the assembly.

In various embodiments, the box 100 may include two unique link (or panel) designs: rectangular and triangular. The rectangular panels (e.g., panel 101, panel 102, and panel 103) create the "front" of the box 100 and the triangular panels (e.g., panel 104, panel 105, and panel 106) create the "back." Projected and isometric views of the two types of panels are illustrated in FIGS. 3A-3B. As shown in FIG. 3A, on the left is an exemplary rectangular panel (e.g., panel 101) and on the right is an exemplary triangular panel (e.g., panel 106) in a top-down view. Also shown in FIG. 3A is the placement of magnets and/or metal pins, specifically of a magnet 101*a* and a steel pin 101*b* that may be aligned with magnets and/or metal pins in other panels (e.g., rectangular panels 102, 103) and are configured to keep the box 100 in a closed configuration until a predetermined amount of force (e.g., rotational force) is applied to separate the magnets and/or steel pins from one another. As shown in FIG. 3B, on the left is an exemplary triangular panel (e.g., panel 106) and on the right is an exemplary rectangular panel (e.g., panel 101) in a perspective view.

As shown in FIG. 3A-3B, each panel 101, 102, 103, 104, 105, 106 may include at least one pin 112 and at least one aperture 114 configured to receive a pin 112 of another panel 101, 102, 103, 104, 105, 106. In various embodiments, when inserted into an aperture 114 of another panel, the pin 112 allows rotation of a panel about the axis of the aperture 114 of the other panel. In various embodiments, the pin 112 may be disposed perpendicularly to the aperture 114. In various embodiments, the pin 112 may be disposed at one corner of the panel 101, 102, 103, 104, 105, 106 and the aperture 114 may be disposed at a different corner of the panel 101, 102, 103, 104, 105, 106. In various embodiments, the pin 112 and the aperture 114 may be disposed on a same side along the perimeter of the panel 101, 102, 103, 104, 105, 106. For example, the pin 112 is disposed at a first corner of panels 101, 106 shown in FIGS. 3A-3B and the aperture 114 is disposed perpendicularly to the pin 112 and at the corner opposite the pin 112 on the same side of the panel 101, 106. In various embodiments, the aperture 114 may be formed in a member 115 that extends outwardly from the body of the panel. In various embodiments, the shape of the aperture 114 may correspond to the shape of the pin 112. In various embodiments, the aperture 114 may be substantially cylindrically-shaped. In various embodiments, the outer facia may be arbitrary. In various embodiments, the panels may be skewed. In various embodiments, the panels may remain substantially planar regardless of shape.

In various embodiments, one or more sides of the panel may include a square cut. In various embodiments, one or more sides of the panel 101, 102, 103, 104, 105, 106 may include a chamfer, a bevel, and/or a fillet. In various embodiments, the chamfer, a bevel, and/or a fillet may be used to prevent overlap of the rear panels during rotation. In various embodiments, one or more bores may be formed in any suitable side of the panel 101, 102, 103, 104, 105, 106 such that the bore is configured to receive a magnet as described above. For example, two beveled sides of panel 101 include bores for receiving magnet 101*a* and metal pin 101*b*. In various embodiments, the one or more bores in each panel 101, 102, 103, 104, 105, 106 may align with one or more bores on another panel 101, 102, 103, 104, 105, 106 so that the magnets and/or pins may releasably couple (via magnetic force) to one another. In various embodiments, only one magnet coupling is required because the panels are coupled in a closed loop.

Figure 4A:
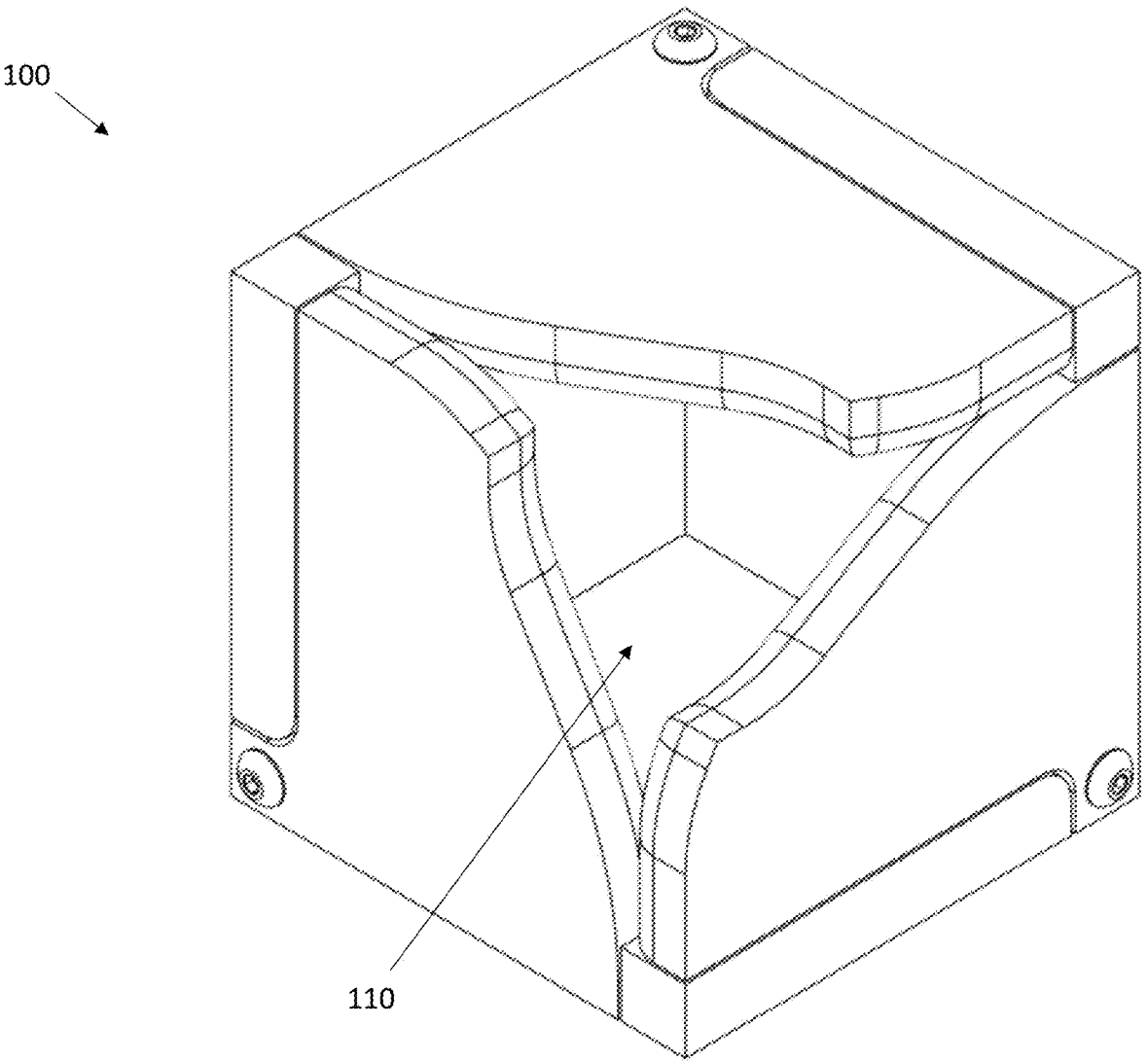
FIG. 4A illustrates a rear opening of the box according to embodiments of the present disclosure.
Figure 4B:
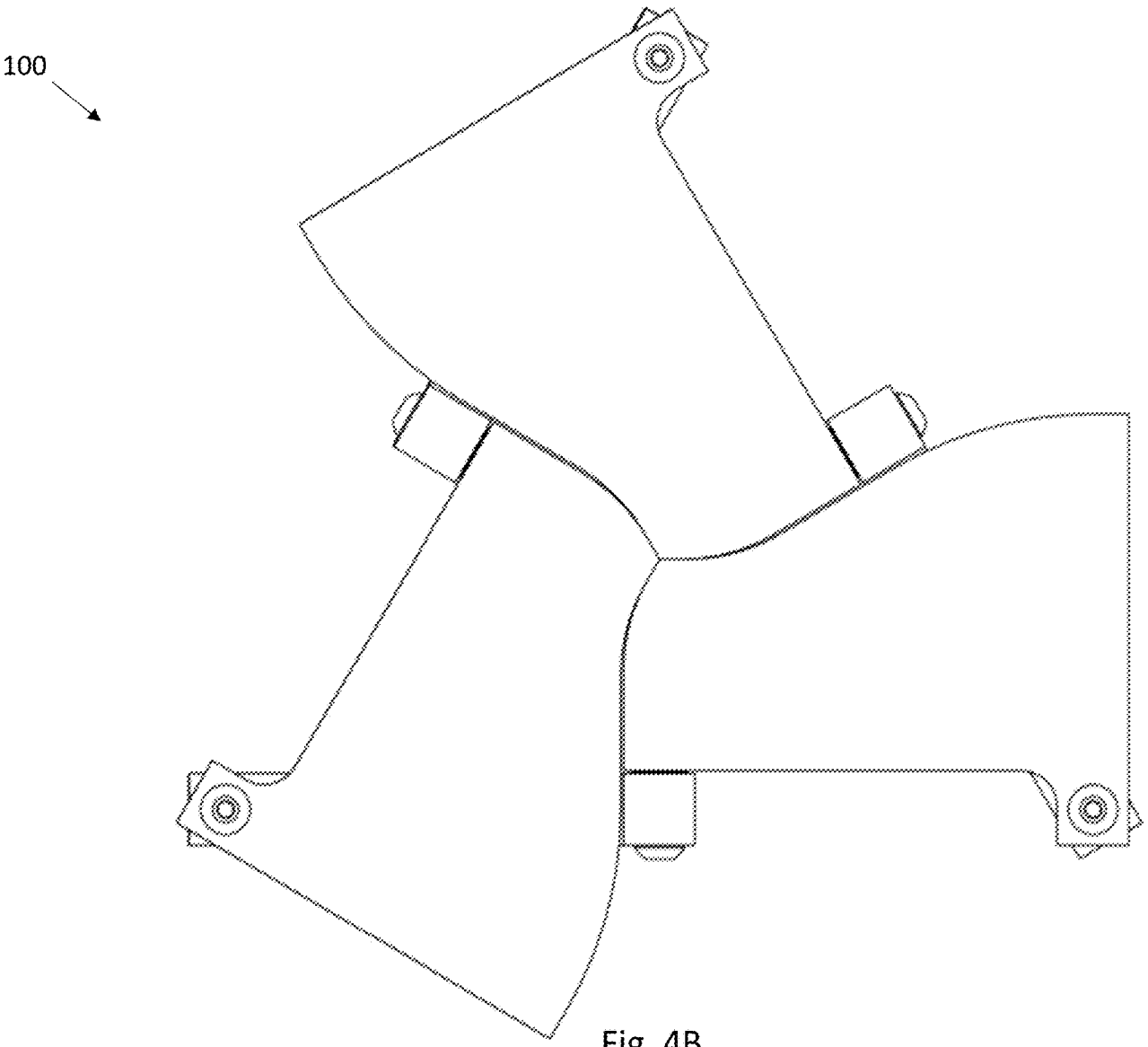
FIG. 4B illustrates a bottom view of the box in an open configuration according to embodiments of the present disclosure.

FIG. 4A illustrates a rear opening of the box and FIG. 4B illustrates a bottom view of the box in an open configuration. As shown in FIG. 4A, in the closed configuration, a portion of the box 100 may be open (i.e., provide access to the interior void space) due to the non-linear side of panels 104, 105, and 106. In various embodiments, the triangular geometry of the panels 104, 105, 106 may result in the rear of the box 100 having a rear opening 110 while the box 100 is in the closed configuration. The rear opening 110 is shown in FIG. 4A. The intersection of panels 104, 105, 106, is shown in FIG. 4B while panels 104, 105, 106 are aligned in a same plane in the open configuration. In various embodiments, the rear opening 110 may closed off by a portion of the insert, thereby closing off (e.g., sealing) the interior volume and preventing any contents (e.g., a ring) from falling out and/or being damaged.

Figure 5A:
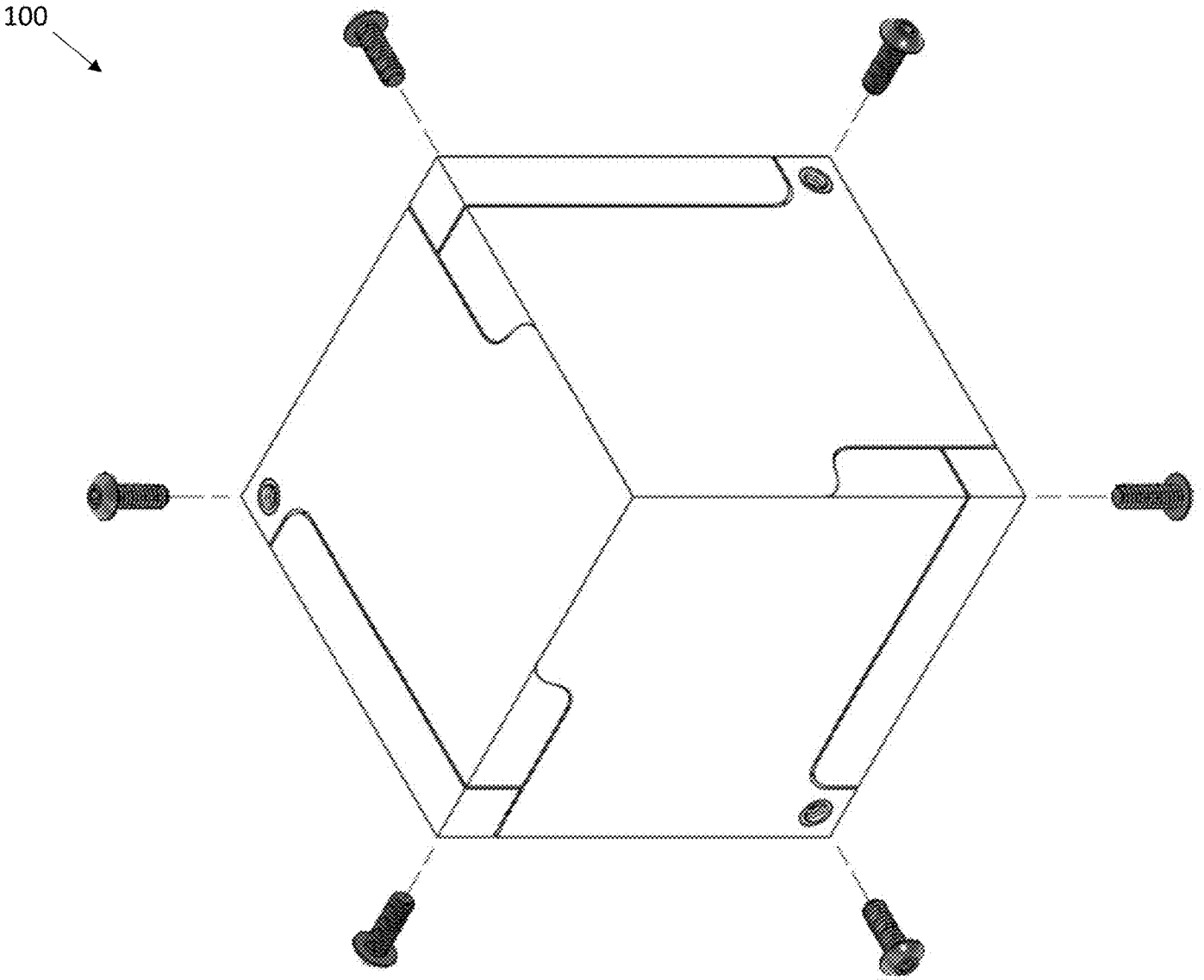
FIG. 5A illustrates a kinetic box final assembly according to embodiments of the present disclosure.
Figure 5B:
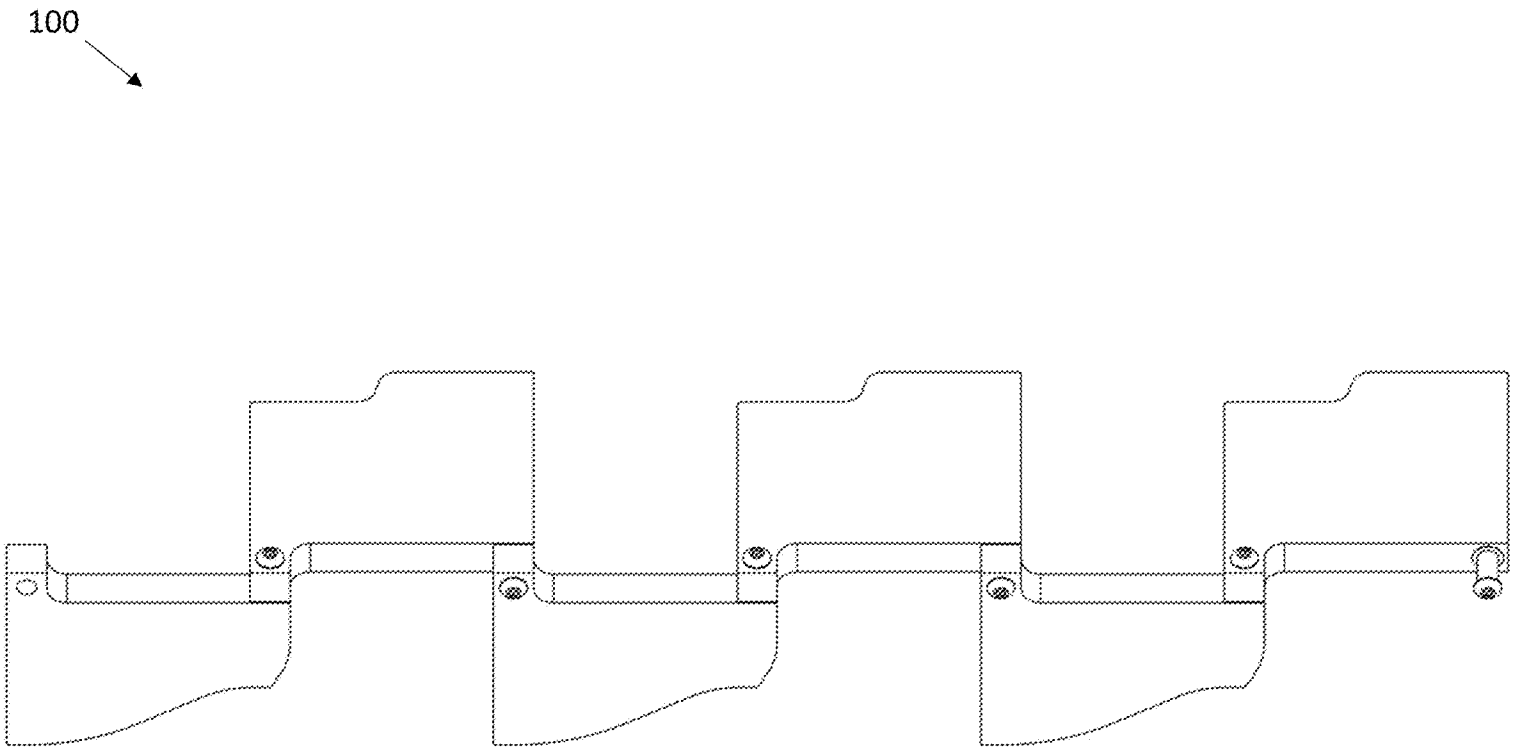
FIGS. 5B-5D illustrate a kinetic box in a semi-assembled state according to embodiments of the present disclosure.
Figure 5C:
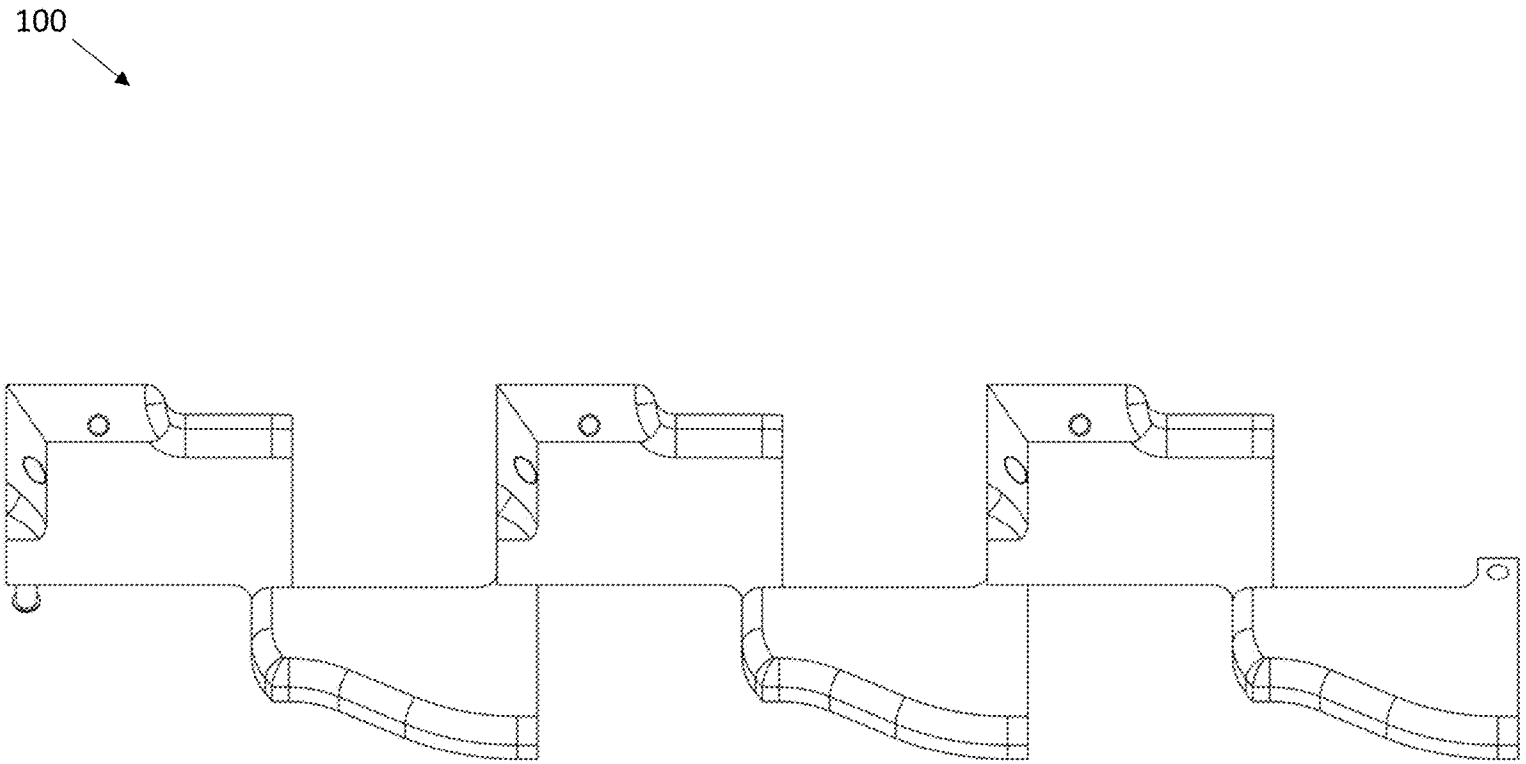
Figure 5D:
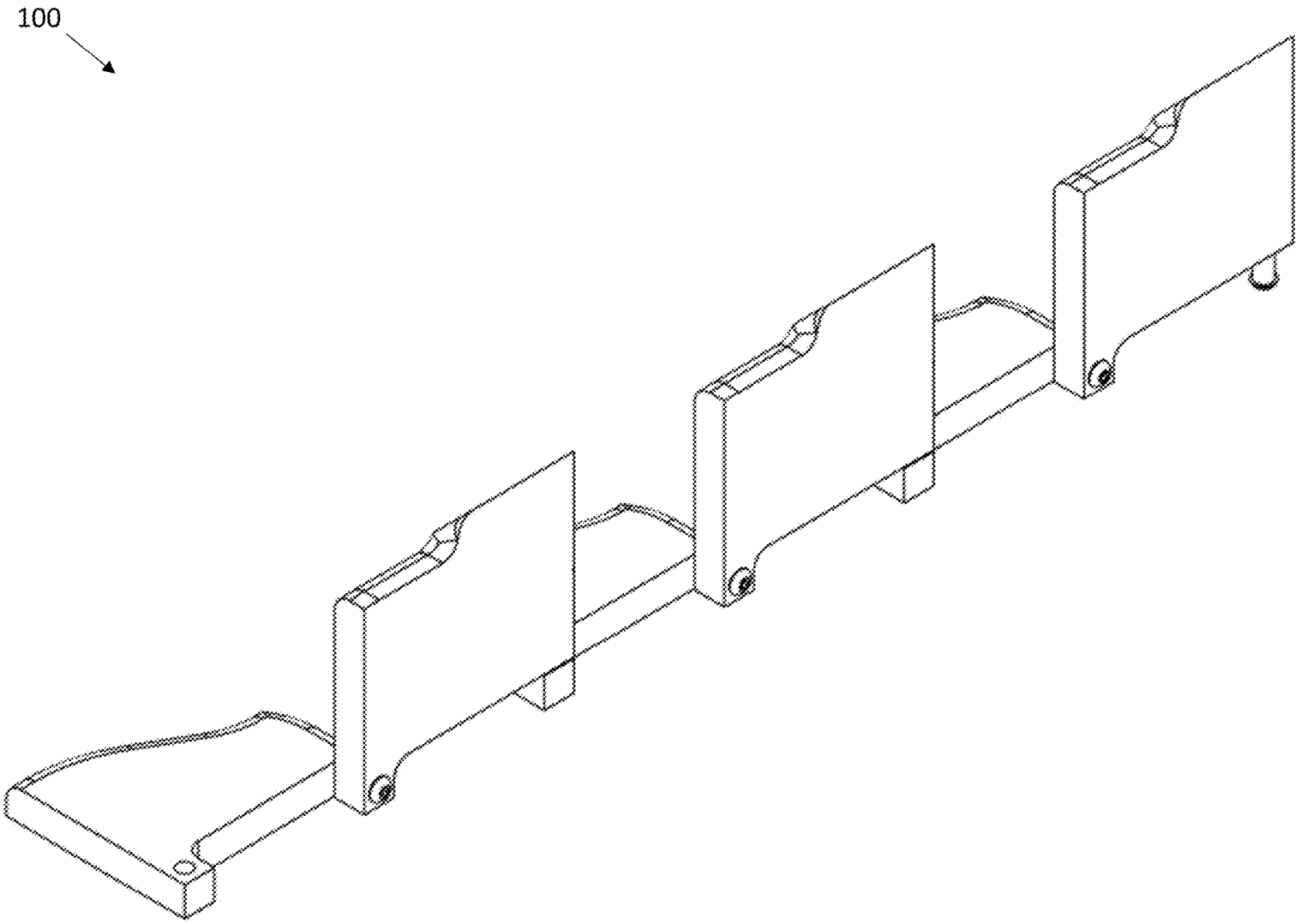
Figure 6A:
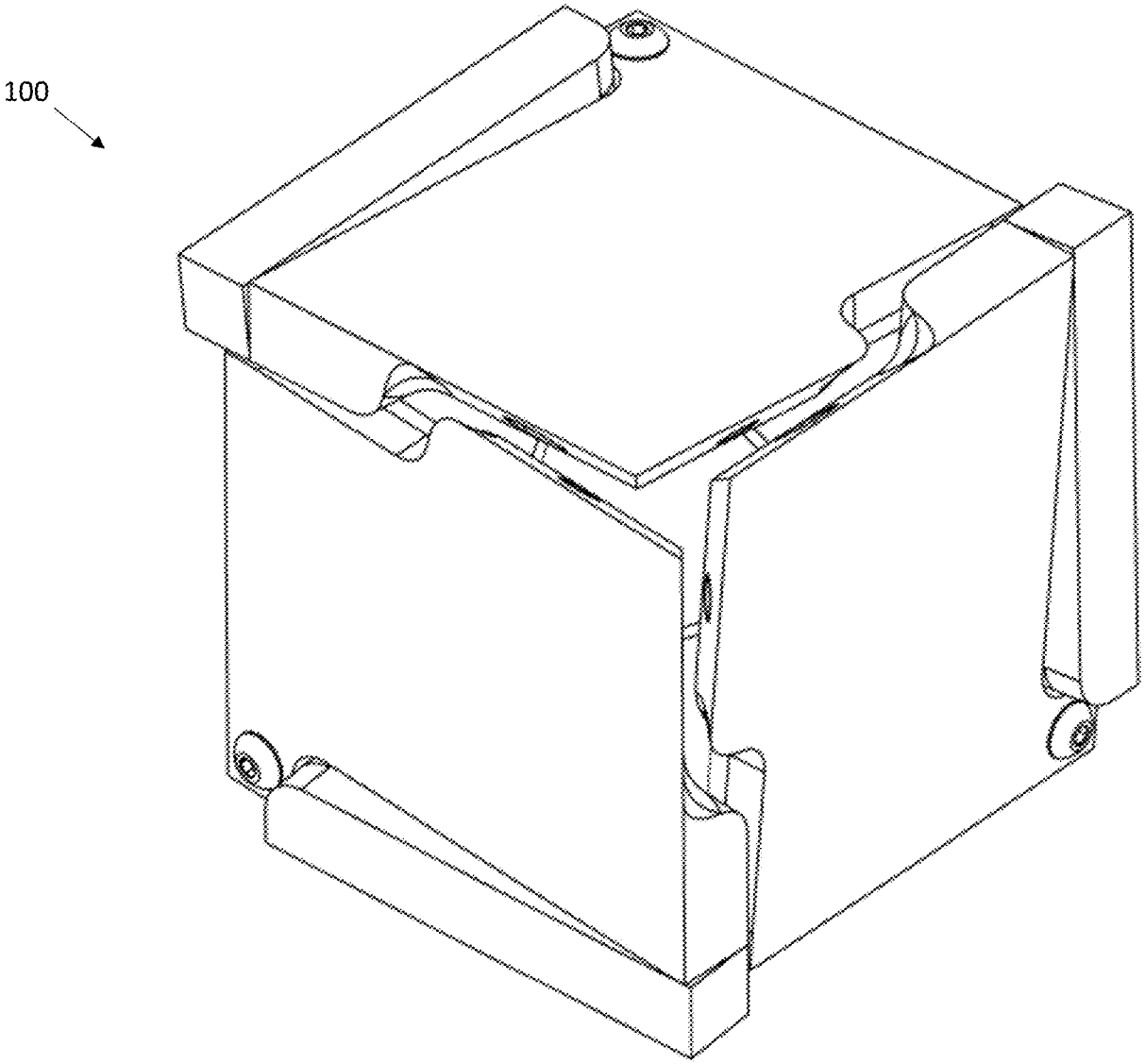
FIGS. 6A-6E illustrates steps in a kinetic box articulation sequence according to embodiments of the present disclosure.
Figure 6B:
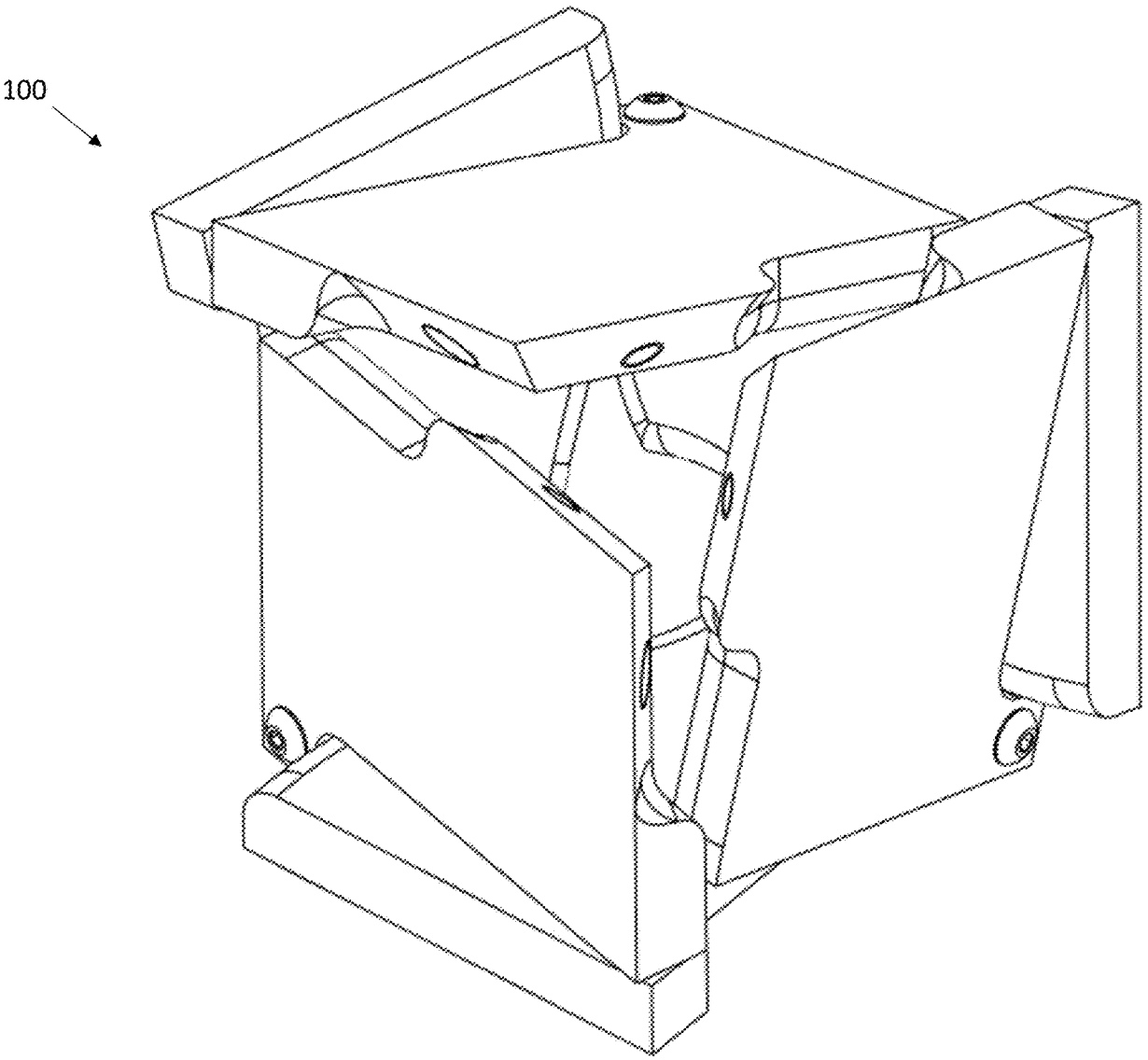
Figure 6C:
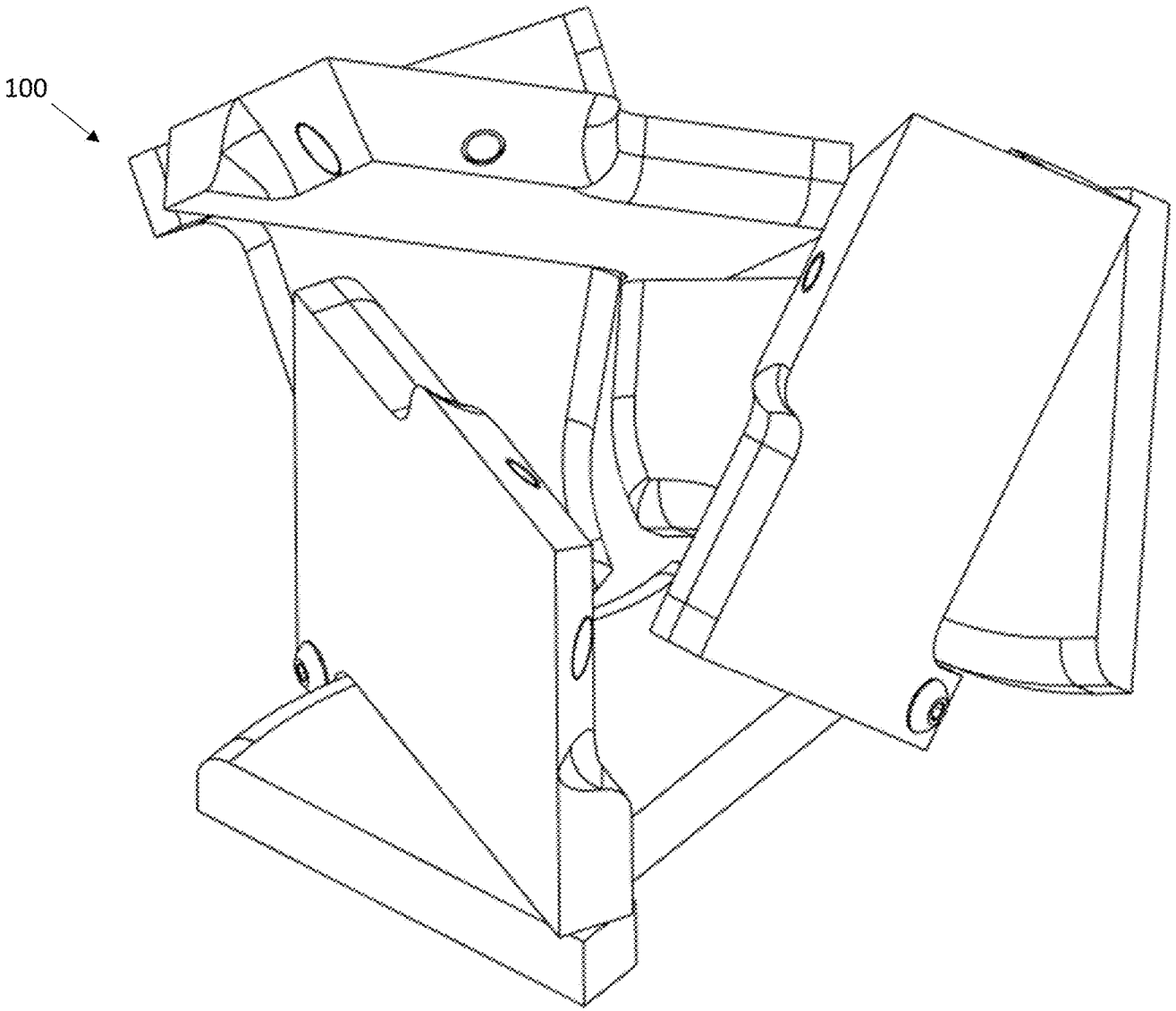
Figure 6D:
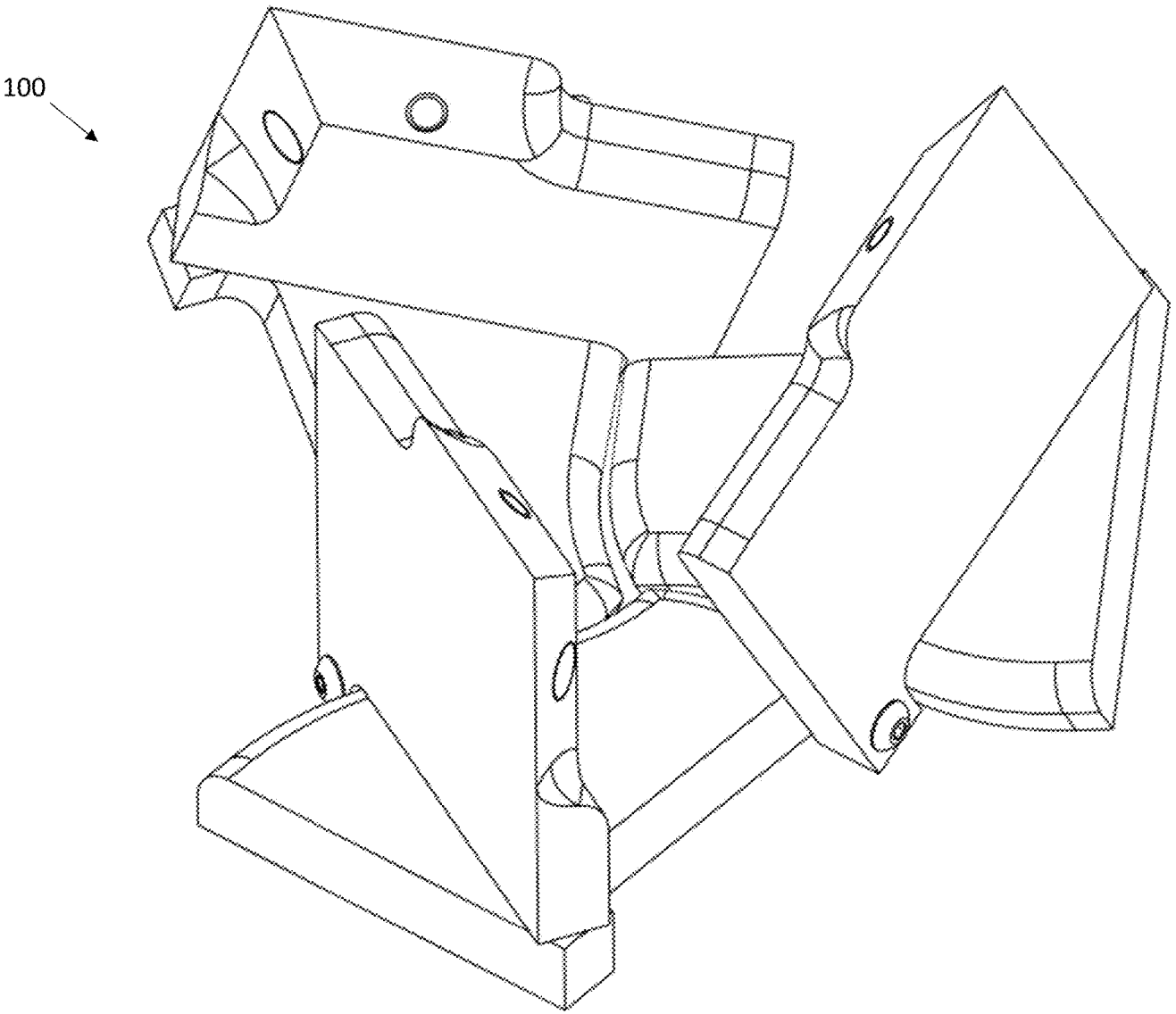
Figure 6E:
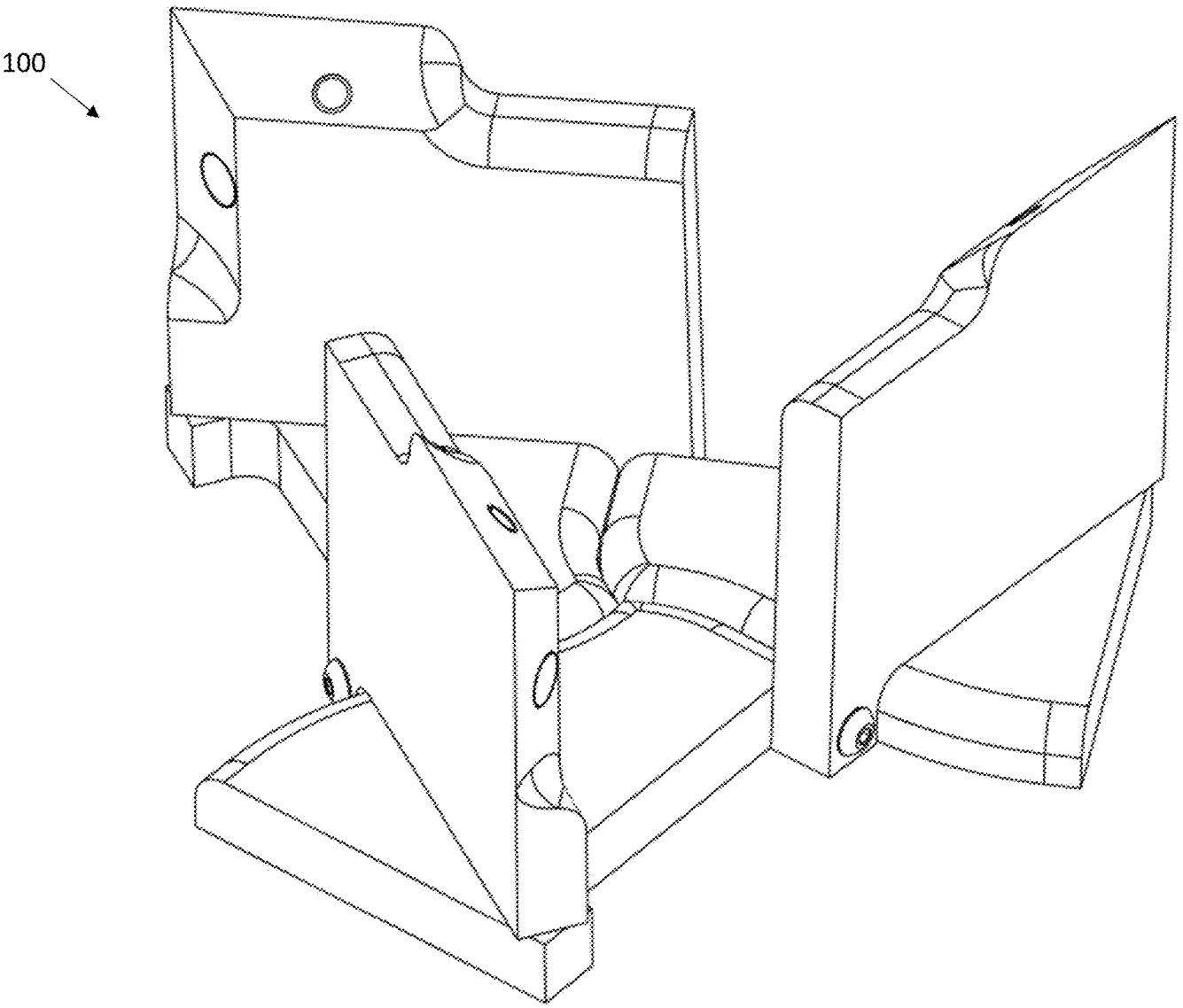

In various embodiments, final assembly of the box may occur when the panels are joined together on their fixed studs and ultimately retained in place with fixation mechanisms (e.g., machine screws) which may affix (e.g., thread) into the studs as shown in FIG. 5A. In various embodiments, screws are nominally unloaded and are only required to prevent the panels from sliding off the studs. FIGS. 5B-5D illustrate a kinetic box in a semi-assembled state according to embodiments of the present disclosure.

In various embodiments, opening of the kinetic box 100 is achieved via rotation of its panels within the assembly. A sequence showing the opening motion of the assembly is illustrated in FIGS. 6A-6E.

In various embodiments, whereas the moving panels of most boxes rotate about axes which roughly coincide with the intersection of its faces, each joint in the six-link Mobius kaleidocycle kinetic box may be substantially normal to one of the two joined panels faces and in-plane with the other. In various embodiments, the required relative orientation of the in-plane and out-of-plane axes within each panel may depend on the number of links in the Mobius kaleidocycle. In various embodiments, the relationship between rotational axes within each link may represent a coordinate transformation which proceeds through the mechanism and may sum to zero when the loop is closed.

Figure 7:
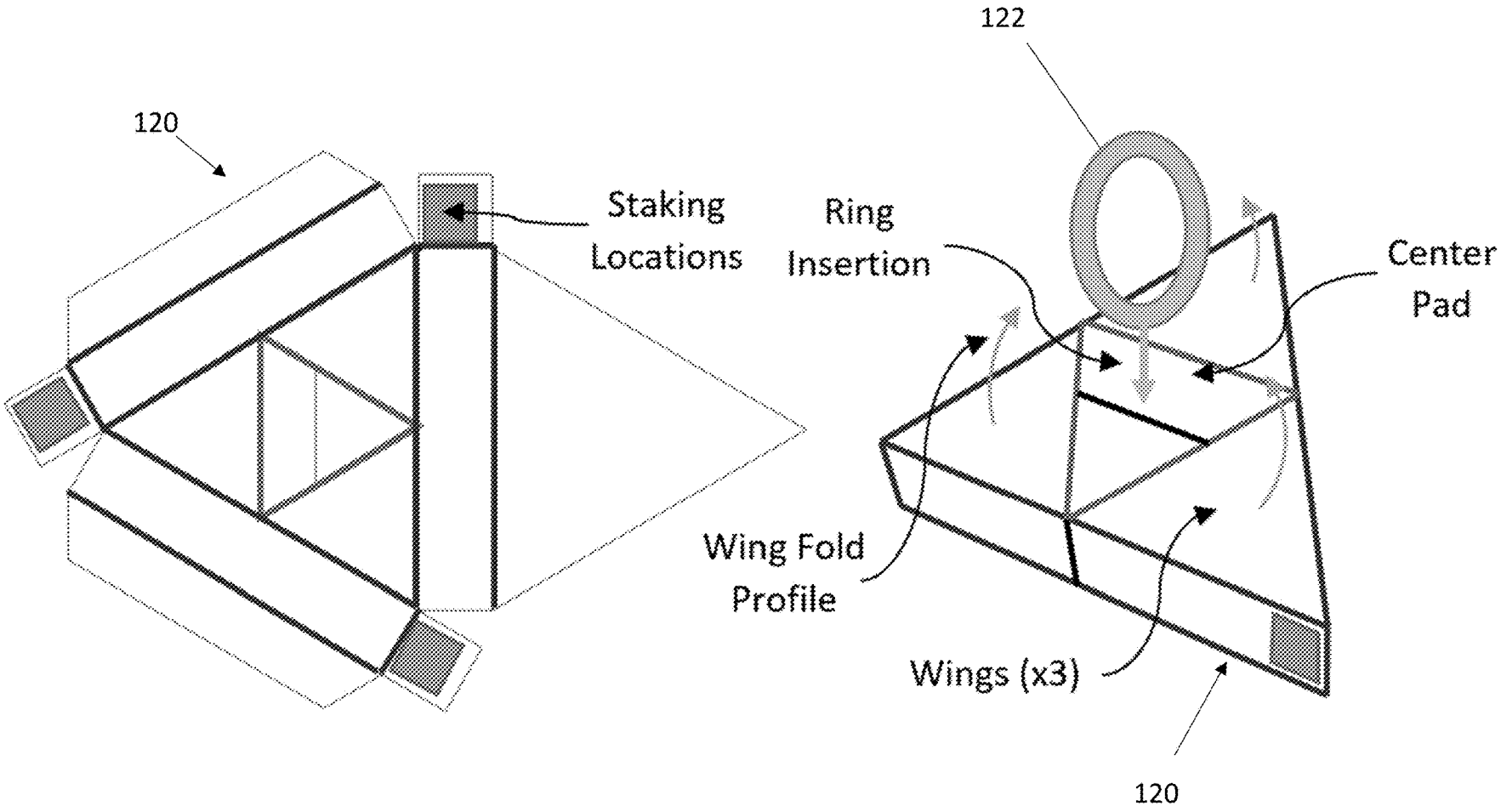
FIG. 7 illustrates an insert fold pattern and folding process according to embodiments of the present disclosure.

While the panels create the outer protective shell of the box, the insert is tasked with retaining and presenting its contents. The current embodiment of the insert is a velvet-wrapped piece of triangular foam which folds around the ring when the box is closed. The insert is restrained (e.g., bonded) inside the box with local adhesive applied in three points between the insert's corners and the box's triangular panels. Adhesive is specifically applied to the outermost tabs which wrap around adjacent fabric after folding down to avoid exposed fabric edges during assembly. The cut/fold pattern of the insert's velvet sheet as well as its folding process are illustrated in FIG. 7. In various embodiments, the insert may be configured to stop rotation of one or more panels after a predetermined amount of rotation.

In various embodiments, the completed insert may consist of four major pieces: the center pad and three surrounding wings. In various embodiments, the four pieces share a common top layer of felt and are currently divided by cutting a single piece of velvet-wrapped foam. In various embodiments, the process of closing the box folds the wings upwards to wrap around the wing, restraining it in place. In various embodiments, while the face of the center pad has a cut for the ring, the rear may be continuous and acts to seal off the rear hole and prevent the ring from falling out the back of the box.

Figure 8A:
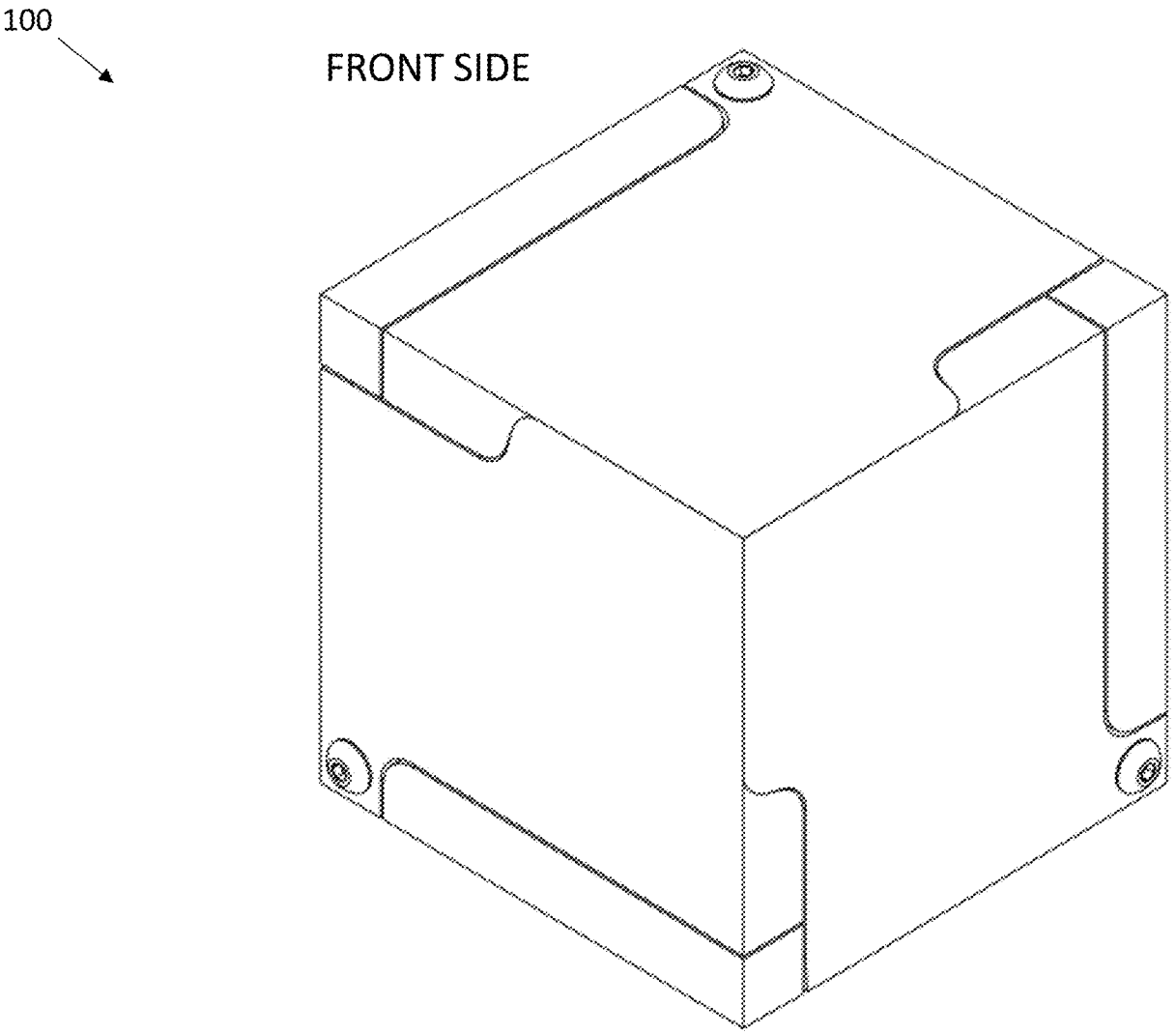
FIGS. 8A-8C illustrate inner and outer dimensions of a kinetic box according to embodiments of the present disclosure.
Figure 8B:
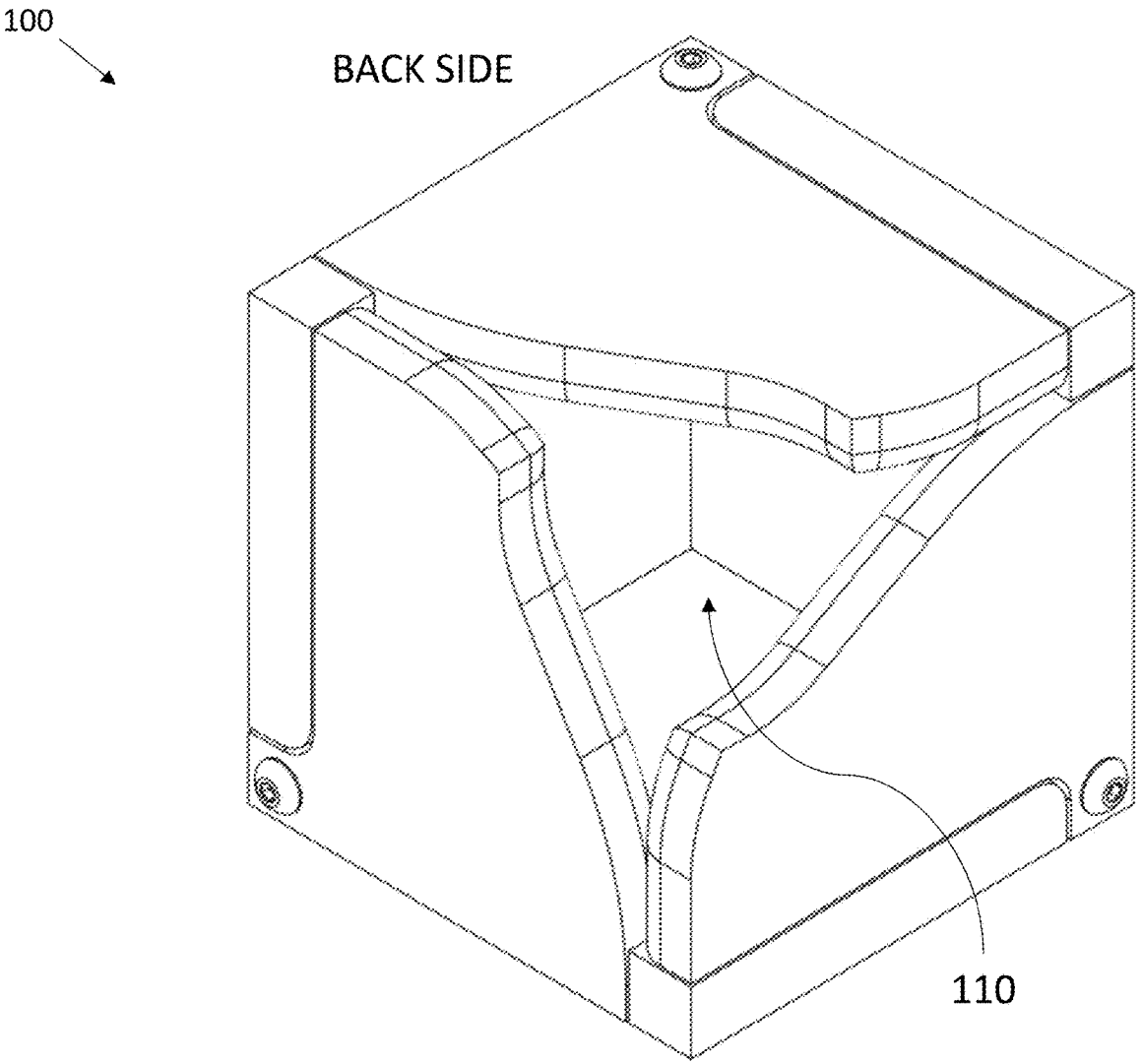
Figure 8C:
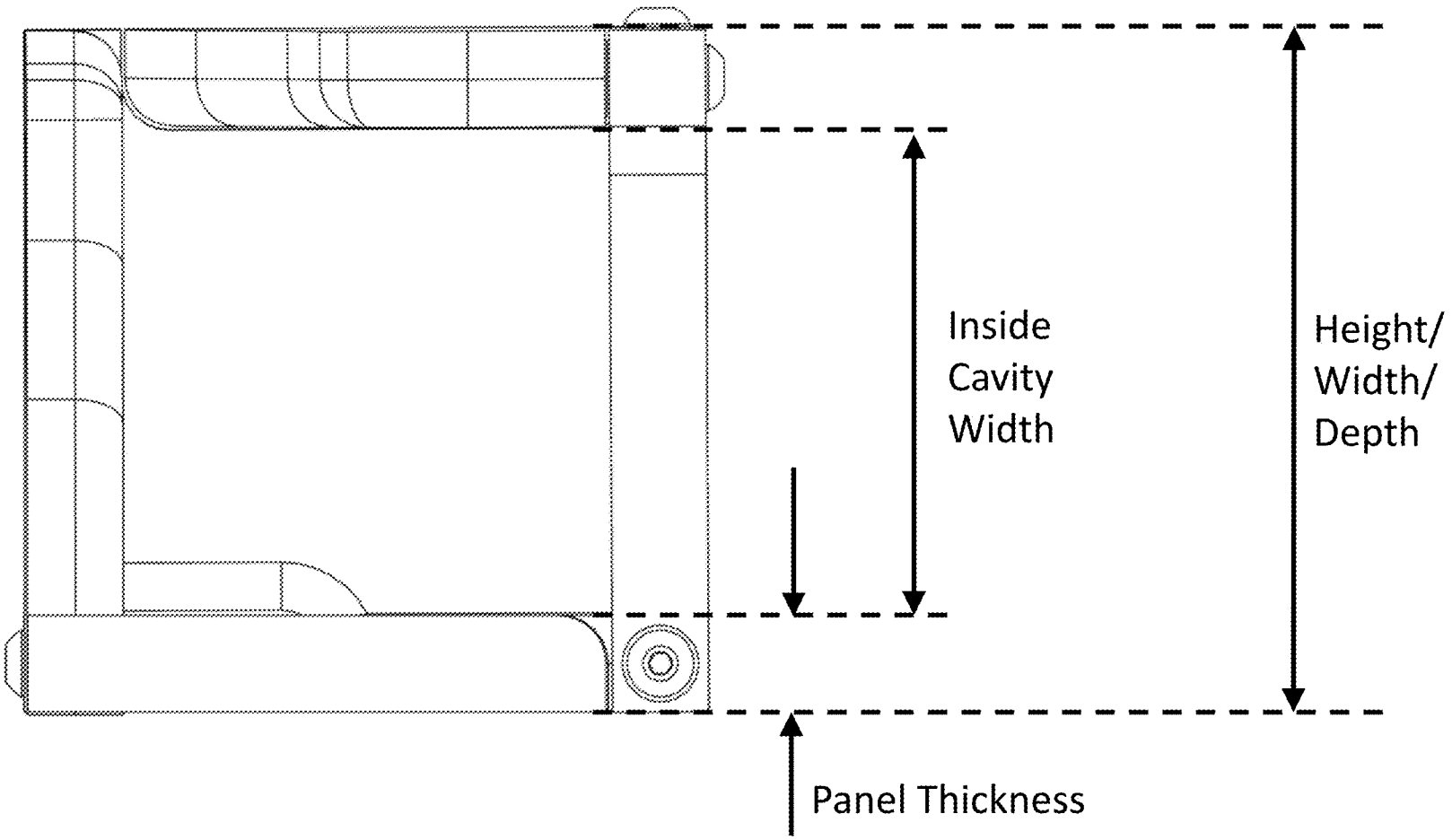

In various embodiments, the geometry of the kinetic box can be described as illustrated in FIGS. 8A-8C. In various embodiments, the thickness of each panel may be 1 mm to 100 mm. Preferably, the thickness of each panel is between 5 mm and 25 mm. In various embodiments each panel 101, 102, 103, 104, 105, 106 may have substantially the same thickness. In various embodiments, any one of the panels 101, 102, 103, 104, 305, 306 may have a different thickness than the other panels 301, 302, 303, 304, 305, 306.

Figure 9:
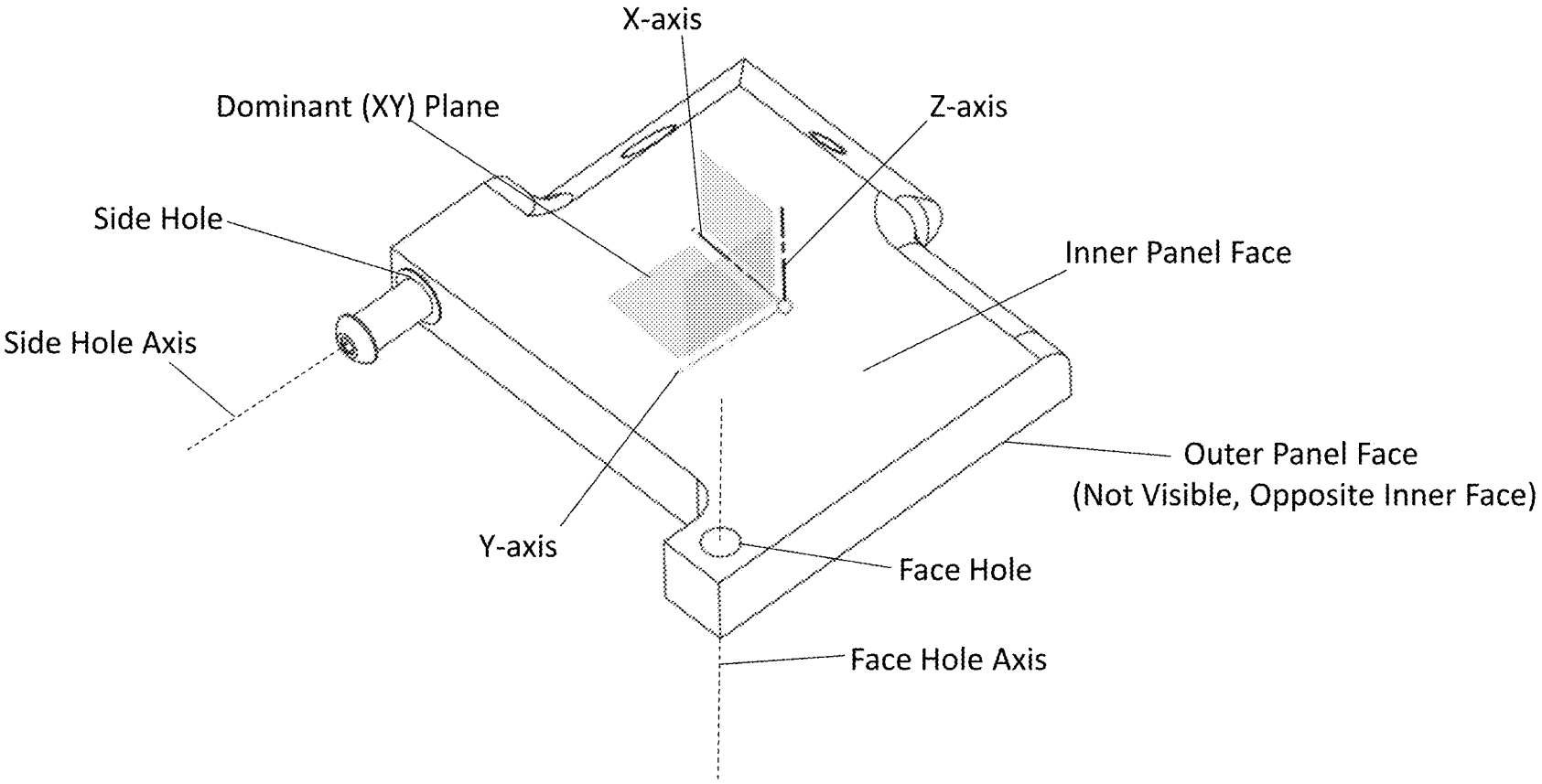
FIG. 9 illustrates a panel coordinate system and plane definition according to embodiments of the present disclosure.
Figure 10A:
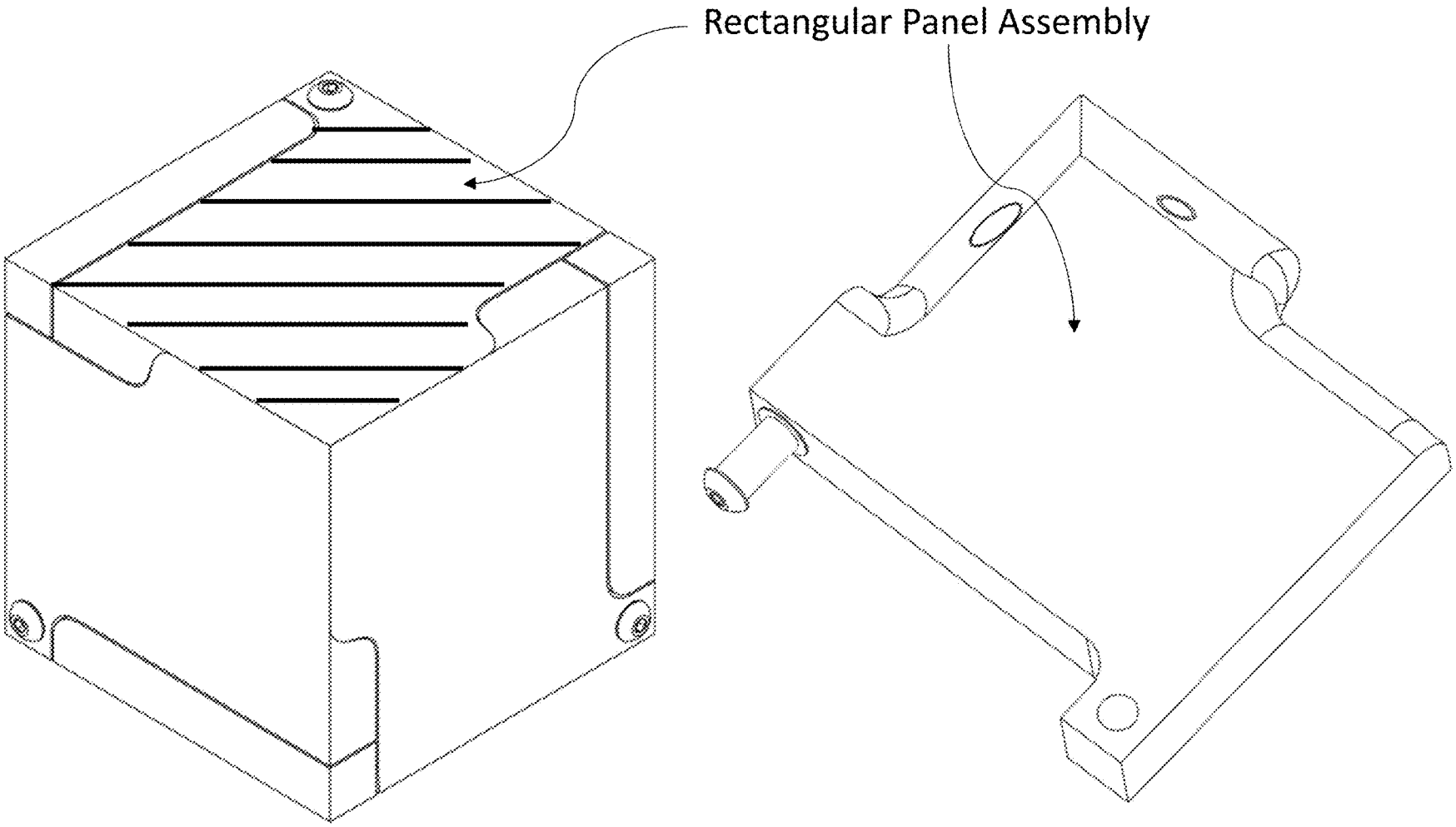
FIGS. 10A-10B illustrate a rectangular panel location and assembly according to embodiments of the present disclosure.
Figure 10B:
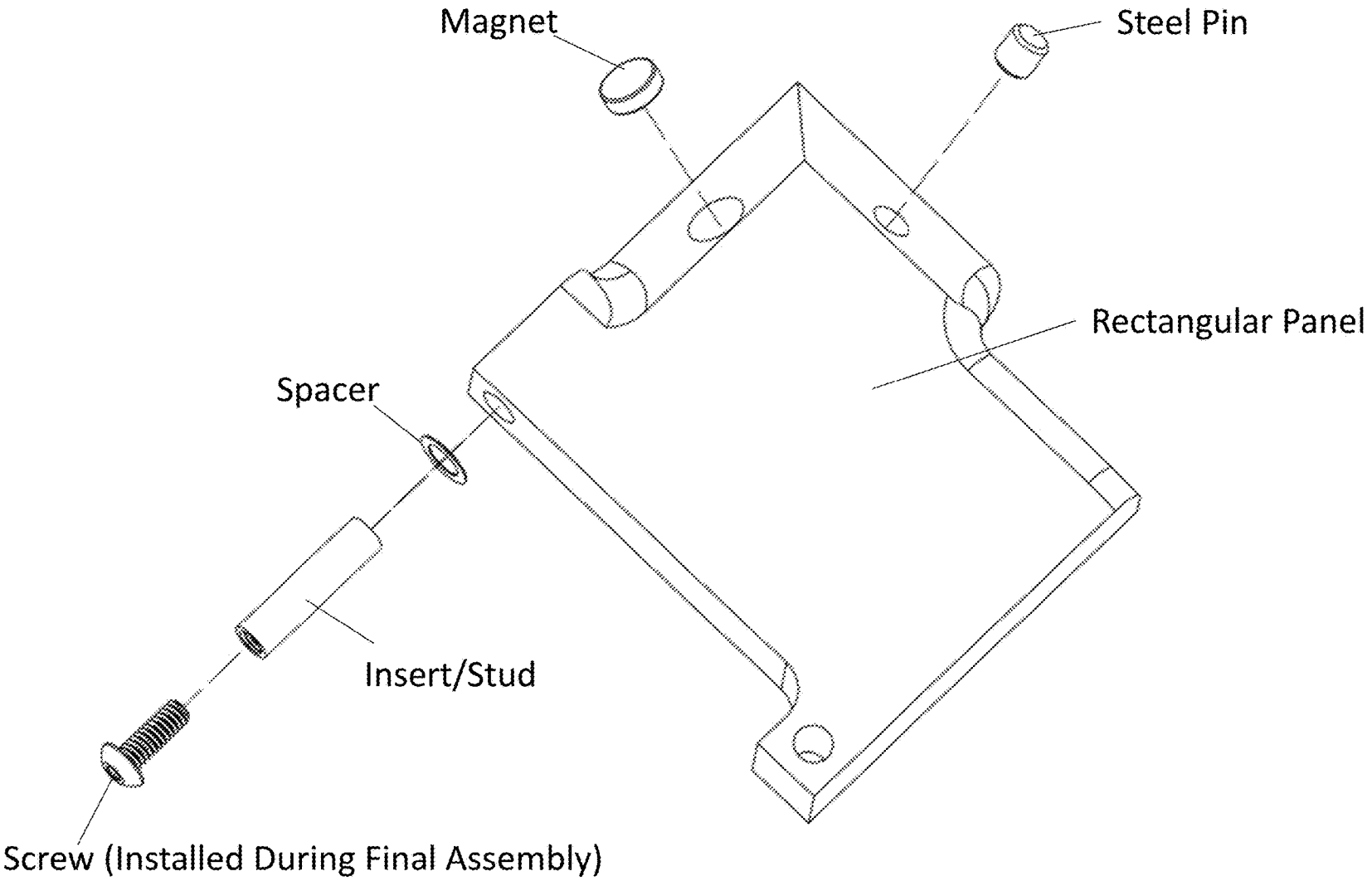

In various embodiments, the overall shape and behavior of the assembly may be driven by the geometry of and relative joint axis position within each panel. FIG. 9 illustrates the coordinate system that is maintained within each panel. In various embodiments, this applies to both rectangular and triangular panels.

Figure 11A:
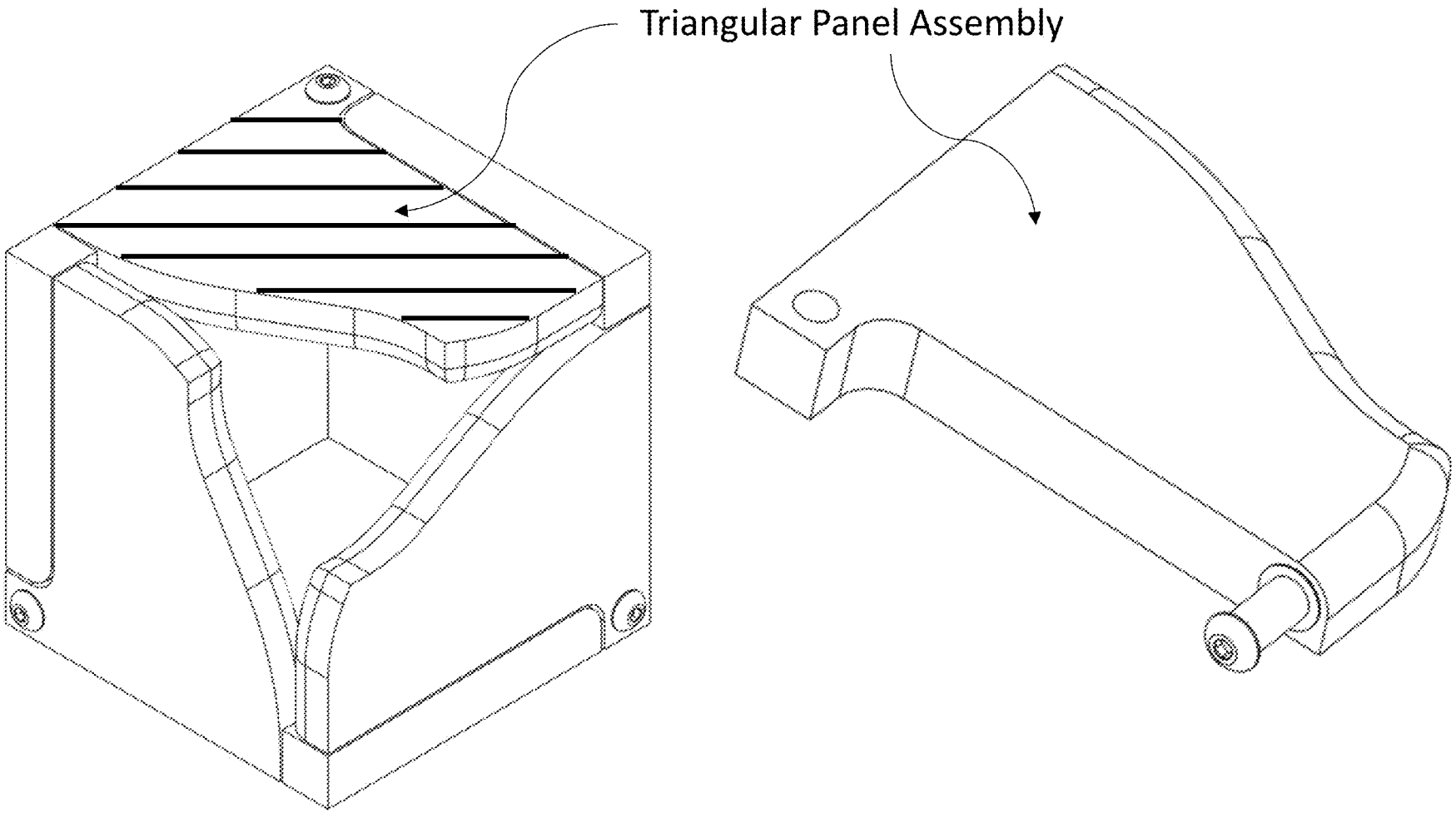
FIGS. 11A-11B illustrate a triangular panel location and assembly according to embodiments of the present disclosure.
Figure 11B:
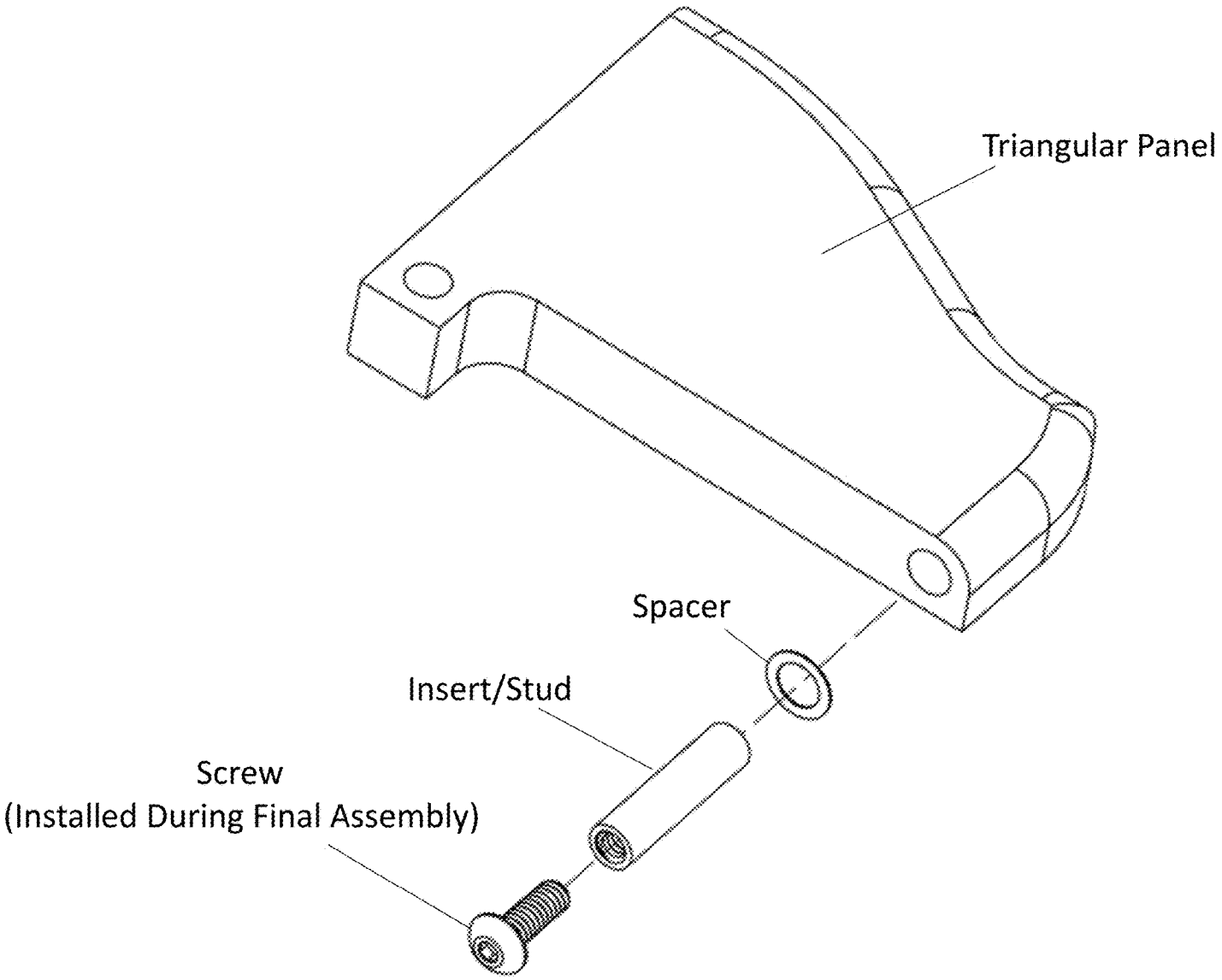
Figure 11C:
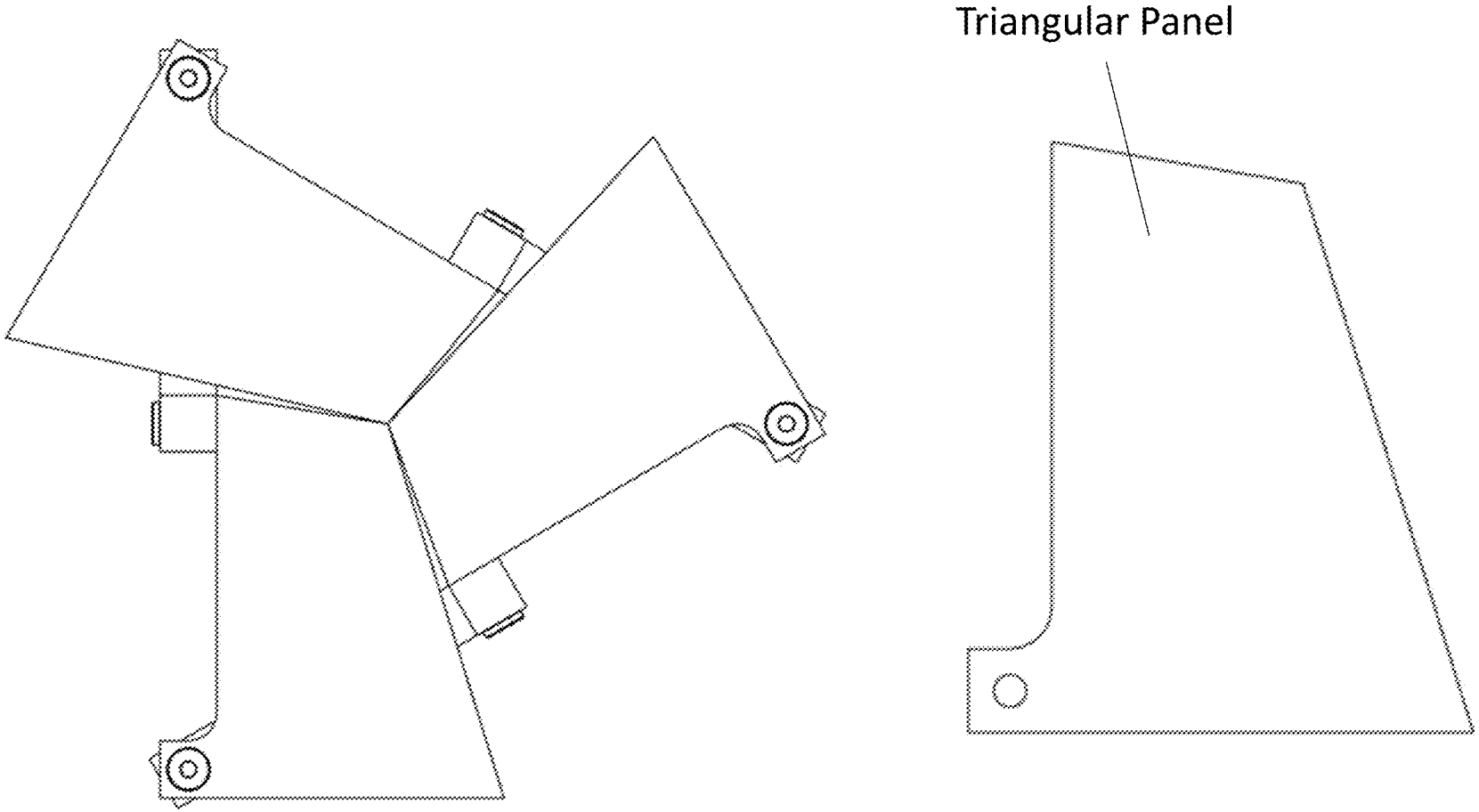
FIGS. 11C-11D illustrate alternative triangular panel shapes according to embodiments of the present disclosure.
Figure 11D:
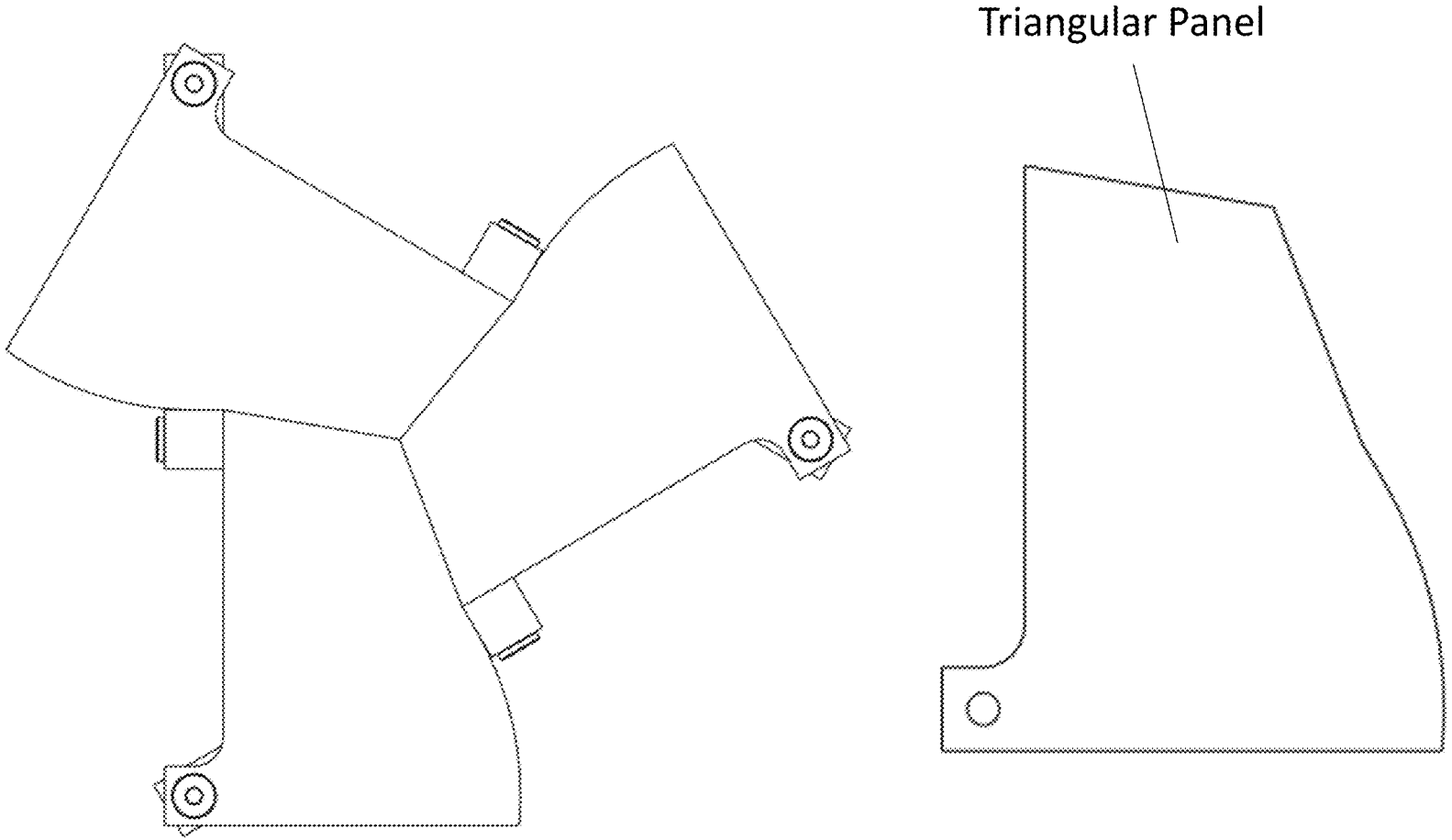

In various embodiments, a panel assembly may include four components: the panel 101, 102, 103, 104, 105, 106, a threaded stud, a spacer, and a loose fastener. In various embodiments, while the triangular panel 104, 105, 106 may only include these four pieces, the rectangular panel 101, 102, 103 may also include a magnet and/or a steel pin to help reduce panel gaps when the box is in the closed configuration. The rectangular and triangular panel assemblies are illustrated in FIGS. 10A-10B and 11A-11B. FIGS. 11C-11D illustrate alternative triangular panel shapes according to embodiments of the present disclosure.

Figure 12:
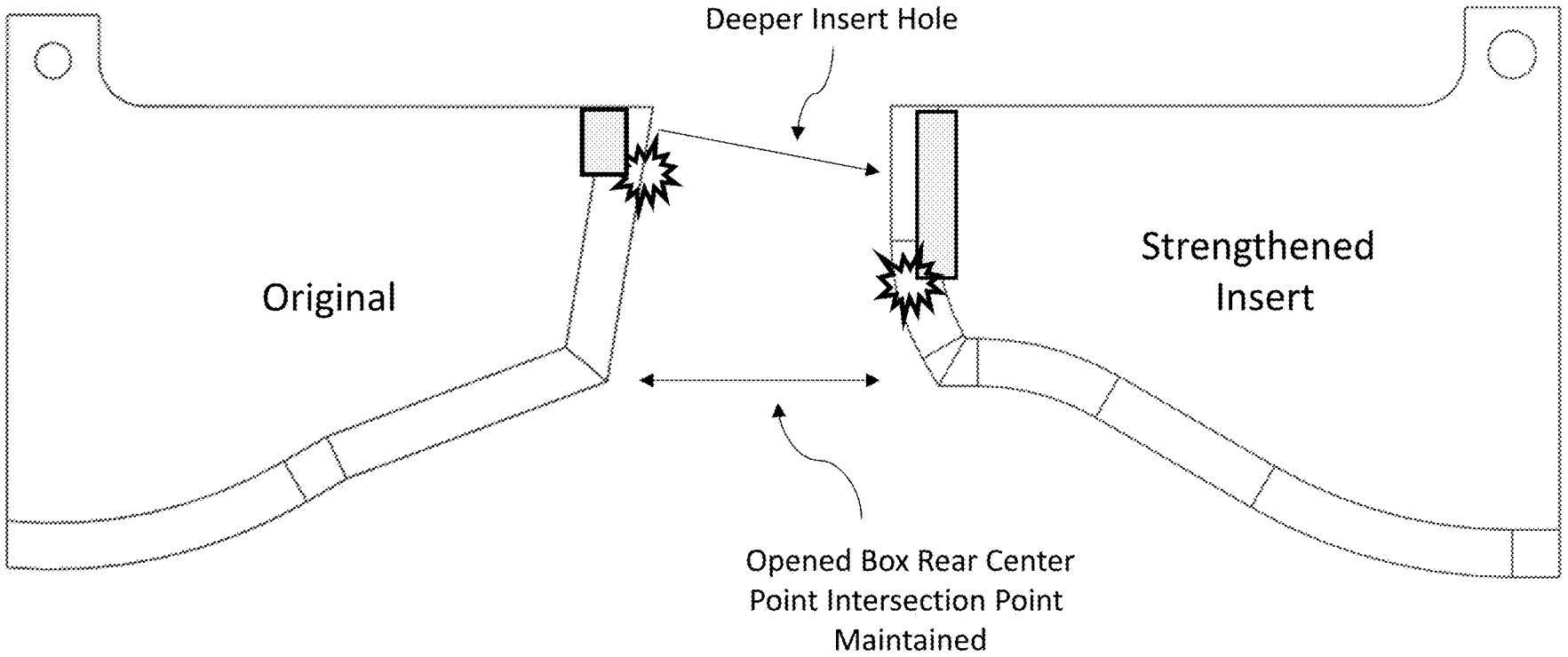
FIG. 12 illustrates triangular panel modification for insert strengthening according to embodiments of the present disclosure.
Figure 13:
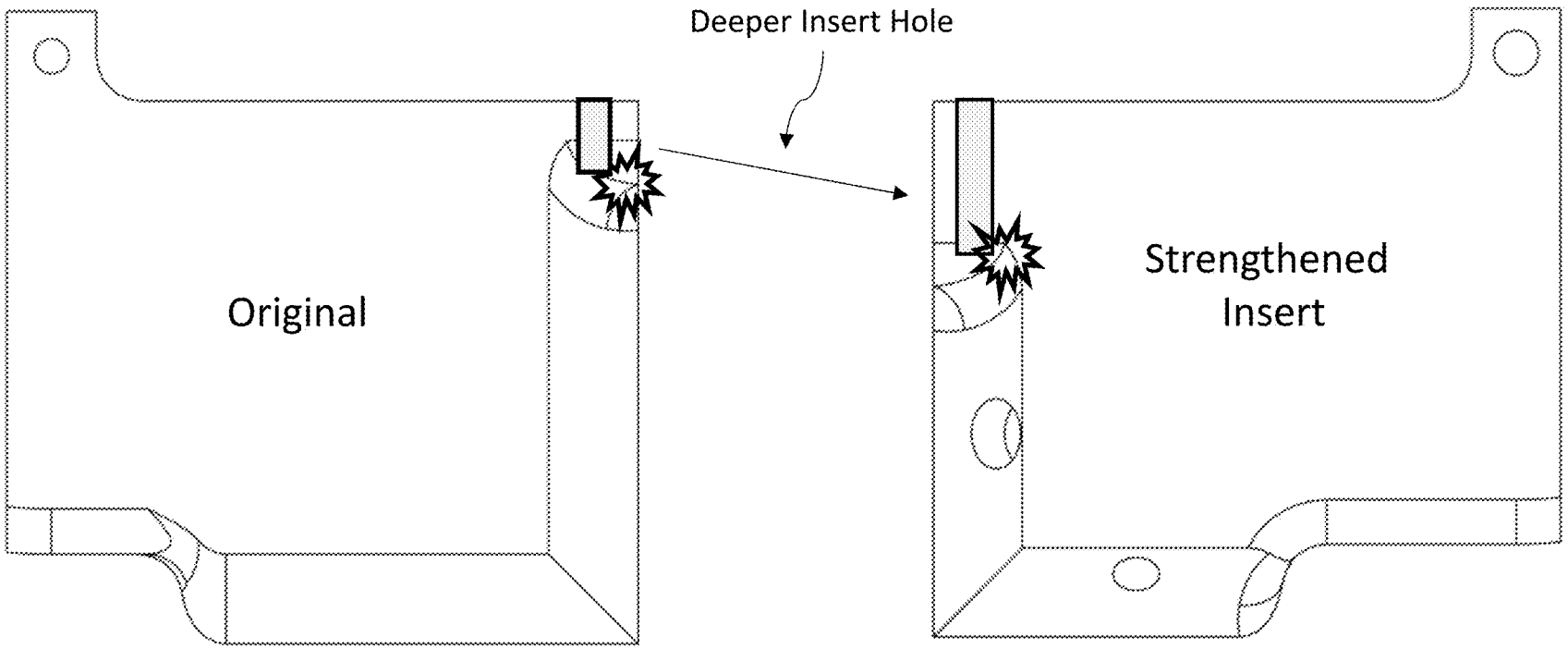
FIG. 13 illustrates rectangular panel modification for insert strengthening according to embodiments of the present disclosure.

In various embodiments, to reduce the likelihood of joint breakage during repeated use, the panel 101, 102, 103, 104, 105, 106 may be modified to increase stock length along the aperture axes. These modifications are illustrated in FIGS. 12-132.

Figure 14A:
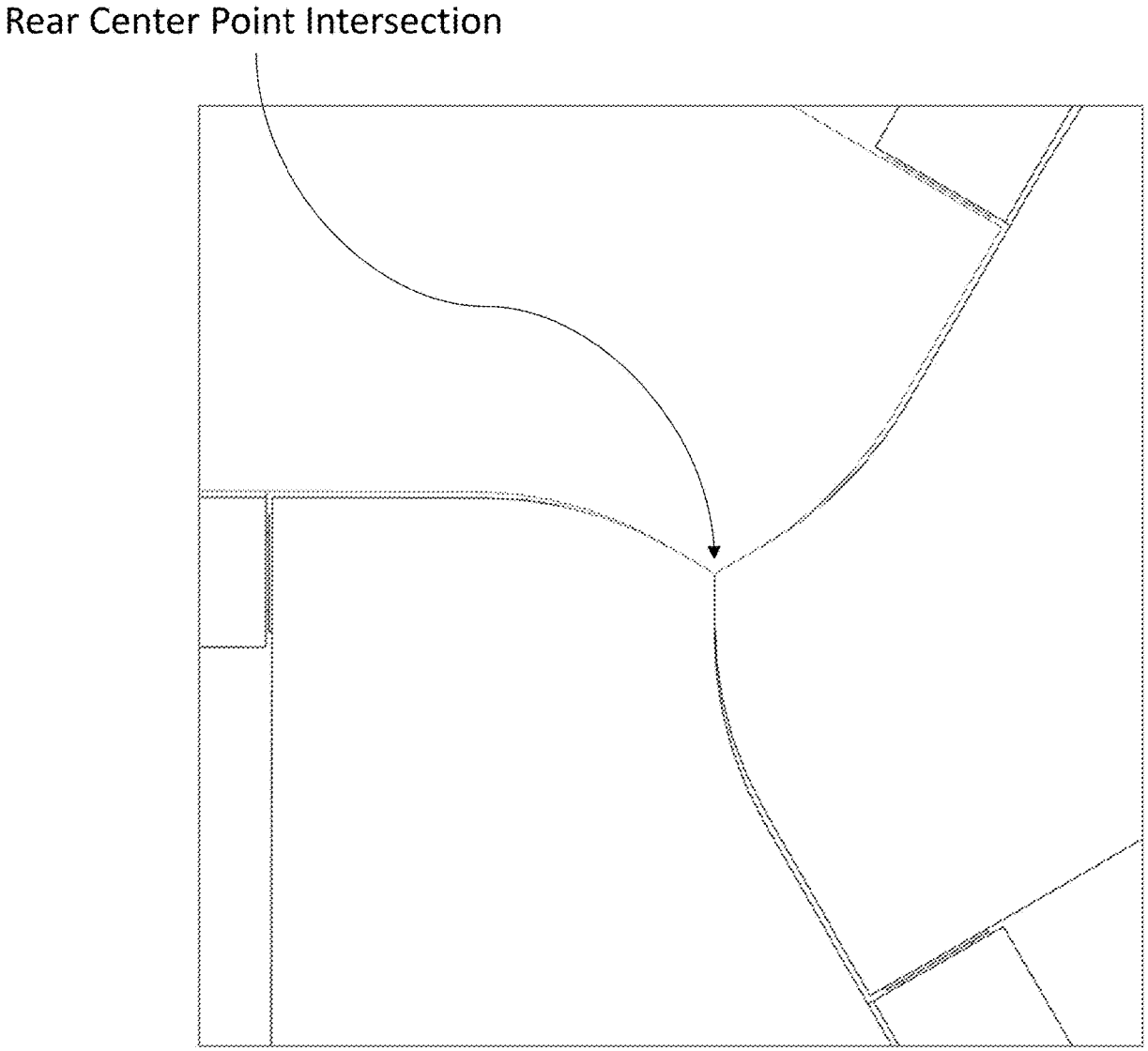
FIGS. 14A-14B illustrate panel clearance and rear intersection point according to embodiments of the present disclosure.
Figure 14B:
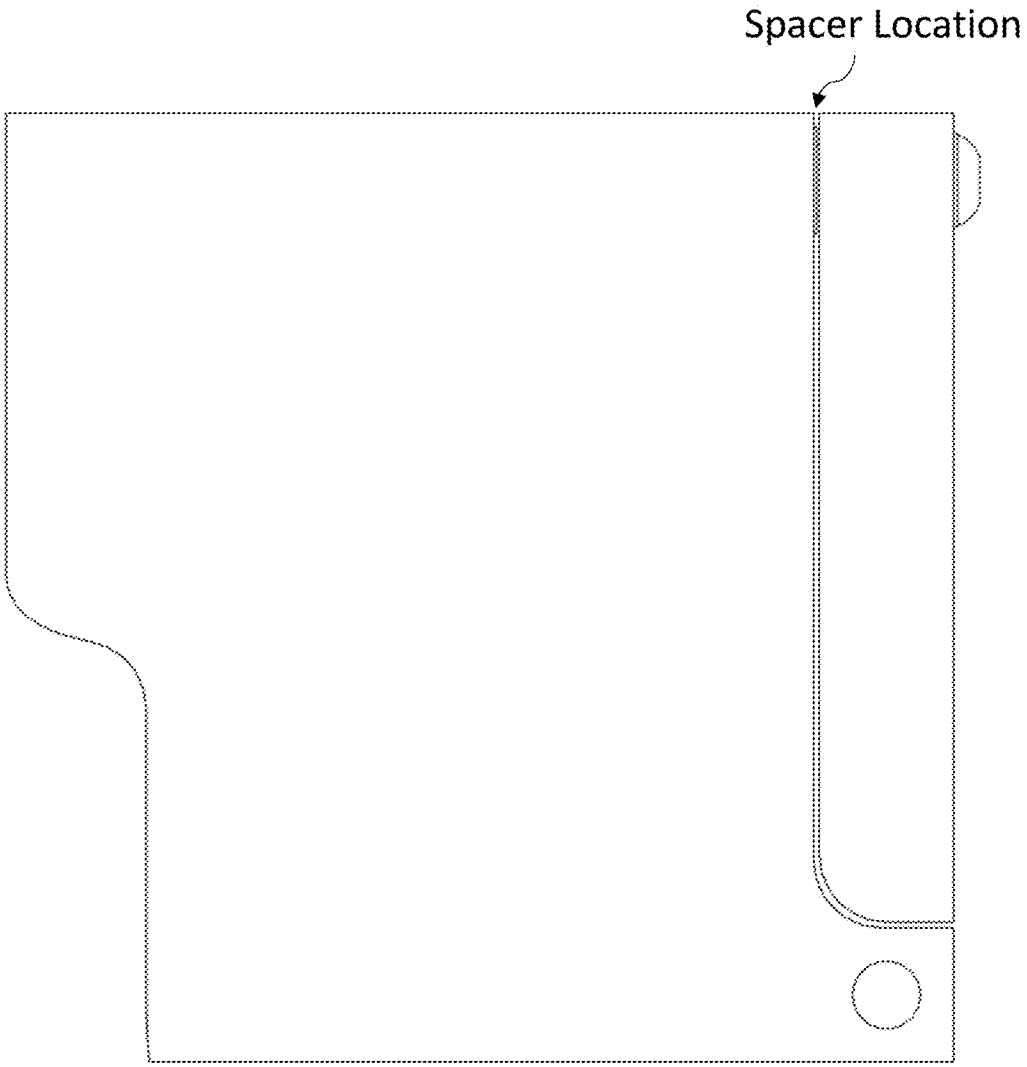

In various embodiments, controlling panel spacing and intersection may allow smooth operation of the kinetic box 100. In various embodiments, all panel-to-panel interfaces may maintain proper clearance, with the exception of the rear intersection point which may contact to prevent over-rotation of the assembly when open. In various embodiments, gaps may be controlled with bushings located around the stud at each joint, reducing the torque required to overcome friction of the feature maintaining the gap. These features are shown in FIGS. 14A-14B.

Figure 15:
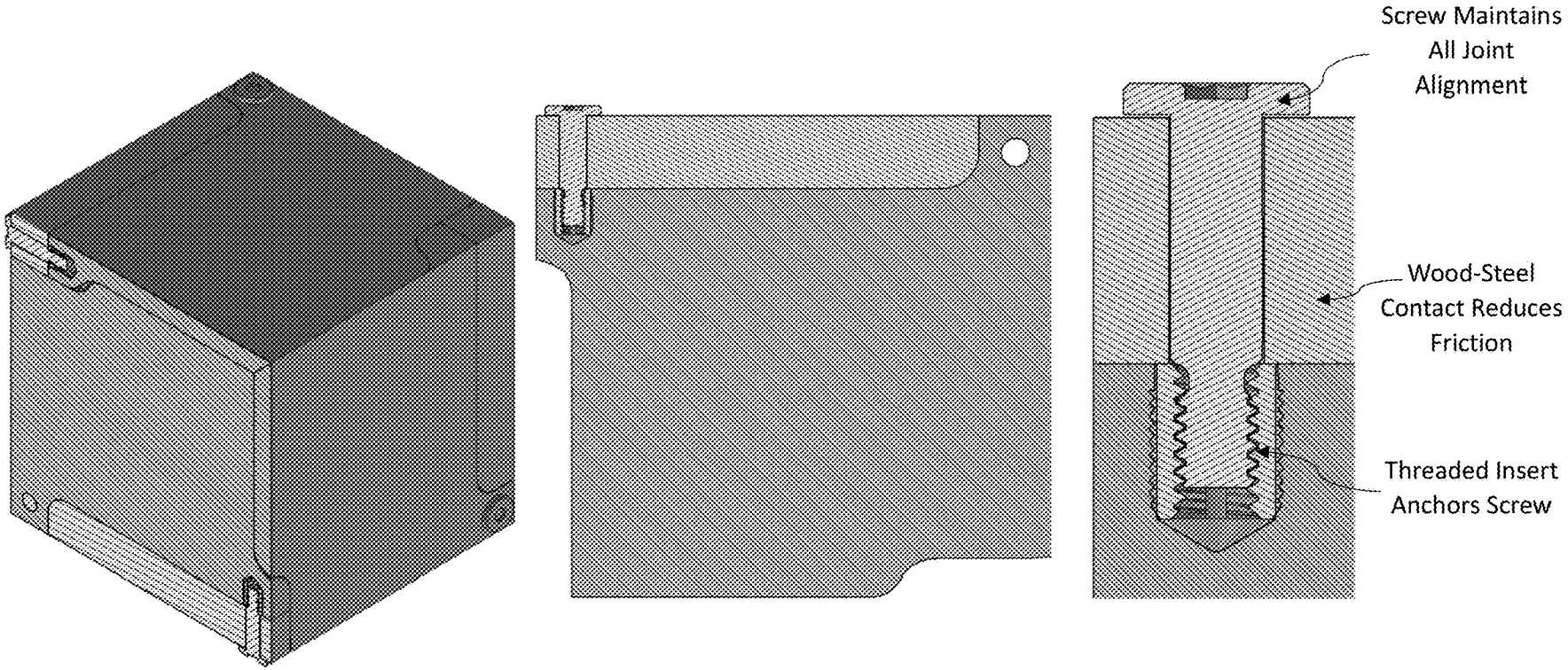
FIG. 15 illustrates a first iteration joint design using shoulder screw for retention and bearing surface according to embodiments of the present disclosure.

In various embodiments, in the six-link Mobius kaleidocycle implementation of the design, the box's six panels may be joined with a total of six rotary joints. In various embodiments, the box design may use a fixed interface to side holes and sliding interface on face holes. In various embodiments, the box design may use a shoulder screw to control all panel alignment. In various embodiments, as shown in FIG. 15, the box may use a steel-wood interface as a low-friction bearing surface. In various embodiments, poor dimensional control of the wood holes may result in panel slop at each joint. In various embodiments, a shallow insert may be replaced with a deeper insert to strengthen the joint.

Figure 16:
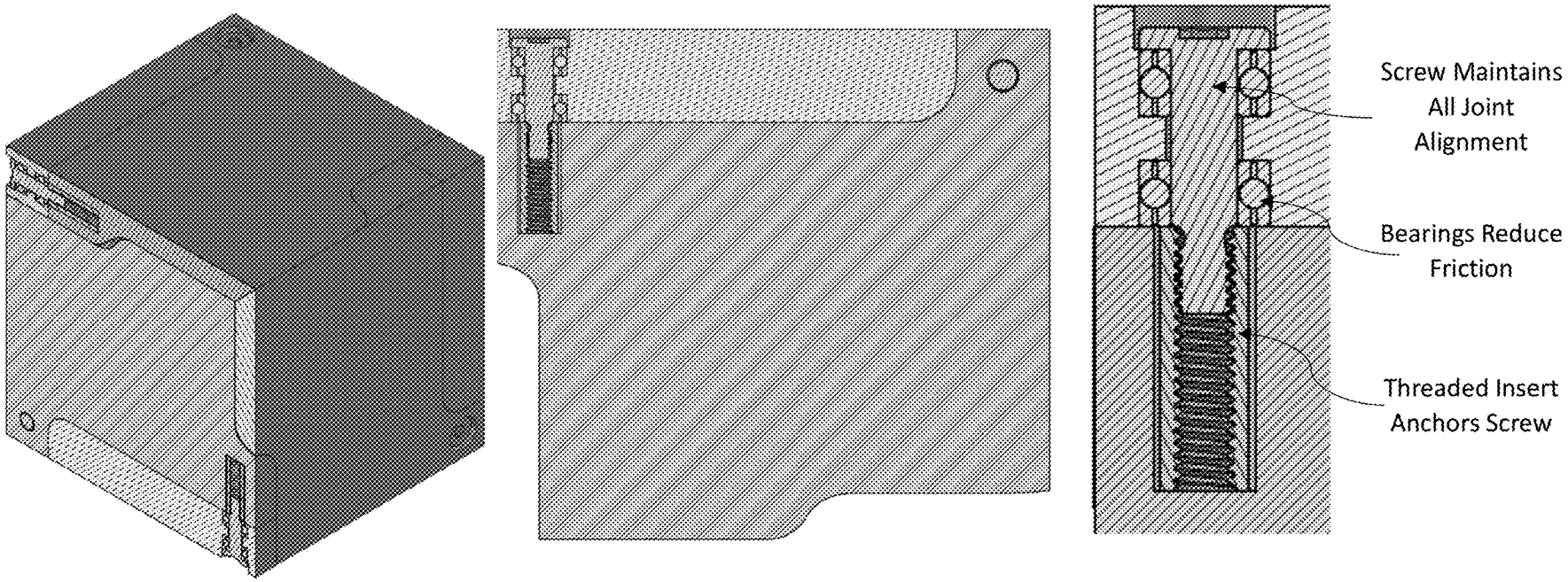
FIG. 16 illustrates a second iteration joint design using shoulder screw for retention and ball bearings according to embodiments of the present disclosure.

In various embodiments, a wood-steel sliding interface may be replaced with ball bearings as shown in FIG. 16. In various embodiments, this may reduce joint slop. In various embodiments, poor dimensional control of the panel hole features may result in high bearing thrust forces during assembly, increasing bearing friction. In various embodiments, the panels may be thickened.

Figure 17:
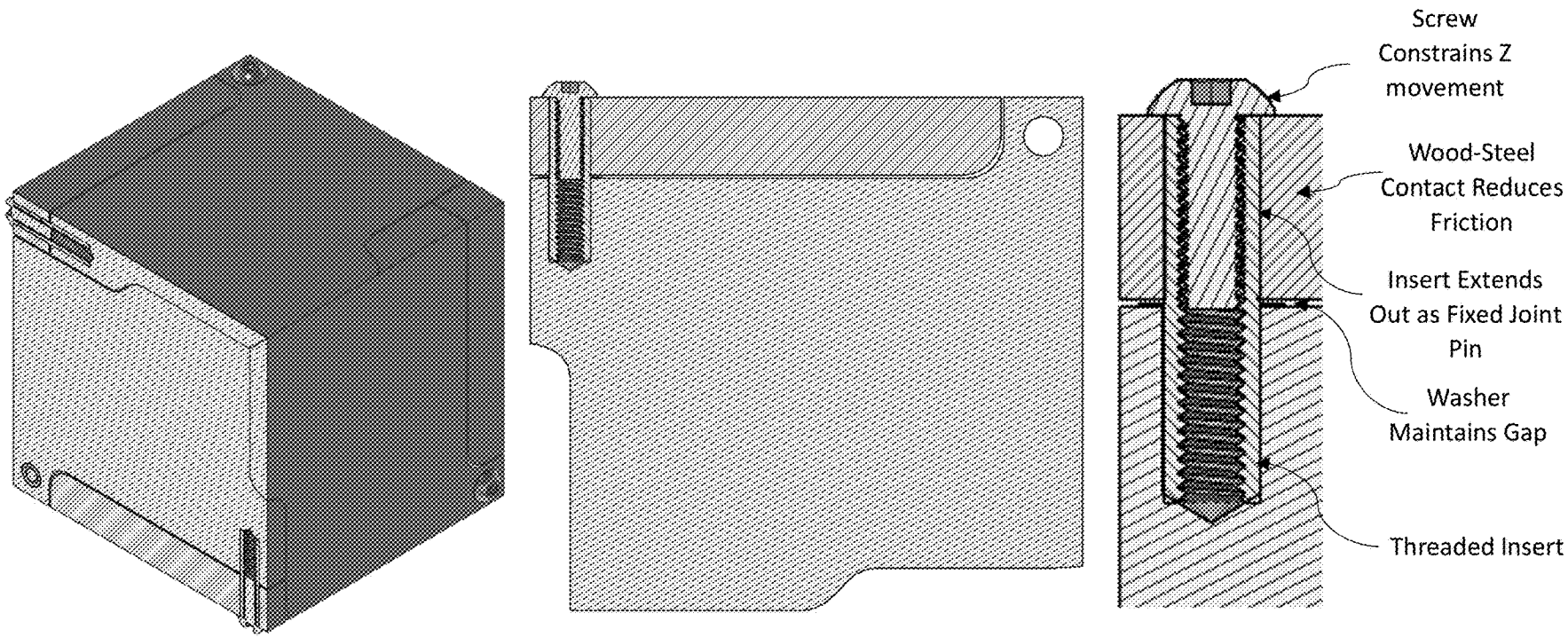
FIG. 17 illustrates a third iteration joint design using screw for retention and insert as bearing surface according to embodiments of the present disclosure.

In various embodiments, as shown in FIG. 17, a threaded insert may be installed in the panels' side hole as a fixed pin around which the adjacent panel's face hole could rotate, relying on the screw only for retention onto the pin. In various embodiments, this may reduce the assembly's sensitivity to as-manufactured panel thickness which previously had to be matched to the screws' shoulder height and also reduced the functional impact of loose screws.

In various embodiments, ball bearings may be used to further reduce the joint friction and slop.

In various embodiments, the weakest portions of the panel assemblies may be the tab holding their face holes. In various embodiments, hardware packaging favors a large face hole, but risks reducing tab support material unless the box panels are thickened. In various embodiments, in the case of wood boxes, orientation of the wood grain along the tab (parallel to the panel's Y-Axis) improves the joint strength significantly. In various embodiments, grain orientation may be oriented in a particular manner during manufacture to produce stronger parts. In various embodiments, this orientation may be applied to both triangular and rectangular panels.

In various embodiments, the box does not necessarily have to be a cube, and the faces of the links do not necessarily have to be the same as the faces of the box. For example, it is possible to make links more complex polygons which create a corner, edge, or combination of corners/edges/faces of the box. The panels may also be non-planar, creating curved or contoured shapes. They may also not be continuous to allow viewing of its contents.

In various embodiments, a Mobius kaleidocycle enclosure may be applied to larger numbers of links by modifying the coordinate transformation within each link (the relative orientation of hole axes within a link). In various embodiments, this could allow boxes resembling more complex polyhedrons to be produced.

In various embodiments, multiple Mobius kaleidocycles may be combined via shared links to create more complex mechanisms capable of more dramatic transformations.

In various embodiments, the exact coordinate transformation may not be identical from link to link. In various embodiments, the angular change and spacing of holes could vary from link to link as long as continuity is achieved in the main mechanism loop (or loops).

In various embodiments, the kinematics of these Mobius kaleidocycle enclosures may be independent of part scale, so larger or smaller boxes should be possible. For example, larger boxes for watches or multiple rings could be made.

In various embodiments, creases (living hinges and/or local application of flexible material) rather than discrete joints could be used to reproduce the Mobius kaleidocycle enclosure. In various embodiments, the associated links may resemble more traditional flexahedron link form factors in this case.

In various embodiments, panels may not have to be made from a single (i.e., monolithic) piece of material, but rather a combination of materials to better meet local functional requirements. For example, the closed loop of links could be created using metal to better retain fasteners and make a more robust mechanism, while the remainder of the panels could be a non-structural material which is tailored for aesthetics. Some portions may also be clear for windows. Additional features like magnets for mounting on separate assemblies could also be included in these non-monolithic designs.

In various embodiments, rather than manufacturing and subsequently joining discrete panels, it is possible to make a partially or completely monolithic box with the same opening/closing motion. In various embodiments, living hinges may be used between panels to make a smooth, low-backlash design.

Figure 18A:
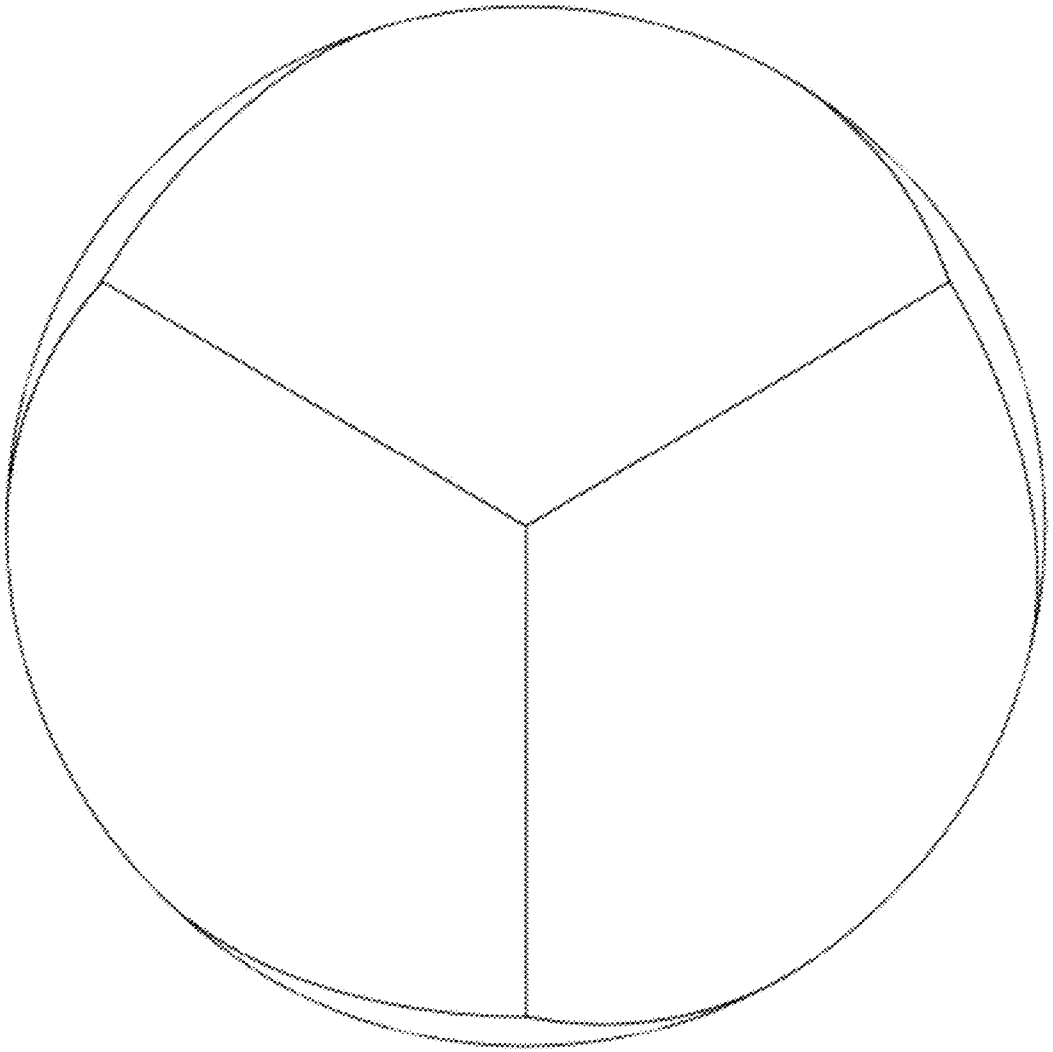
FIG. 18A illustrates a kinetic enclosure (e.g., sphere) in the closed state according to embodiments of the present disclosure.
Figure 18B:
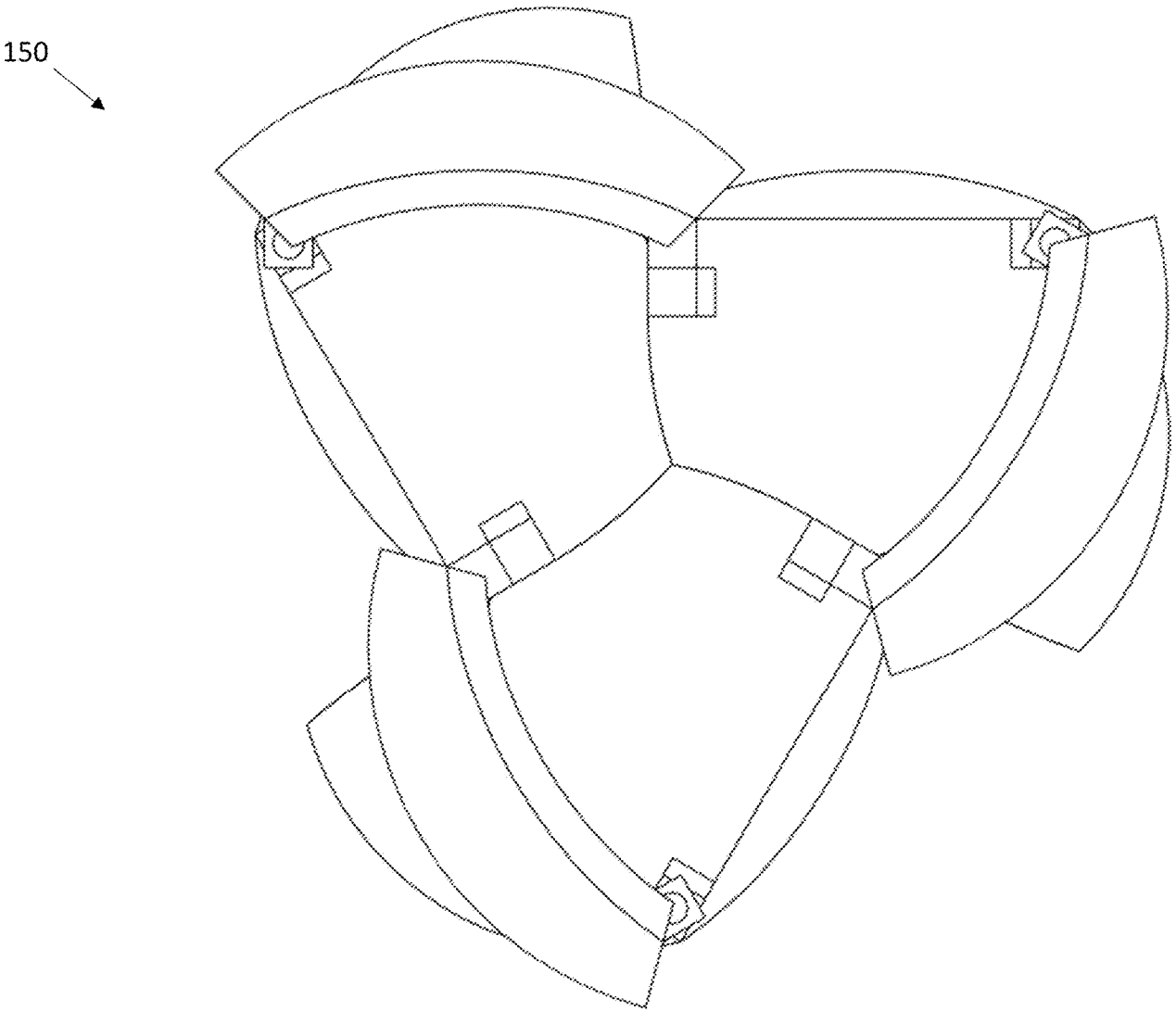
FIG. 18B illustrates a kinetic sphere in the open state according to embodiments of the present disclosure.
Figure 18C:
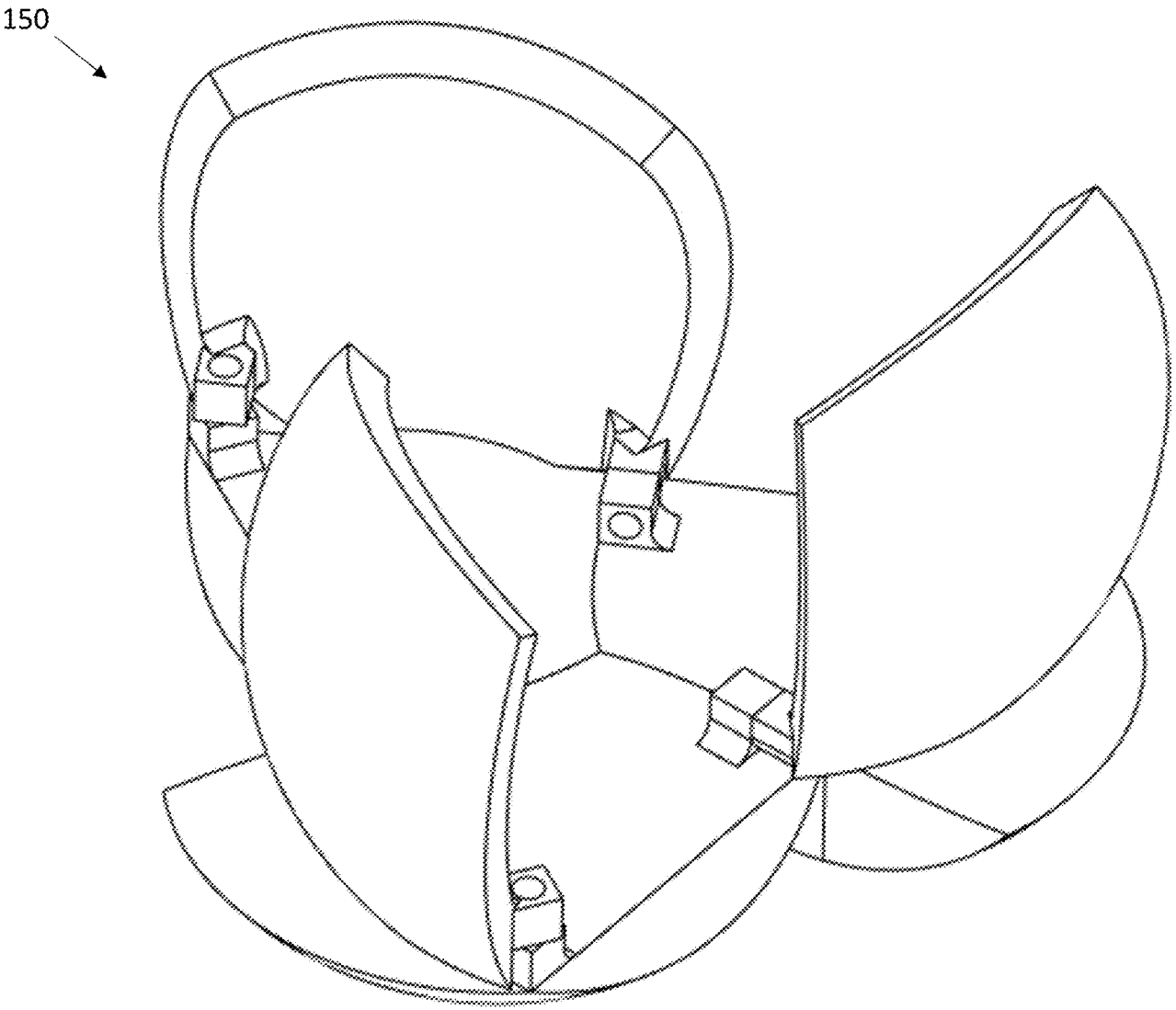
FIG. 18C illustrates a kinetic sphere in the open state according to embodiments of the present disclosure.

FIG. 18A illustrates a kinetic sphere 150 in the closed state. The kinetic sphere 150 may be substantially similar to the kinetic box 100 described above in that the kinetic sphere includes six panels that make up the spherical enclosure. FIG. 18B illustrates a kinetic sphere 150 in the open state. FIG. 18C illustrates a kinetic sphere 150 in the open state.

When in the closed configuration, the panels 151, 152, 153, 154, 155, 156 together form a substantially spherical shape. When in the open configuration, the inner surfaces of panels 154, 155, 156 form a substantially flat surface and the panels 151, 152, 153 are approximately perpendicular to (e.g., extending upwards from) the flat surface of panels 154, 155, 156.

Figure 19:
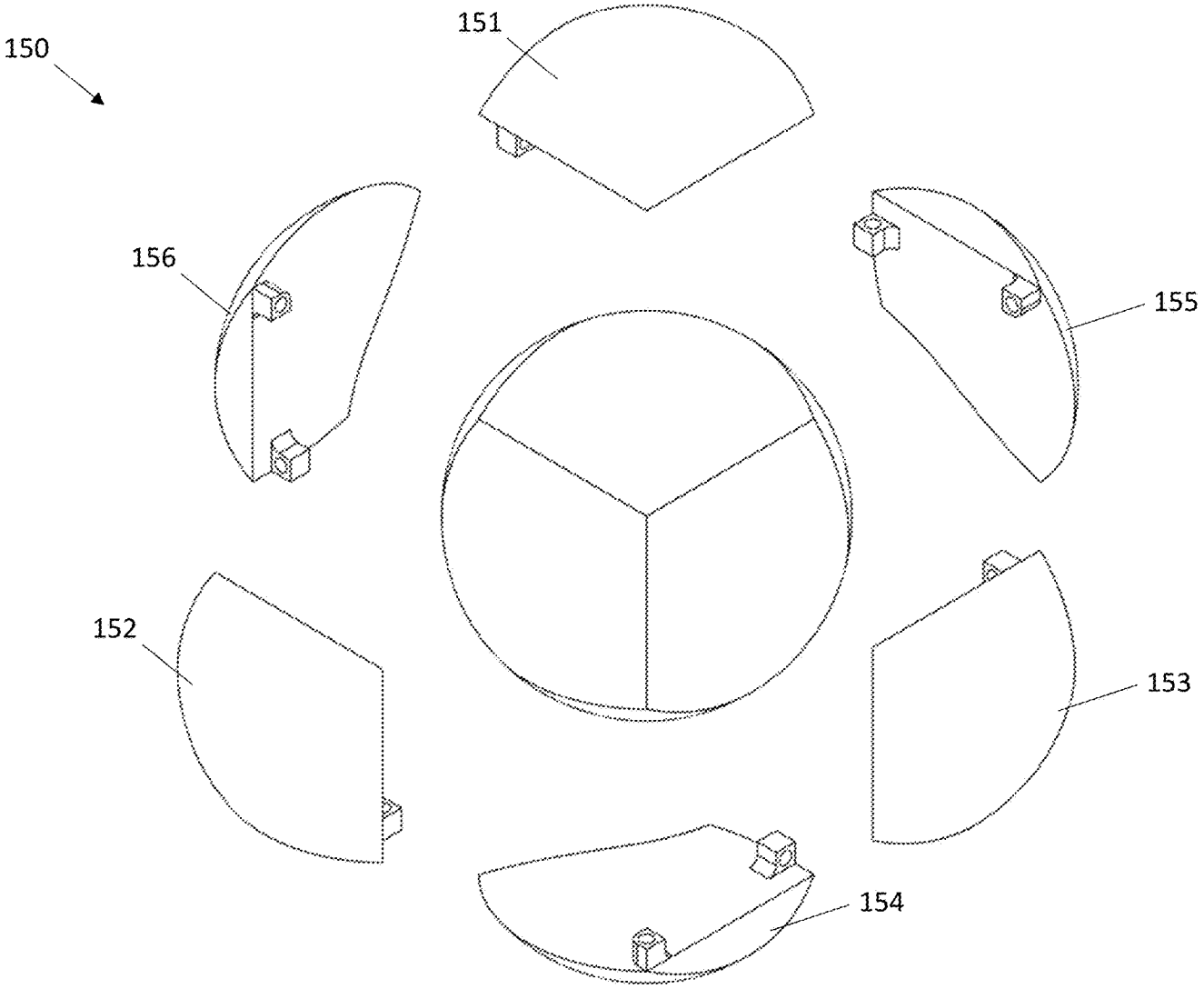
FIG. 19 illustrates an exploded view of a sphere with an assembled sphere in the center, according to embodiments of the present disclosure.

FIG. 19 illustrates an exploded view of a sphere 150 with an assembled sphere 150 in the center. The kinetic sphere 150 includes panels 151, 152, 153 that make up the front of the kinetic sphere 150 and panels 154, 155, 156 that make up the back of the kinetic sphere 150.

Figure 20A:
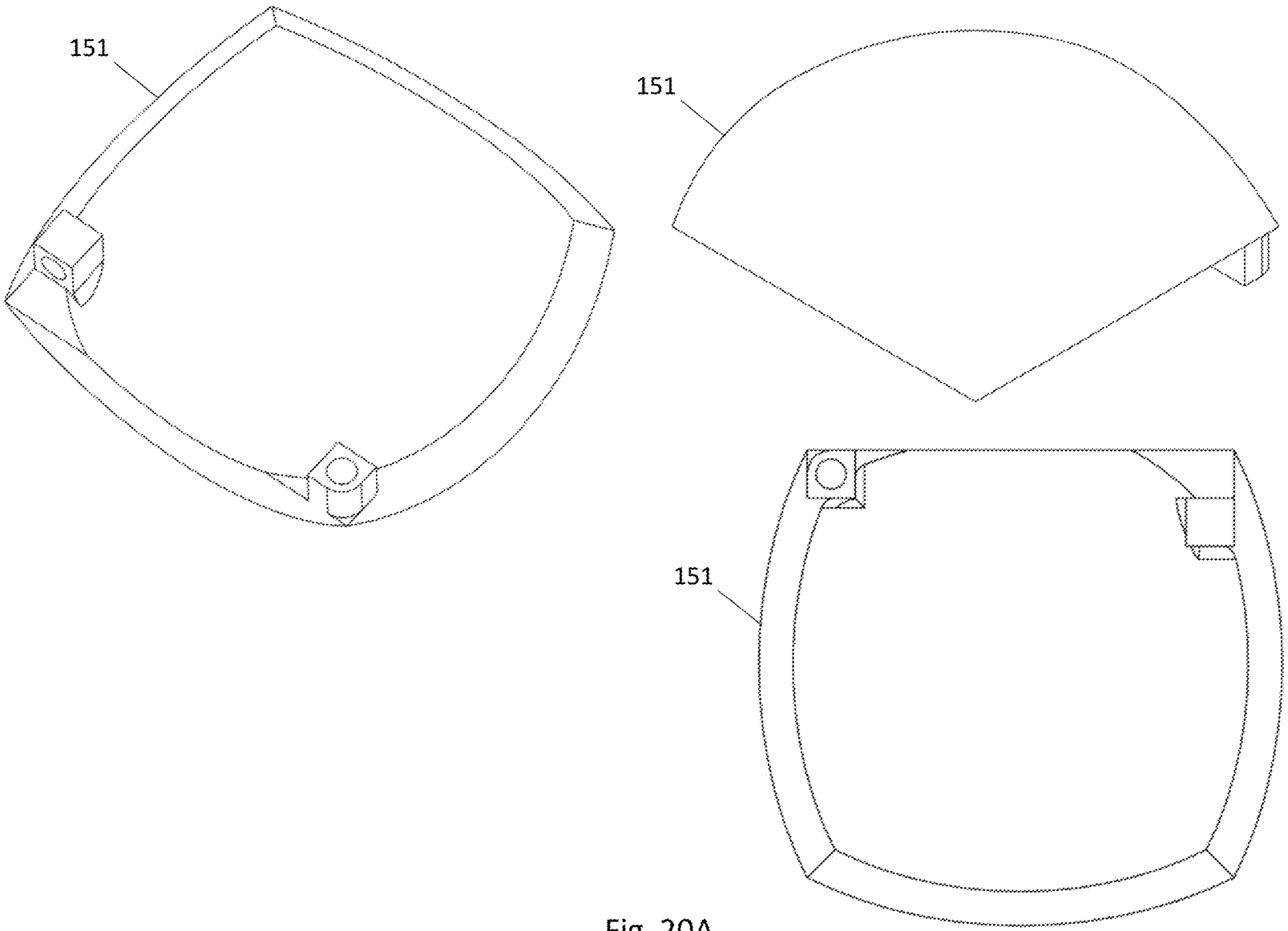
FIG. 20A illustrates one panel of a kinetic sphere according to embodiments of the present disclosure.
Figure 20B:
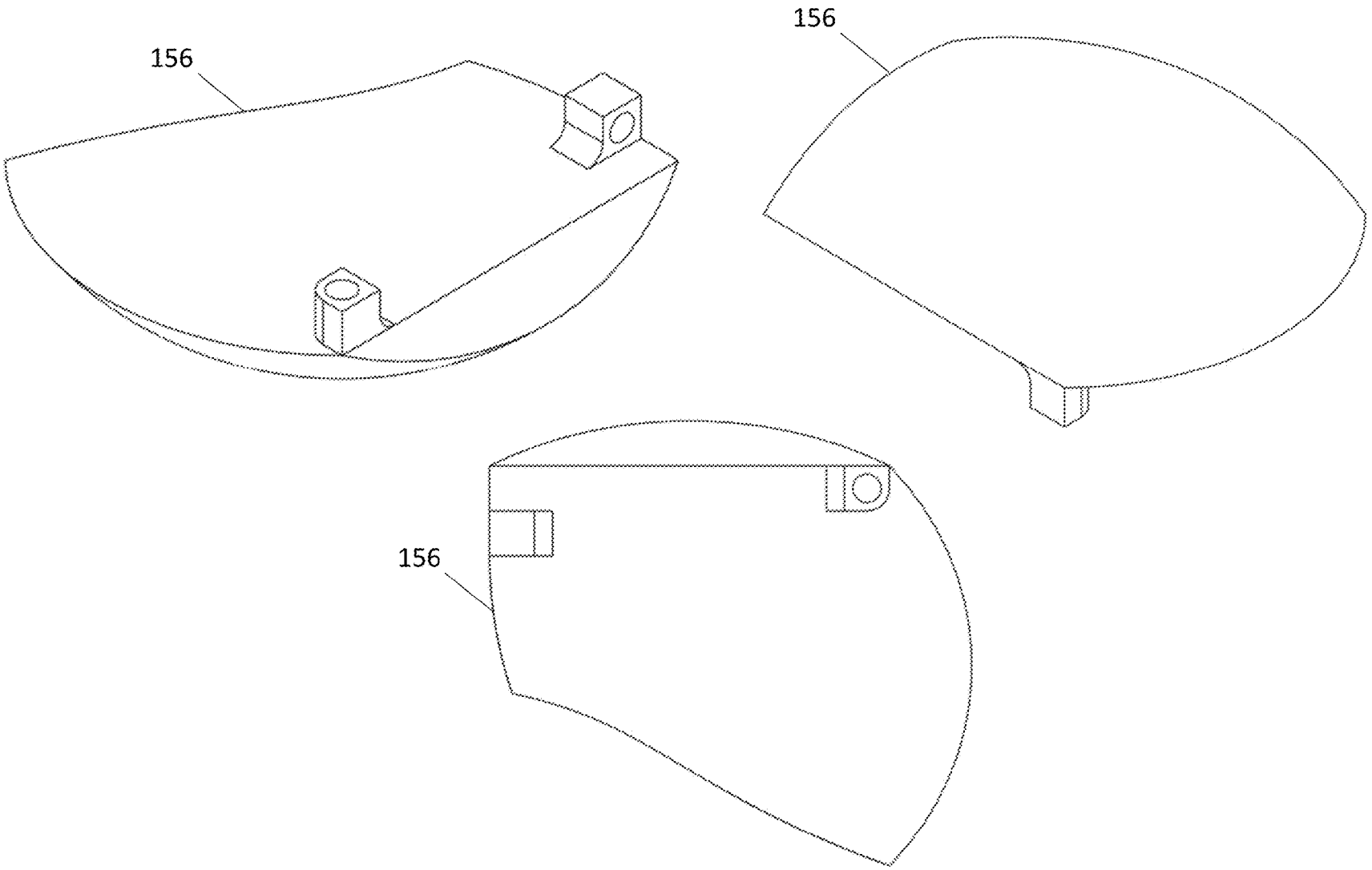
FIG. 20B illustrates another panel of a kinetic sphere according to embodiments of the present disclosure.

FIG. 20A illustrates one panel of a kinetic sphere 150 and FIG. 20B illustrates another panel of a kinetic sphere.

Figure 21A:
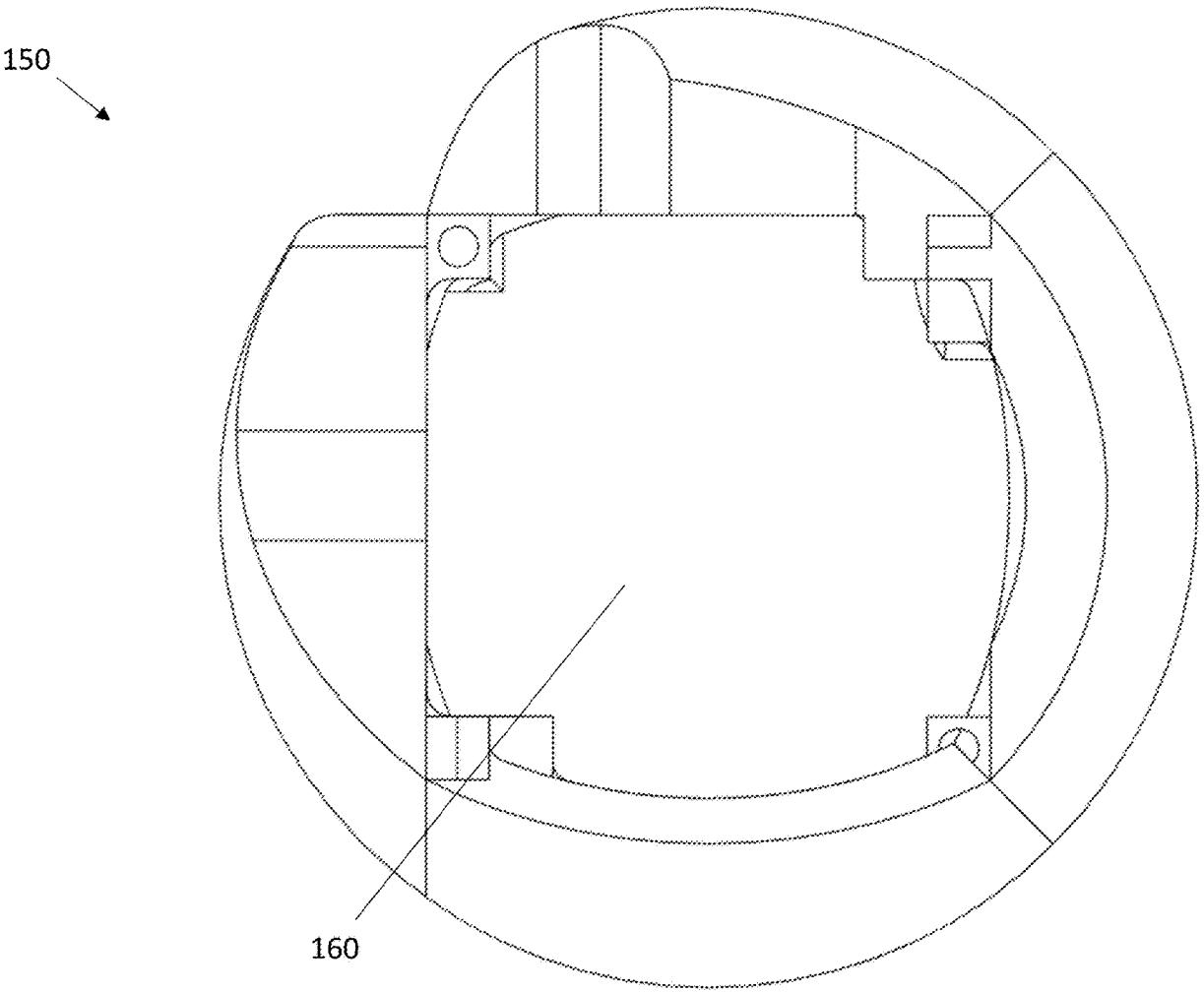
FIG. 21A illustrates a rear of the kinetic sphere according to embodiments of the present disclosure.
Figure 21B:
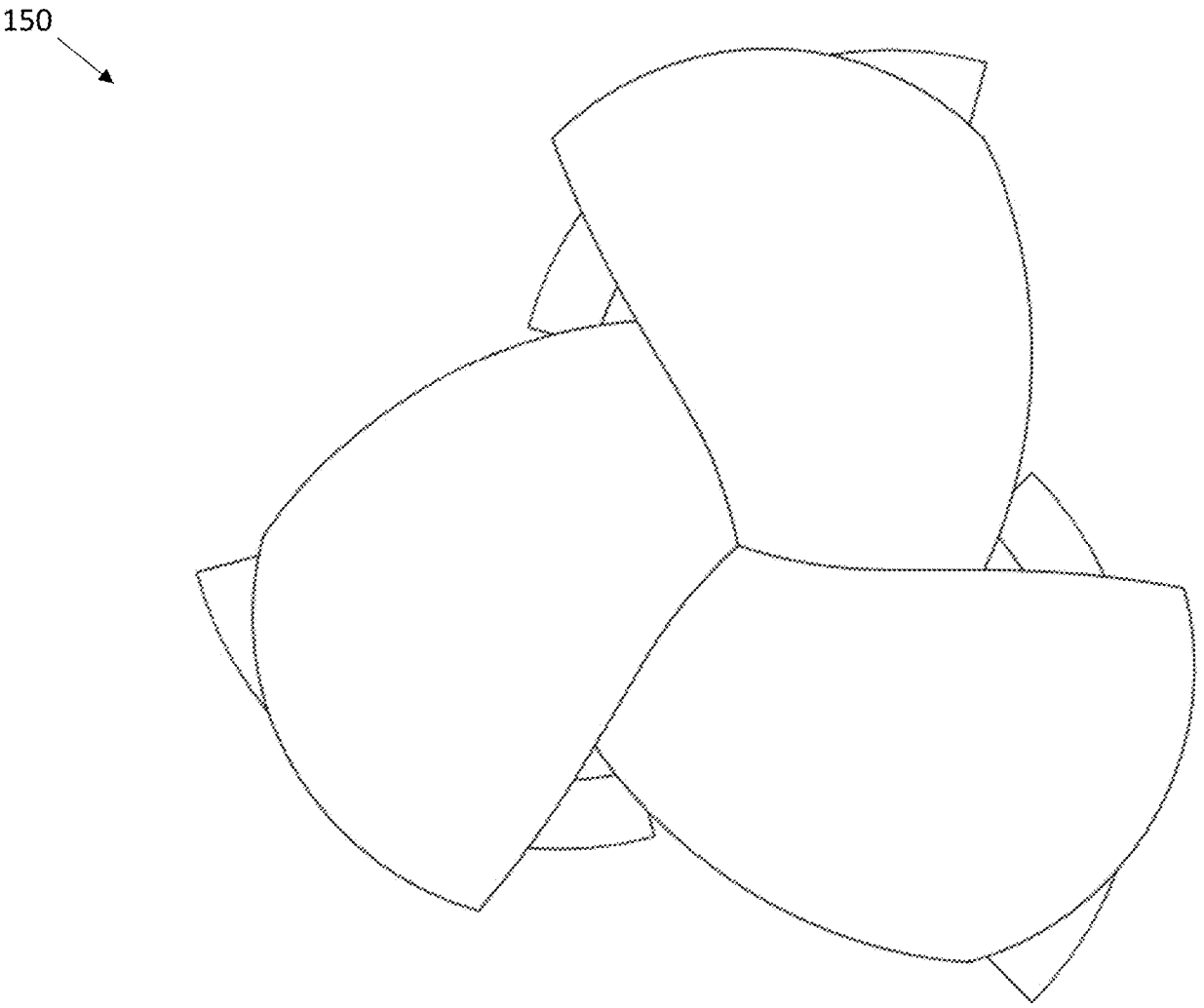
FIG. 21B illustrates a bottom view of the kinetic sphere in an open configuration according to embodiments of the present disclosure.
Figure 22A:
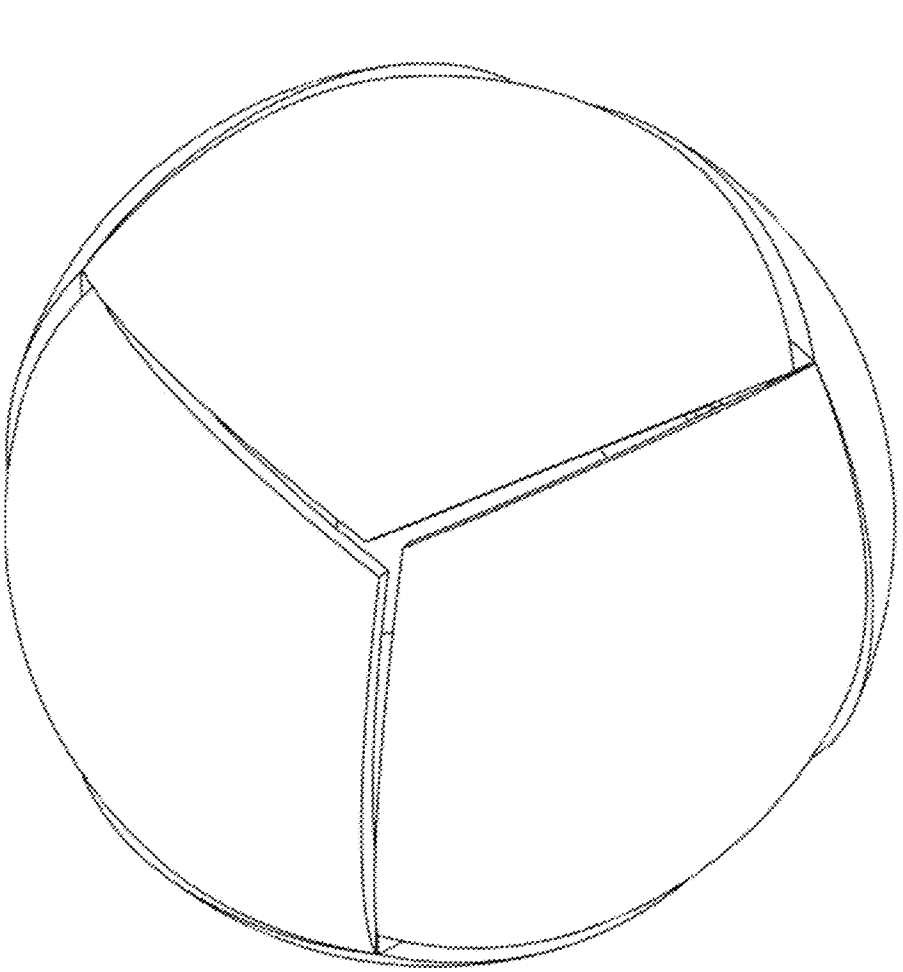
FIGS. 22A-22E illustrates steps in a kinetic sphere articulation sequence according to embodiments of the present disclosure.
Figure 22B:
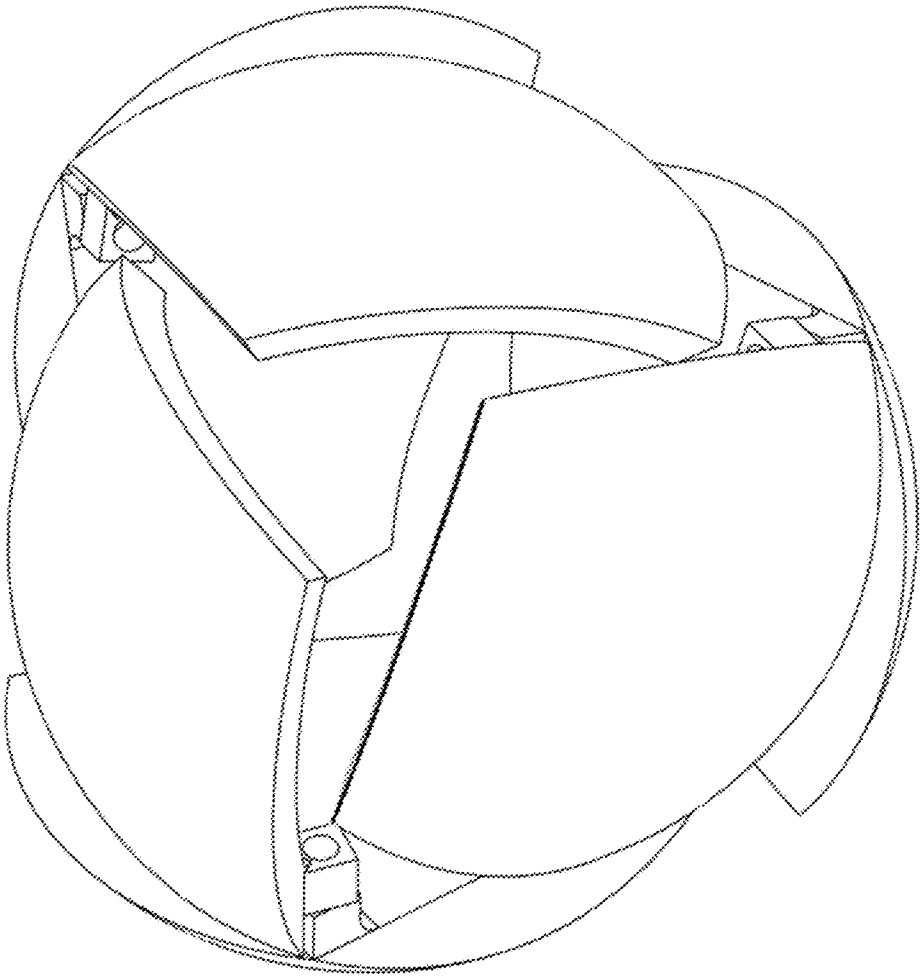
Figure 22C:
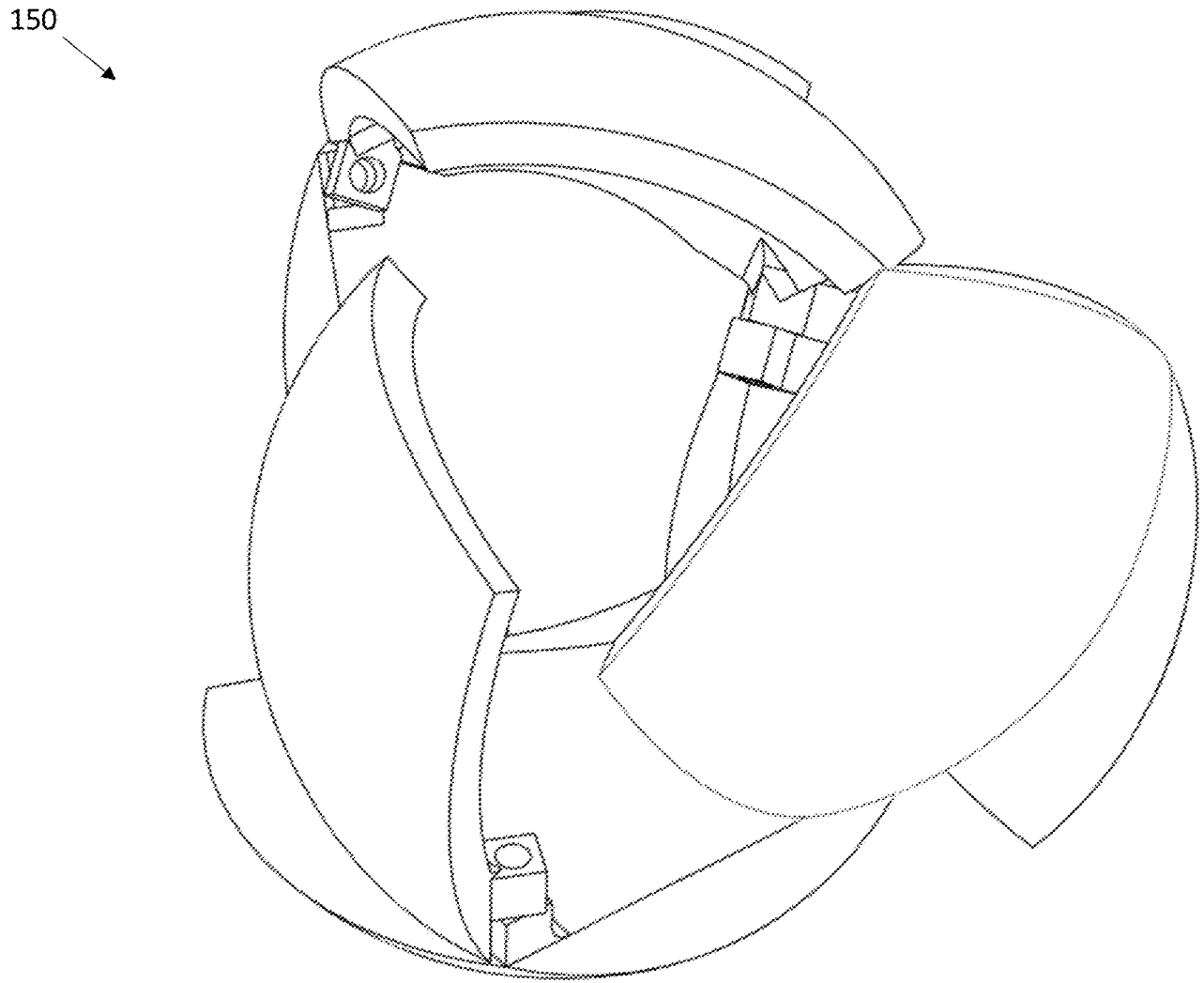
Figure 22D:
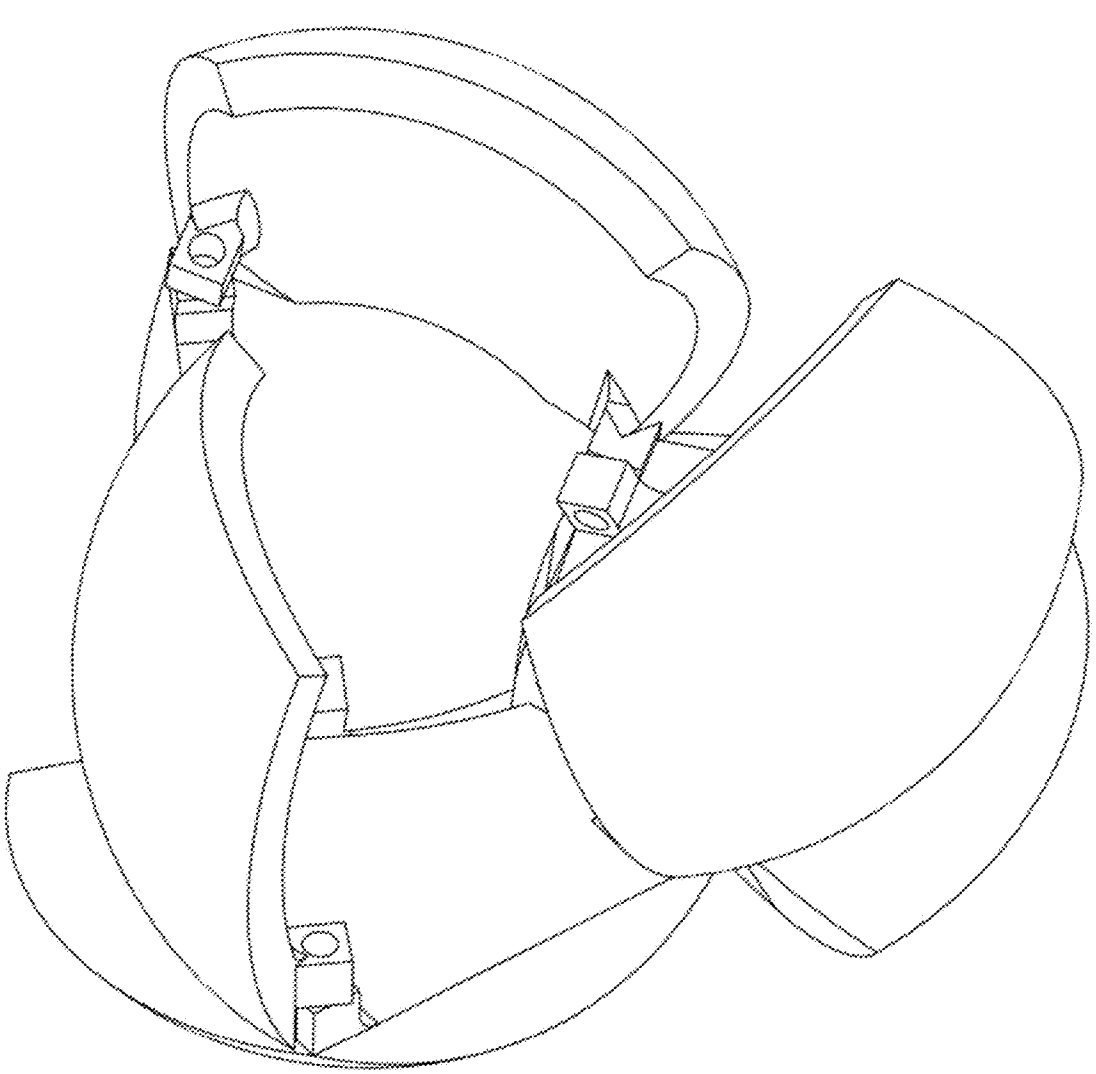
Figure 22E:
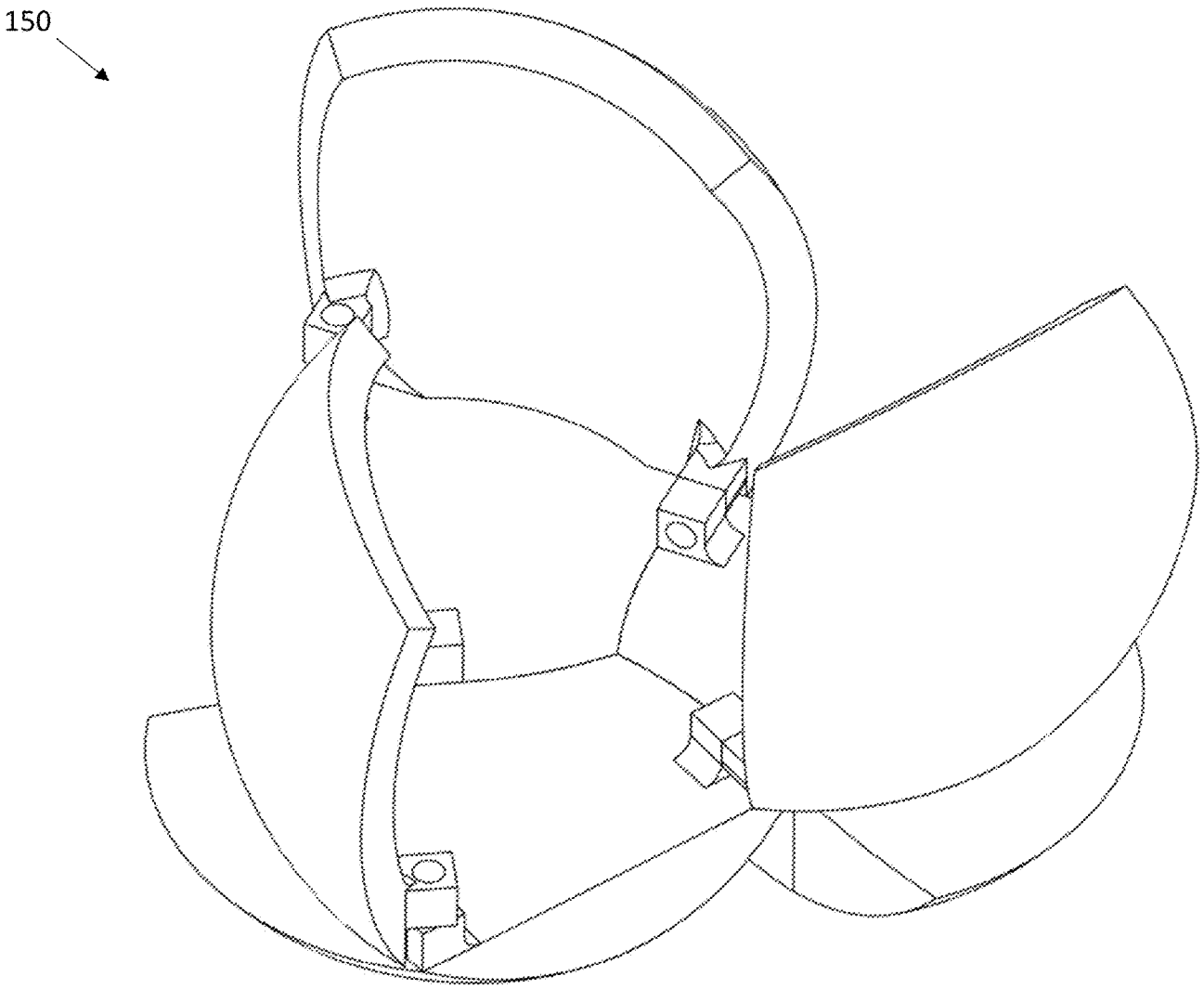

FIG. 21A illustrates a rear of the kinetic sphere. FIG. 21B illustrates a bottom view of the kinetic sphere 150 in an open configuration. In various embodiments, the kinetic sphere 150 may include a rear opening 160.

FIGS. 22A-22E illustrates steps in a kinetic sphere 150 articulation sequence.

Desk Lamp

Figure 23A:
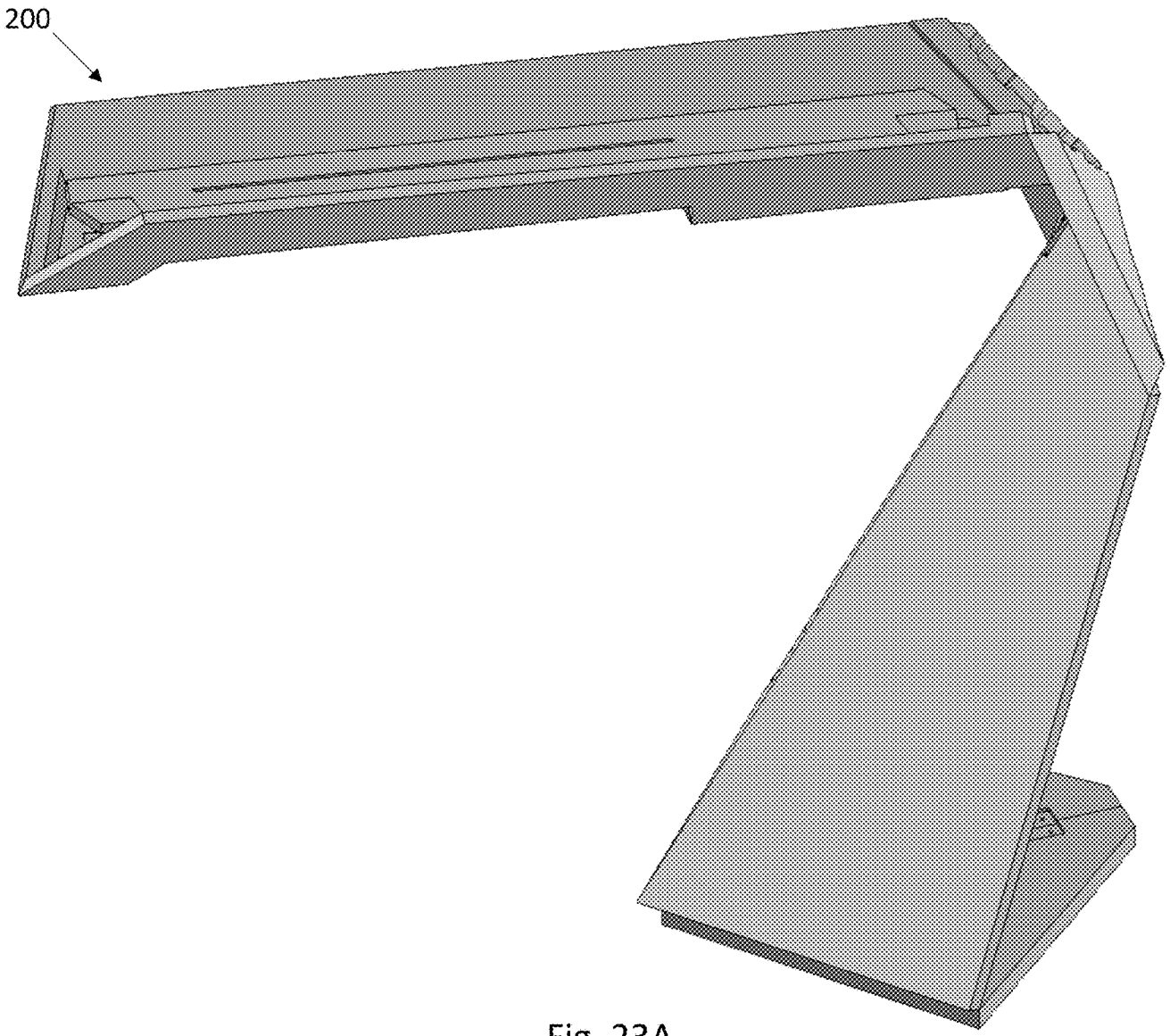
FIG. 23A illustrates an origami-inspired lamp in an unfolded state according to embodiments of the present disclosure.
Figure 23B:
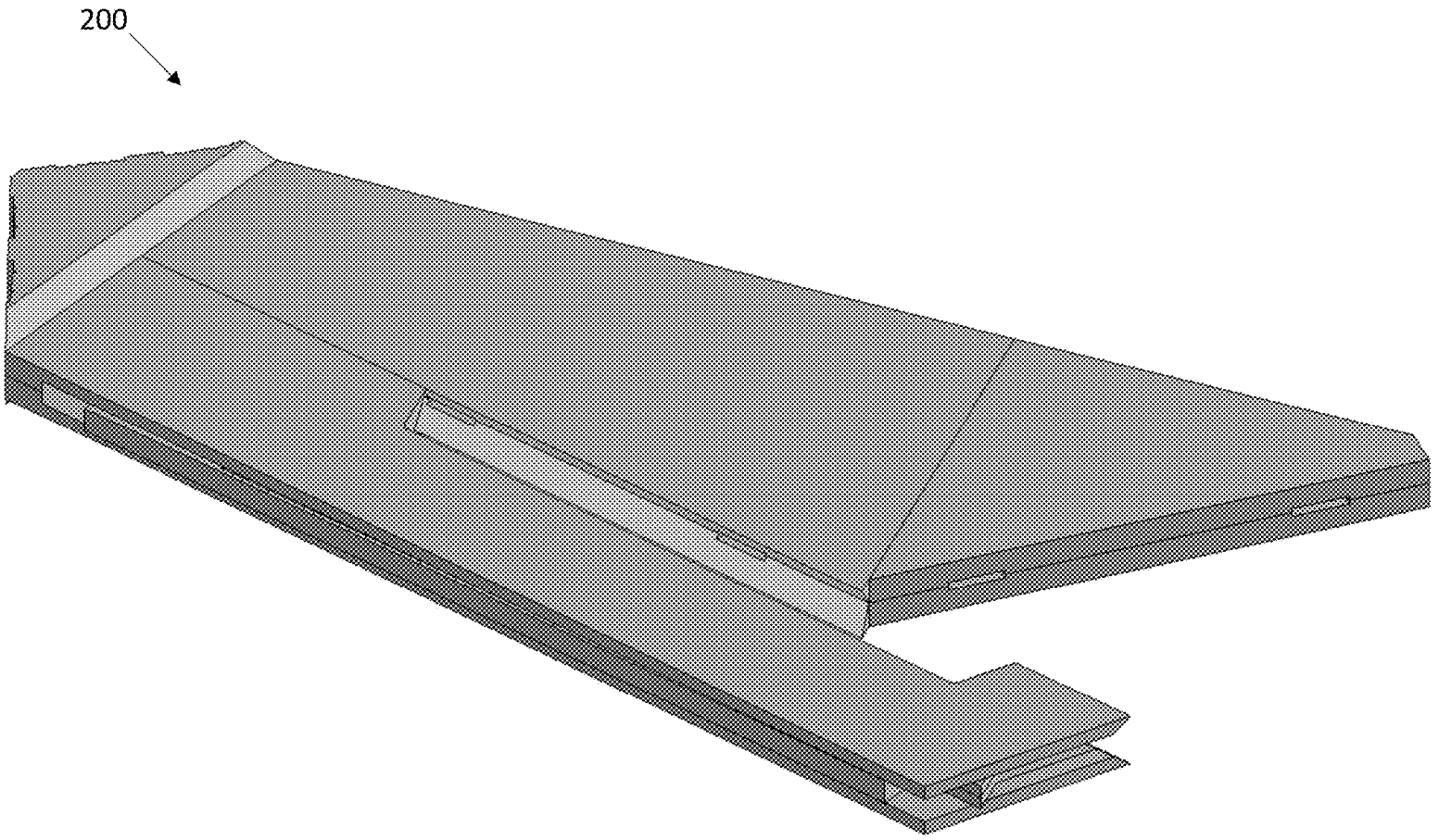
FIG. 23B illustrates an origami-inspired lamp in a folded state according to embodiments of the present disclosure
Figure 24A:
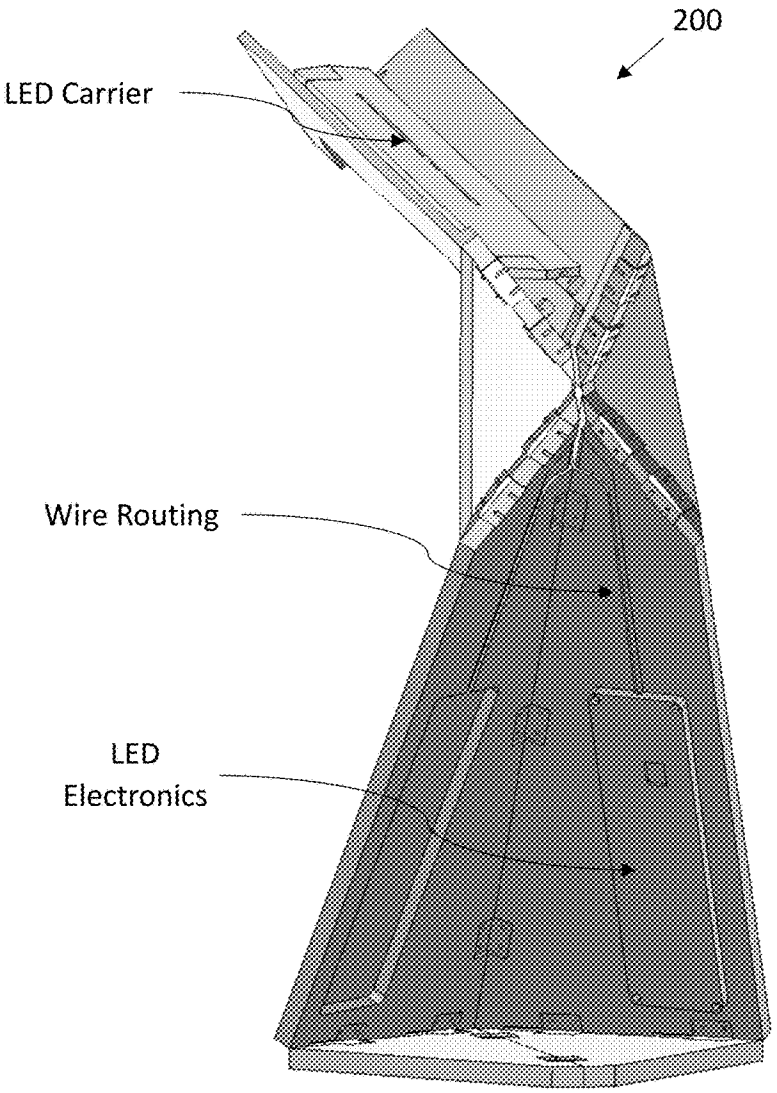
FIGS. 24A-24B illustrate origami-inspired lamp electronics packaging according to embodiments of the present disclosure.
Figure 24B:
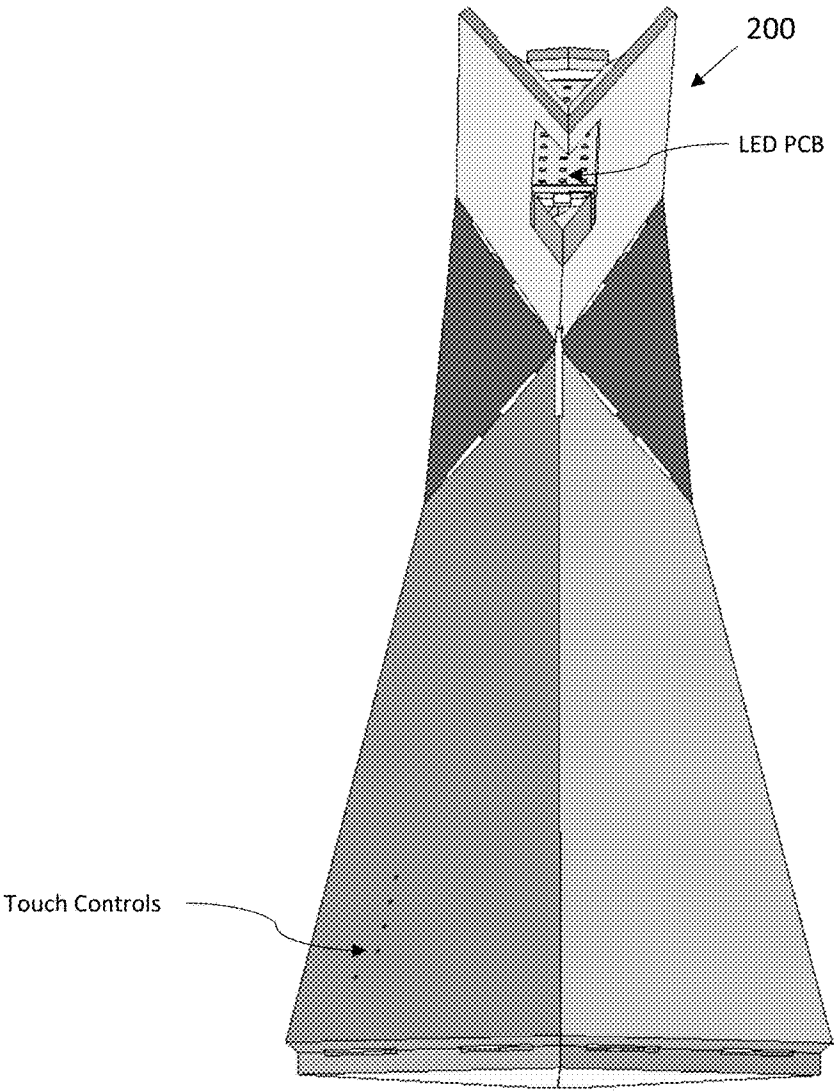
Figure 25:
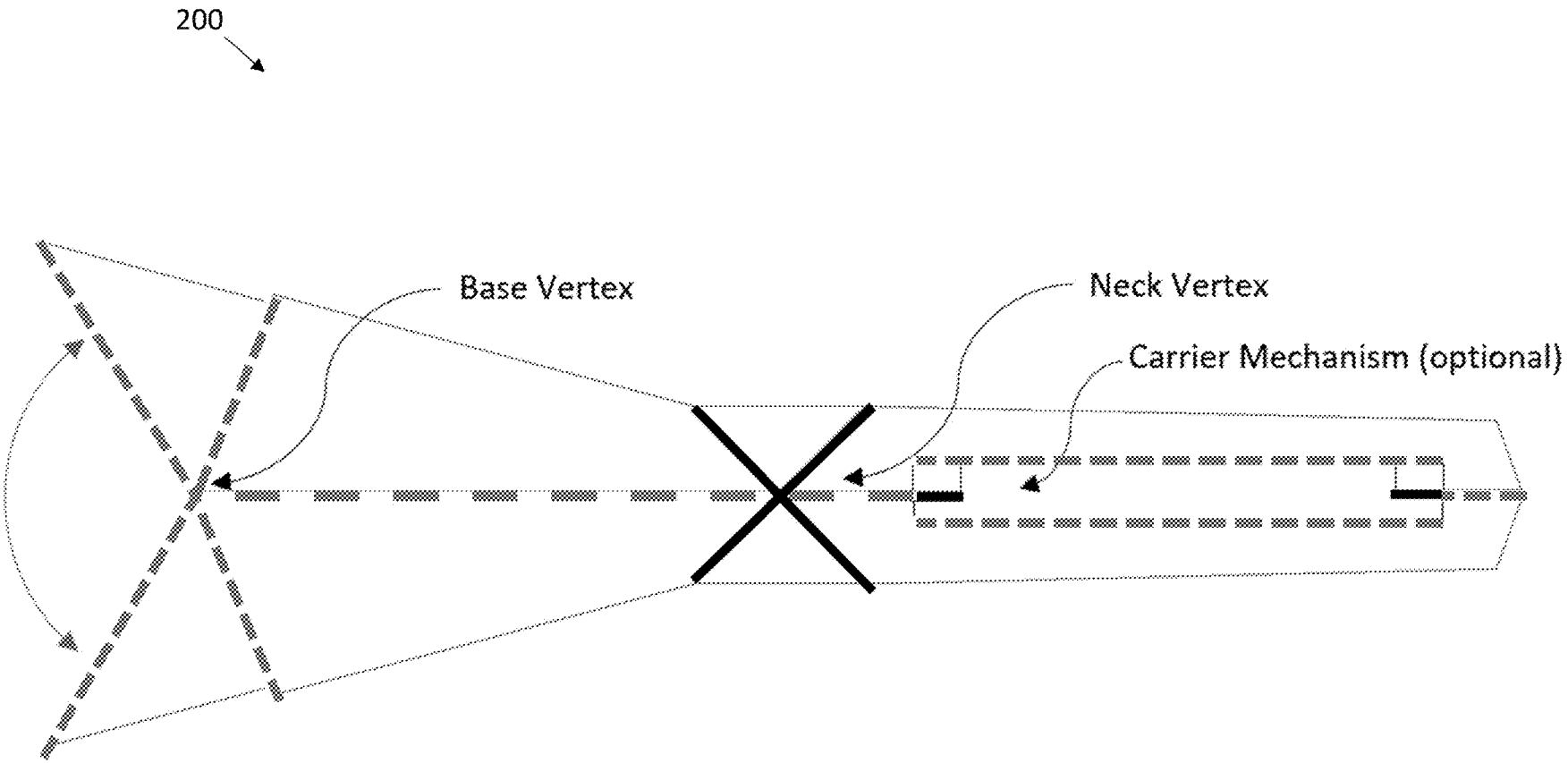
FIG. 25 illustrates flattened origami-inspired lamp fold pattern and vertex nomenclature according to embodiments of the present disclosure.
Figure 26:
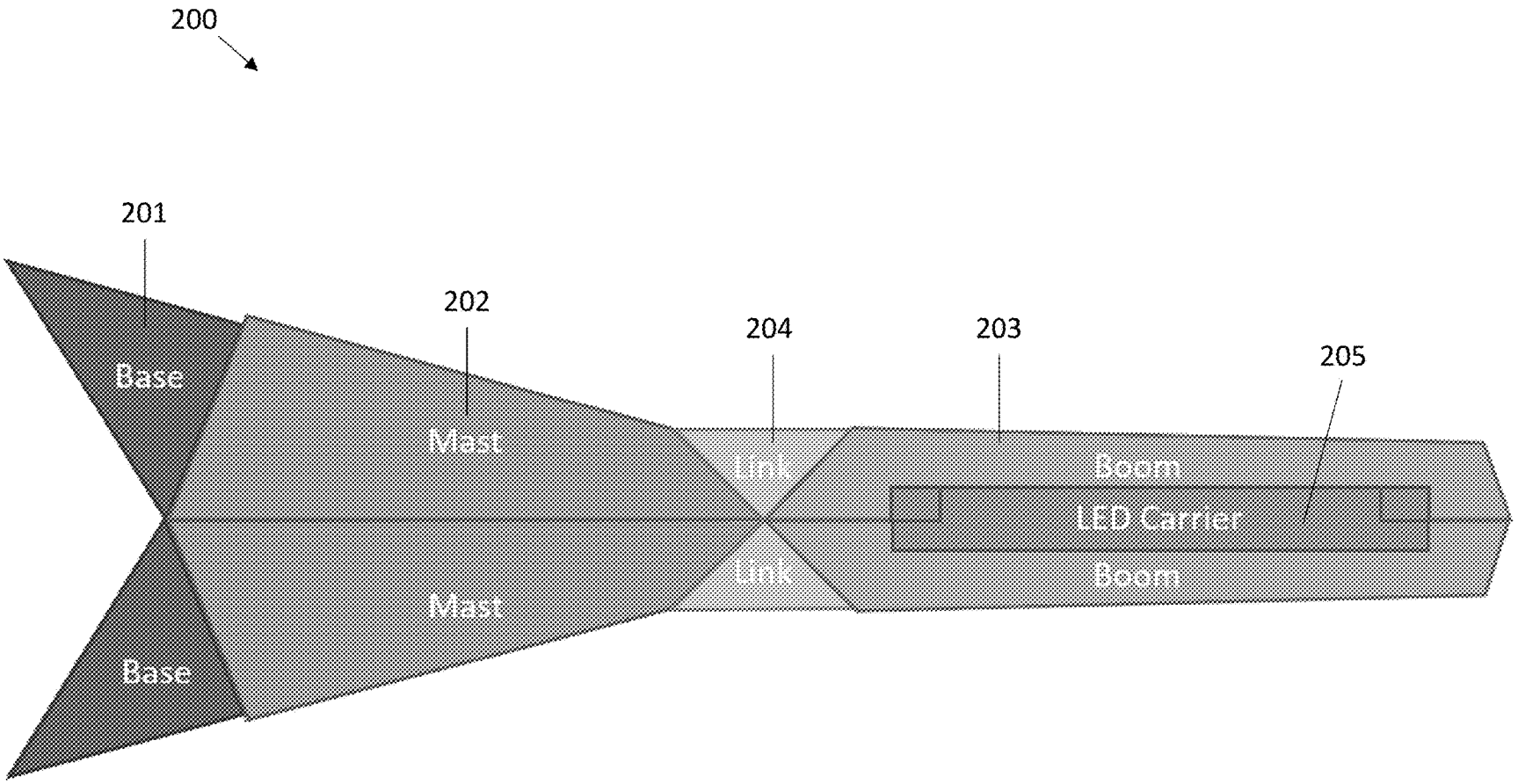
FIG. 26 illustrates flattened origami-inspired lamp panel nomenclature according to embodiments of the present disclosure.
Figure 27:
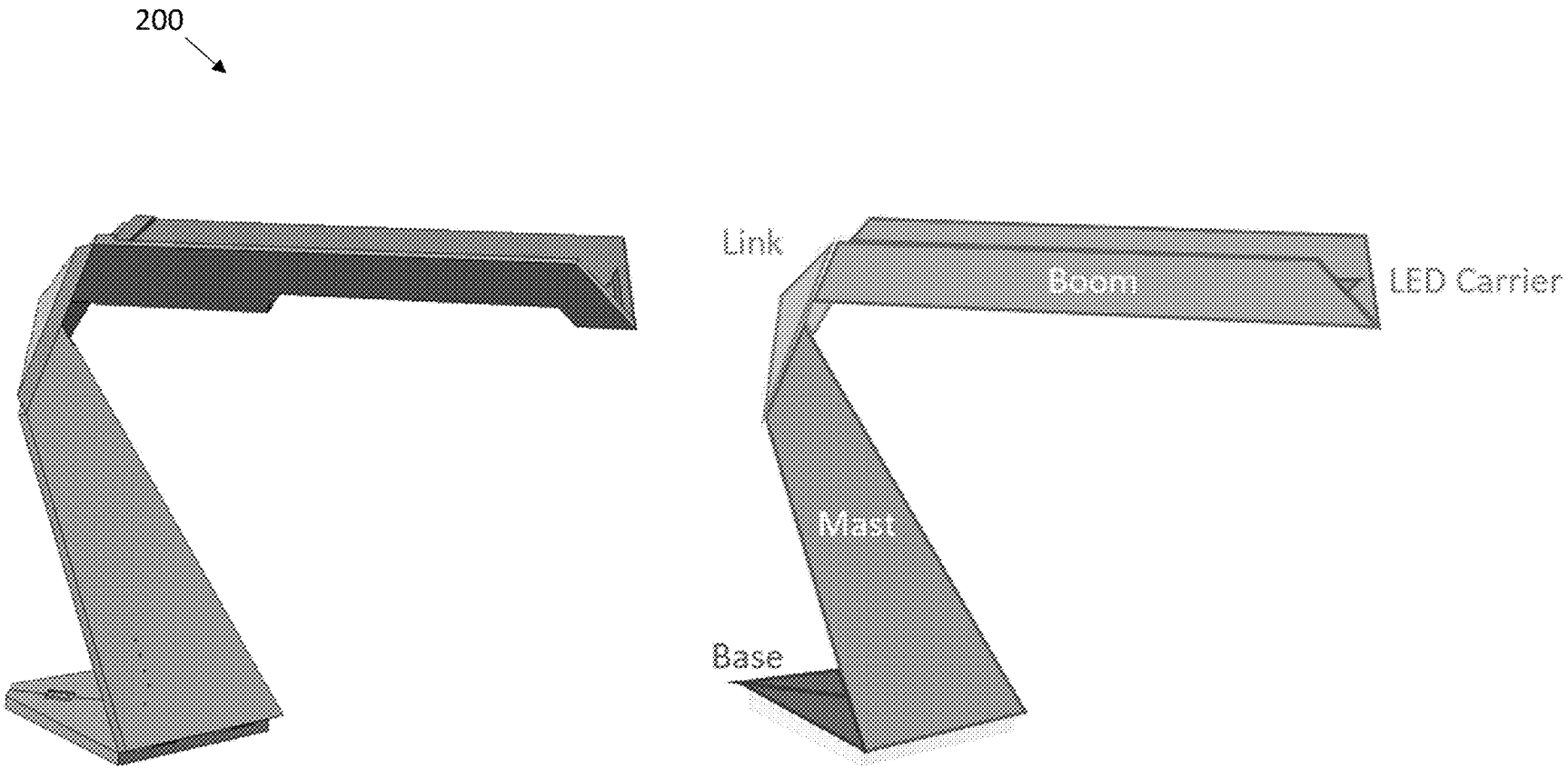
FIG. 27 illustrates deployed origami-inspired lamp geometry and panel reference according to embodiments of the present disclosure.

As shown in FIGS. 23A-23B, an origami-inspired lamp 200 may include a light-emitting diode (LED) desk lamp capable of folding between a deployed (i.e., unfolded) state (FIG. 23A) to a flat (i.e., folded) state (FIG. 23B) using joints between a collection of rigid panels. In various embodiments, illumination may be achieved with low-profile electronics (e.g., LEDs) which may be installed within and/or between the rigid panels, allowing the folded thickness of the lamp 200 to be a fraction of its overall height. FIGS. 24A-24B illustrate origami-inspired lamp electronics packaging In various embodiments, the design of the lamp 200 may be based on the simple origami fold pattern shown in FIG. 25, with dashed gray lines indicating "valley" folds into the page, thick black lines indicating "mountain" folds out of the page, and thin gray lines indicating cuts. In various embodiments, the leftmost and rightmost valley folds are shared, creating a conical joint which keeps the lamp open when deployed. The base panels may also be eliminated entirely while maintaining a stable, deployed lamp through bevel selection in the mast. In various embodiments, two major origami vertexes and one kirigami folding feature in this fold pattern may be included: the Base Vertex on the left, the Neck Vertex in the middle, and the Carrier Mechanism on the right. In various embodiments, the Neck Vertex is essential to the basic function of the lamp, whereas the Base Vertex and Carrier Mechanisms depend on design choices or neck mechanism design. As shown in FIGS. 26-27, the linkages of the lamp may come in the form of panels with finite thickness which can be collected into five major groups: base, mast, link, boom, and LED carrier. In various embodiments, the folding and articulation behaviors are governed by the angles around each vertex, and the overall size of the assembly is controlled via the crease lengths.

In various embodiments, the lamp 200 includes a base 201, a mast 202, and a boom 203 connected to the mast 202 via a link 204. The lamp 200 optionally includes a carrier mechanism 205 on the boom 203 onto which an LED chip may be secured. In various embodiments, the lamp 200 may include two valley folds between the base 201 and the mast 202. In various embodiments, the mast 202 includes a central valley fold down its entire length. In various embodiments, the link 204 includes two mountain folds crossing over one another. In various embodiments, the boom 203 includes a central valley fold. In various embodiments, the carrier mechanism 205 may be created using two valley folds on either side of the central valley fold of the boom 203 and two mountain folds at each end of the carrier mechanism 205.

Figure 28:
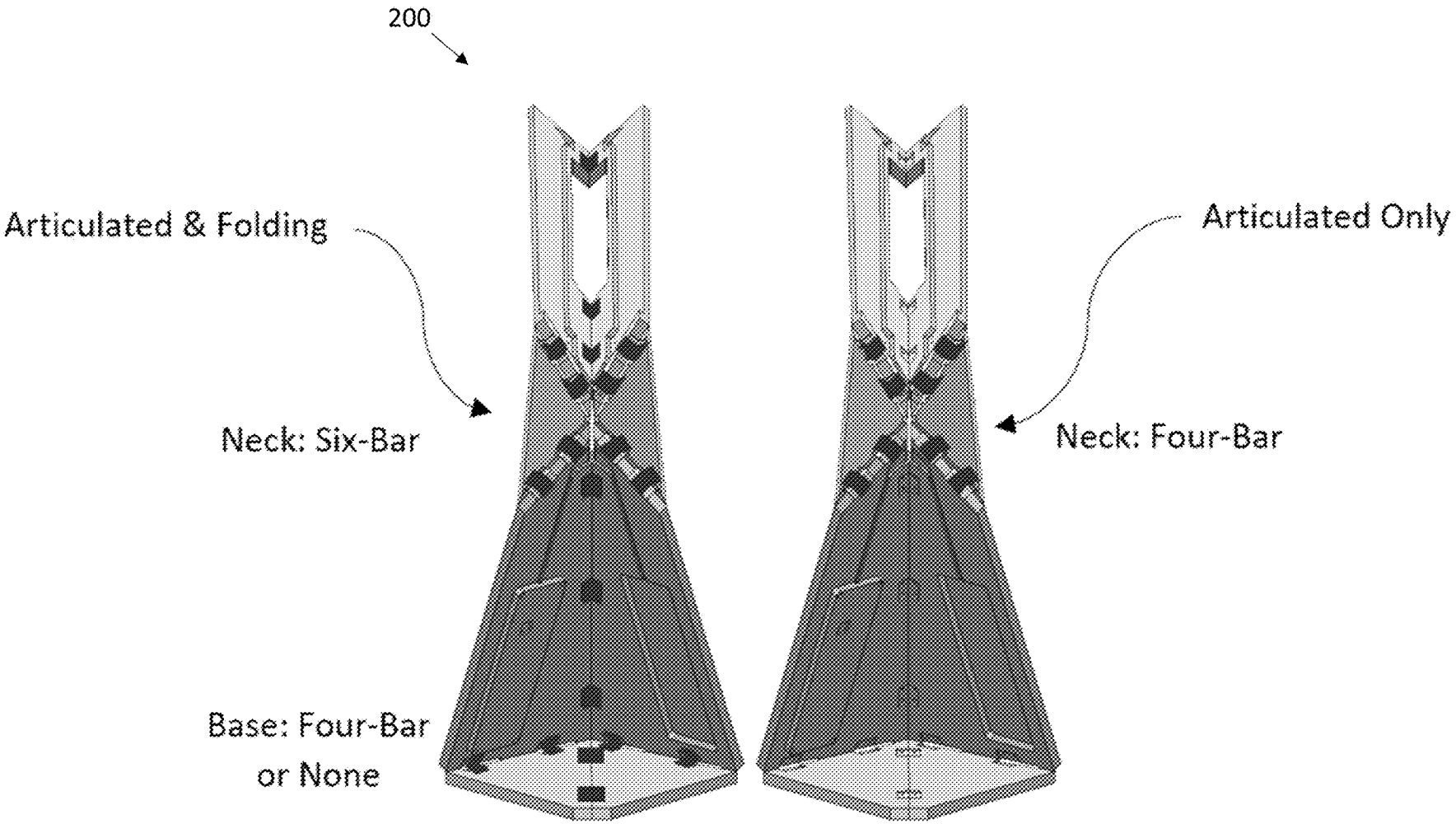
FIG. 28 illustrates exemplary origami-inspired lamp hinge locations according to embodiments of the present disclosure.

In various embodiments, the physical implementation of the folding design is a mechanism where linkages and joints reproduce the folding behavior of this fold pattern as shown in FIG. 28. In various embodiments, in the articulated and folding arrangement, the base vertex (if used) includes a four-bar linkage and the next vertex is a six-bar linkage. In the articulated-only arrangement, the neck vertex includes a four-bar mechanism. In various embodiments, the exact arrangements of joints in the base and neck mechanisms depends on the desired mode of articulation, if any.

Figure 29A:
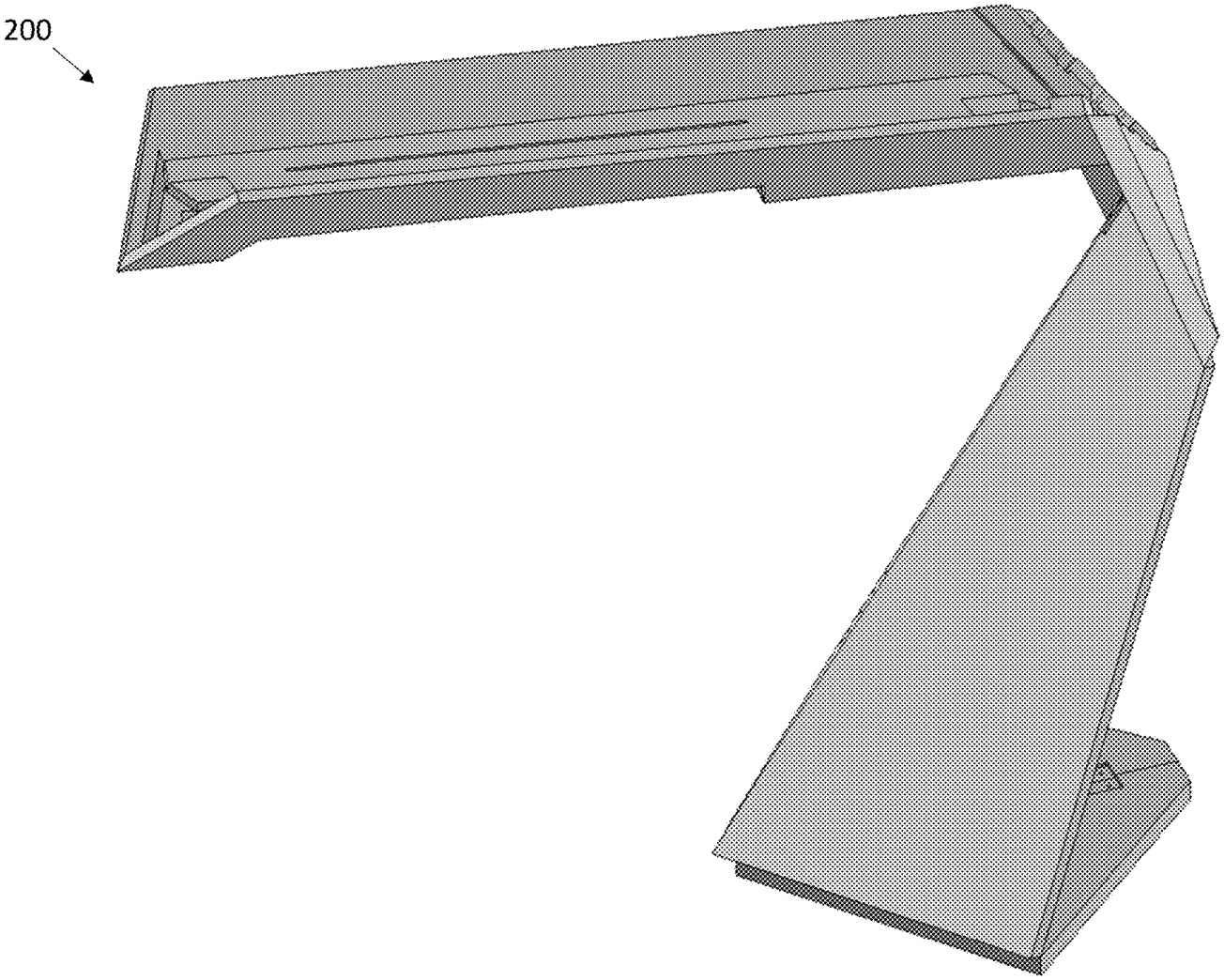
FIGS. 29A-29E illustrate steps for folding an origami-inspired lamp according to embodiments of the present disclosure.
Figure 29B:
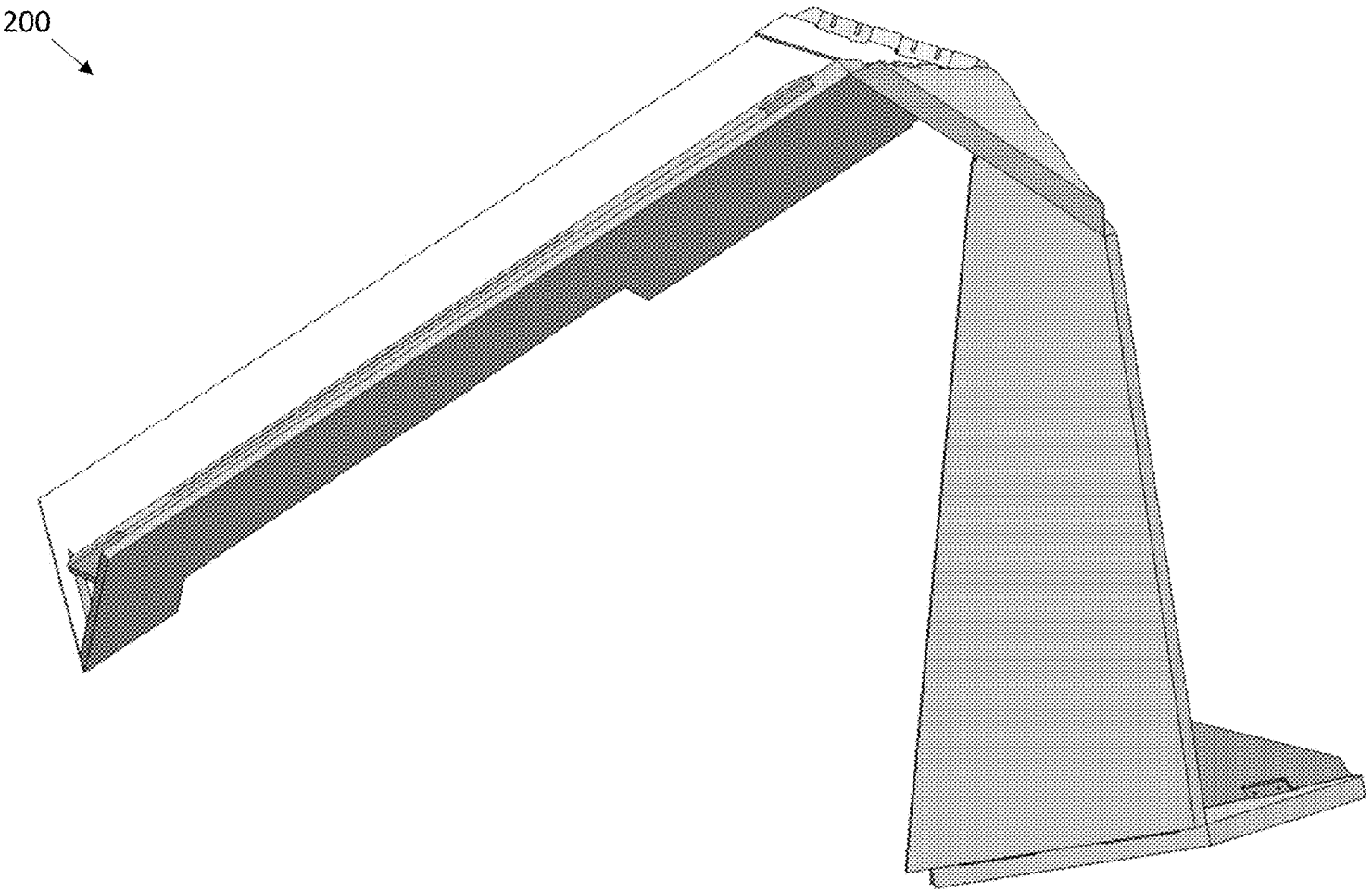
Figure 29C:
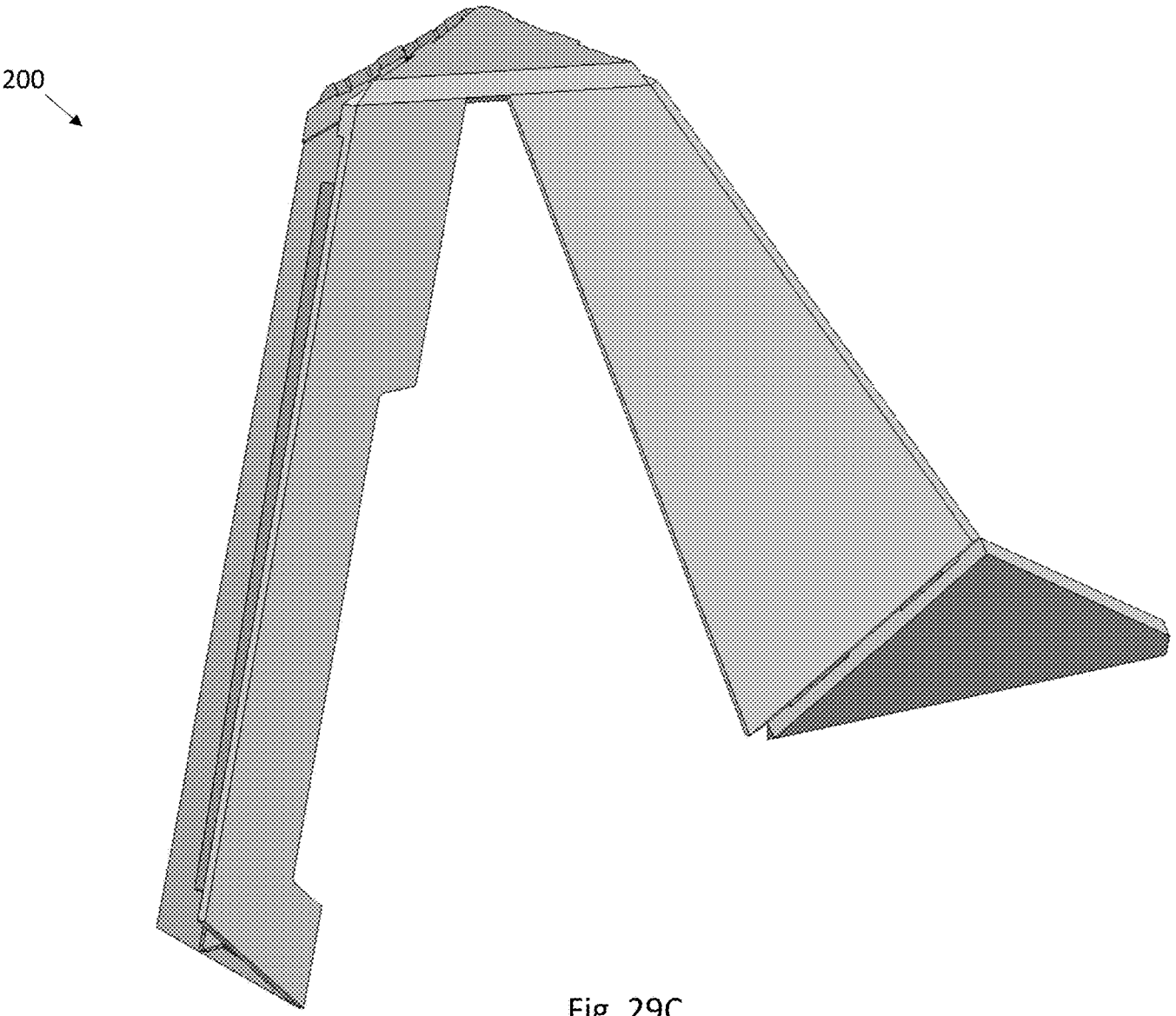
Figure 29D:
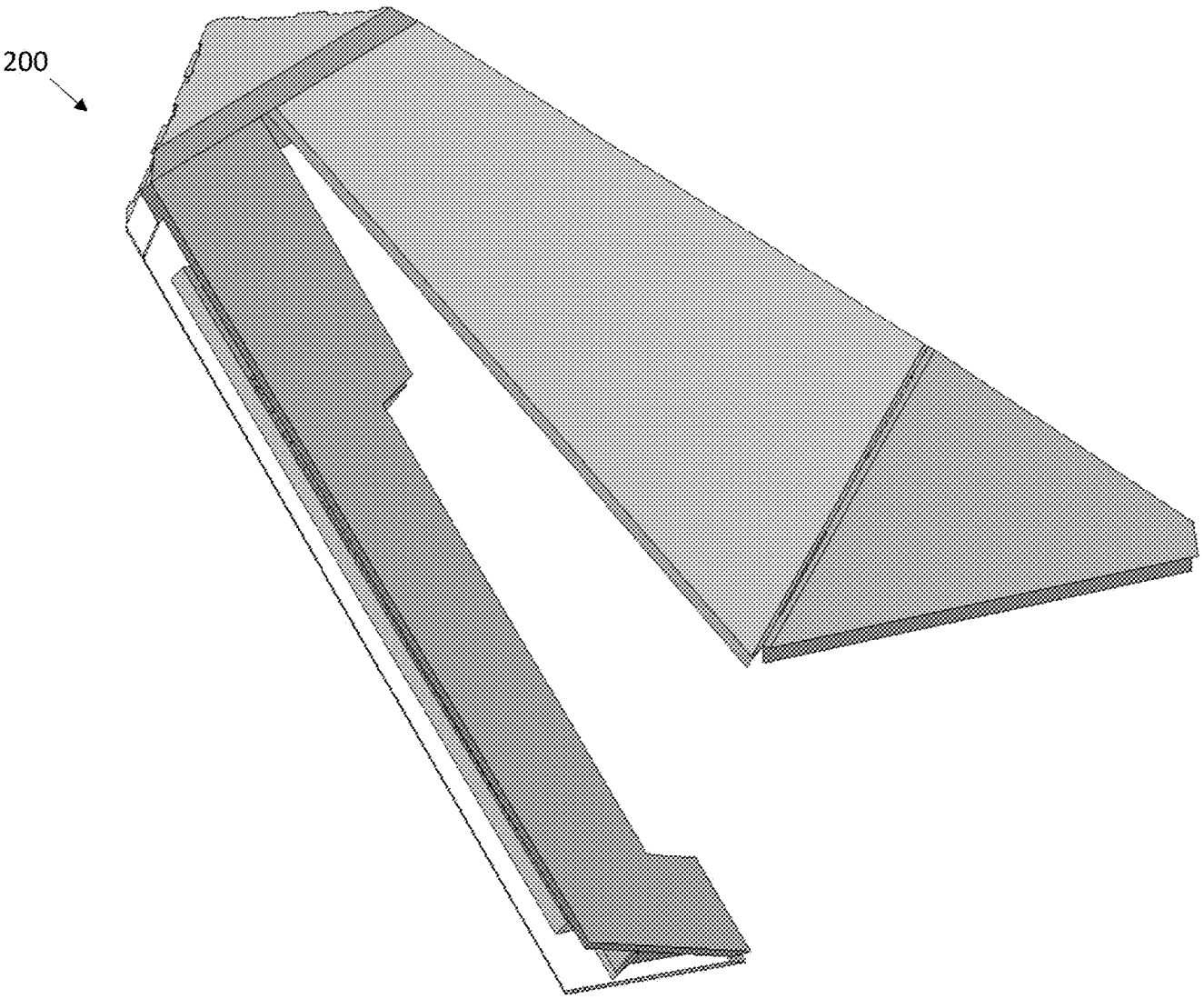
Figure 29E:
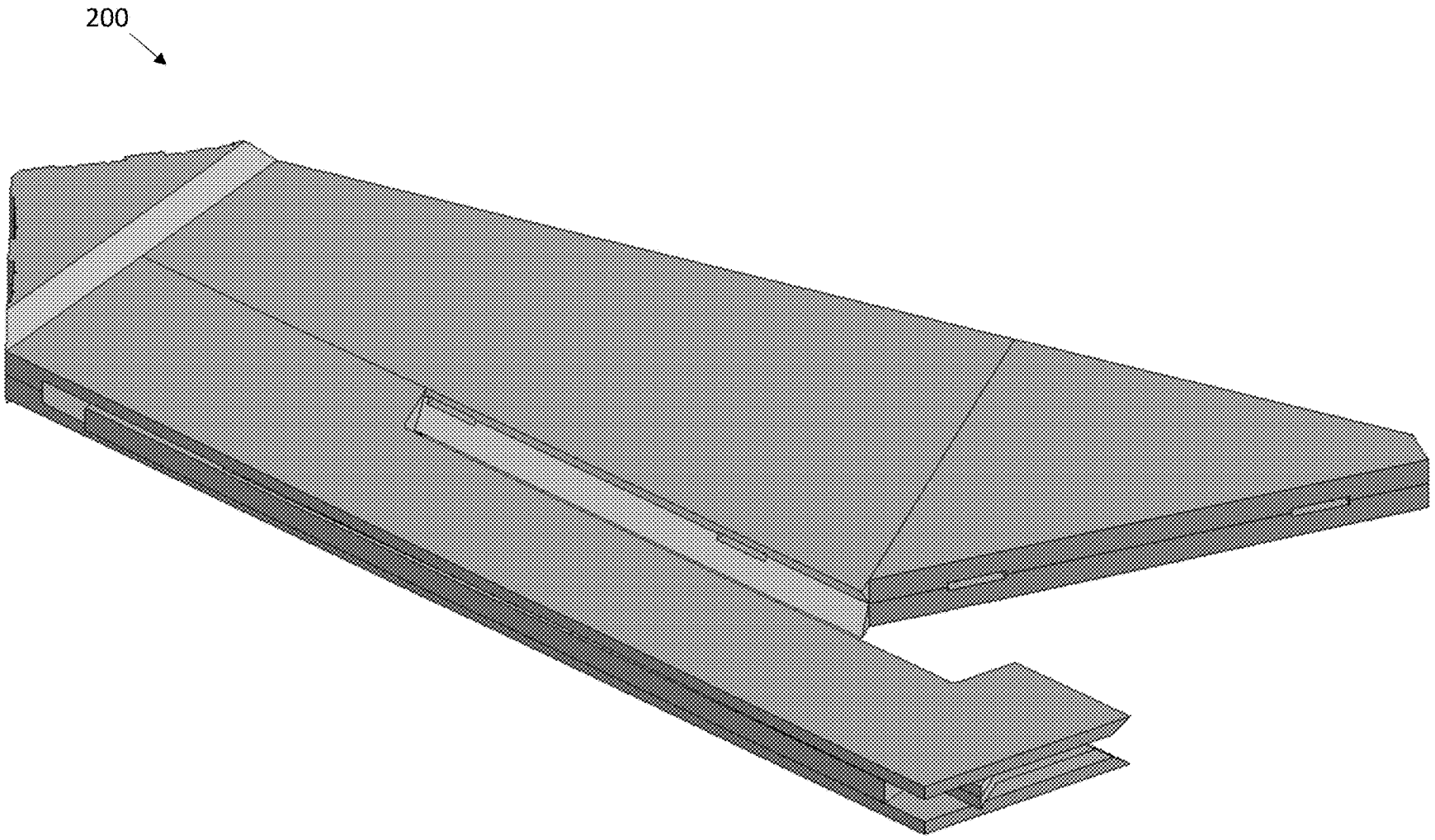
Figure 30:
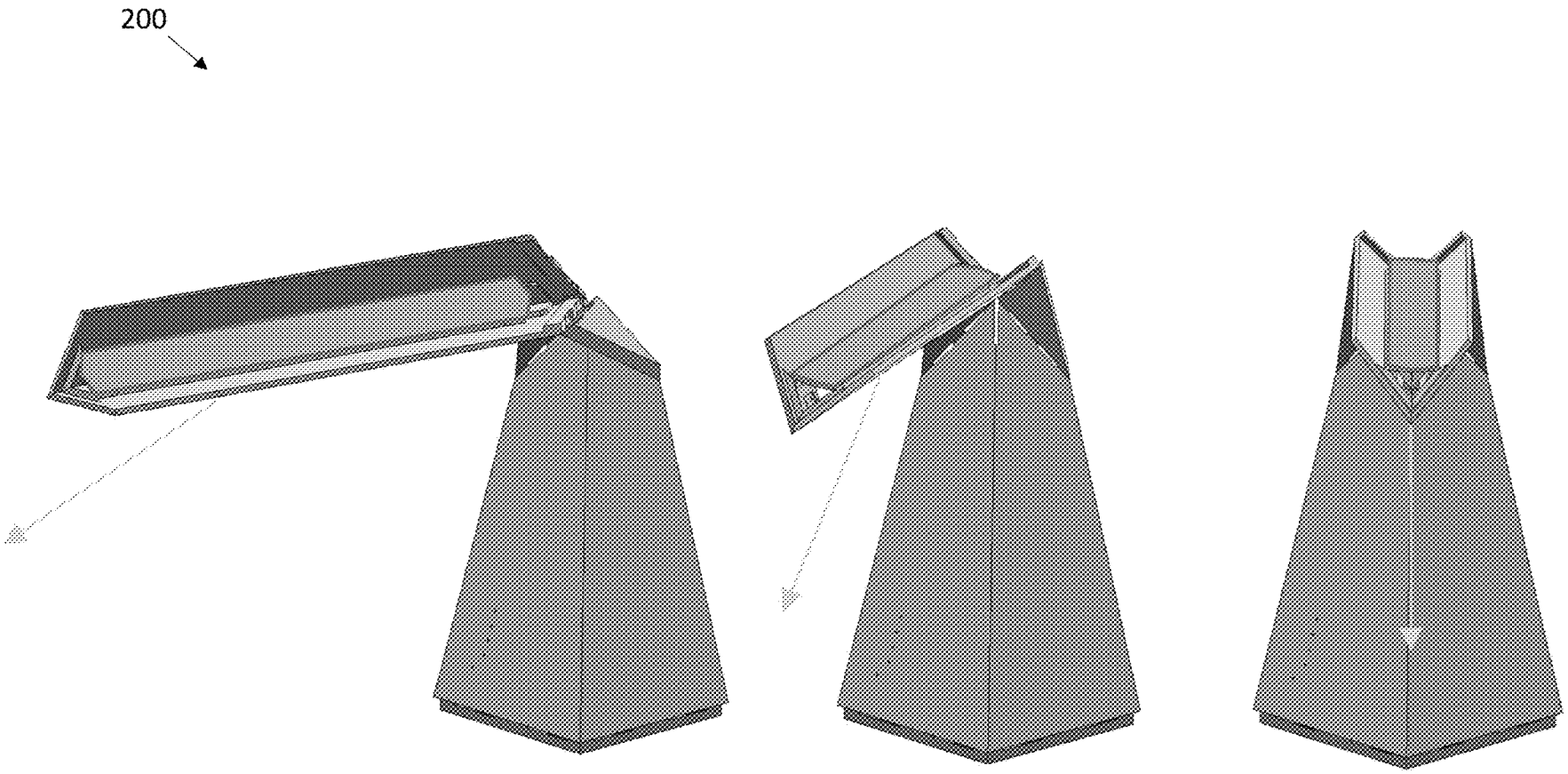
FIG. 30 illustrates an origami-inspired lamp in-plane boom articulation according to embodiments of the present disclosure.
Figure 31:
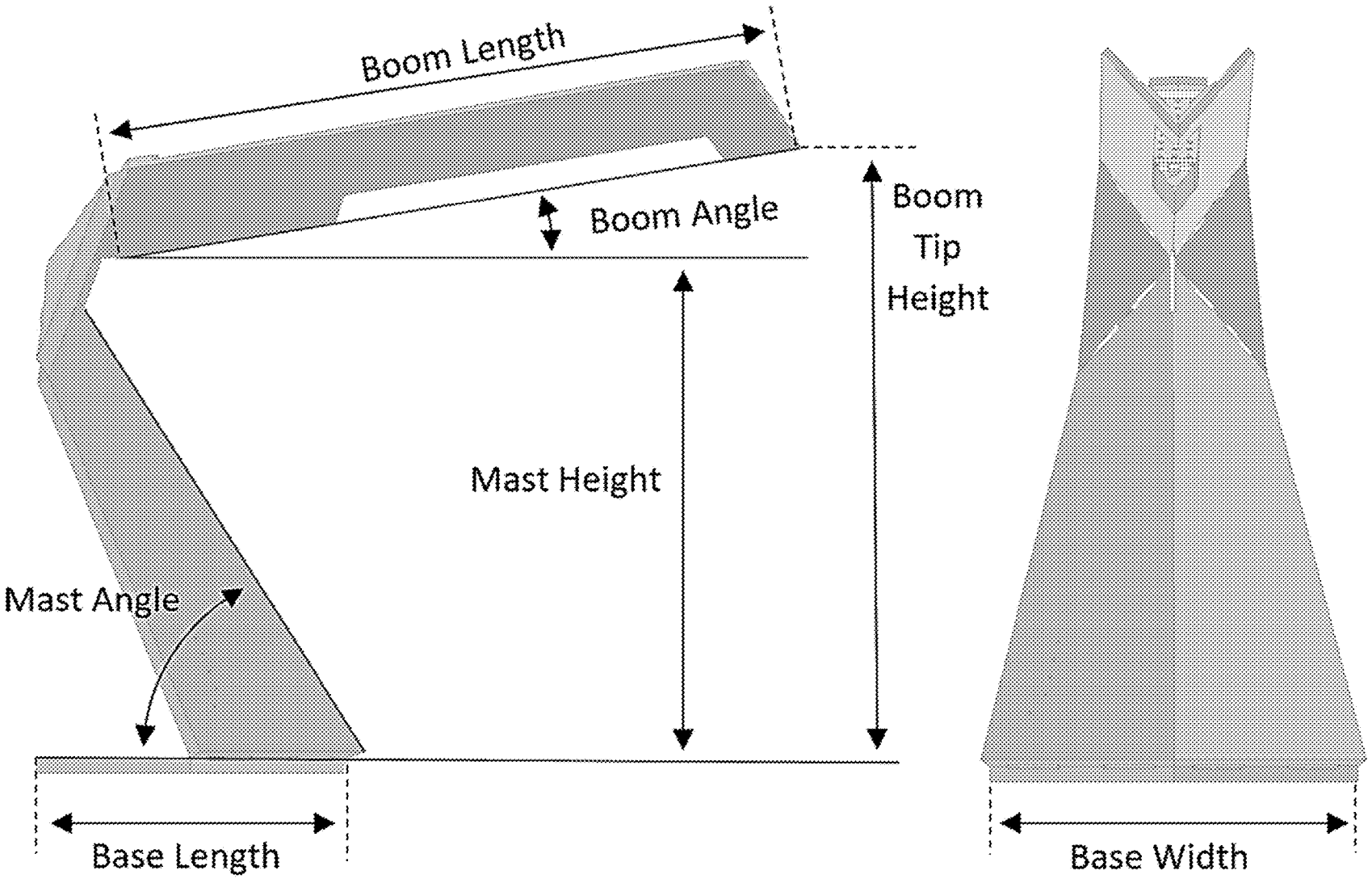
FIG. 31 illustrates lamp dimensional nomenclature according to embodiments of the present disclosure.

In various embodiments, flat-folding and articulation can be achieved independently or together in the same design. In various embodiments, strictly articulated, strictly folding, and/or folding-and-articulated lamp designs may be manufactured. In various embodiments, articulation refers to changing the orientation of the boom to orient light in the desired location and can occur in two ways: in-plane left-right rotation and out-of-plane up-down tilting. In various embodiments, different articulation modes are achieved through selecting joint orientation around the neck mechanism. FIGS. 29A-29E illustrate steps in folding an origami lamp from an unfolded state to a fully folded state. As shown in FIG. 29E, when in the folded configuration, the base, mast and boom components are coplanar with each other on both the upper and lower surfaces. Also, in some embodiments, the folding/collapse of each element (e.g., base, mast and boom) can be performed independent of the remaining elements. Additionally or alternatively, the folding/collapse of all elements can be synchronized such that a folding force applied to a single element can actuate the remaining elements to fold simultaneously. FIG. 30 illustrates various in-plane boom articulation capabilities of an origami lamp. In various embodiments, the folds of the lamp may be a one degree-of-freedom six-bar linkage when fully opened. In various embodiments, the folds of the lamp may switch between a one degree-of-freedom six-bar linkage when fully opened and a one degree-of-freedom 4-bar mechanism when actuating. In various embodiments, the lamp has continuous single degree-of-freedom motion through actuation The nomenclature for the origami lamp's dimensions is shown in FIG. 31.

Figure 32:
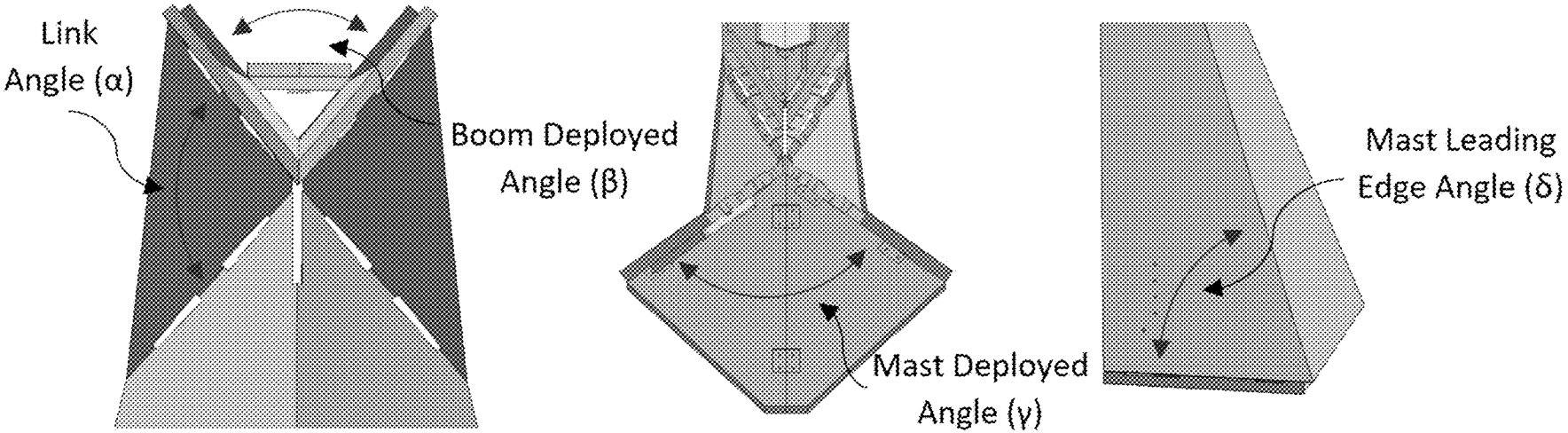
FIG. 32 illustrates critical lamp geometry angles according to embodiments of the present disclosure.

In various embodiments, the behavior of the origami lamp is governed by four angles: Link Angle ($\alpha$), Boom Deployed Angle ($\beta$), Mast Deployed Angle ($\gamma$), and Mast Leading Edge Angle ($\delta$). The location of each angle is shown in FIG. 32.

In various embodiments, tuning these angles allows positioning of the lamp's center of gravity (CG) throughout motion, the foldability/unfoldability of the assembly, and the overall appearance of the piece. In various embodiments, the impact of each angle on the centered and full-ROM (swept) boom as well as the unfolded mast is often coupled as is illustrated in the table shown in FIG. 33.

In various embodiments, the base's four-degree conical vertex offers one of two locking features for the lamp when unfolded. In various embodiments, with the angles around the vertex summing to less than 360 degrees, the feature may not completely flatten. In various embodiments, two of the four links may be located below the lamp, causing them to align when the lamp is deployed and creating a fully-locked three-bar linkage. In various embodiments, the links are kept in-line below the lamp to effectively create a fully locked three-bar linkage. Those links may also be eliminated, instead relying on mast interference to resist collapse of the lamp while deployed.

Figure 34:
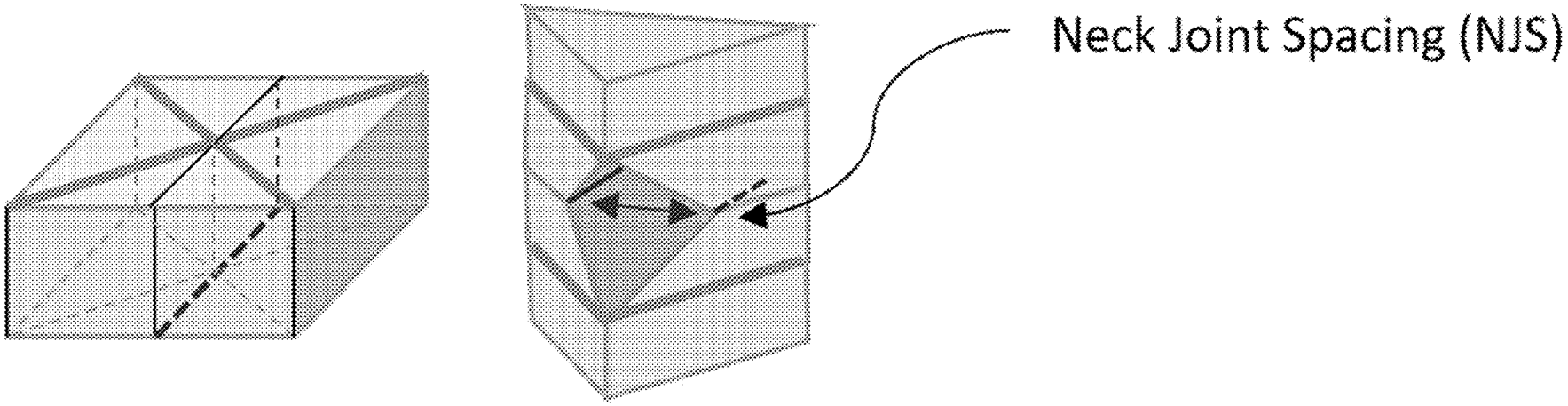
FIG. 34 illustrates neck joint fold pattern and joint spacing according to embodiments of the present disclosure.

In various embodiments, a six-degree implementation of the neck vertex offers both articulation and folding functionality for the lamp. The type of articulation depends on Neck Joint Spacing (NJS) as shown in FIG. 34.

Figure 35:
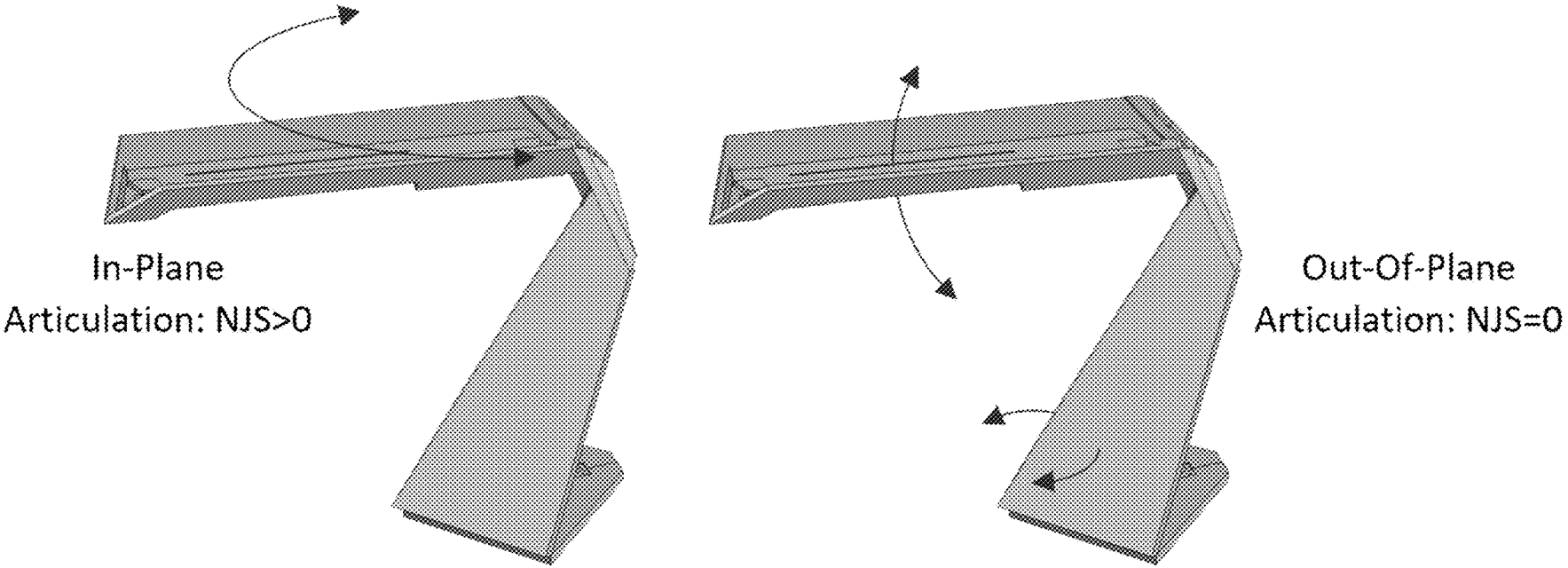
FIG. 35 illustrates lamp boom articulation modes according to embodiments of the present disclosure.

In various embodiments, for finite NJS, only one flat-folding state is possible, and unfolding is limited to an intermediate state where all four mountain (or valley) folds intersect at a single point, creating a spherical four-bar mechanism. In various embodiments, the resulting single degree of freedom mechanism allows in-plane articulation of the boom as shown in FIG. 35. In various embodiments, re-centering of the mechanism allows the panels to move back to their flat state. In various embodiments, finite NJS with beveled edges also offers a rotation-limiting (locking) feature for the lamp, potentially eliminating the need for base panels entirely.

In various embodiments, for zero NJS, two flat folding states exist with single degree of freedom movement in-between, allowing significant variation in boom elevation. In various embodiments, similar adjustment may be possible with NJS>0, but articulation may only occur when the boom is completely extended and is unlikely to be stable. In both cases, tunable boom elevation may require modification of the mast angle and some accommodation of this variation at the base, potentially or likely via modification of base panels.

Figure 36A:
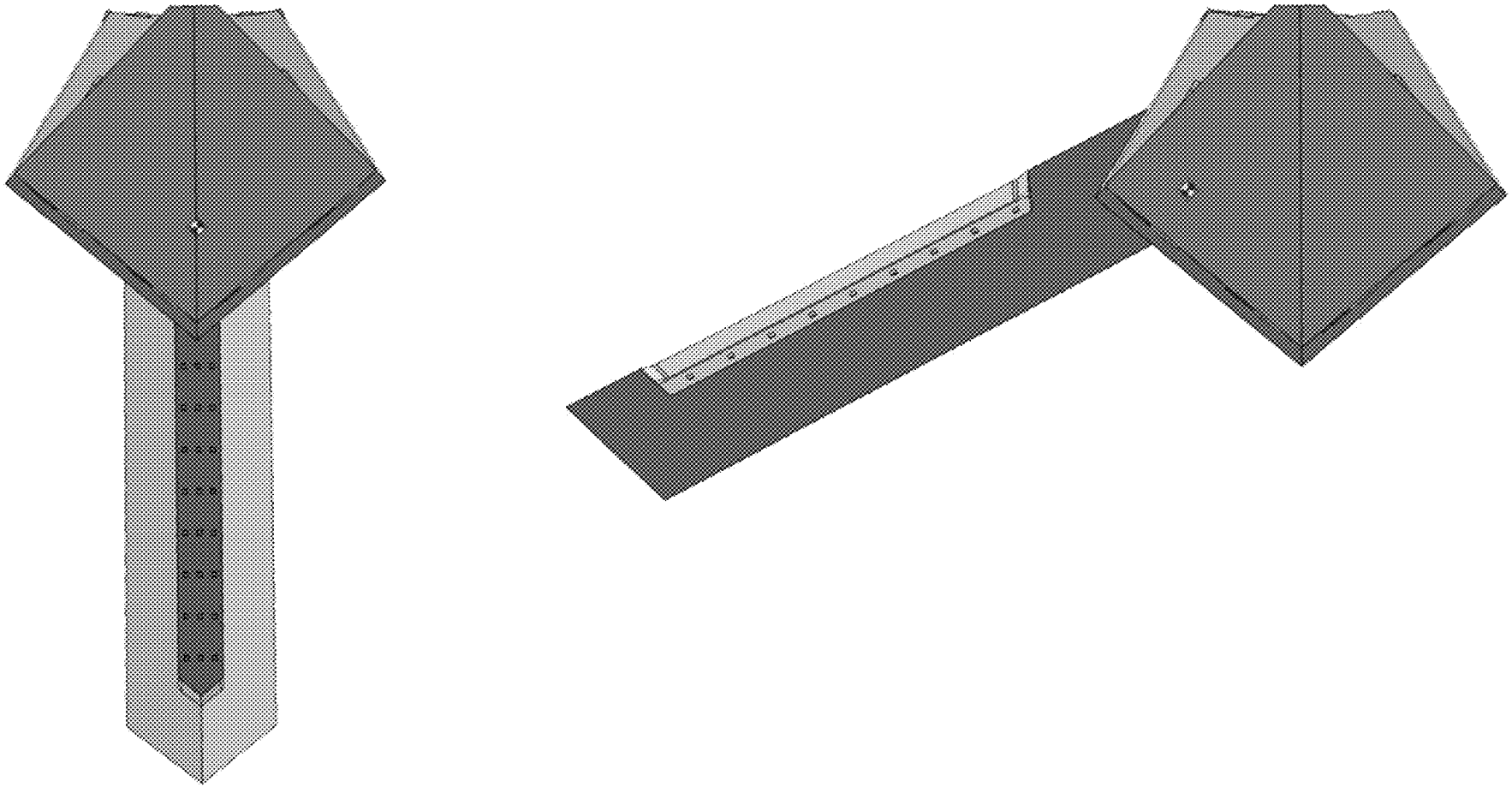
FIG. 36A illustrates lamp center of gravity position within base during boom articulation according to embodiments of the present disclosure.
Figure 36B:
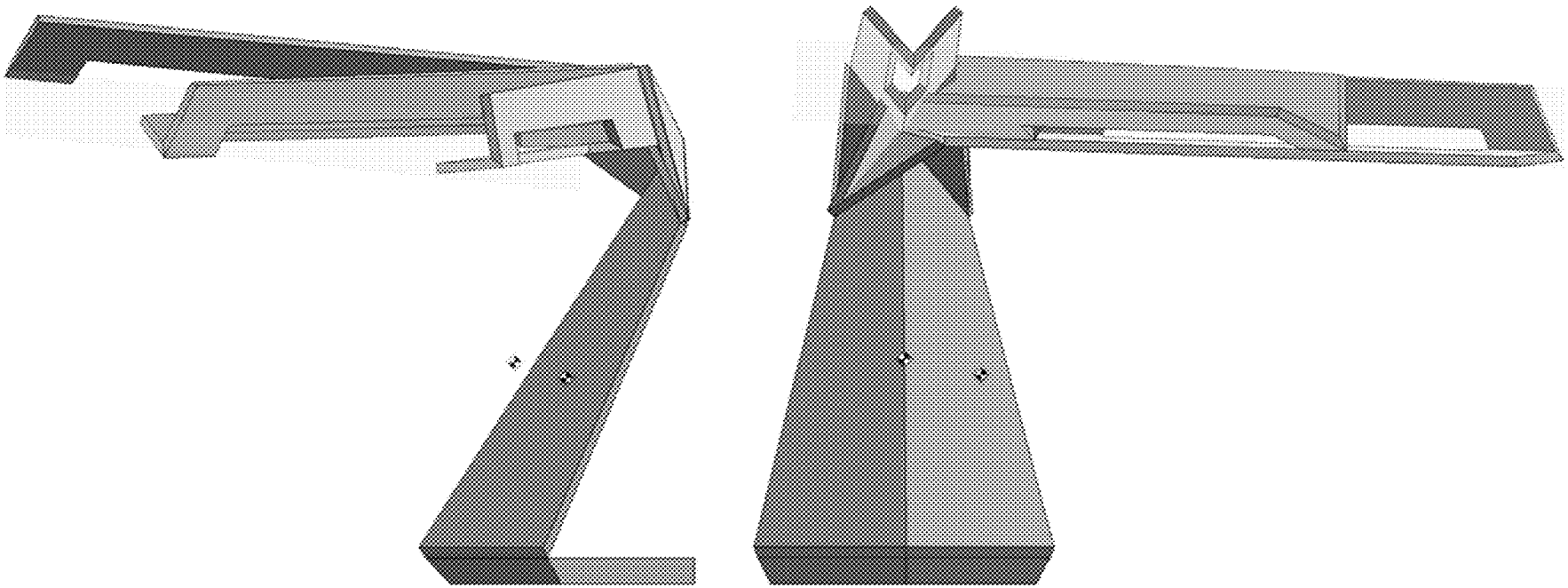
FIG. 36B illustrates lamp center of gravity height and top height during boom articulation according to embodiments of the present disclosure.
Figure 37B:
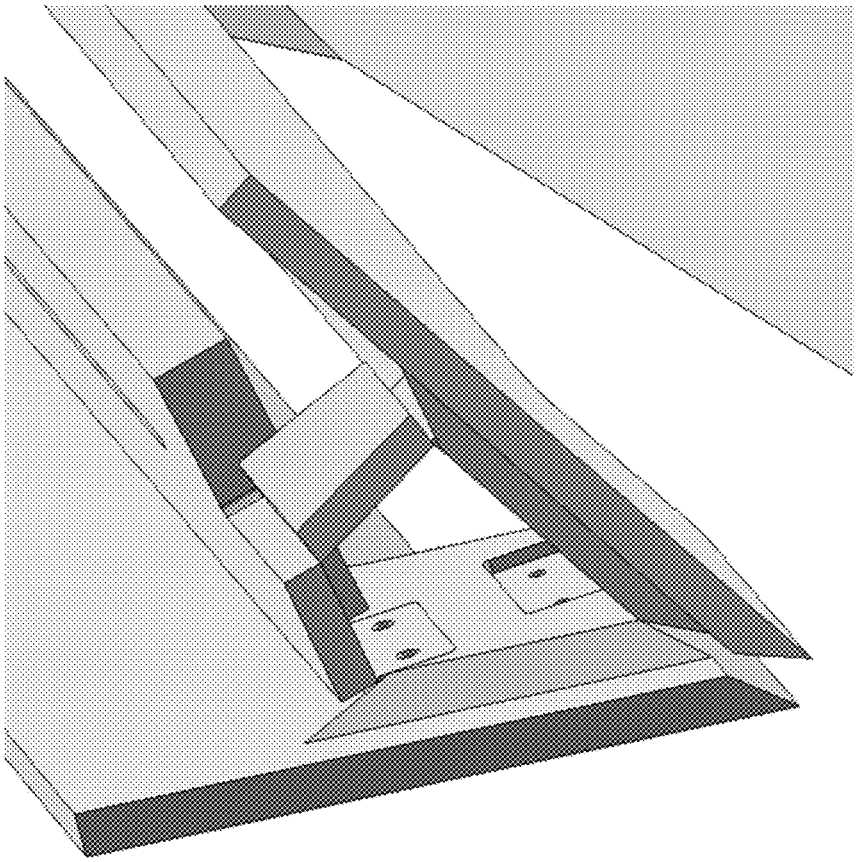
FIG. 37A-37D illustrate a production baseline LED carrier synchronization according to embodiments of the present disclosure.
Figure 37A:
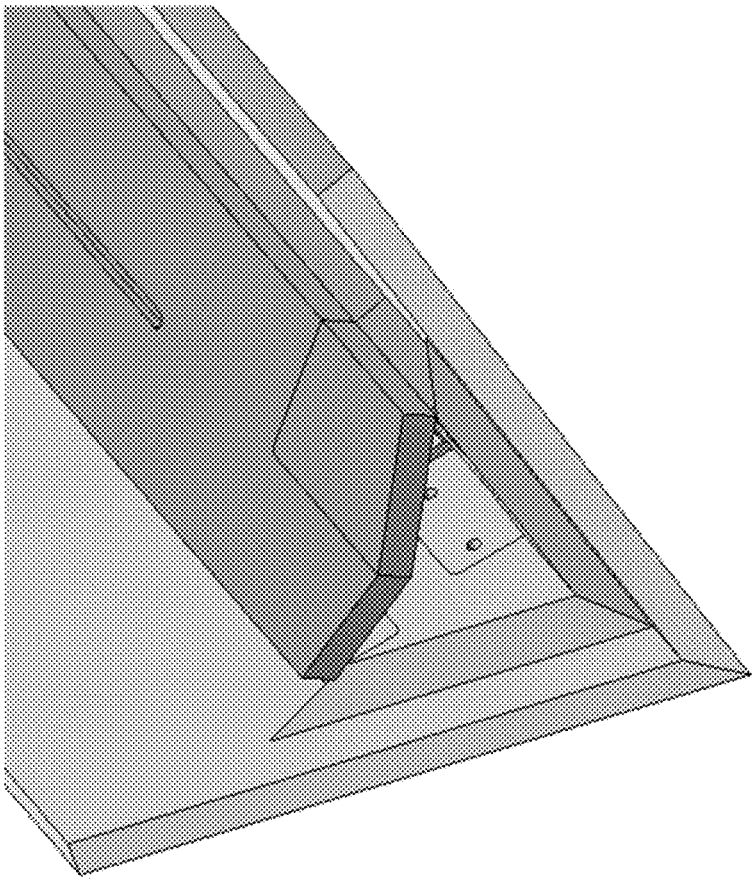
Figure 37D:
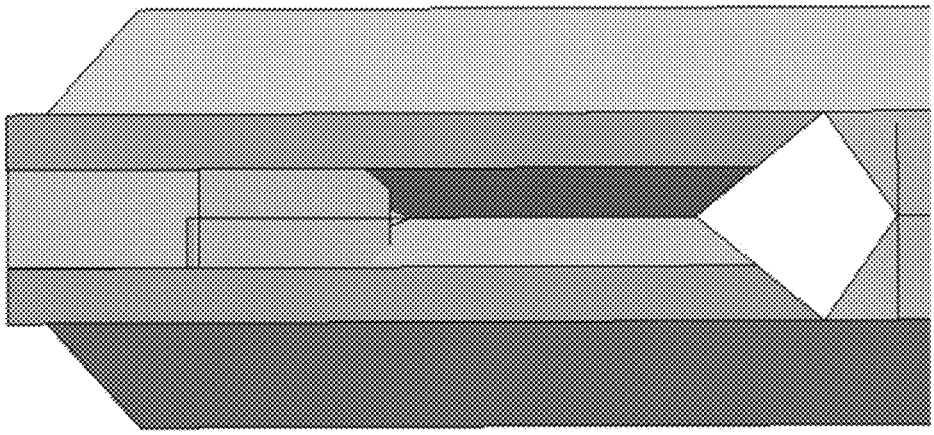
Figure 37C:
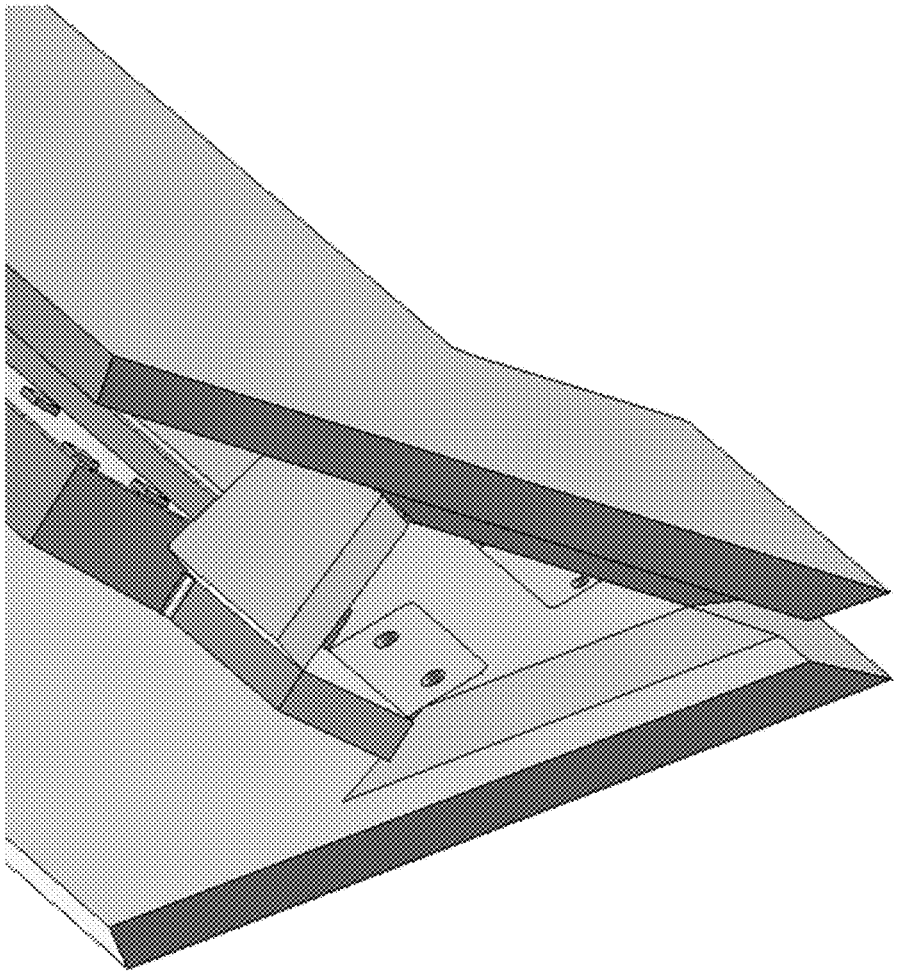

In various embodiments, stability of the deployed lamp during articulation depends on maintaining proper CG location as the boom moves. FIGS. 36A-36B illustrate the in-plane and out-of-plane locations of the lamp CG as the baseline lamp design's boom is moved from its center point to its full range of motion. In various embodiments, keeping the CG within the base may prevent the lamp from tipping over, and minimizing CG height variation allows the boom to rest in whatever position that the boom is placed into.

In various embodiments, to allow flat folding of the assembly with a finite-width light emitting diode (LED) printed circuit board (PCB) which is oriented largely horizontal to the surface on which its placed, the PCB may need to pivot within the assembly while folding as shown in FIGS. 37A-37D. In various embodiments, tape may be used as a fixation mechanism.

In various embodiments, a lamp may be both flat folding and articulated when deployed. In various embodiments, this requires at least the use of a six-degree vertex at the neck and finite NJS.

In various embodiments, an alternate version of the flat-folding, articulated design uses a six bar mechanism at the neck but with zero NJS. In various embodiments, with adjustable mast and boom angles, the boom angle may be freely varied.

In various embodiments, use of a single four bar linkage at the neck allows articulation of the boom without the need for folding. An example of this would be using a spherical four-bar linkage at the neck, but this may be possible with other single degree of freedom mechanisms which could include higher bar counts.

In various embodiments, it is possible to use the fold pattern in manufacturing but not routine use. An example would be folded sheet metal which could be formed or initiated with a stamping operation, creating the 3D lamp with 2D stock.

In various embodiments, the lamp may be relatively short as pictured but may also be taller for floor lamp applications. In various embodiments, the boom may also be longer to allow farther reach, especially in floor lamp application.

In various embodiments, rather than sweeping the boom, it is possible to keep the boom location fixed and instead rotate the base to tilt the boom left and right.

In various embodiments, the rotary joints interconnecting its largely rigid panels can be achieved with hinges as in the current production design, but could also be made with flexible materials like plastic, leather, fabric, whether integral to the panels or bonded directly. In various embodiments, it is also possible to design the lamp such that creases aren't discrete, and are instead achieved through virtual rotational axes (instant centers) or gross deflection of the lamp's panels.

In various embodiments, in order to elevate the boom, the base may be designed so that it's not nominally capable of flattening due to the angle of base panels and the mast bevel interference. In various embodiments, the weight of the lamp may allow flattening of the base, preloading the mast, and helping elevate the boom.

In various embodiments, to add resistance to the boom movement, resistance can be added to the hinges through joint misalignment of addition of a damper to the joints.

In various embodiments, it is possible to eliminate the base vertex entirely, relying only on interference/resistance in the mast joint to keep the lamp in place. In this embodiment, the only major vertex of the lamp may be the neck vertex.

In various embodiments, rather than a single LED PCB for illumination, light guides or multiple LED PCBs could be used for illumination. This could eliminate the need for an articulated LED carrier entirely. In various embodiments, incandescent, fluorescent, and/or organic LED illumination may be possible.

In various embodiments, instead of discrete power, control, and illumination circuitry, all electronics may be co-located on a single board.

In various embodiments, the mast and boom may be manufactured as single pieces of material instead of discrete, articulated panels.

Figure 38:
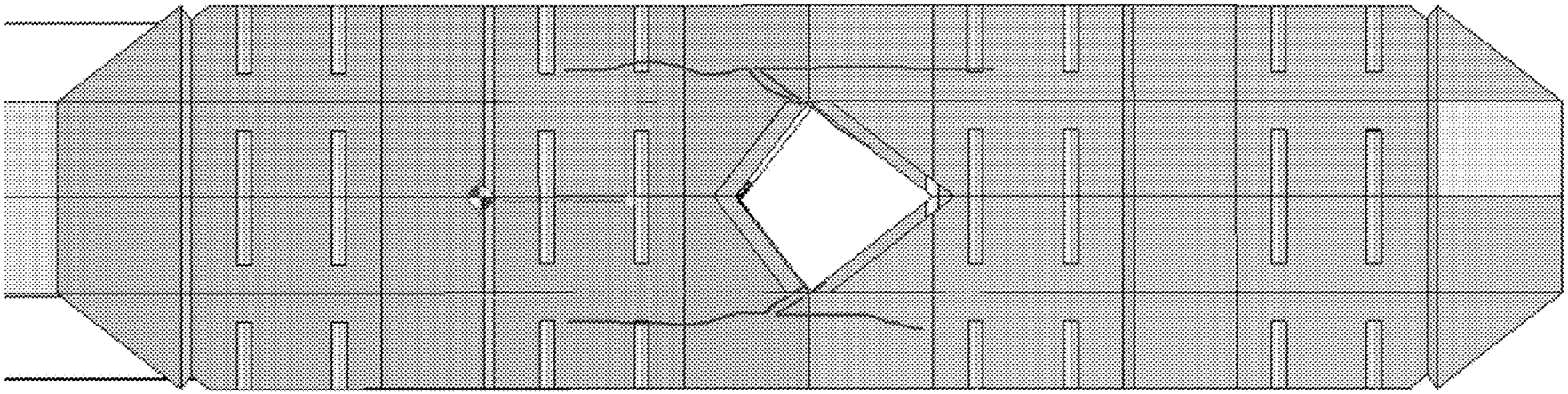
FIG. 38 illustrates boom and mast bevel modification allowing interlocking while folded according to embodiments of the present disclosure.

In various embodiments, the bevel designs and joint alignment for the mast and boom could be modified such that the parts interlock when folded, preventing relative motion of the various pieces when it's in its folded state but still allowing the lamp to unfold properly. An example of this geometry modification as shown in FIG. 38.

In various embodiments, the lamp may be made out of wood, metal, plastic, composite, glass, fabric, leather, or any other material capable of achieving sufficient stiffness such that it can support its own weight.

In various embodiments, the creases and/or joints in the lamp may not be linear, and instead may have curvature. In various embodiments, curved creases and/or joints can add additional stiffness or locking to the assembly, or add more styling options.

In various embodiments, batteries may be integrated into the assembly. In various embodiments, the lamp may also include other electronics which could be useful on a desk or night stand like USB ports, clocks, speakers, radios, alarms, displays, digital assistants, and wireless chargers. In this case, the base may be thickened and pocketed to allow packaging of the thicker battery cells within the base assembly.

In various embodiments, additional electronics could also be packaged in the mast, links, or boom.

Figure 39:
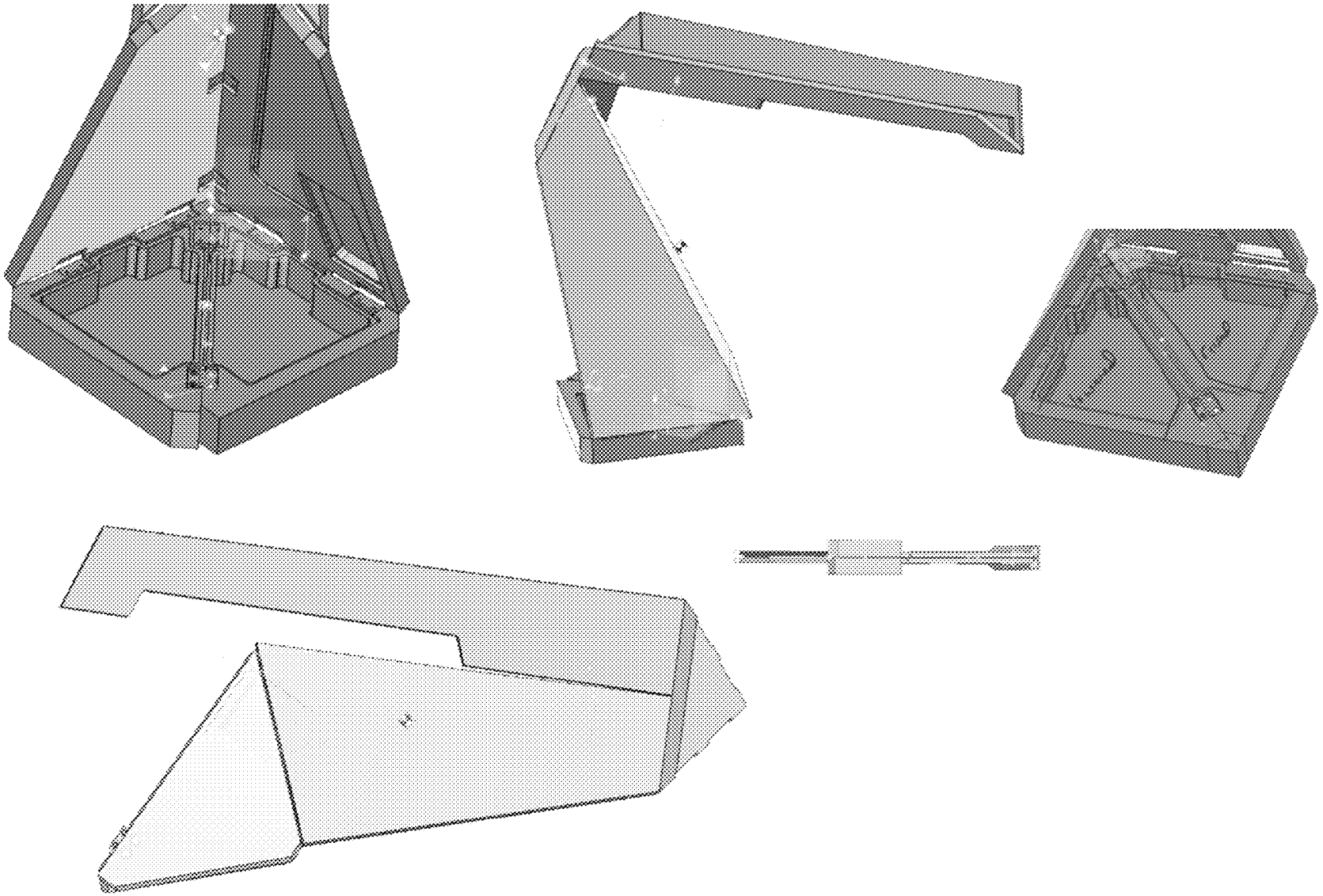
FIG. 39 illustrates a base extension approach for base electronics according to embodiments of the present disclosure.

The base of the lamp may also be extended outside of the normal base form factor when folded. FIG. 39 shows an exemplary alternate base extension approach for base electronics.

In various embodiments, the entire lamp may be created with a single piece of material which itself has cuts and creases, or even experiences gross deflection near traditional mountains and valleys. In this case, the lamp may be made from corrugated plastic and joints are made by cutting the material down to one facesheet (mountain joints are cut to the bottom face, valley joints are cut to the top face.)

In various embodiments, the lamp may be made from paper and/or cardboard constructions, especially if cost reduction is desired.

In various embodiments, portions of or the entire lamp may be made out of a printed circuit board, eliminating the need for panels as well as circuitry. In various embodiments, joints could be created with flex joints (e.g., rigid-flex printed circuit board) which could also include the harnessing. In various embodiments, the design of the boom and stiffness of the flex material could allow a preloaded LED assembly resting on the inside of the boom, and this would not be capable of falling through the LED opening due to a closed base vertex.

Centerfold Table

Figure 40A:
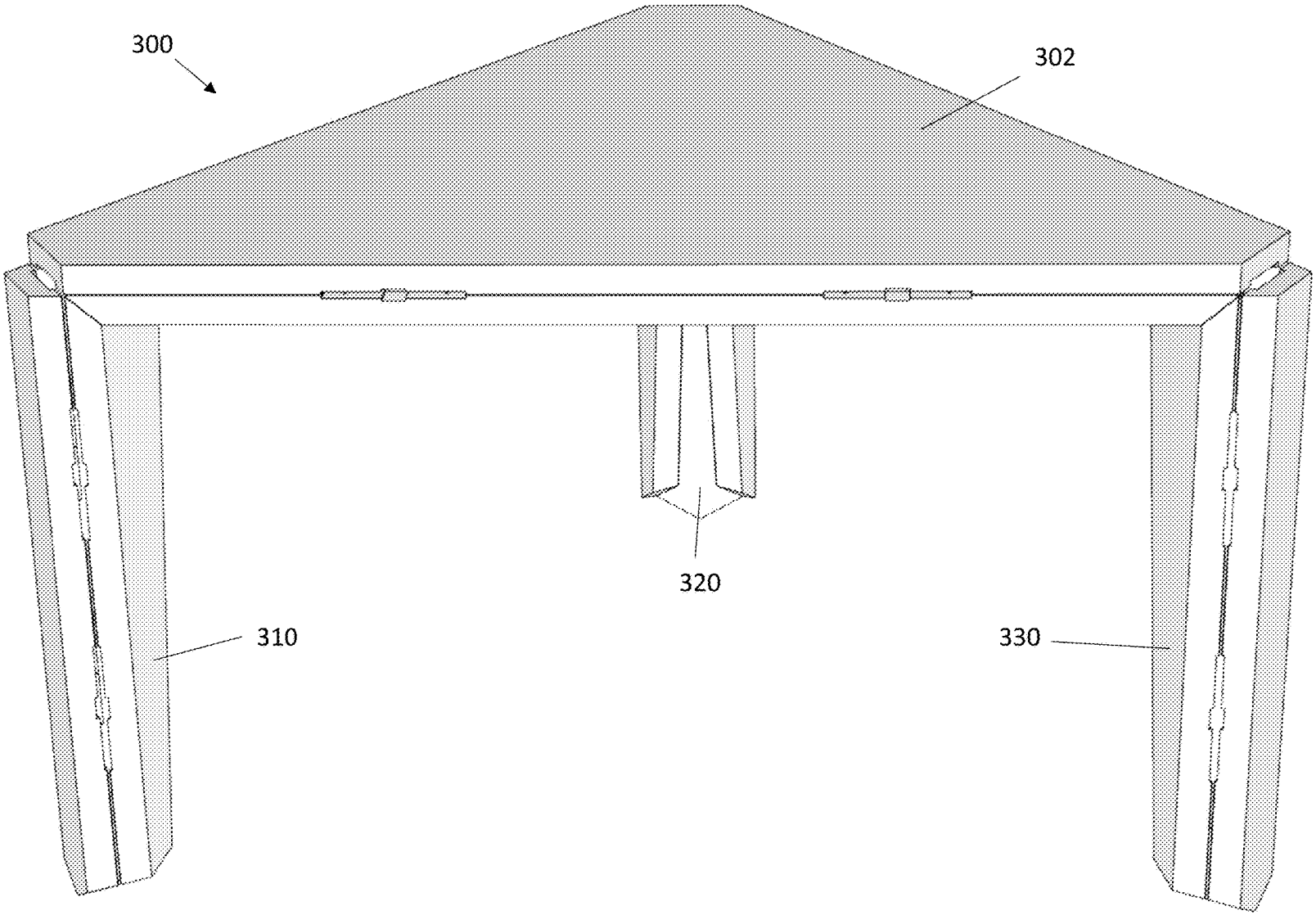
FIGS. 40A-40D illustrate a three-leg centerfold table in a deployed configuration according to embodiments of the present disclosure.
Figure 40B:
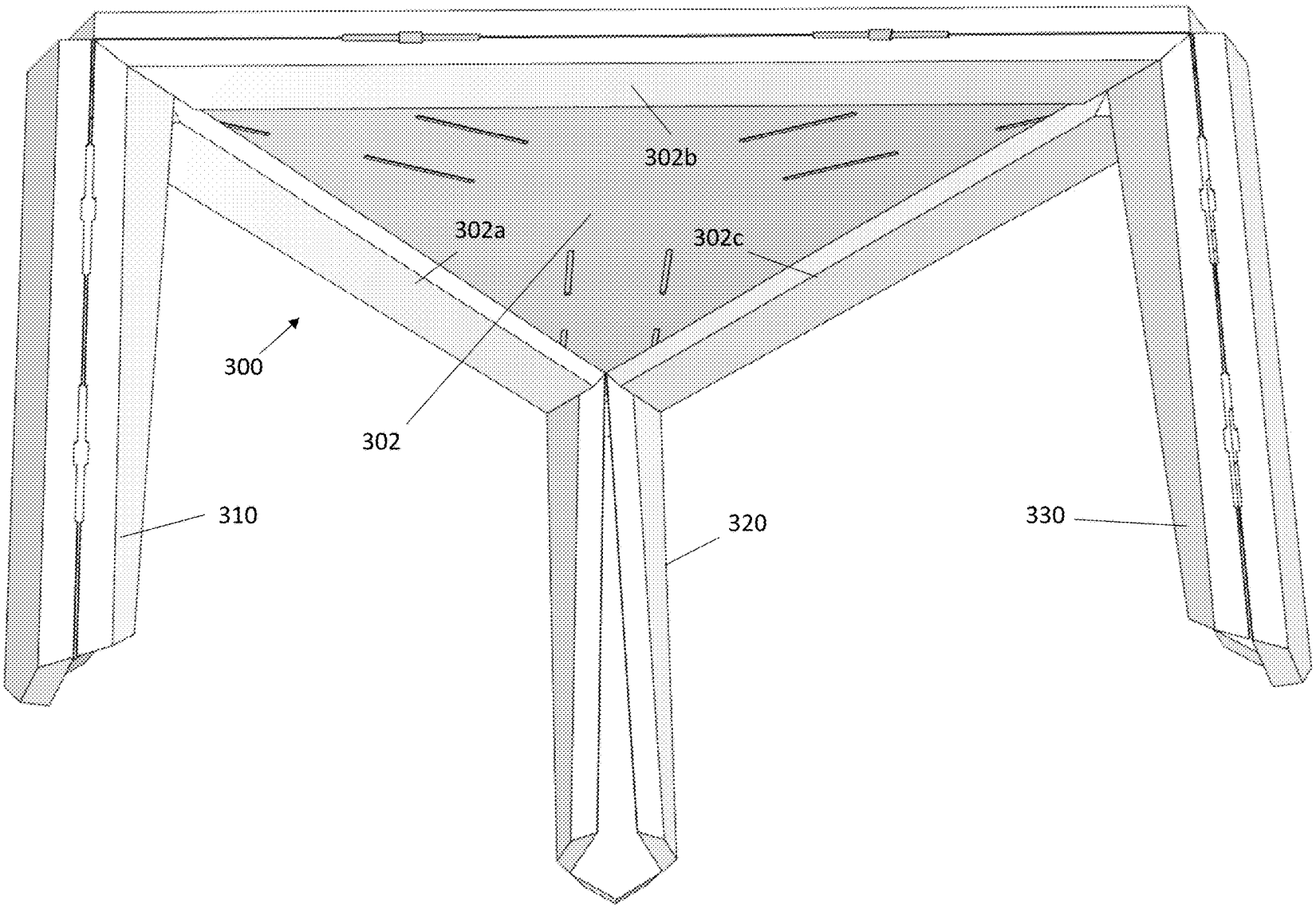
Figure 40C:
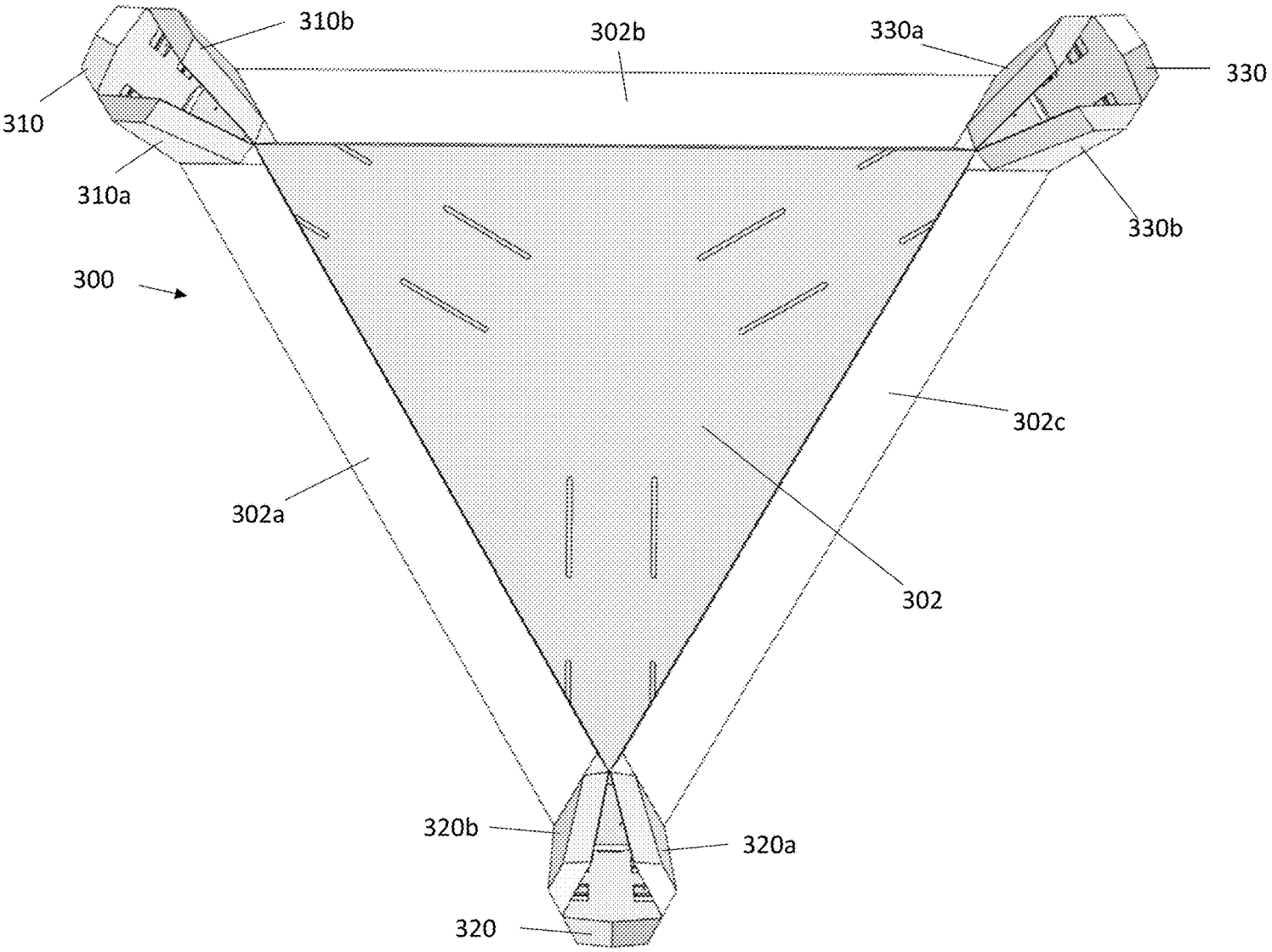
Figure 40D:
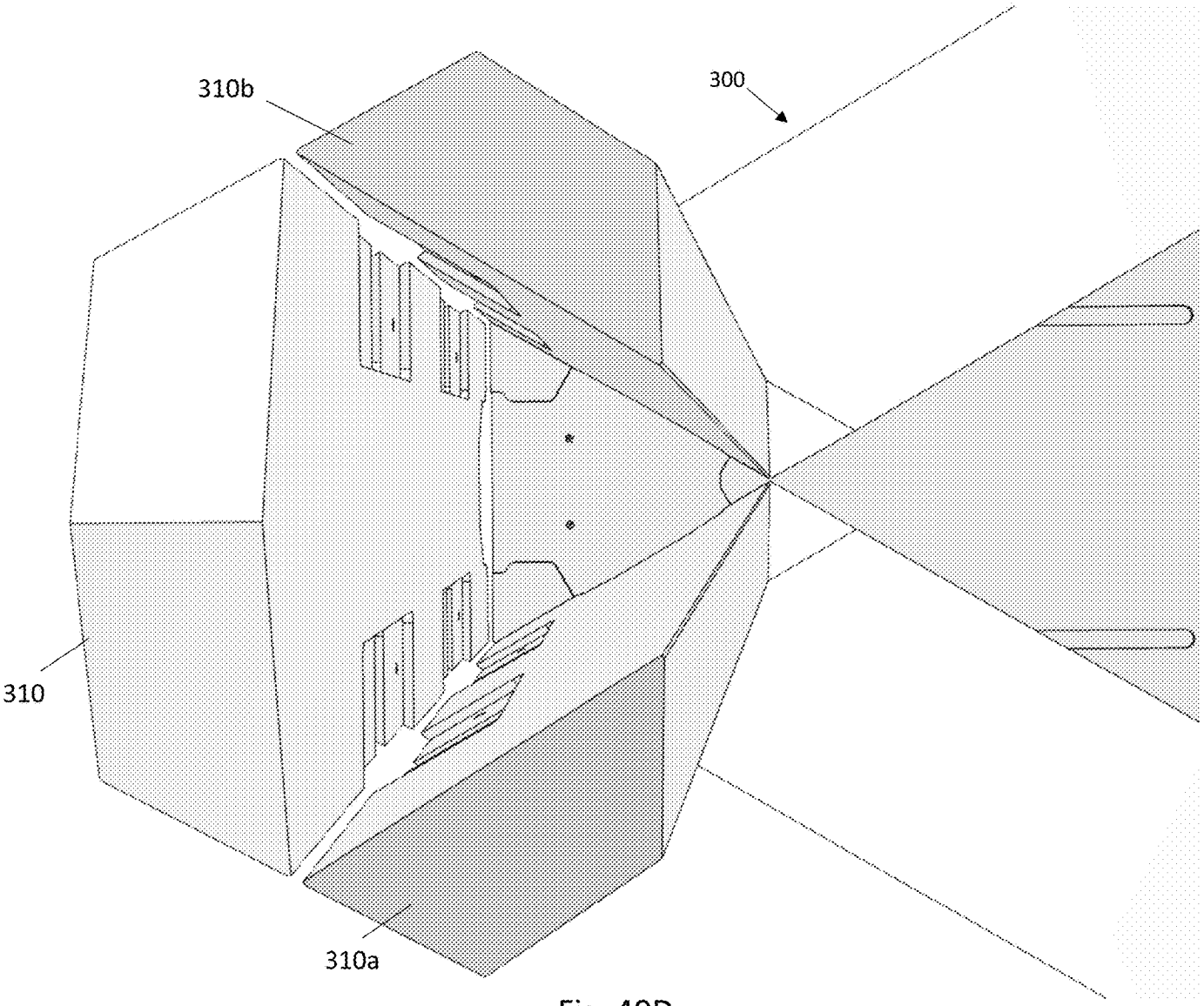
Figure 40E:
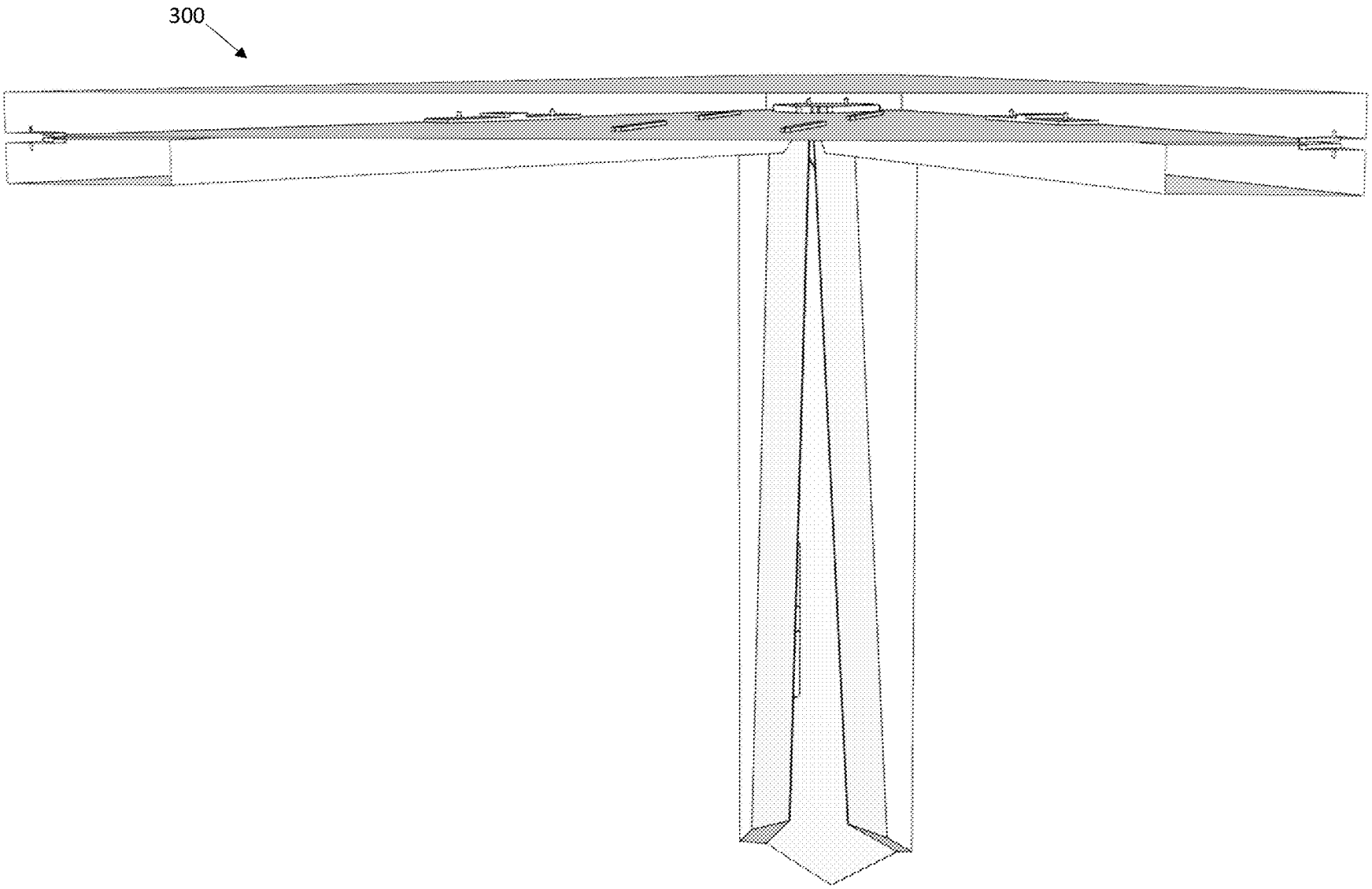
FIG. 40E illustrates a cross section of the three-leg centerfold table according to embodiments of the present disclosure.

A centerfold table 300 described herein includes a platform that uses a pattern of joints to assume two primary states, one of which is intended for storage (i.e., a folded configuration) and the other which is intended for routine use (i.e., an unfolded configuration). FIGS. 40A-40D illustrate a three-leg centerfold table 300 with the legs 310, 320, 330 in a deployed configuration for routine use. FIG. 40E illustrates a cross section of the centerfold table 300.

In various embodiments, the table 300 includes a base 302 and a plurality of legs 310, 320, 330. For example, the table 300 may include three legs, four legs, five legs, etc. As shown in FIG. 40A-40E, the base 302 of the table may be substantially triangular-shaped (e.g., shaped as an equilateral triangle). In other embodiments, the base 302 may include any suitable shape, including, but not limited to, circular, rectangular, square, trapezoidal, etc.

In various embodiments, each side of the base 302 includes an edge panel and each side of the legs 310, 320, 330, includes a brace panel. For example, the base 302 includes edge panels 302*a*-302*c*, leg 310 includes brace panels 310*a*, 310*b*, leg 320 includes brace panels 320*a*, 320*b*, and leg 330 includes brace panels 330*a*, 330*b*. In various embodiments, each edge panel and/or brace panel is coupled to its respective component via one or more hinges. For example, edge panels 302*a*-302*c* are couple to base 302 via one or more hinges per panel. In another example, brace panels 310*a*-310*b* are coupled to leg 310 via one or more hinges per panel. In various embodiments, each brace panel of legs 310, 320, 330 is coupled to an edge panel 302*a*-302*c* of the base 302. For example, brace panel 310*a* is coupled to edge panel 302*a* of the base 302 while brace panel 310*b* is coupled to edge panel 302*b* of the base 302. Similarly, brace panel 320*a* is coupled to edge panel 302*c* of the base 302 while brace panel 320*b* is coupled to edge panel 302*a* of the base 302 and brace panel 330*a* is coupled to edge panel 302*b* of the base 302 while brace panel 330*b* is coupled to edge panel 302*c* of the base 302.

Figure 41A:
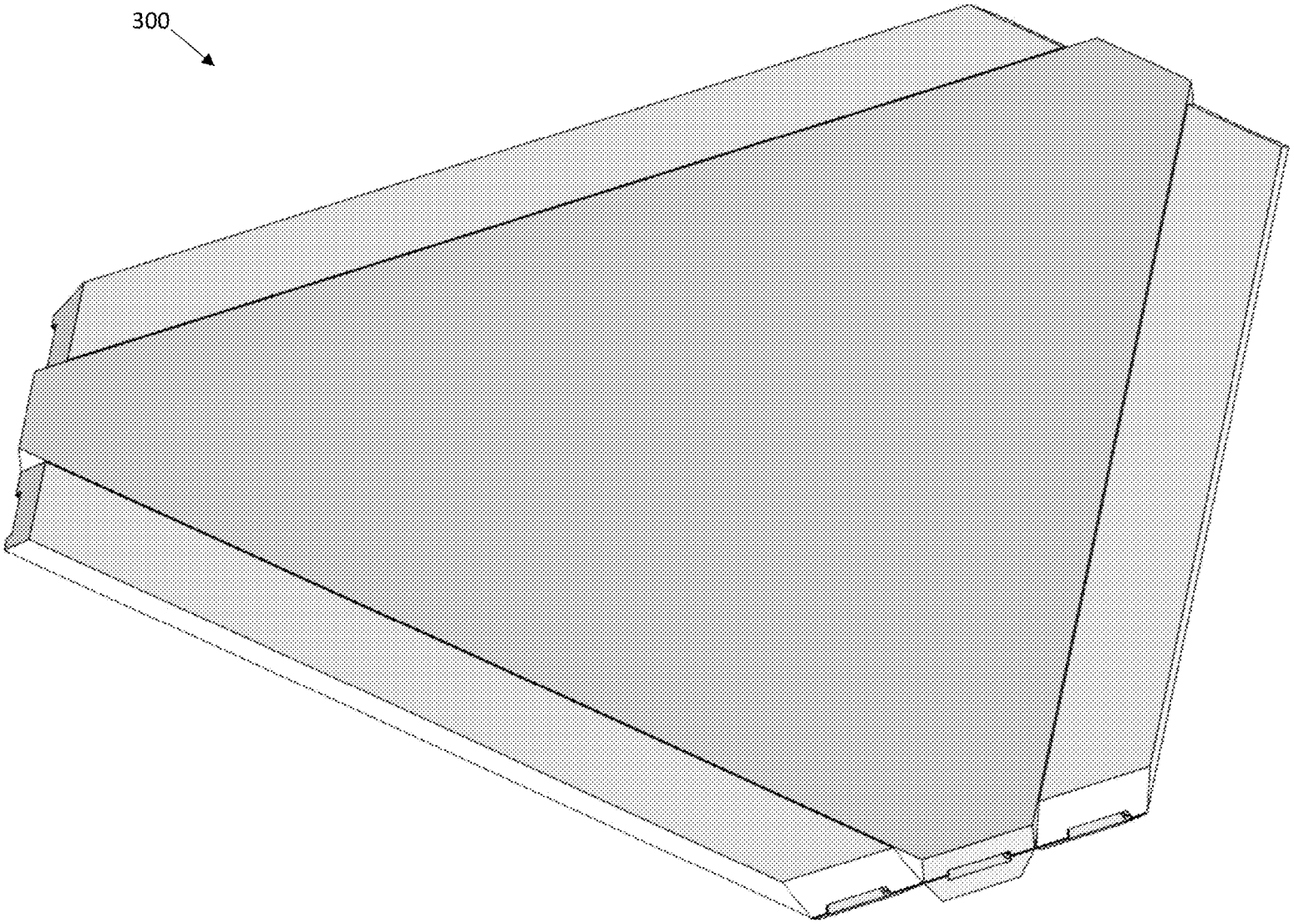
FIGS. 41A-41C illustrate a three-leg centerfold table in a storage configuration according to embodiments of the present disclosure.
Figure 41B:
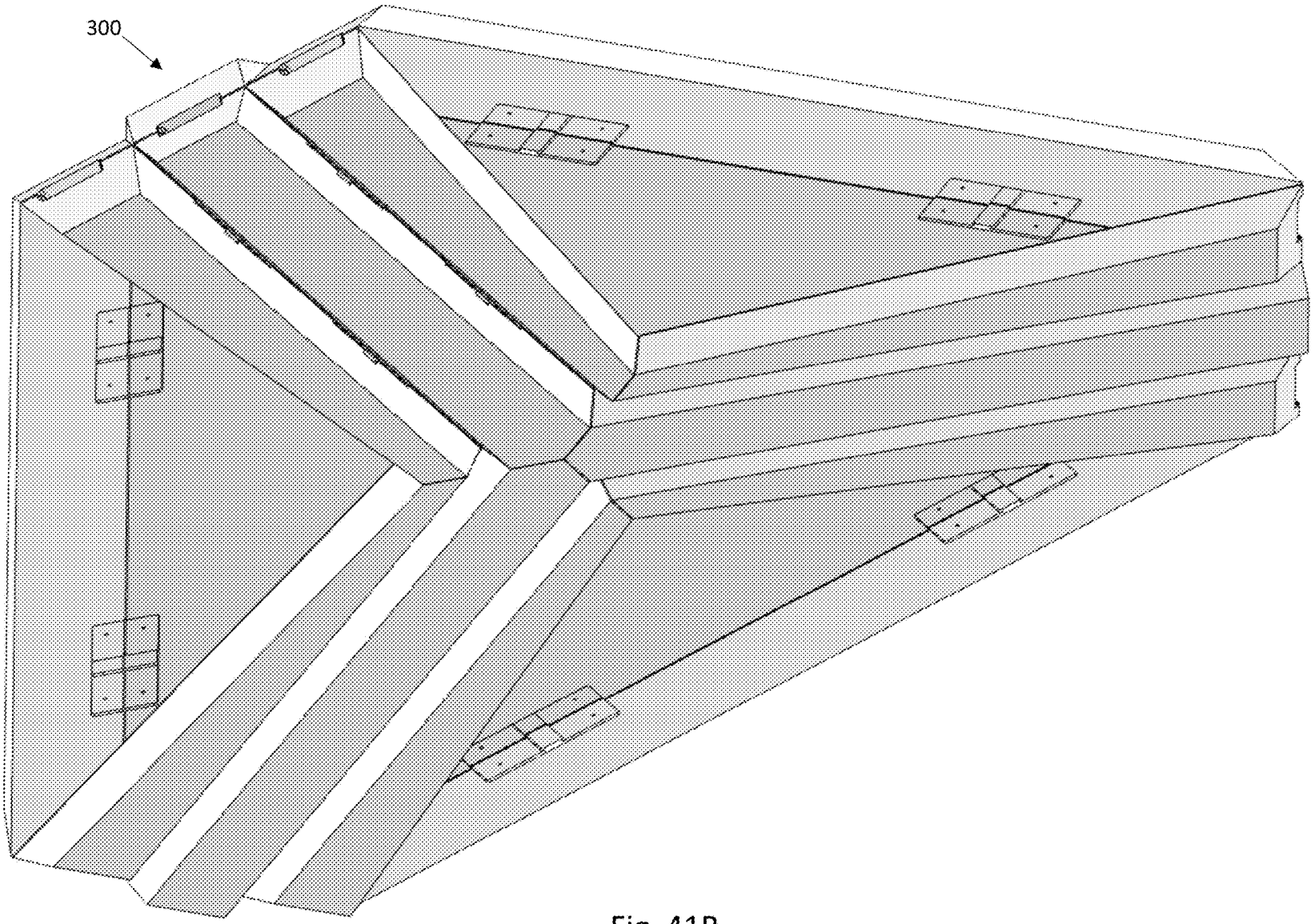
Figure 41C:
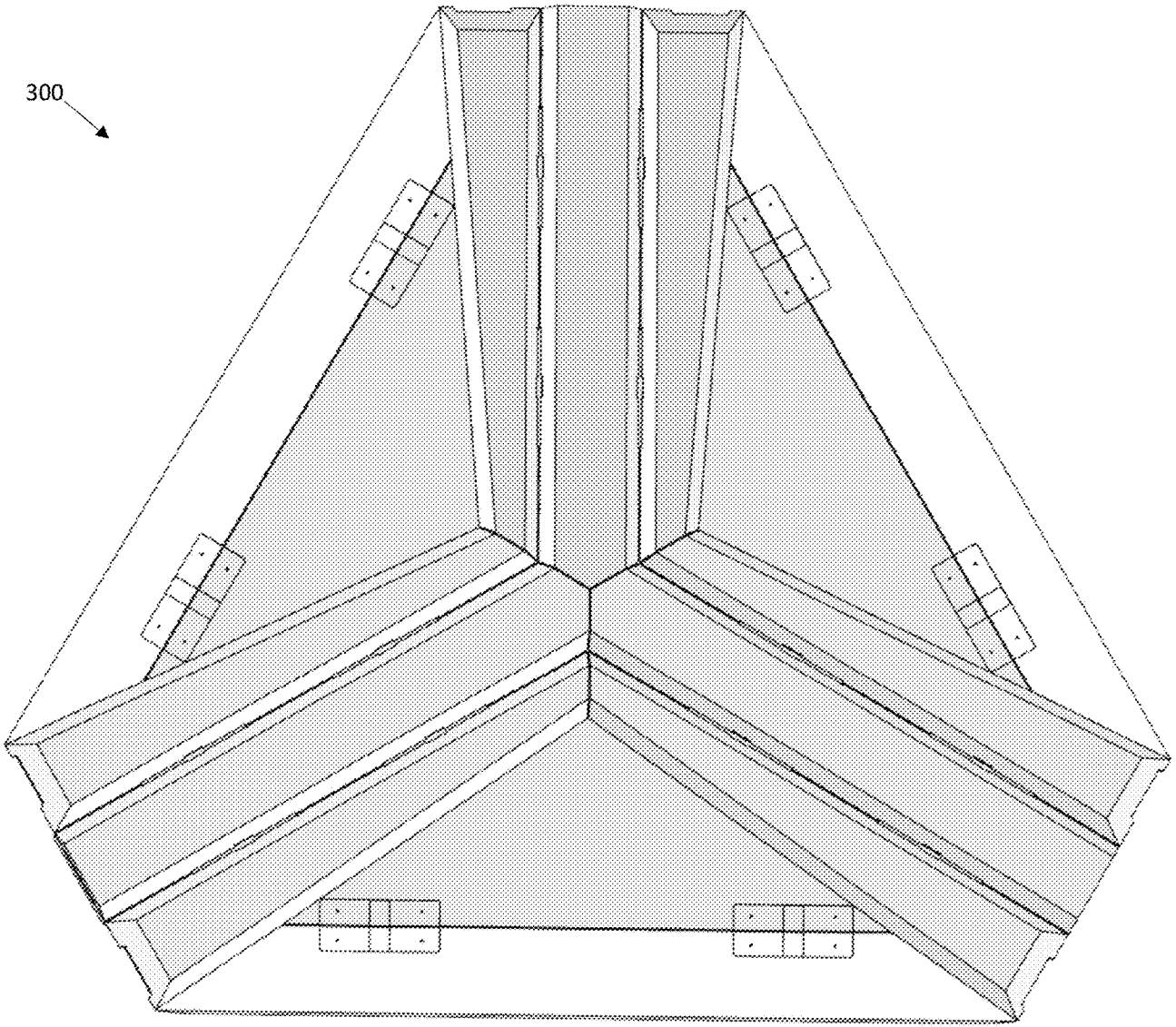

FIGS. 41A-41C illustrate the three-leg centerfold table 300 in a storage configuration. In various embodiments, the fold pattern of each of the legs of the centerfold table allows single degree-of-freedom deployment from a flattened state, improving ease of setup for the operator. In various embodiments, in the unfolded configuration, each brace panel 310*a*, 310*b*, 320*a*, 320*b*, 330*a*, 330*b*, of the legs 310, 320, 330 is folded inwardly towards the center of the table while the edge panels 302*a*, 302*b*, 302*c* of the base 302 fold down underneath the table. In various embodiments, when folding the unfolded table back to the storage (i.e., folded) configuration, each edge panel 302*a*, 302*b*, 302*c* of the base 302 folds outwardly until it becomes aligned with and in the same plane (i.e., a first plane) as the base 302, as shown in FIG. 41A. In various embodiments, when folding the unfolded table back to the storage (i.e., folded) configuration, each brace panel 310*a*, 310*b*, 320*a*, 320*b*, 330*a*, 330*b*, along with each leg 310, 320, 330, folds outwardly and both the brace panels 310*a*, 310*b*, 320*a*, 320*b*, 330*a*, 330*b* and the legs 310, 320, 330 become aligned with the base 302 (and the first plane). In various embodiments, an intermediate "flattened" state (shown below in FIG. 46C) is when the base 302, the edge panels 302*a*, 302*b*, 302*c*, the legs 310, 320, 330, and the brace panels 310*a*, 310*b*, 320*a*, 320*b*, 330*a*, 330*b* are all aligned in the same plane.

As folding continues, the legs 310, 320, 330, and the brace panels 310*a*, 310*b*, 320*a*, 320*b*, 330*a*, 330*b* are folded towards the center of the base 302 thereby aligning with a second plane that is parallel to the first plane of the base 302, as shown in FIGS. 41B-41C. In various embodiments, in the folded configuration, each brace panel 310*a*, 310*b*, 320*a*, 320*b*, 330*a*, 330*b*, of the legs 310, 320, 330 is aligned with and in the same plane with one another (i.e., the second plane), as shown in FIGS. 41B-41C.

Figure 42B:
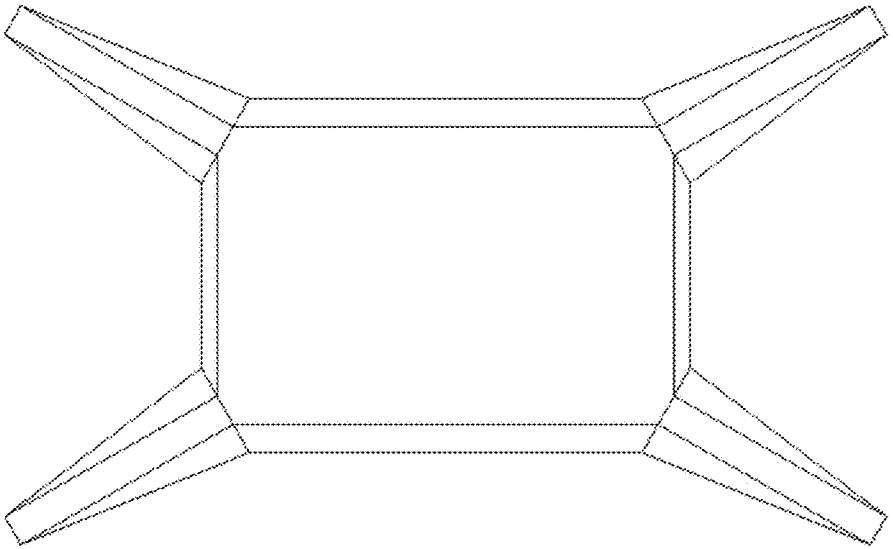
FIG. 42B illustrates a four-leg centerfold table fold pattern according to embodiments of the present disclosure.
Figure 42A:
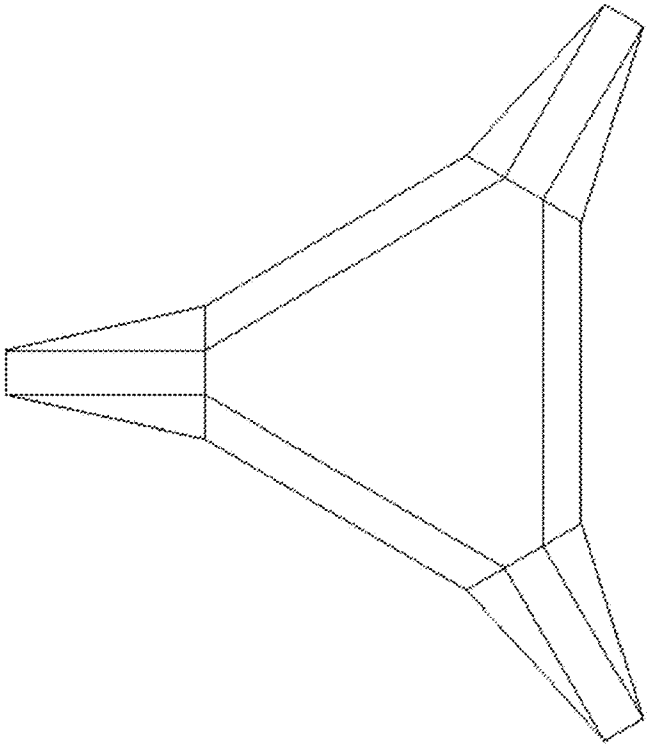
FIG. 42A illustrates a three-leg centerfold table fold pattern according to embodiments of the present disclosure.
Figure 43B:
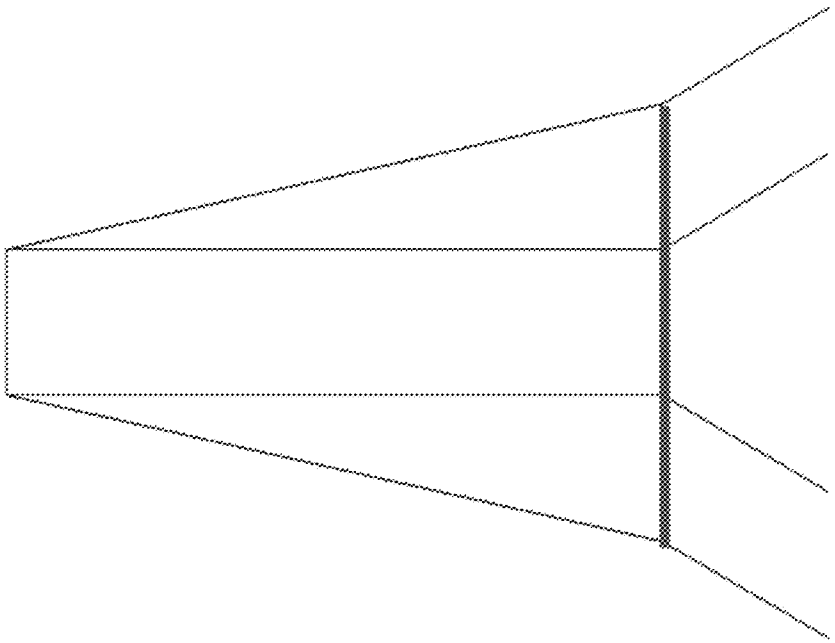
FIGS. 43A-43B illustrate three-leg table crease assignments during deployment and stowing according to embodiments of the present disclosure.
Figure 43A:
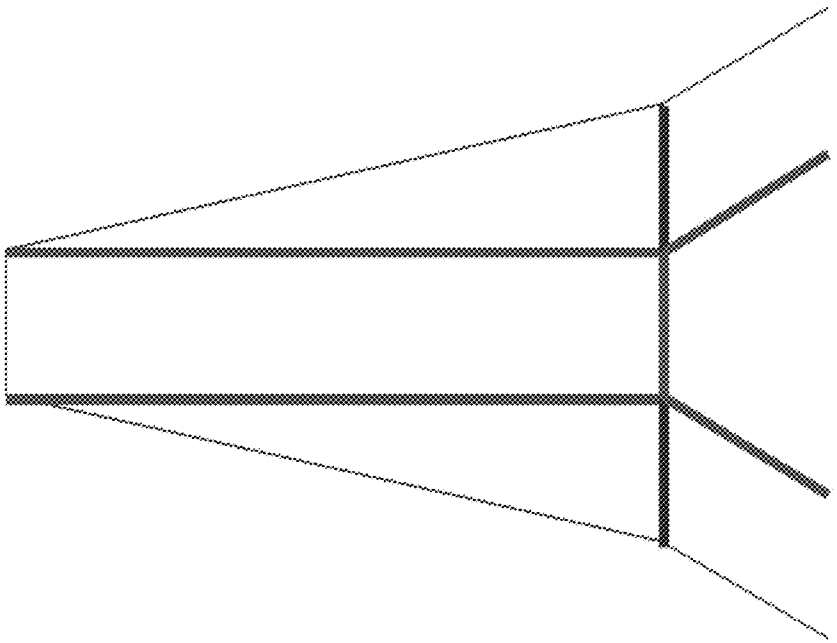
Figure 43D:
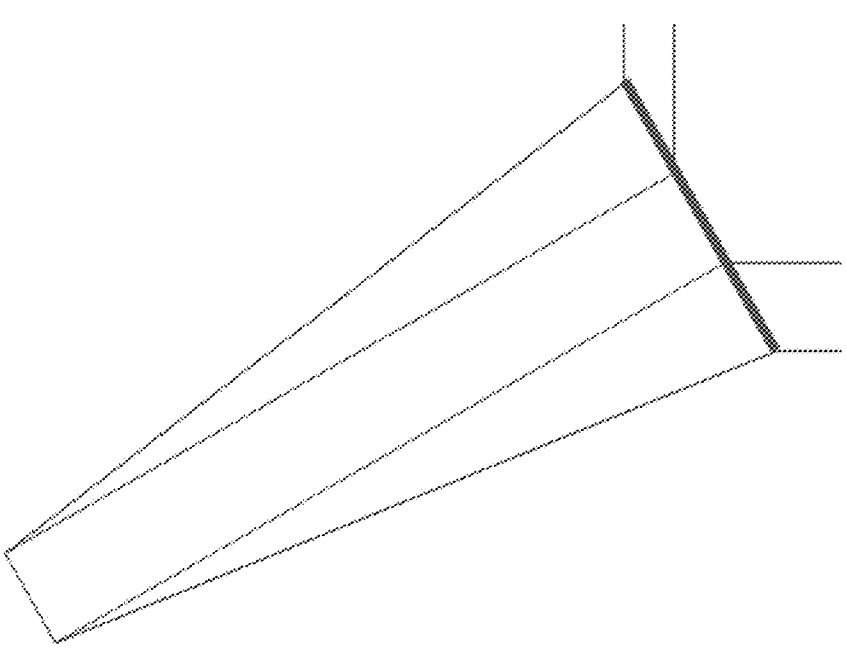
FIGS. 43C-43D illustrate four-leg table crease assignments during deployment and stowing according to embodiments of the present disclosure.
Figure 43C:
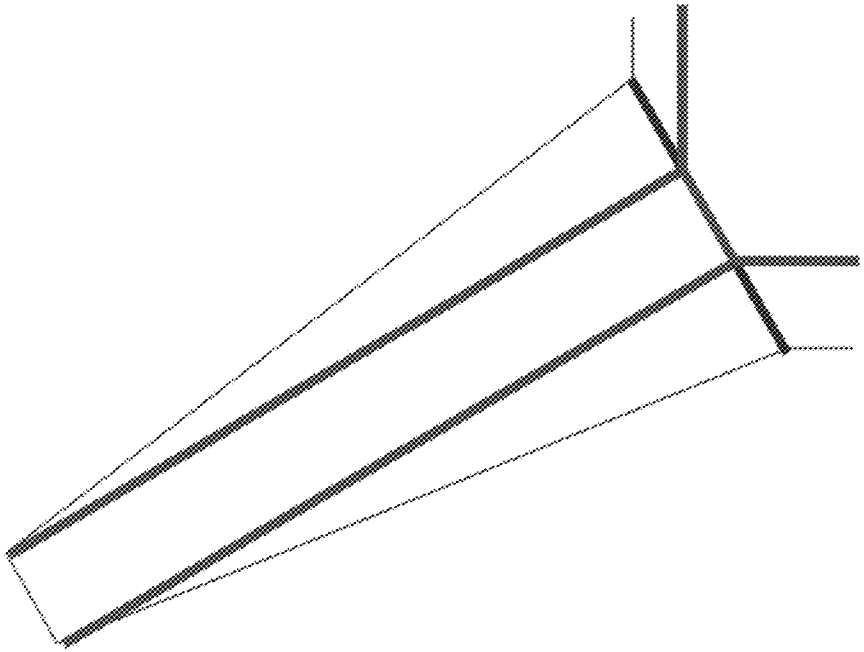

Exemplary fold pattern for three and four-legged designs without mountain or valley assignment are illustrated in FIGS. 42A-42B.

In various embodiments, critical folding elements for the table involve the knee joint. The mountain and valley assignments for the deployment and stowing states are shown in FIGS. 43A-43D, with red indicating mountains and blue indicating valleys. Illustrations for three leg tables (FIGS. 43A-43B) and four leg tables (FIGS. 43C-43D) are disclosed. As can be seen in FIGS. 43A-43D, the fold pattern may vary on the same creases depending on the folding state. In various embodiments, stowing may be simpler with only a few joints participating, whereas deployment relies on articulation of more (e.g., all) joints.

Figure 44B:
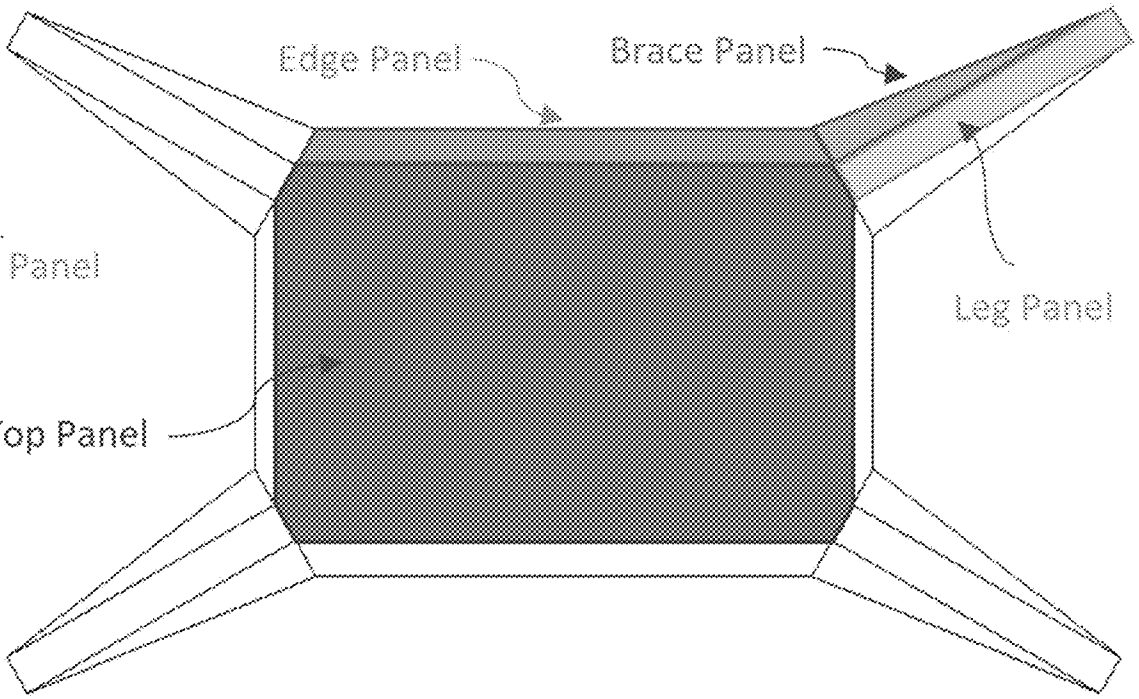
FIG. 44B illustrates a four-leg centerfold table panel assignment according to embodiments of the present disclosure.
Figure 44A:
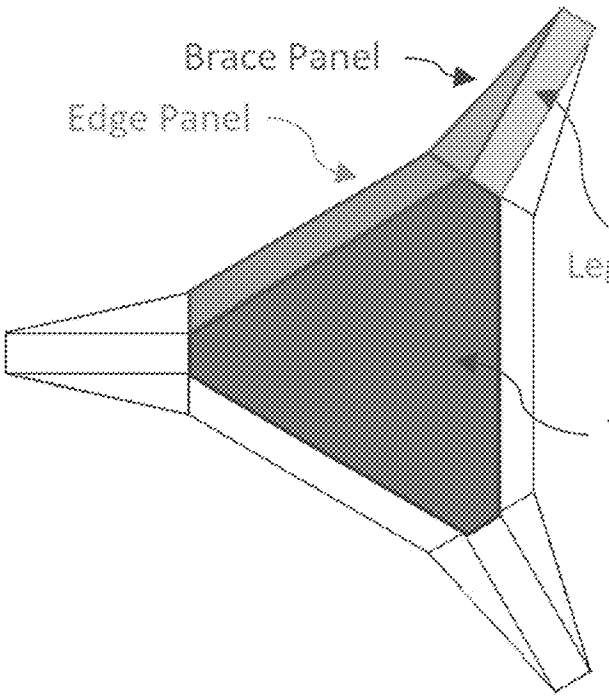
FIG. 44A illustrates a three-leg centerfold table panel assignment according to embodiments of the present disclosure.
Figure 44C:
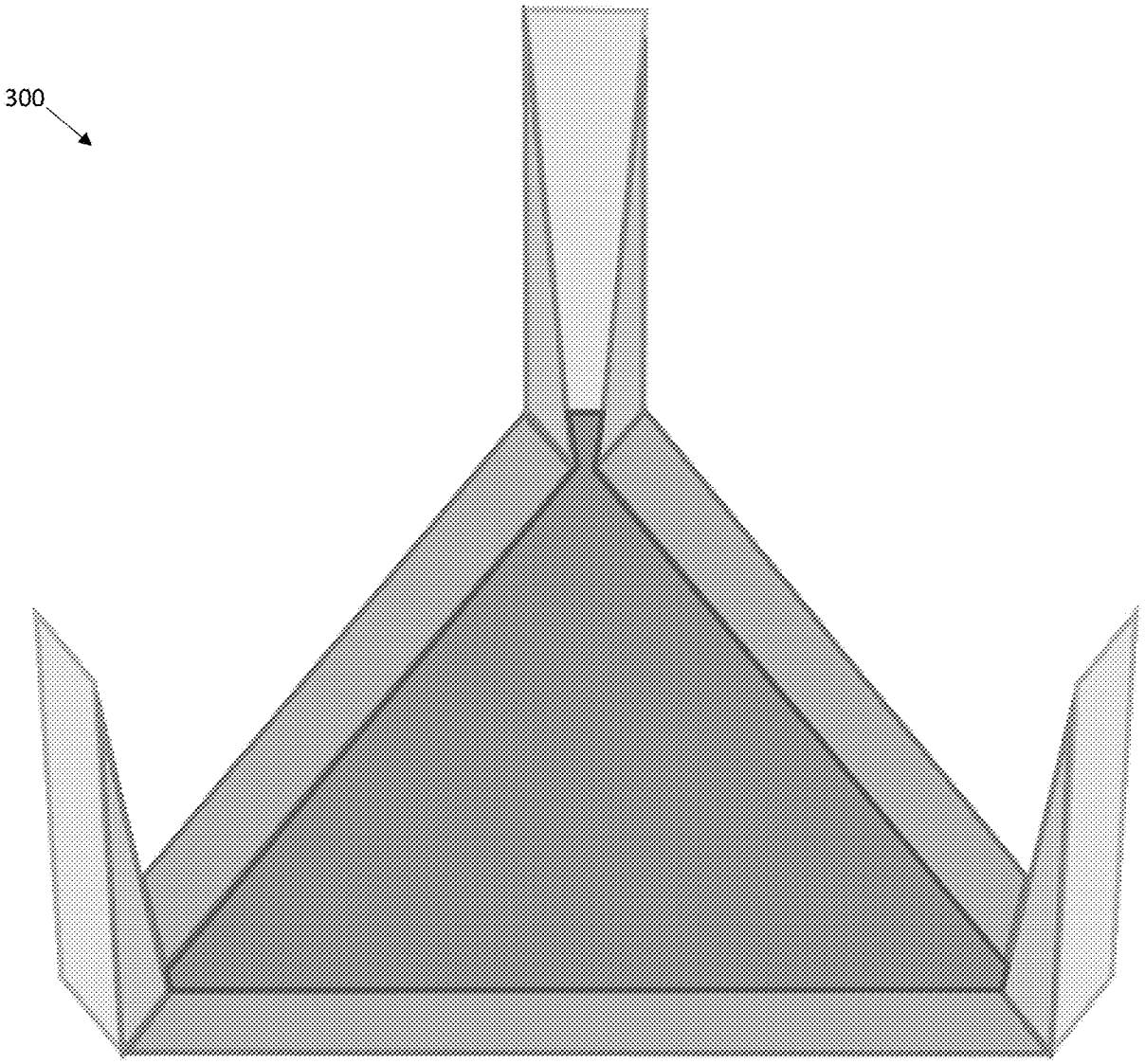
FIG. 44C illustrates an upside-down deployed three-leg table with panel assignments according to embodiments of the present disclosure.
Figure 45A:
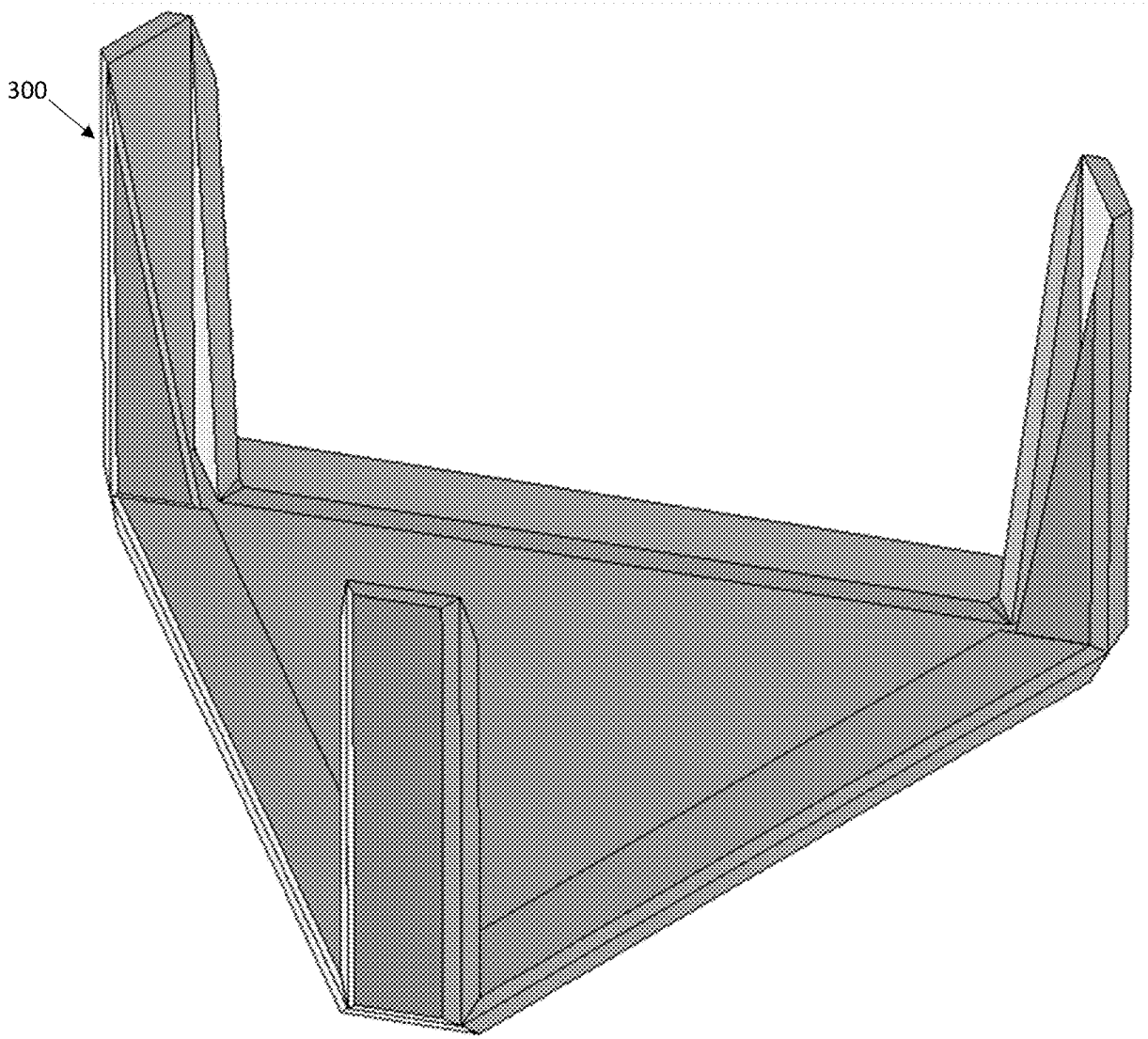
FIGS. 45A-45C illustrate steps to fold a three-leg table from a deployed to flattened articulation according to embodiments of the present disclosure.
Figure 45B:
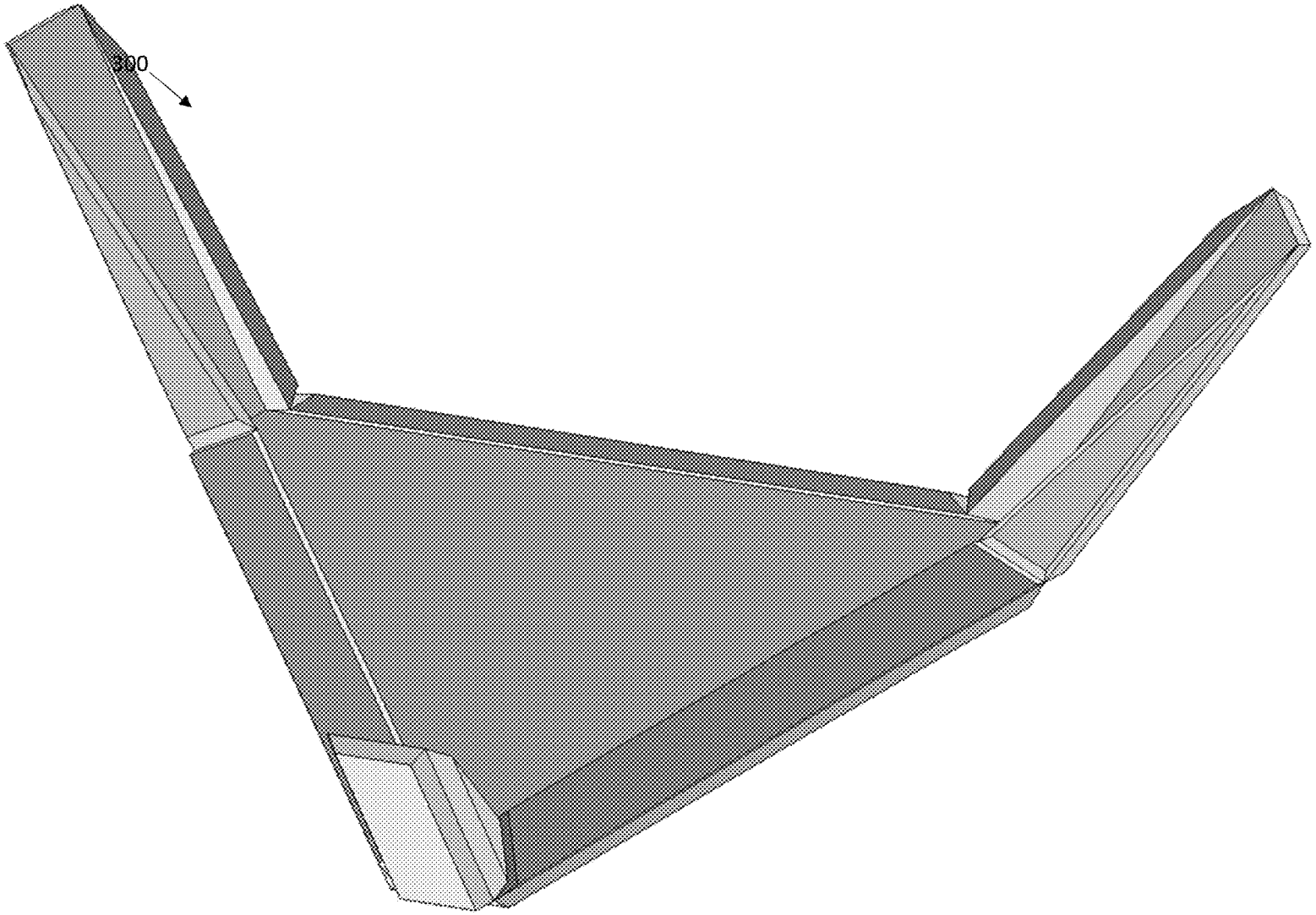
Figure 45C:
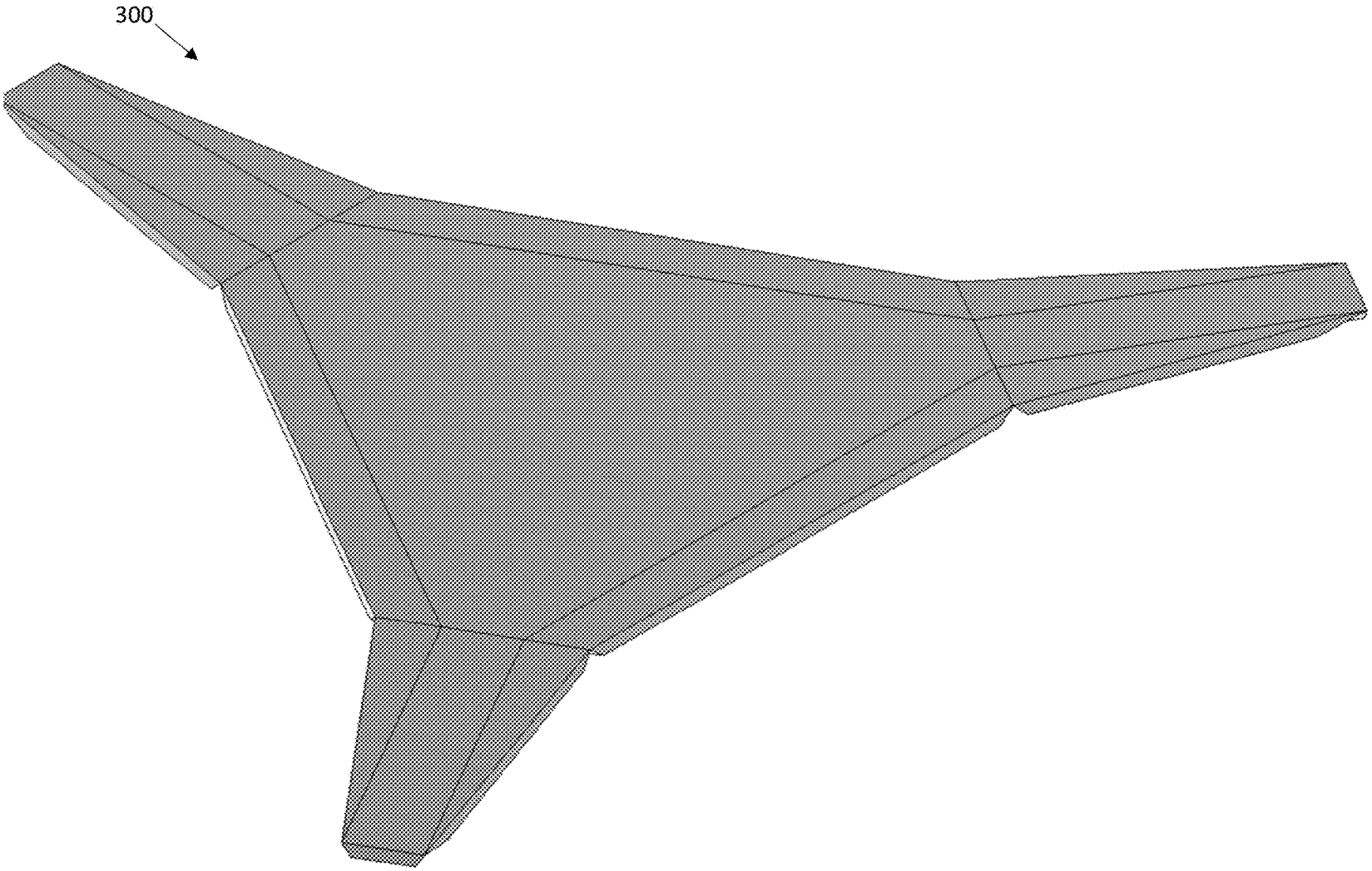
Figure 45D:
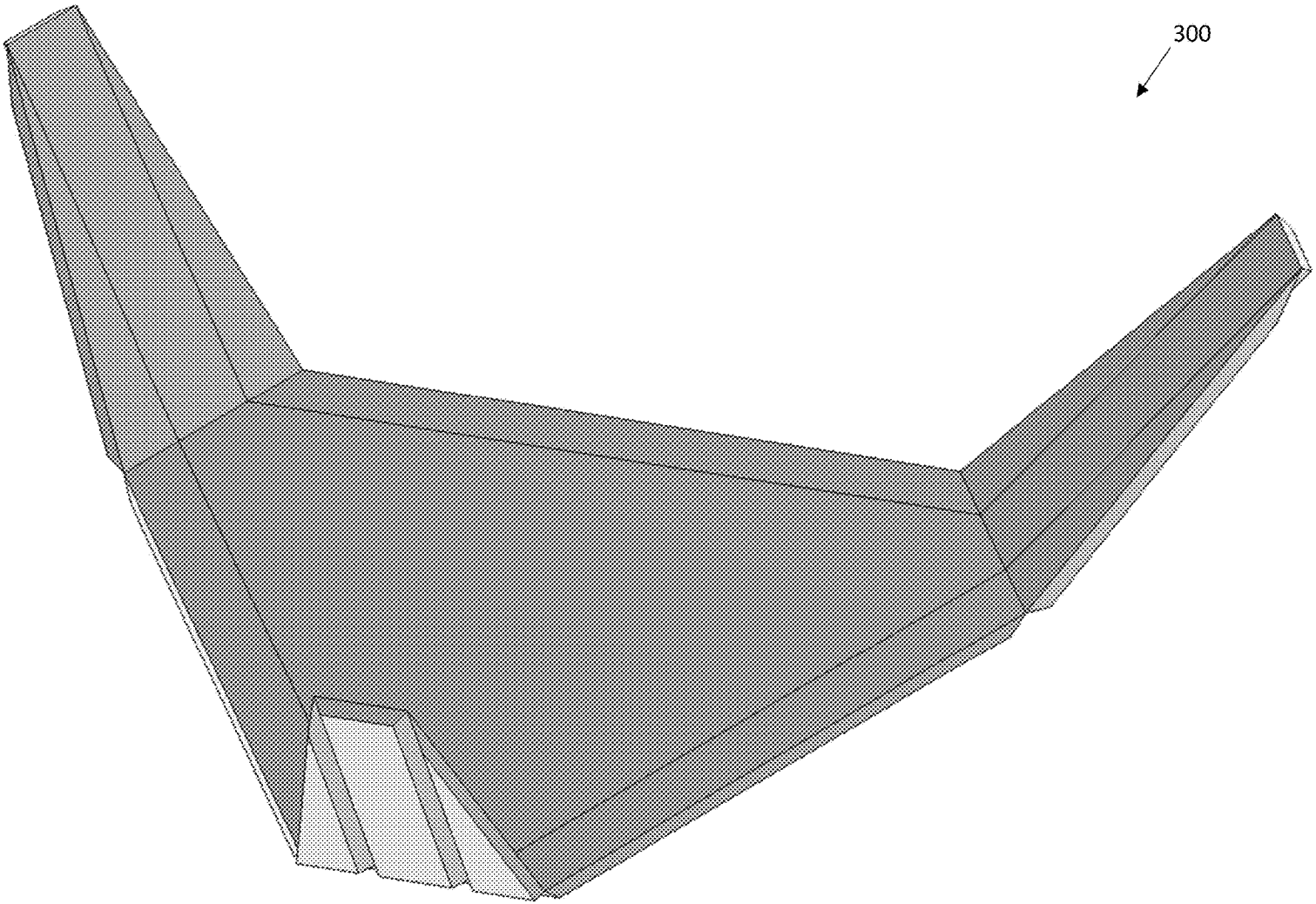
FIGS. 45D-45F illustrate steps to fold a three-leg table from a flattened to storage articulation according to embodiments of the present disclosure.
Figure 45E:
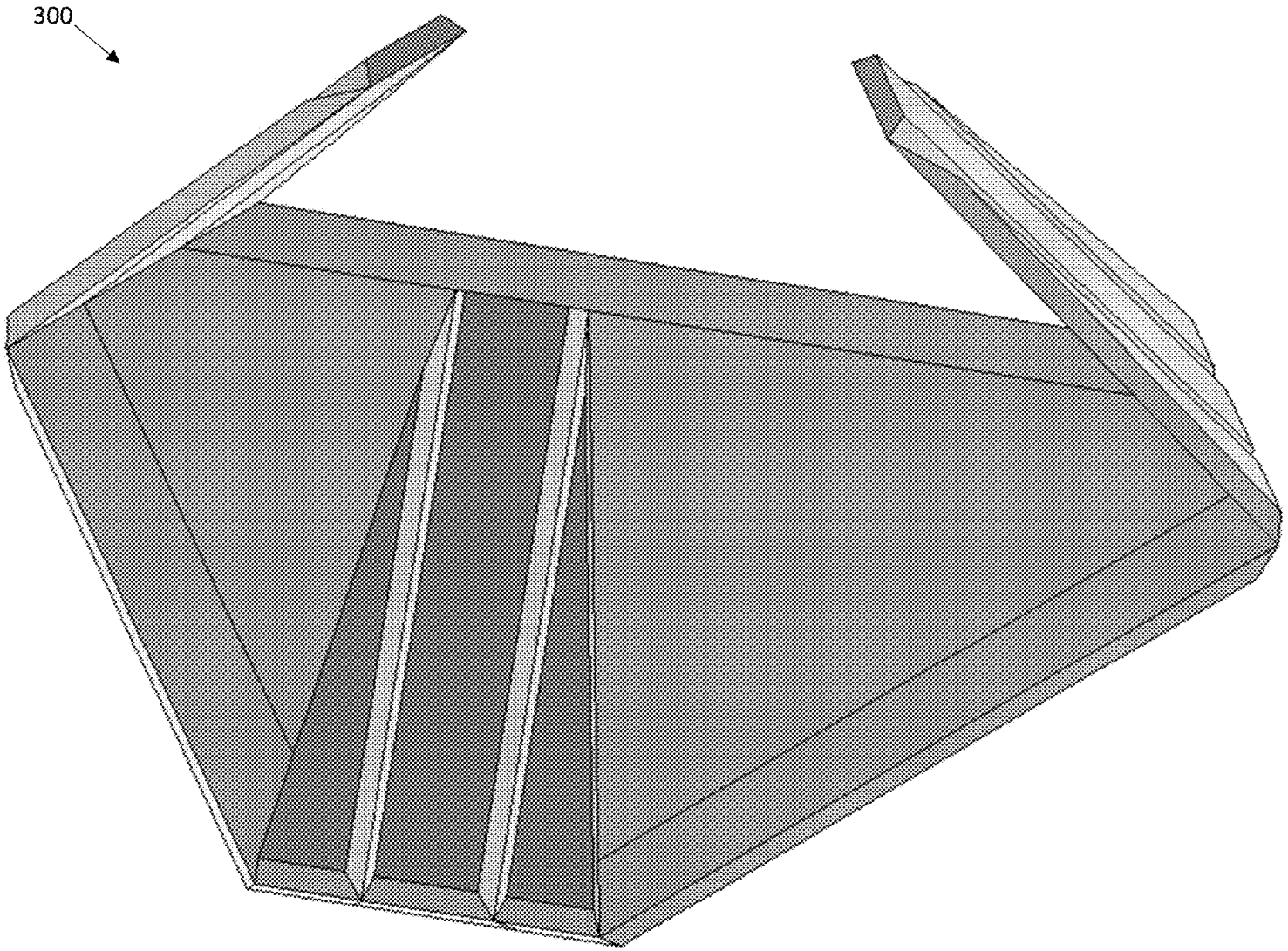
Figure 45F:
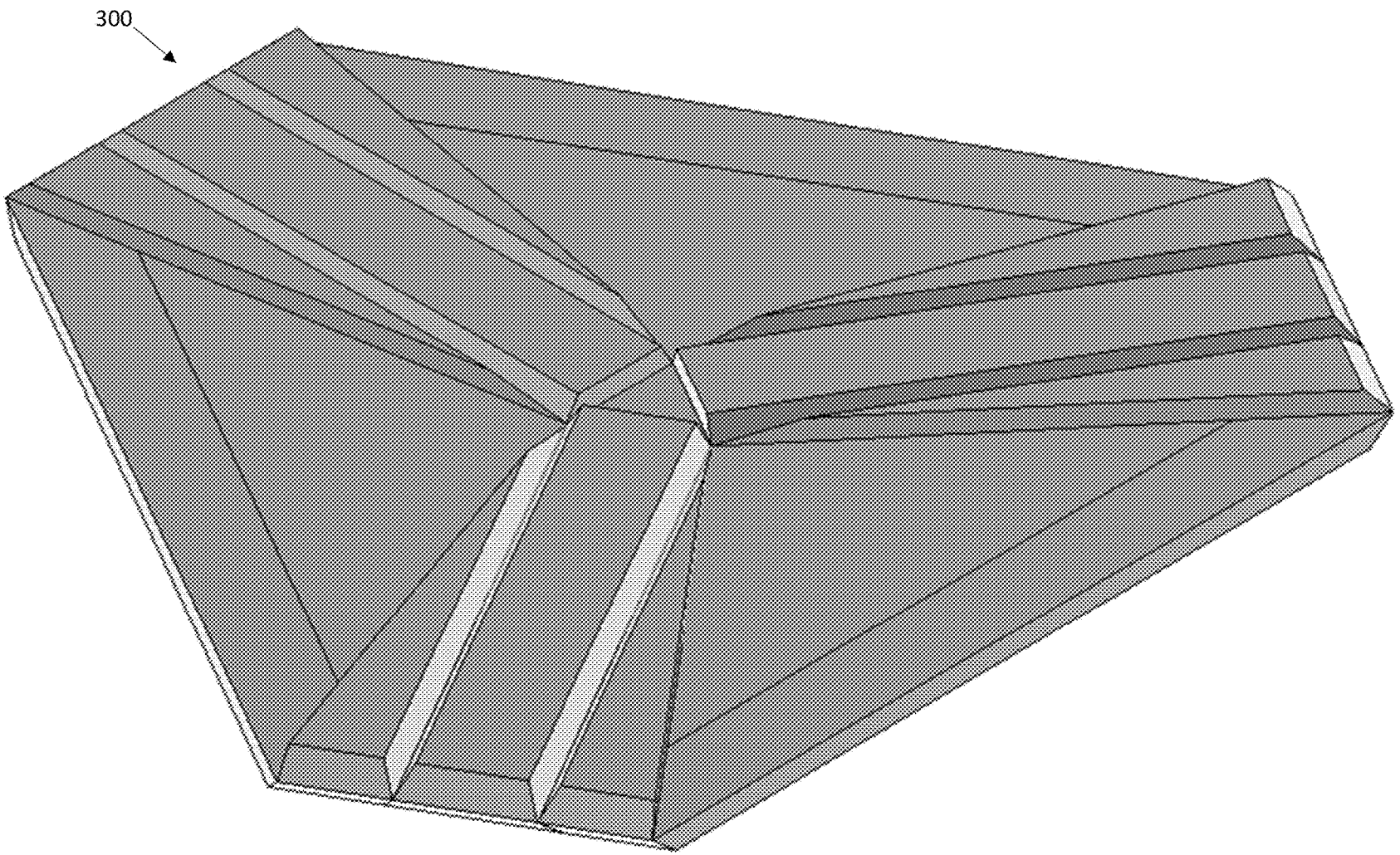

As shown in FIGS. 44A-44C, the table design may be broken up into four types of panels: top, edge, brace, and leg. These assignments on the flattened three and four-legged tables are shown in FIGS. 44A-44B. A fully folded table is illustrated in FIG. 44C with the four types of panels colored as described above.

In various embodiments, the centerfold table may have two main operational states (i.e., storage and deployed) with one main intermediate state (flattened). The transitions from deployed to flattened (FIGS. 45A-45C) and flattened to storage (FIGS. 45D-45F) are shown in FIGS. 45A-45F.

In various embodiments, these operational and intermediate states apply to tables with any number of legs. In various embodiments, stowage may occur with multiple steps (for example, as many steps as there are legs). In various embodiments, deployment occurs with a single degree of freedom. In various embodiments, proper initiation of at least n−1 braces, where n is the number of legs, may be required for proper leg deployment.

Figure 46B:
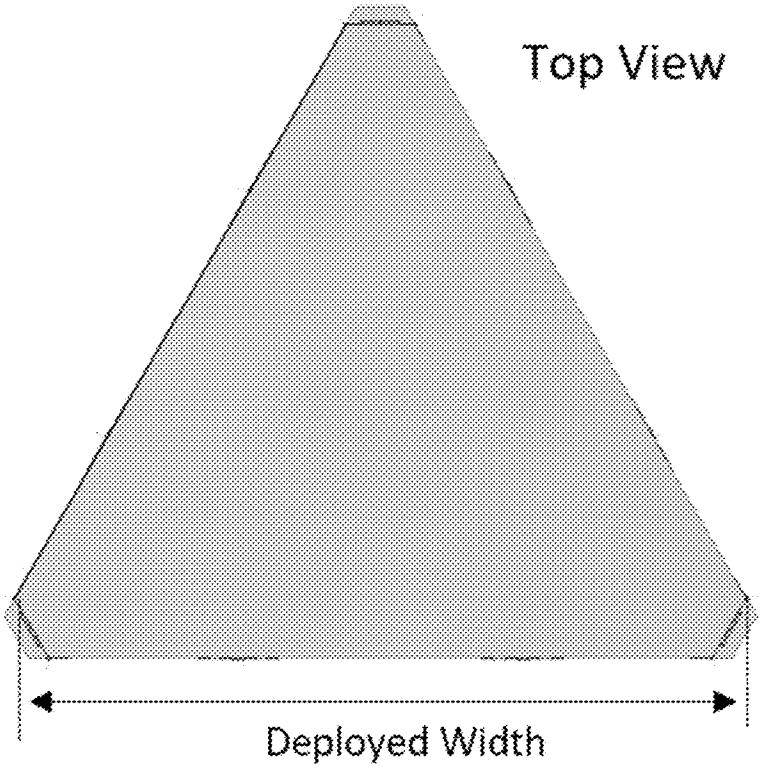
FIG. 46B illustrates a top view of a three-leg centerfold table in a deployed configuration according to embodiments of the present disclosure.
Figure 46A:
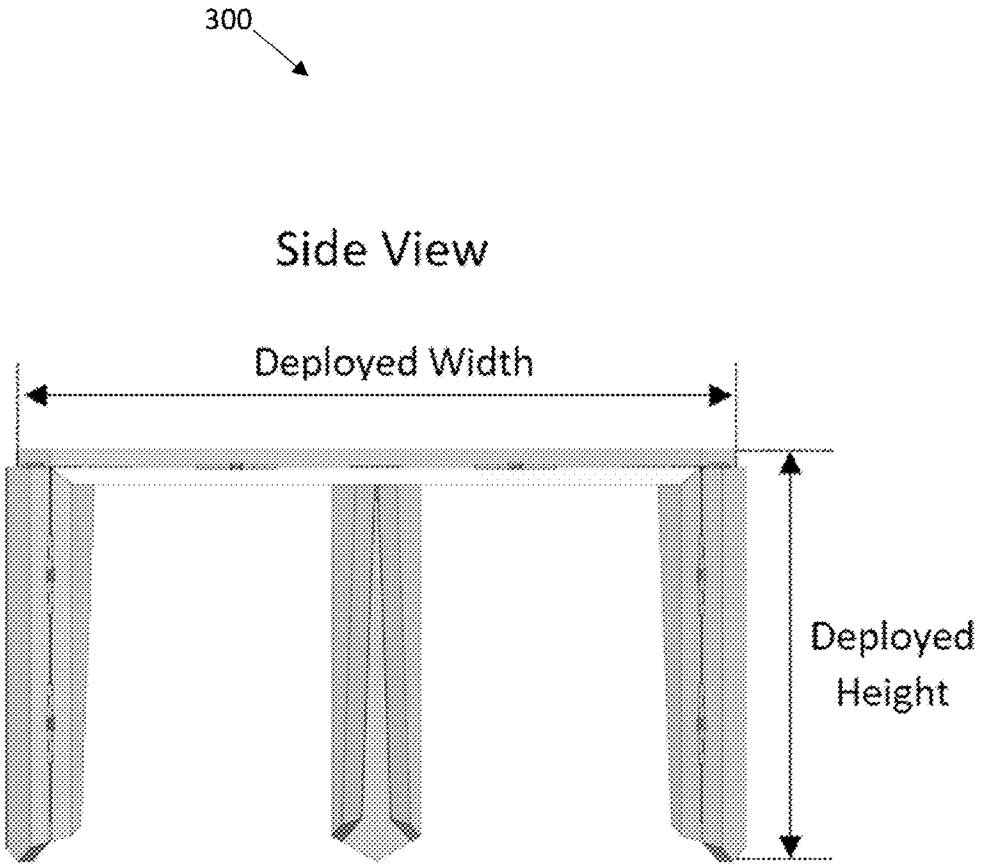
FIG. 46A illustrates a side view of a three-leg centerfold table in a deployed configuration according to embodiments of the present disclosure.

As shown in FIGS. 46A-46B and FIGS. 46A-46B, the centerfold table may use the same nomenclature as most ordinary tables consisting largely of a table top and legs. In various embodiments, this nomenclature is consistent regardless of the number of legs. The illustrations in FIGS.

Figure 47B:
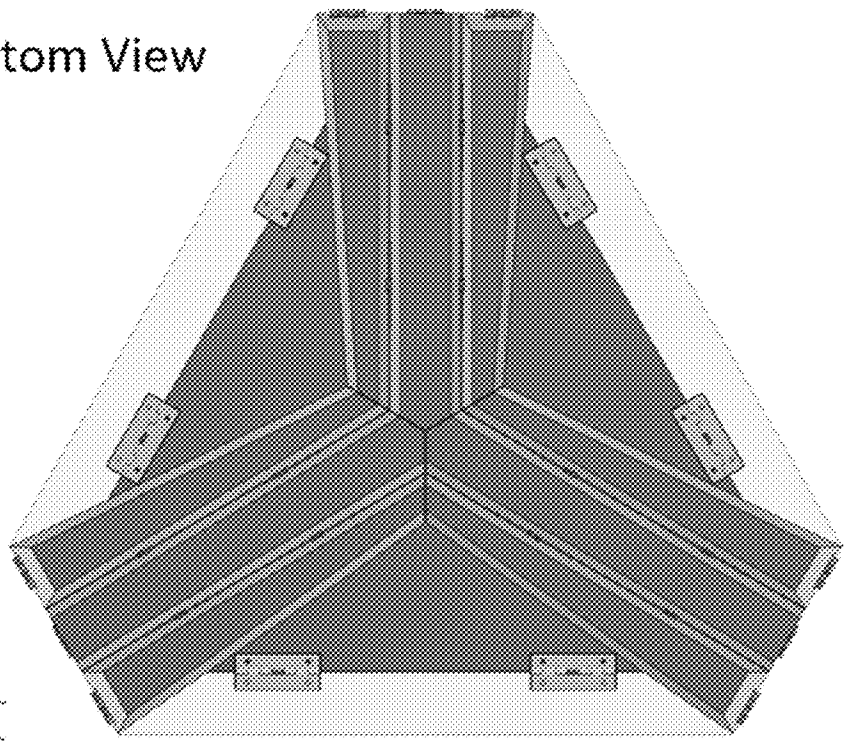
FIG. 47B illustrates a bottom views of a three-leg centerfold table in a storage configuration according to embodiments of the present disclosure.
Figure 47A:
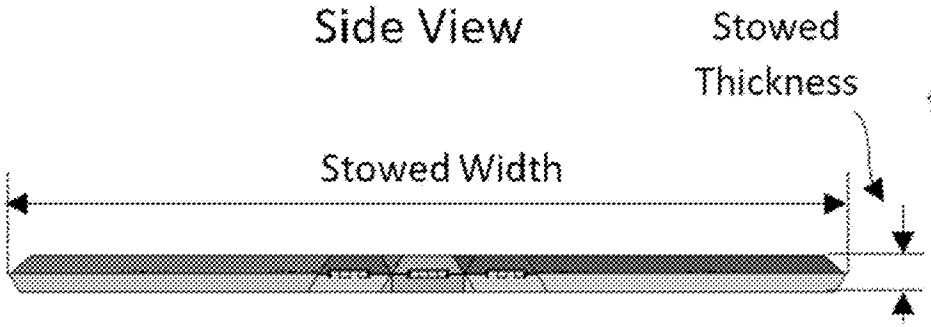
FIG. 47A illustrates a side view of a three-leg centerfold table in a storage configuration according to embodiments of the present disclosure.

46A-46B and FIGS. 47A-47B illustrate how height, width, and thickness terms are applied to the centerfold table. As shown in FIGS. 47A-47B, when in the stowed configuration, the table has a planar upper surface and a planar lower surface (i.e. all components lie flush, or coplanar, with each other), with the edges forming a faceted or pointed side. In other words, the table forms a hexagon when in the stowed configuration.

In various embodiments, due to the high width to height ratio of the legs, any backlash remaining in the knee joint between the top and leg may result in large translation at the table foot. In various embodiments, reducing or eliminating joint backlash helps avoid a "wobbly" table. In various embodiments, this may be achieved via use of crimped, bearing, or partially misaligned joints.

Figure 48:
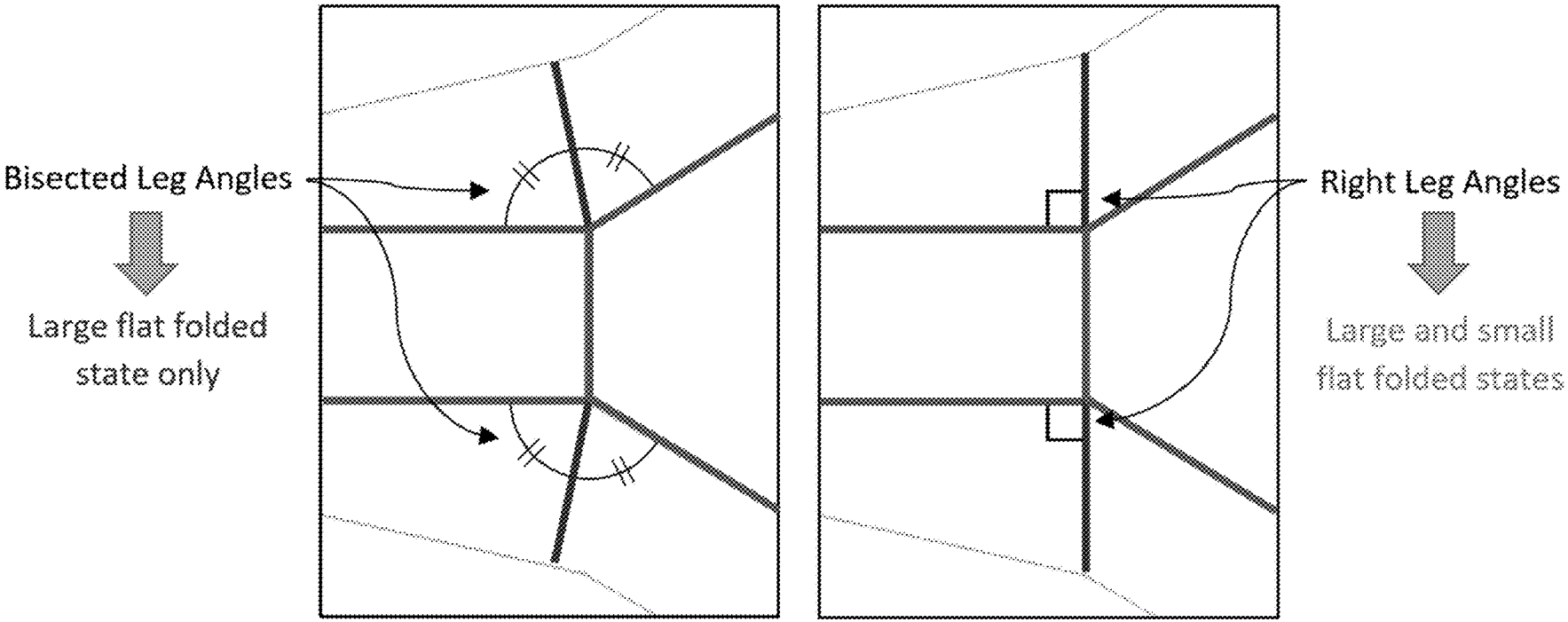
FIG. 48 illustrates alignment of knee joints allows flat folding according to embodiments of the present disclosure.

In various embodiments, an important element of the centerfold table is how the joints are aligned at the knee, as shown in FIG. 48. In various embodiments, whereas tables have been published in the past using the fold pattern on the left where mountain creases bisect the angle between the leg and the top, the centerfold table aligns all joints along the knee. In various embodiments, this may take away true single degree of freedom motion of the table, but in return, may allow the legs to fold inward after flattening, allowing more efficient stowage.

In various embodiments, knee joint alignment may affect the number of possible folding states that are possible as a result. In various embodiments, a folding table may include up to 3n+1 folding states, where n is the number of legs, of the table when all knee joints are aligned. In various embodiments, not all legs need to be aligned the same, but this may affect the stowed form factor of the table.

Figure 49:
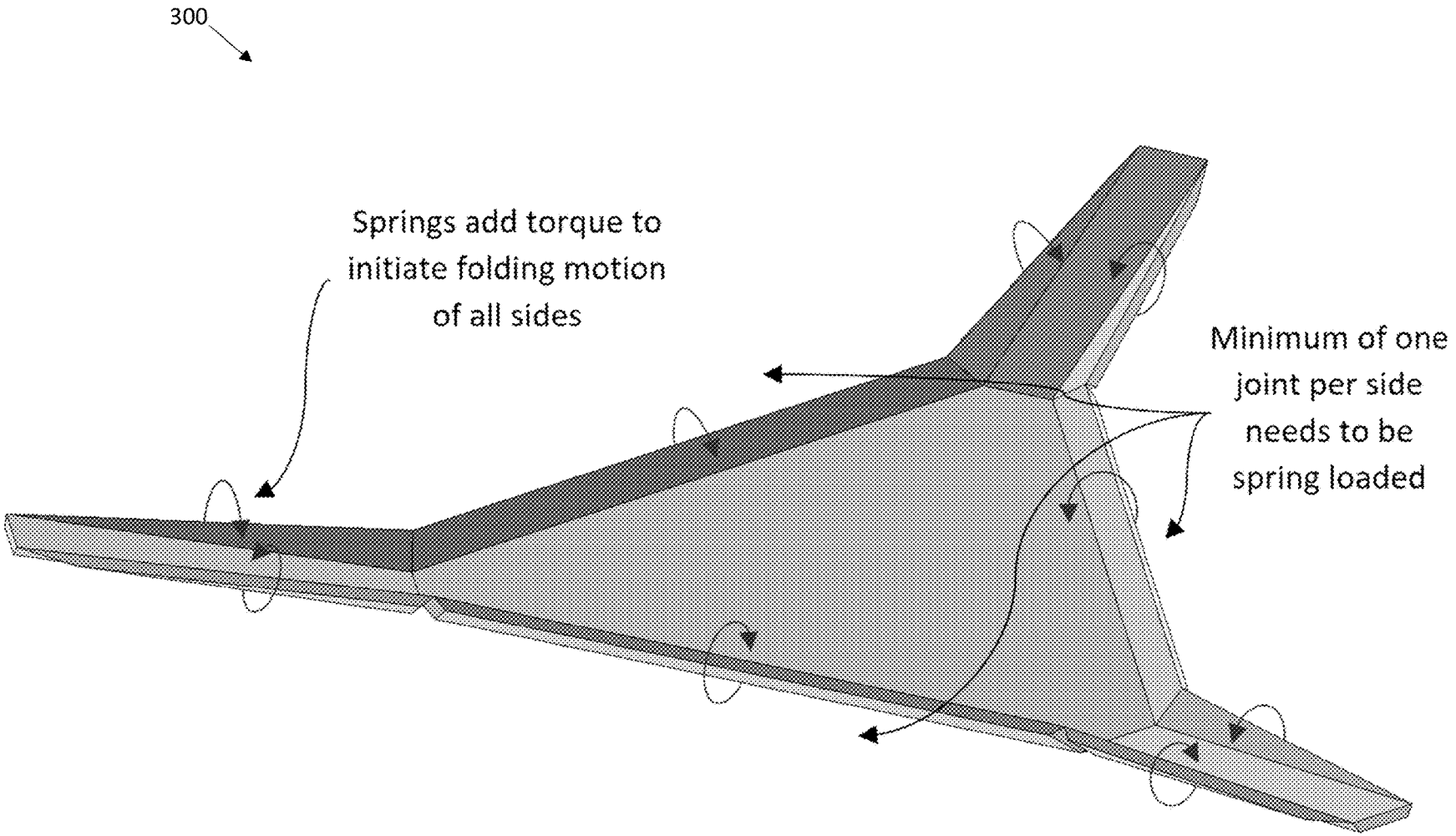
FIG. 49 illustrates torque application to joints to encourage proper deployment according to embodiments of the present disclosure.
Figure 50:
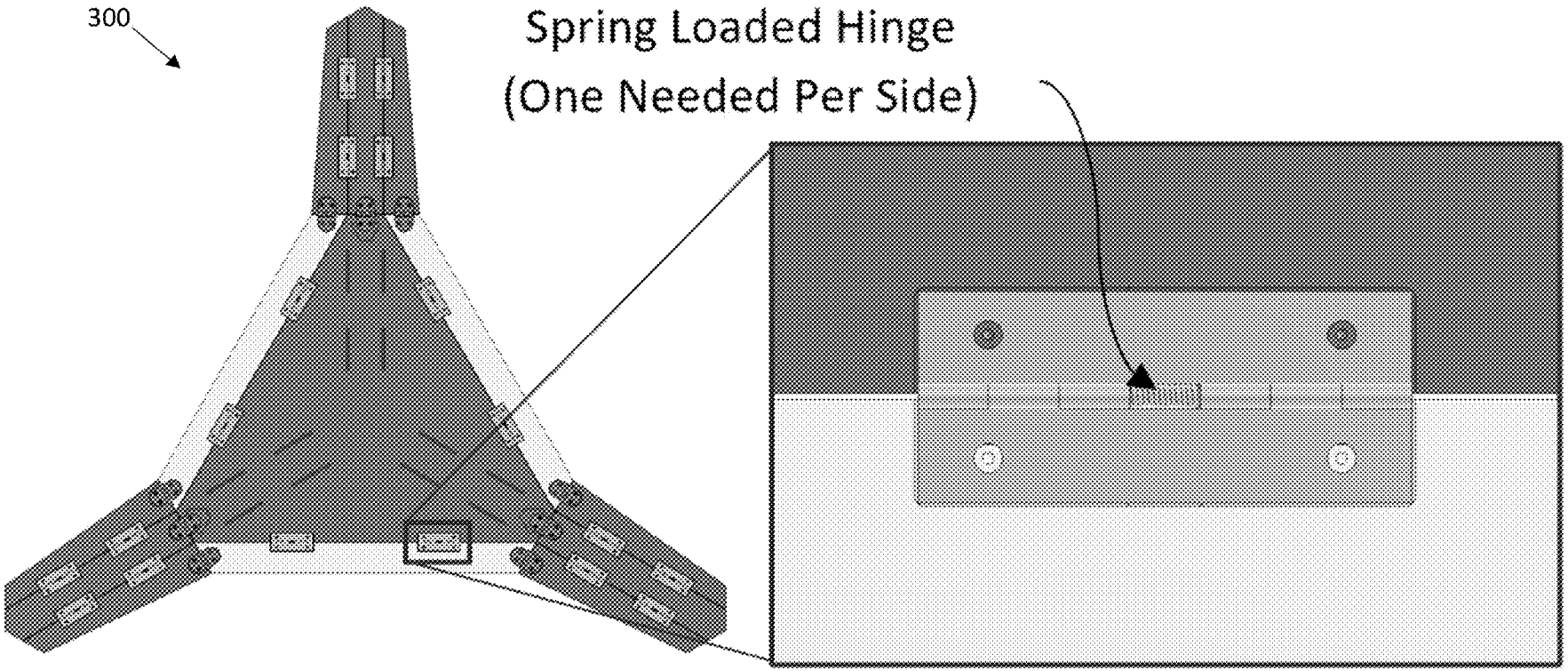
FIG. 50 illustrates spring loaded hinges to initiate deployment according to embodiments of the present disclosure.

In various embodiments, to manage the folding states of the table, particularly during deployment, torque can be added to joints to initiate folding in a desired configuration. Spring loading may not be required on all joints. In various embodiments, one joint may include spring loading within each independently-operating segment. The torque application required for folding is illustrated in FIG. 49 and FIG. 50. The application of the torque can be controlled, e.g. via a release lock/lever to actuate movement of the folding components of the table.

In various embodiments, torque may be applied to joints using spring loaded hinges as shown in FIG. 50. In various embodiments, torque may be applied with flexures or living joints as well.

In various embodiments, the centerfold table design is compatible with any number of legs. Three and four-legged versions are disclosed. In various embodiments, a centerfold table may also work with five, six, or more legs. Nomenclature, folding behavior, need for some degree of knee joint alignment, and need for fold initiation may be conserved regardless of number of legs. The legs can be of a fixed length, or can be adjustable (e.g. include extendable/retractable telescoping portions).

In various embodiments, foot shapes can be changed to modify their appearance of functionality. For example, creating L-shaped braces creates leg extensions which can help prevent collapse of the table under load. In various embodiments, the end of braces and legs may be collinear. In various embodiments, the table may rest on extended braces rather than the legs themselves. In various embodiments, these changes may affect its deployed behavior and may be used to improve its stability or overall aesthetic.

In various embodiments, variations of the table could be made such that the table is not capable of flat folding, instead transitioning between states in a non-flattened configuration through use of conical or hyperbolic joints around its knees.

In various embodiments, rather than a collection of discrete panels with discrete joints, the table may be made from a single sheet with living hinges between panels. In various embodiments, the living hinge(s) could come from bulk material, or instead from a portion of a laminate.

Figure 51:
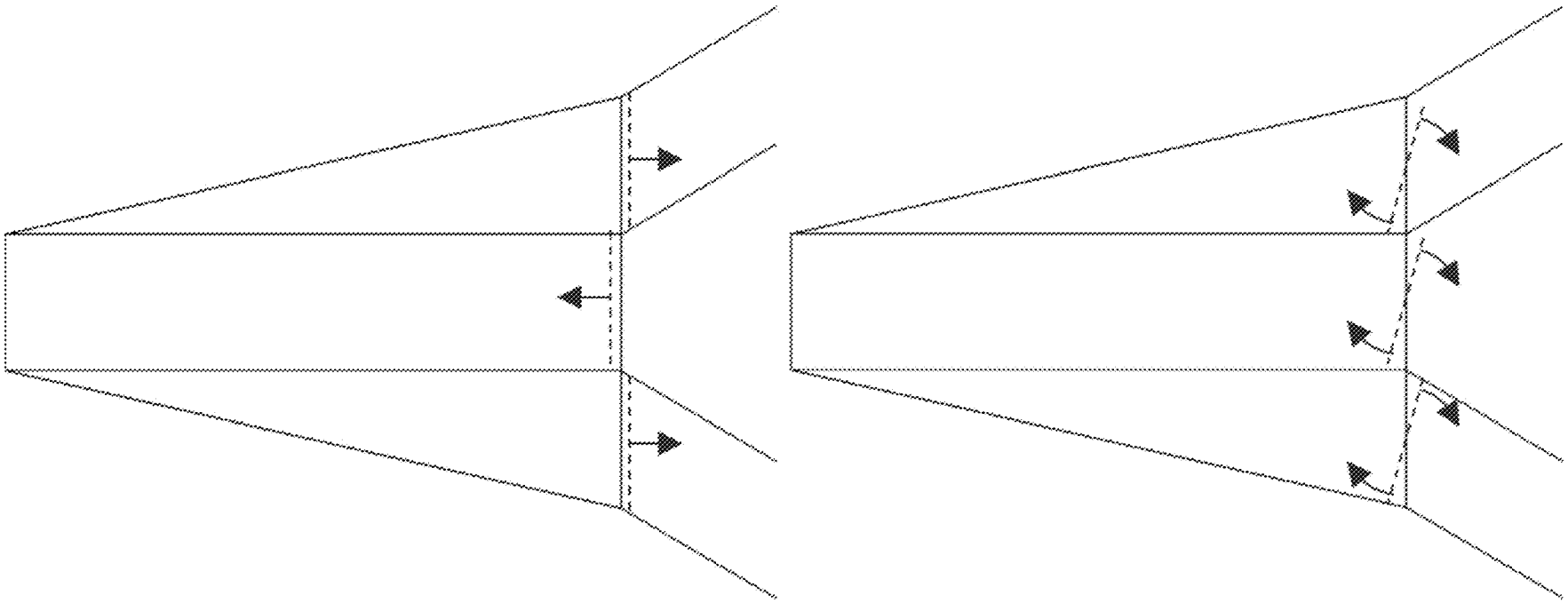
FIG. 51 illustrates deliberate joint misalignment to eliminate backlash according to embodiments of the present disclosure.

In various embodiments, one method of eliminating joint backlash is to preload the joints with deliberate misalignment of rotational axes. In various embodiments, this can be achieved via displacement or rotation of joint axes along a line as shown in FIG. 51.

In various embodiments, a variety of hinge types are compatible with this design. This includes anything which creates a relatively deterministic rotational axis, for example living hinges, flexures, and design offset folding joints. In various embodiments, materials for these hinges may include metal as well as plastic, leather, fabric, or even wood.

Figure 52:
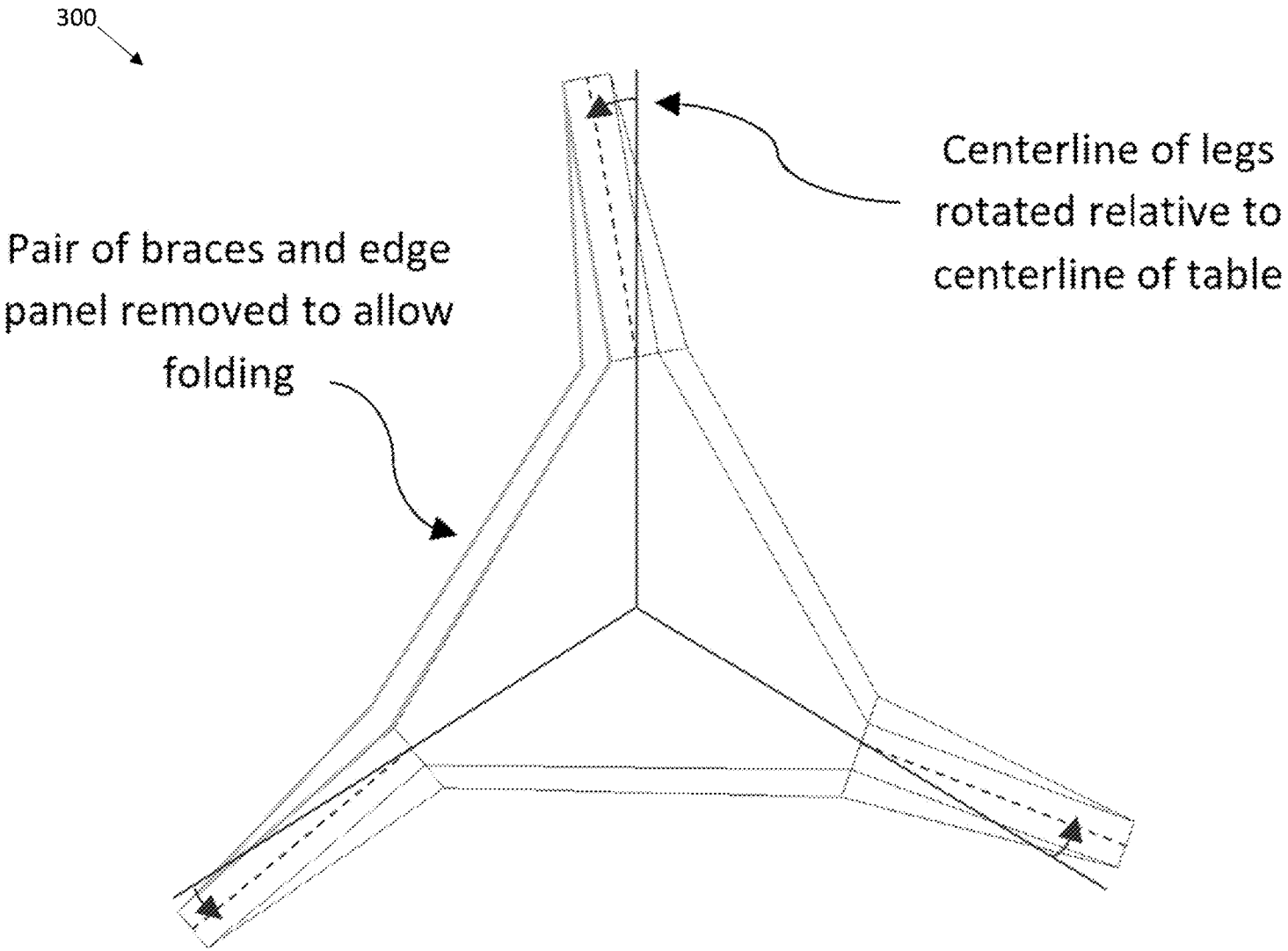
FIG. 52 illustrates exemplary fold pattern modification according to embodiments of the present disclosure.

In various embodiments, while the centerfold tables described above include tables whose leg centerlines intersect the center of the table, these axes can be misaligned as shown in FIG. 52. In various embodiments, due to the angle changes, one or more of the edges and brace pairs may need to be removed.

Figure 53:
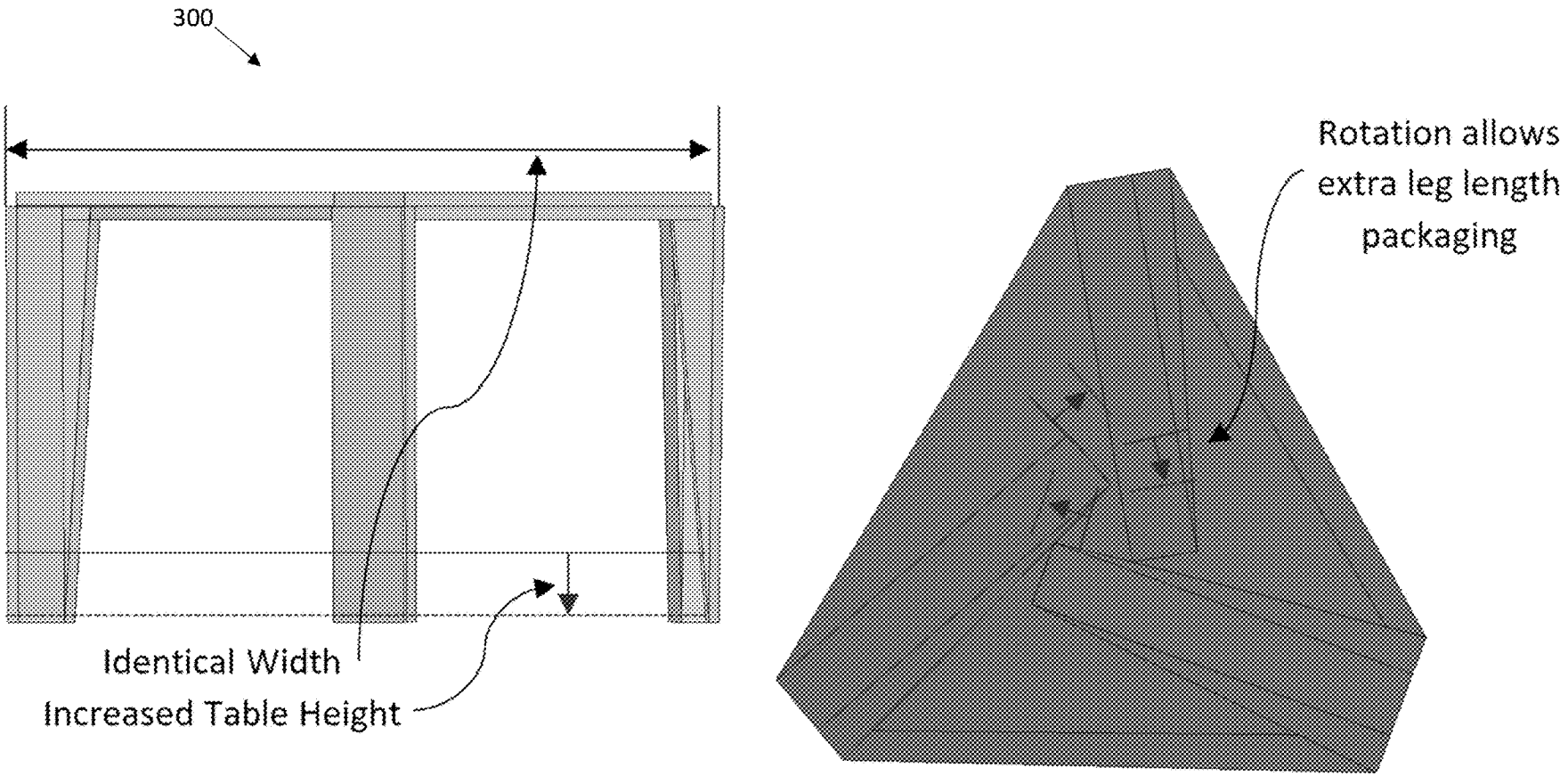
FIG. 53 illustrates a table having leg lengthening and height increase according to embodiments of the present disclosure.

In various embodiments, misalignment of these exes allows nesting of legs when stowed to increase the height to width ratio of the deployed table. This is illustrated in FIG. 53.

Figure 54:
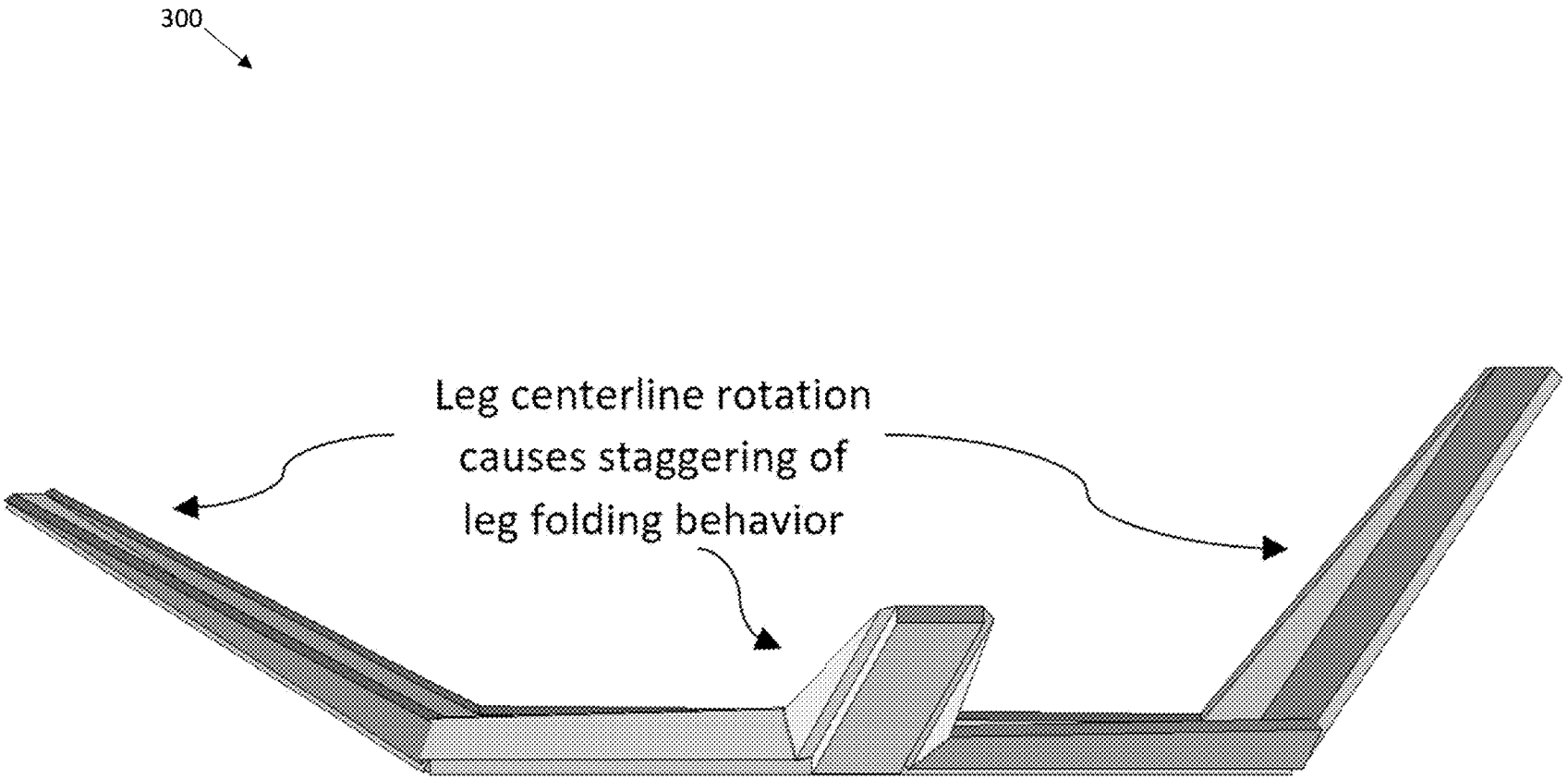
FIG. 54 illustrates staggered leg folding behavior according to embodiments of the present disclosure.
Figure 55B:
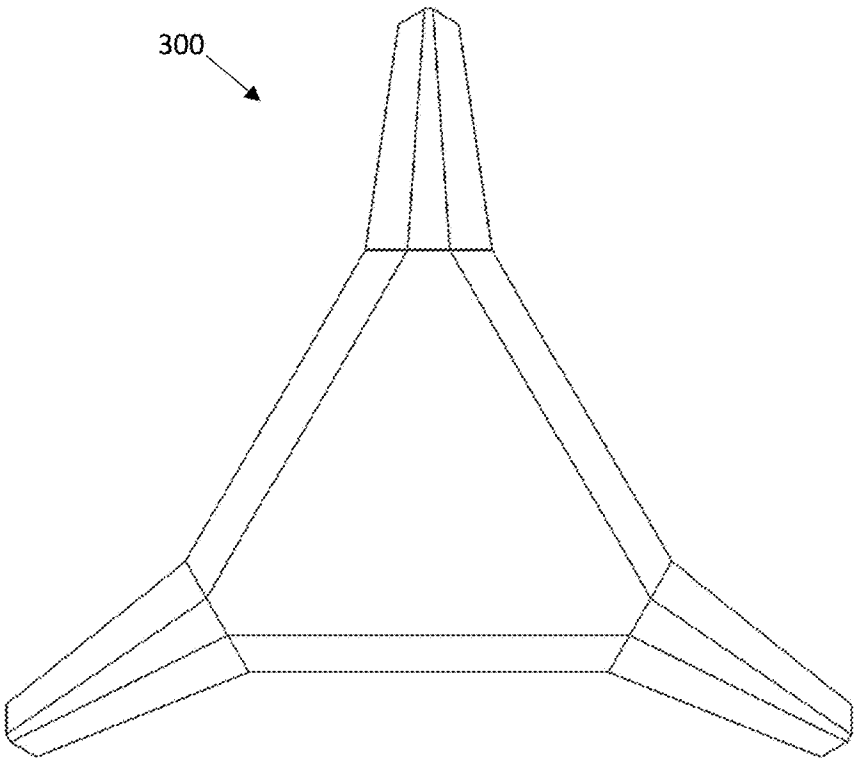
FIG. 55B illustrates a toe-out table fold pattern according to embodiments of the present disclosure.
Figure 55A:
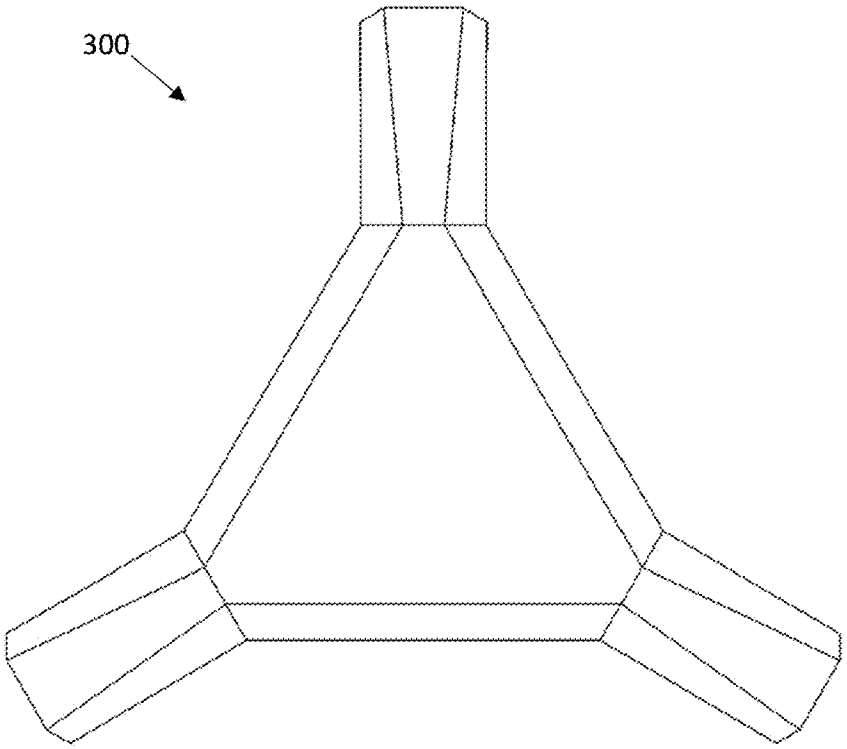
FIG. 55A illustrates a tow-in table fold pattern according to embodiments of the present disclosure.
Figure 56:
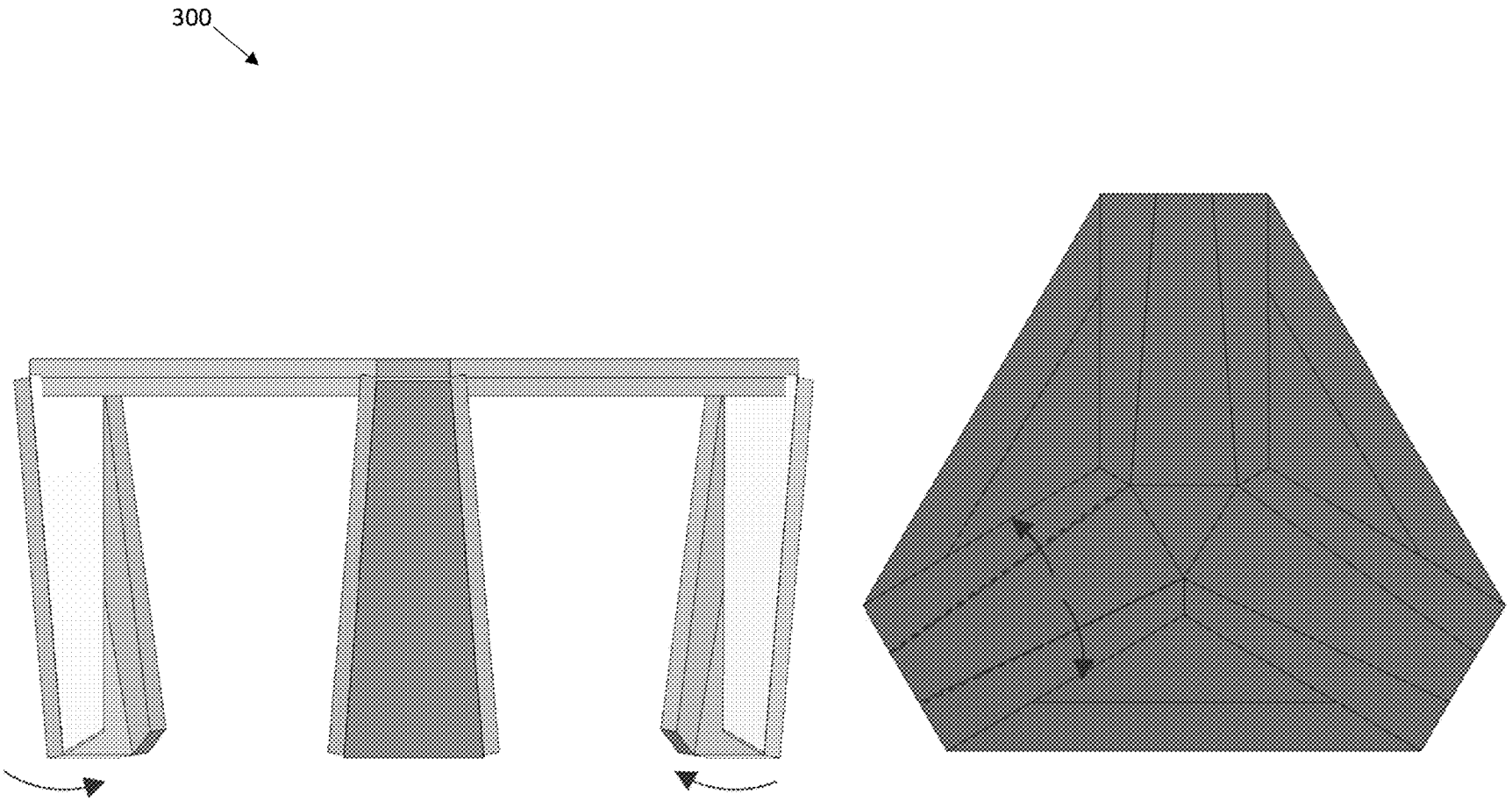
FIG. 56 illustrates a centerfold table where expanding leg angles pulls legs in according to embodiments of the present disclosure.
Figure 57:
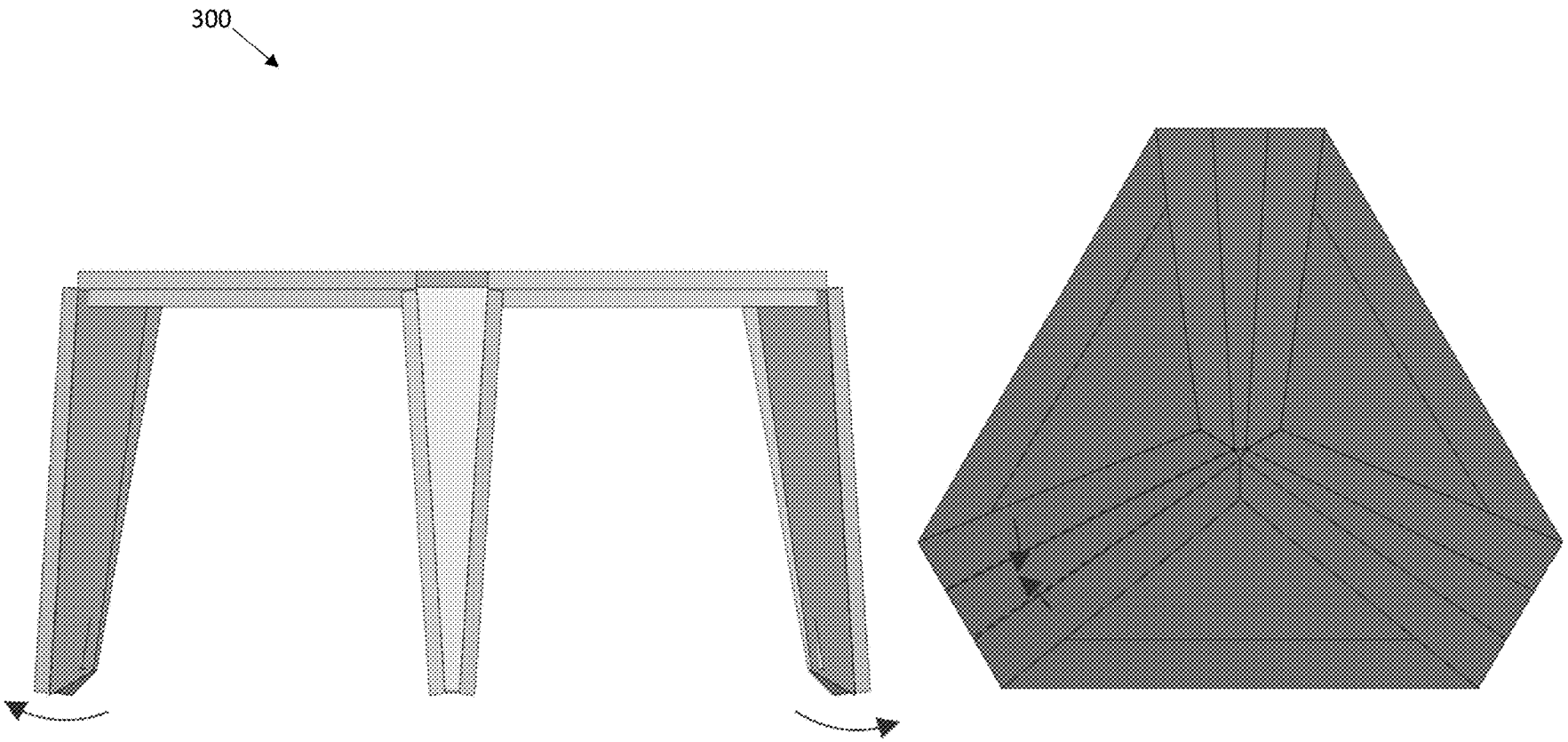
FIG. 57 illustrates a centerfold table where contracting leg angles pushes table legs out according to embodiments of the present disclosure.

In various embodiments, in addition to changing the height limitations of the table, skewing the leg centerlines changes the folding behavior such that legs are no longer synchronized during deployment. FIG. 54 illustrates a side view of leg centerline rotation causing staggering of leg folding behavior.

In various embodiments, the impact of leg skewing is consistent with various numbers of legs.

In various embodiments, the orientation of deployed legs can be manipulated by changing the parallelism of leg joints. As shown in FIGS. 55A-55B and FIGS. 56-57, expansion of leg joints results in a toe-in configuration whereas contraction creates a toe-out configuration. In various embodiments, this variation can be helpful when trying to prevent legs from spreading out under load.

In various embodiments, any components of the kinetic enclosure 100, the desk lamp 200, or the centerfold table 300 may be made of a metal. In various embodiments, the metal is selected from the group consisting of: iron, carbon steel, stainless steel, aluminum, titanium, a nickel alloy, a copper alloy, an aluminum alloy, brass, bronze, a zinc alloy, a magnesium alloy, gold, silver, and platinum.

In various embodiments, any components of the kinetic enclosure 100, the desk lamp 200, or the centerfold table 100 may be made of a polymer. In various embodiments, the polymer is selected from the group consisting of: polyethylene, high-density polyethylene, polyurethane, polyvinyl chloride, polyamide, polyethylene terephthalate, polycarbonate, polypropylene, polystyrene, and acrylonitrile butadiene styrene In various embodiments, any components of the kinetic enclosure 100, the desk lamp 200, or the centerfold table 300 may be made of a wood. In various embodiments, the wood is selected from the group consisting of: oak, pine, cherry, maple, walnut, birch, mahogany, ash, teak, basswood, rosewood, hickory, cedar, redwood, a wood composite or laminate, a wood derivative (e.g., wood pulp, cellulose, etc.). In various embodiments, panels may include different materials. In various embodiments, panels may include a combination of materials.

In various embodiments, any components of the kinetic enclosure 100, the desk lamp 200, or the centerfold table 300 may be made of a composite material. In various embodiments, the composite material is carbon fiber, fiberglass, aramid fibers with polymer or carbon matrix, and/or polymer-saturated felt.

While the disclosed subject matter is described herein in terms of certain preferred embodiments, those skilled in the art will recognize that various modifications and improvements may be made to the disclosed subject matter without departing from the scope thereof. Moreover, although individual features of one embodiment of the disclosed subject matter may be discussed herein or shown in the drawings of the one embodiment and not in other embodiments, it should be apparent that individual features of one embodiment may be combined with one or more features of another embodiment or features from a plurality of embodiments.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

What is claimed is:

1. An apparatus having single degree-of-freedom motion, said apparatus having an open configuration and a closed configuration for creating a partially-enclosed space, the apparatus comprising:

six or more panels, wherein each panel is coupled to two other panels of the six or more panels, wherein each panel is coupled at a first joint having a first axis and a second joint having a second axis, the six or more panels forming a closed loop;

wherein the first axis and the second axis do not intersect with one another for each panel;

wherein each panel is rotatable such that the total rotation of all joints is a predetermined number of degrees from the closed configuration to the open configuration.

2. The apparatus of claim 1, wherein each of the six or more panels comprises a substantially flat shape.

3. The apparatus of claim 1, wherein each of the six or more panels comprises a non-planar shape.

4. The apparatus of claim 1, wherein at least three of the panels comprise a first shape.

5. The apparatus of claim 4, wherein at least three of the panels comprise a second shape that is different from the first shape.

6. The apparatus of claim 1, wherein each of the six or more panels is rigid.

7. The apparatus of claim 1, wherein the apparatus comprises a closed loop of links, having a single degree of freedom.

8. The apparatus of claim 1, wherein the first and second joints comprise cylindrical joints.

9. The apparatus of claim 1, wherein one or more panels each comprise at least one magnet.

10. The apparatus of claim 1, wherein rotation of the six or more panels causes the apparatus to switch between the closed configuration and the open configuration.

11. The apparatus of claim 1, wherein, in the open configuration, at least three panels of the six or more panels are aligned in a same plane.

12. An apparatus having an open configuration and a closed configuration for creating a partially-enclosed space, the apparatus comprising:

a first panel;

a second panel being perpendicular to the first panel in the closed configuration;

a third panel being perpendicular to the first panel and the second panel in the closed configuration;

a fourth panel opposite the first panel in the closed configuration, the fourth panel being perpendicular to the second panel and the third panel in the closed configuration;

a fifth panel opposite the second panel in the closed configuration, the fifth panel being perpendicular to the first panel, the third panel, and the fourth panel in the closed configuration;

and a sixth panel opposite the third panel in the closed configuration, the sixth panel being perpendicular to the first panel, the second panel, the third panel, and the fourth panel in the closed configuration;

wherein:

the first panel is rotatably coupled to the fifth panel and the sixth panel;

the second panel is rotatably coupled to the fourth panel and the sixth panel; and the third panel is rotatably coupled to the fourth panel and the fifth panel.

13. The apparatus of claim 12, wherein the first panel, the second panel, and the third panel have a similar shape.

14. The apparatus of claim 12, wherein the fourth panel, the fifth panel, and the sixth panel have a similar shape.

15. The apparatus of claim 12, wherein the first panel, the second panel, and the third panel have a different shape from the fourth panel, the fifth panel, and the sixth panel.

16. The apparatus of claim 12, wherein the fourth panel, the fifth panel, and the sixth panel each comprise a non-linear side such that, when in the open configuration, at least a portion of each non-linear side contacts one another.

17. The apparatus of claim 12, wherein at least one panel comprises at least one magnet.

18. The apparatus of claim 12, wherein the first panel, the second panel, and the third panel each comprise a magnet and a metal pin.

19. The apparatus of claim 18, wherein the magnet of the first panel is aligned with the metal pin of the second panel, the metal pin of the first panel is aligned with the magnet of the third panel, and the magnet of the second panel is aligned with the metal pin of the third panel.

20. The apparatus of claim 12, wherein rotation of each of the first panel, the second panel, the third panel, the fourth panel, the fifth panel, and the sixth panel causes the apparatus to switch between the closed configuration and the open configuration.

21. The apparatus of claim 12, wherein, in the open configuration, the fourth panel, the fifth panel, and the sixth panel are aligned in a plane and the first panel, the second panel, and the third panel are each perpendicular to the plane.

22. The apparatus of claim 12, wherein the first panel, the second panel, the third panel, the fourth panel, the fifth panel, and the sixth panel each comprise a cylindrical pin and a cylindrical aperture.

23. The apparatus of claim 22, wherein each cylindrical pin extends perpendicularly to the cylindrical aperture on the same panel.

24. The apparatus of claim 22, wherein the cylindrical pin is disposed at a first corner of each panel and the cylindrical aperture is disposed at a second corner on a same side of each panel.

* * * * *